US012287167B2

(12) United States Patent
Noonan et al.

(10) Patent No.: US 12,287,167 B2
(45) Date of Patent: Apr. 29, 2025

(54) FIREARM

(71) Applicant: F.M. Products Inc, Boise, ID (US)

(72) Inventors: Paul T. Noonan, Boise, ID (US); Aaron Neal Trout, Boise, ID (US)

(73) Assignee: F.M. Products Inc, Boise, ID (US)

( * ) Notice: Subject to any disclaimer, the term of this patent is extended or adjusted under 35 U.S.C. 154(b) by 1100 days.

(21) Appl. No.: 17/186,974

(22) Filed: Feb. 26, 2021

(65) Prior Publication Data

US 2021/0180896 A1 Jun. 17, 2021

Related U.S. Application Data

(63) Continuation-in-part of application No. 16/433,941, filed on Jun. 6, 2019, now Pat. No. 11,105,571, which is a continuation of application No. 15/863,856, filed on Jan. 5, 2018, now Pat. No. 10,352,635.

(60) Provisional application No. 63/119,773, filed on Dec. 1, 2020, provisional application No. 62/443,173, filed on Jan. 6, 2017.

(51) Int. Cl.

| | |
|---|---|
| ***F41A 3/72*** | (2006.01) |
| ***F41A 3/66*** | (2006.01) |
| ***F41A 5/18*** | (2006.01) |
| ***F41A 5/30*** | (2006.01) |
| ***F41C 23/16*** | (2006.01) |
| ***F41G 11/00*** | (2006.01) |

(52) U.S. Cl.

CPC ..... *F41A 3/72* (2013.01); *F41A 3/66* (2013.01); *F41A 5/18* (2013.01); *F41A 5/30* (2013.01); *F41C 23/16* (2013.01); *F41G 11/003* (2013.01)

(58) Field of Classification Search

CPC .... F41A 3/72; F41A 7/02; F41A 35/06; F41A 35/07

See application file for complete search history.

(56) References Cited

U.S. PATENT DOCUMENTS

| | | | | |
|---|---|---|---|---|
| 3,731,588 A * | 5/1973 | Curtis | F41A 19/34 | 89/1.4 |
| 4,416,186 A * | 11/1983 | Sullivan | F41A 3/66 | 89/198 |
| 7,231,861 B1 * | 6/2007 | Gauny | F41A 3/72 | 89/1.4 |
| 8,266,998 B1 * | 9/2012 | Davis | F41A 3/72 | 89/1.4 |
| 8,464,453 B1 * | 6/2013 | Ubl | F41A 3/68 | 42/15 |

(Continued)

FOREIGN PATENT DOCUMENTS

| | | | |
|---|---|---|---|
| EP | 2141436 A2 * | 1/2010 | F41A 29/00 |

*Primary Examiner* — Benjamin P Lee

(57) ABSTRACT

A firearm is disclosed. The firearm contains a lower receiver containing a first opening, wherein the first opening is configured to accommodate a firing mechanism, an upper receiver removably coupled with the lower receiver, a barrel removably coupled with the upper receiver, a bolt carrier assembly positioned within the upper receiver, wherein the bolt carrier assembly is movable between a locked position and an unlocked position, wherein the bolt carrier assembly contains a rear surface, wherein the rear surface of the bolt carrier assembly is positioned between the barrel and the first opening when the bolt carrier assembly is in the locked position.

5 Claims, 117 Drawing Sheets

(56) References Cited

U.S. PATENT DOCUMENTS 8,567,301 B1 * 10/2013 Sharron ..... F41A 3/72 89/1.4
8,863,632 B1 * 10/2014 O'Malley ..... F41A 3/72 89/1.4
8,899,138 B2 * 12/2014 Brown ..... F41A 3/72 89/1.4
9,109,848 B2 * 8/2015 Brown ..... F41A 7/02
9,354,014 B2 * 5/2016 Swadener ..... F41A 35/06
10,215,513 B2 * 2/2019 Cross ..... F41A 19/25
11,085,714 B2 * 8/2021 Doll ..... F41G 11/003
11,662,175 B1 * 5/2023 Dustin ..... F41C 23/08 42/74
2009/0019754 A1 * 1/2009 Moretti ..... F41A 15/16 42/69.02
2011/0036232 A1 * 2/2011 Dublin ..... F41A 3/72 89/1.4
2011/0271827 A1 * 11/2011 Larson ..... F41A 21/34 89/193
2012/0180647 A1 * 7/2012 Dublin ..... F41A 5/18 89/191.01
2012/0204713 A1 * 8/2012 Patel ..... F41A 3/66 42/2
2013/0061737 A1 * 3/2013 Brown ..... F41A 3/72 89/1.4
2015/0226501 A1 * 8/2015 Gibbens ..... F41A 3/66 42/16
2015/0323267 A1 * 11/2015 Donnelly ..... F41A 3/54 89/139
2016/0047614 A1 * 2/2016 Larson, Jr. ..... F41G 11/003 89/191.01
2018/0010879 A1 * 1/2018 Bonine ..... F41A 3/84
2018/0202732 A1 * 7/2018 Gibbens ..... F41A 3/66
2019/0257601 A1 * 8/2019 Brown ..... F41A 3/84
2019/0293379 A1 * 9/2019 Taylor ..... F41A 25/12
2023/0168051 A1 * 6/2023 DiMuzio ..... F41A 3/66 42/16
2023/0272989 A1 * 8/2023 McMinn ..... F41A 3/94 89/191.01

* cited by examiner

FIREARM

CROSS REFERENCE TO RELATED APPLICATIONS

This application is a continuation-in-part of U.S. patent application Ser. No. 16/433,941 titled "Firearm With Forward Charging System" filed Jun. 6, 2019, which is incorporated herein by reference in its entirety. The U.S. patent application Ser. No. 16/433,941 is a continuation of U.S. patent application Ser. No. 15/863,856 titled "Firearm With Forward Charging System" filed Jan. 5, 2018, now issued U.S. Pat. No. 10,352,635, which is incorporated herein by reference in its entirety. The U.S. patent application Ser. No. 15/863,856 claims the benefit of U.S. Provisional Application No. 62/443,173, filed on Jan. 6, 2017, which is incorporated herein by reference in its entirety. This application claims the benefit of U.S. Provisional Application No. 63/119,773, filed on Dec. 1, 2020, which is incorporated herein by reference in its entirety.

FIELD

The present invention relates to a firearm.

BACKGROUND

Referring to FIG. 1, a top-mounted T-shaped charging handles 2 are standard features of M-16 and AR 15 style rifles. When the charging handle 2 is pulled back towards the butstock, the operator of the firearm can eject a spent shell casing or an unfired cartridge from a chamber, load a round from the magazine, clear a jam or misfire, move a bolt into battery, and/or release a bolt locked to the rear. However, to accomplish any of these tasks, the operator of the firearm must tilt the firearm towards the ground and away from the intended target to get the leverage necessary to operate the charging handle 2.

There needs to be a better way of performing these tasks without forcing the operator of the firearm to move the firearm away from the intended target.

BRIEF DESCRIPTION OF THE FIGURES

FIG. 39 depicts a perspective view of an exemplary embodiment presently disclosed.

FIGS. 73-82 depict a partially disassembled view of a firearm according to some embodiments presently disclosed.

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements, and are not drawn to scale.

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Figure 2A:
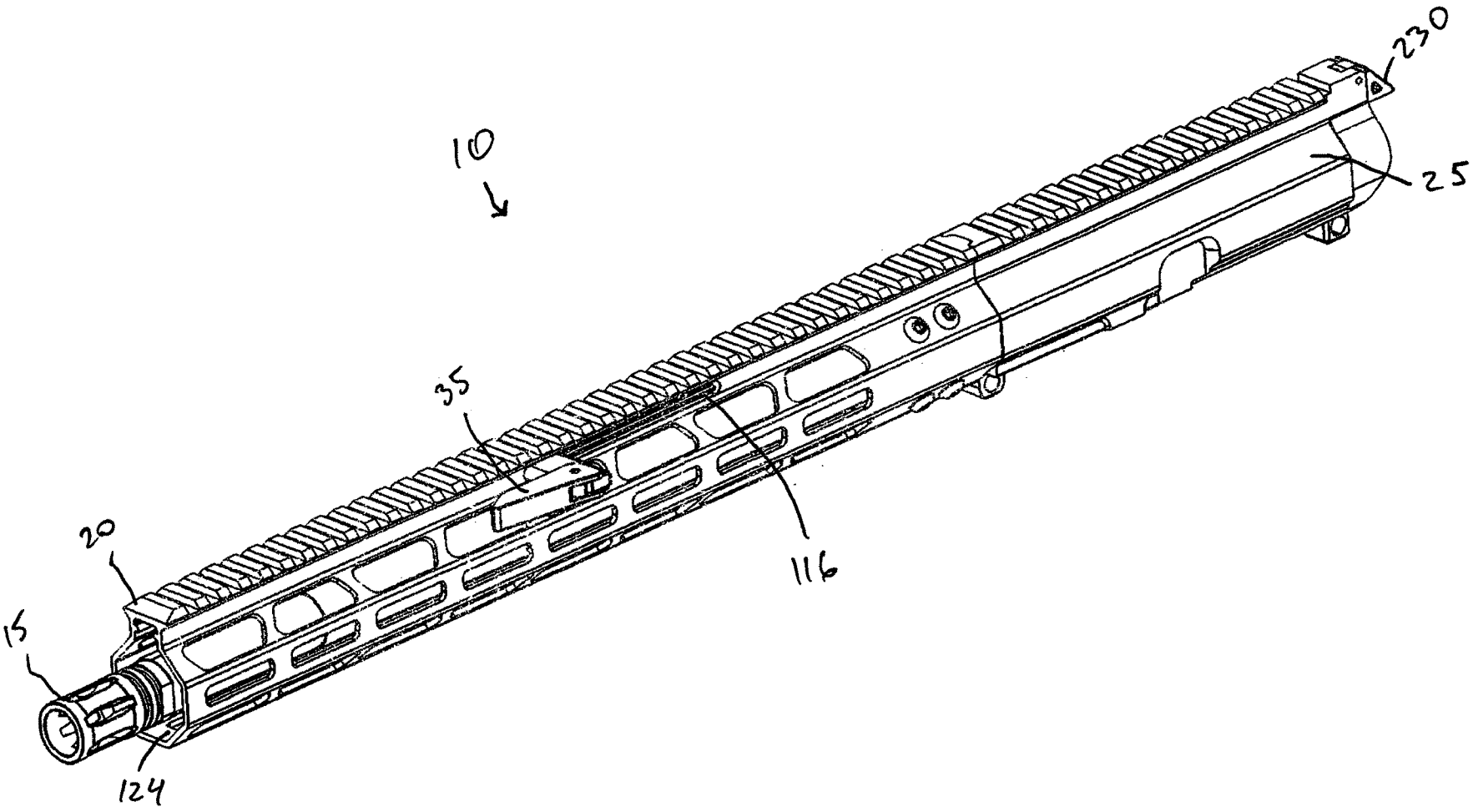
FIG. 2*a* depicts an assembled view of an upper receiver assembly according to the present disclosure.
Figure 2B:
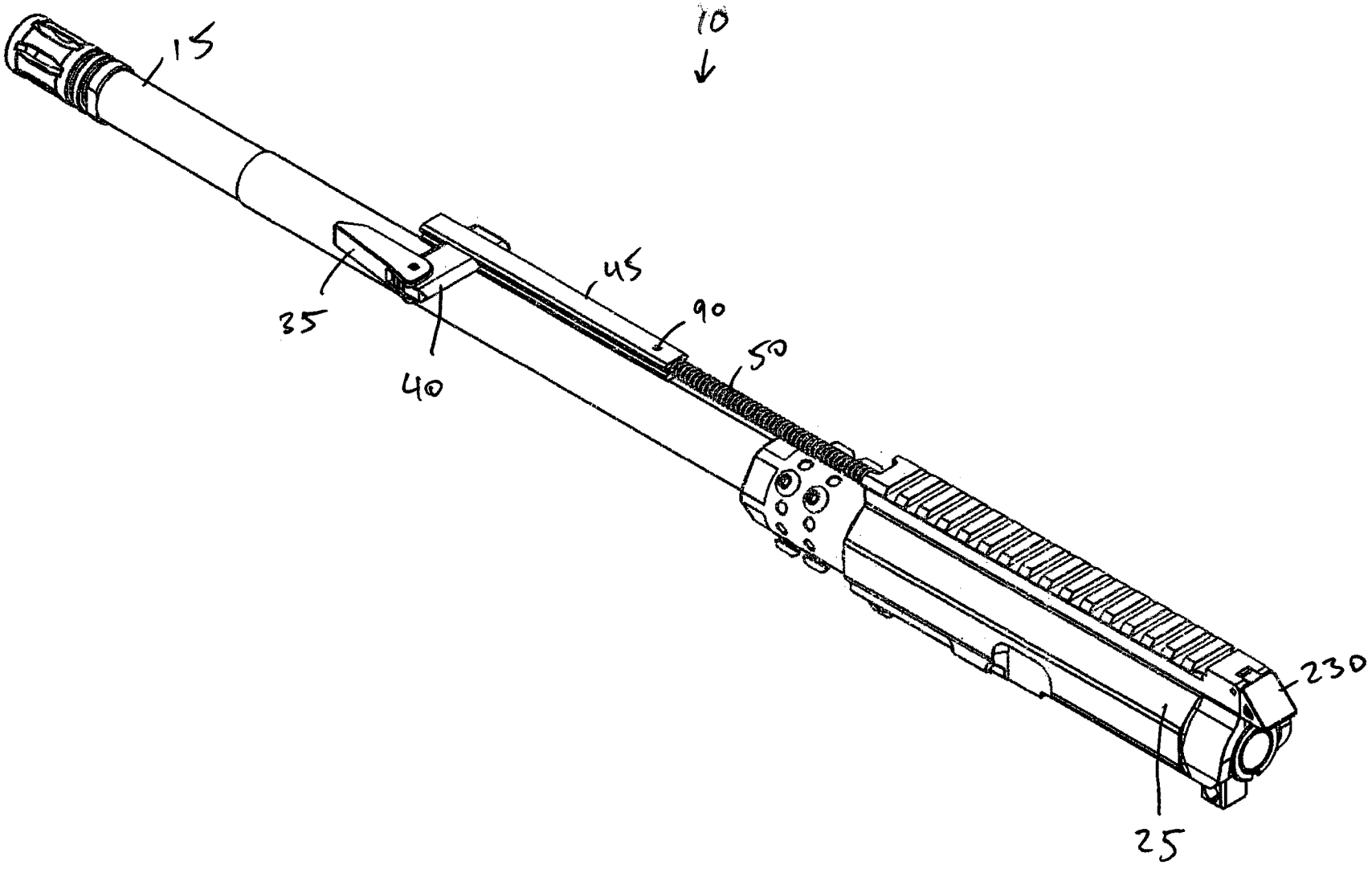
FIG. 2*b* depicts a partially disassembled view of the upper receiver assembly shown in FIG. 2*a*.
Figure 8:
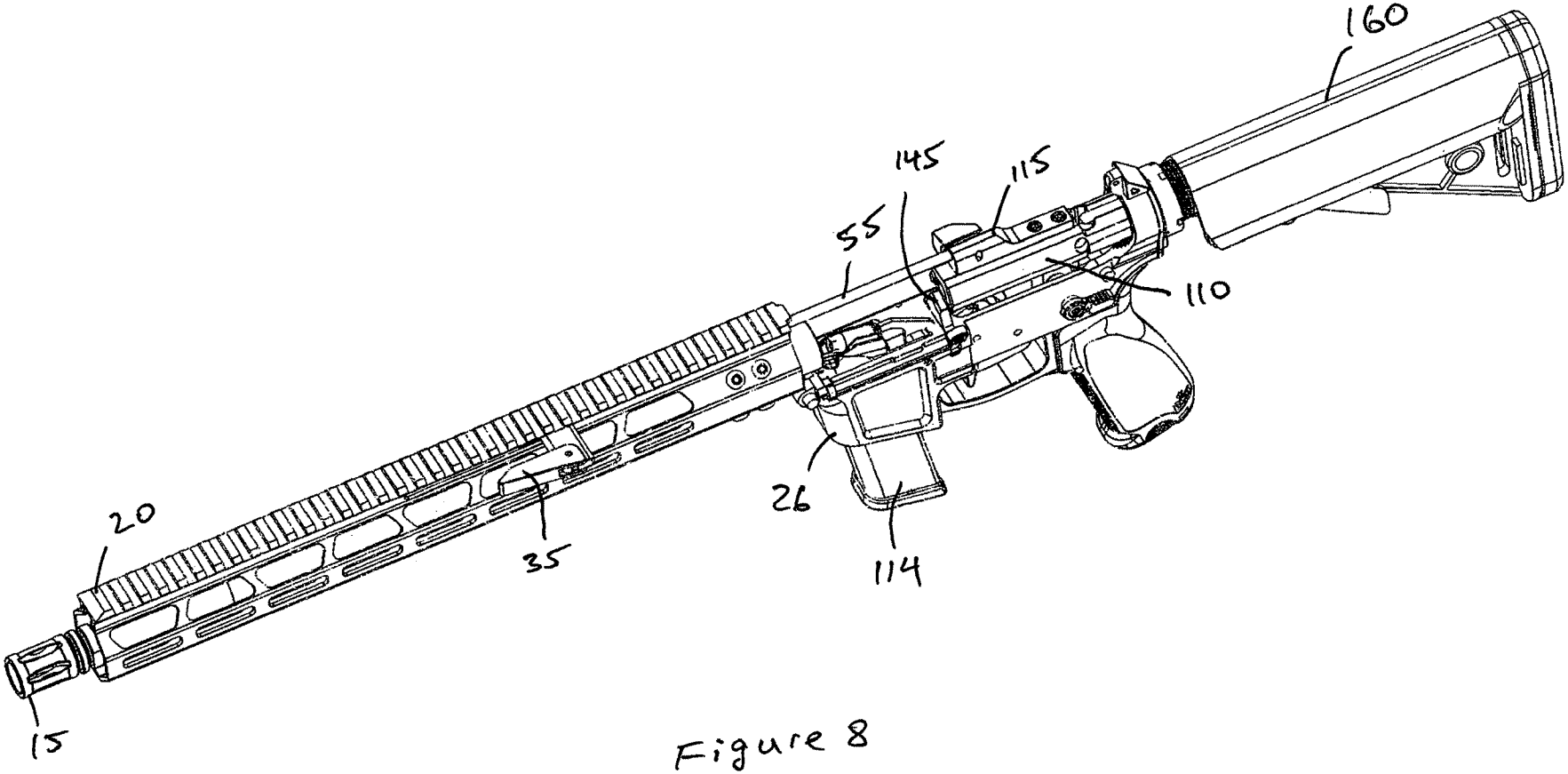
FIGS. 8-10 depict forward charging system according to the present disclosure.
Figure 9:
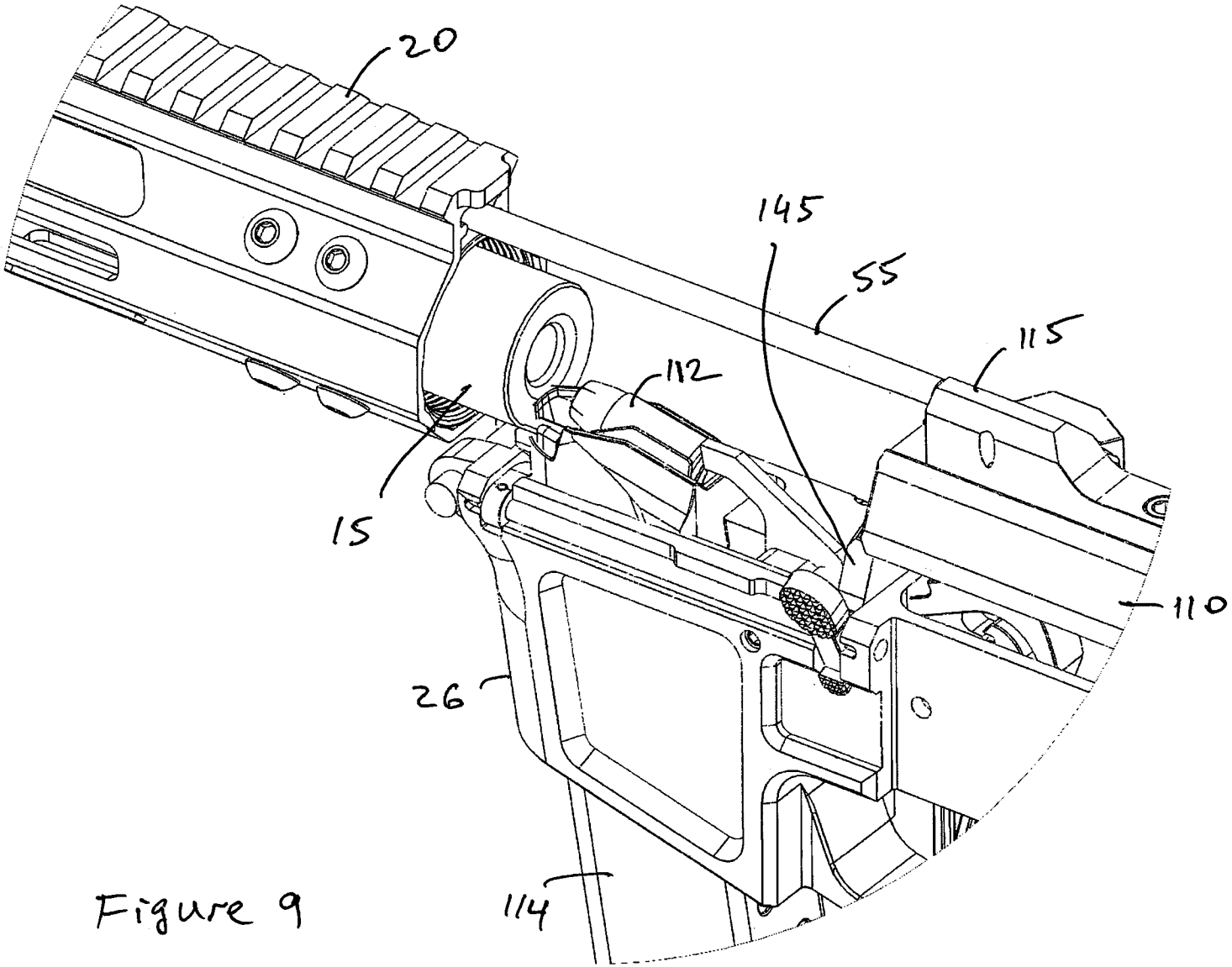
Figure 10:
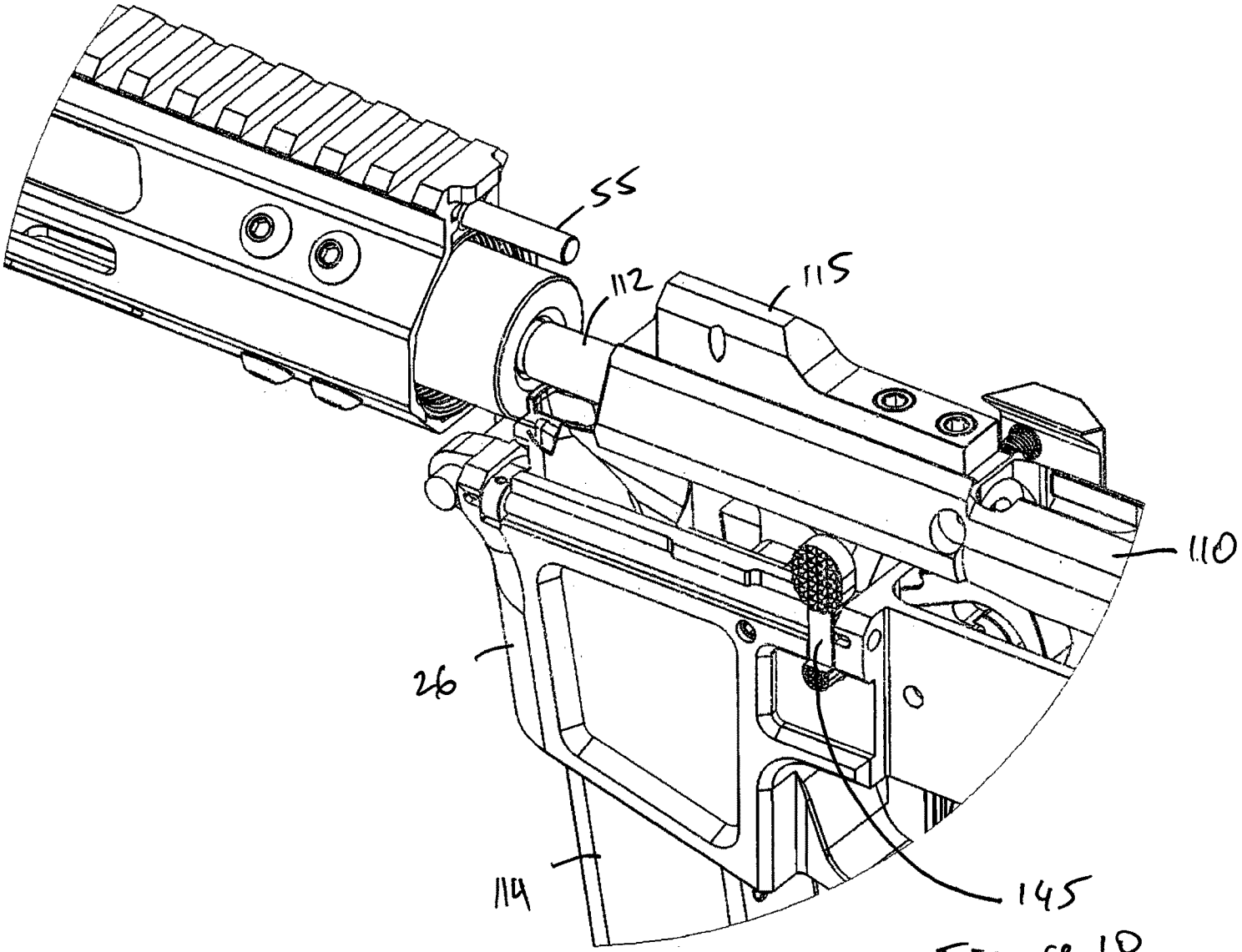

Referring to FIG. 2*a*, an upper receiver assembly 10 is shown according to some embodiments presently disclosed. The upper receiver assembly 10 comprises a barrel 15, a hand guard 20 and an upper receiver 25. According to some embodiments the upper receiver 25 is coupled to a lower receiver 26 shown in FIGS. 8-10. The hand guard 20 may removably encircle the barrel 15. According to some embodiments the upper receiver 25 is coupled with the barrel 15 as shown in FIG. 2*b*. According to some embodiments the upper receiver 25 is coupled with the hand guard 20. According to some embodiments the hand guard 20 is coupled with the barrel 15 as shown in FIGS. 9-10.

Referring to FIGS. 2*b*-4, the upper receiver assembly 10 comprises a forward charging system 30 according to some embodiments presently disclosed. The forward charging system 30 comprises a charging base 40, a charging trolley 45, and a rod 55. The forward charging system 30 may also comprise a return spring 50.

The charging trolley 45 comprises a forward portion 60 and a rear portion 65. According to some embodiments presently disclosed, the charging base 40 is coupled with the charging trolley 45's forward portion 60. According to some embodiments presently disclosed, the charging base 40 is coupled with the charging trolley 45 adjacent to the forward portion 60. According to some embodiments presently disclosed, the charging trolley 45 comprises an opening 75 (shown in FIG. 4) configured to accommodate the charging base 40 as shown in FIG. 5. The opening 75 may be a through opening to allow the charging base 40 to be inserted on either the right or left side of the charging trolley 45. The charging base 40 may be coupled with the charging trolley 45 using, for example, a fastener 70 shown in FIGS. 6-7. The fastener 70 may be a pin, a screw, a set screw, a full dog point set screw, or a dogleg set screw. According to some embodiments presently disclosed, the charging trolley 45 comprises an opening 80 (shown in FIGS. 5-7) and the charging base 40 comprises an opening 85 (shown in FIG. 4). The openings 80 and 85 are configured to accommodate the fastener 70. A set screw may be fully threaded and does not have any head projecting out of the screw thread. According to some embodiments presently disclosed, the charging base 40 is coupled substantially perpendicular to the charging trolley 45. According to some embodiments presently disclosed, the charging base 40 is coupled at an angle to the charging trolley 45.

The rod 55 comprises a forward portion 56 and a rear portion 58. According to some embodiments presently disclosed, rod 55's forward portion 56 is coupled with the charging trolley 45's rear portion 65. The rod 55 may be coupled with the charging trolley 45 using, for example, a fastener 90 shown in FIG. 4. The fastener 90 may be a pin, a screw, a set screw, a full dog point set screw, or a dogleg set screw. According to some embodiments presently disclosed, the charging trolley 45 comprises an opening 95 configured to accommodate rod 55's forward portion 56. According to some embodiments presently disclosed, the charging trolley 45 comprises an opening 100 and the rod 55 comprises an opening 105. The openings 100 and 105 are configured to accommodate the fastener 90.

According to some embodiments presently disclosed, the upper receiver 25 comprises a bolt carrier assembly 110. The bolt carrier assembly 110 is movable between a first (locked) position and a second (unlocked) position. The bolt carrier assembly 110 supports and positions a bolt (not shown). The first (locked) position is position in which the bolt carrier 110 has positioned the bolt (not shown) for firing ammunition through the barrel 15. The second (unlocked) position is any position other than the first (locked) position as shown in FIGS. 8-10.

According to some embodiments presently disclosed, the upper receiver 25 comprises a carrier key 115 coupled with a top portion of the bolt carrier assembly 110. One or more fasteners 120 may be used to couple the carrier key 115 with the bolt carrier assembly 110. The one or more fasteners 120 may be a pin, a screw, a set screw, a full dog point set screw, or a dogleg set screw.

According to some embodiments presently disclosed, the forward charging system 30 is configured to move the bolt carrier assembly 110 from the first (locked) position to the second (unlocked).

Figure 1:
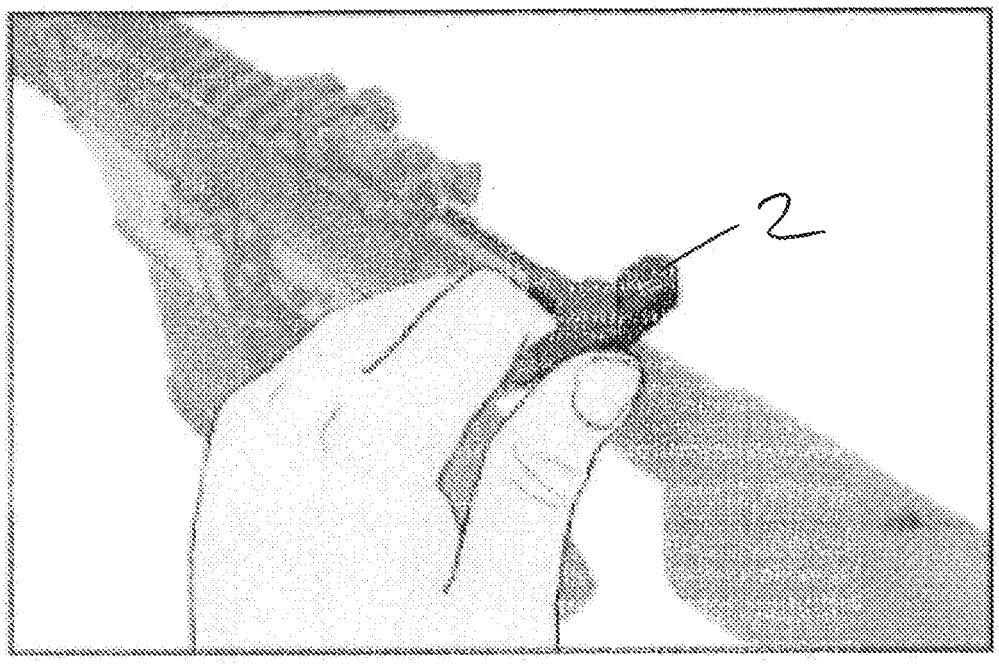
Figure 1 PRIOR ART
FIG. 1 depicts a top-mounted T-shaped charging handle as known in the prior art.
Figure 3:
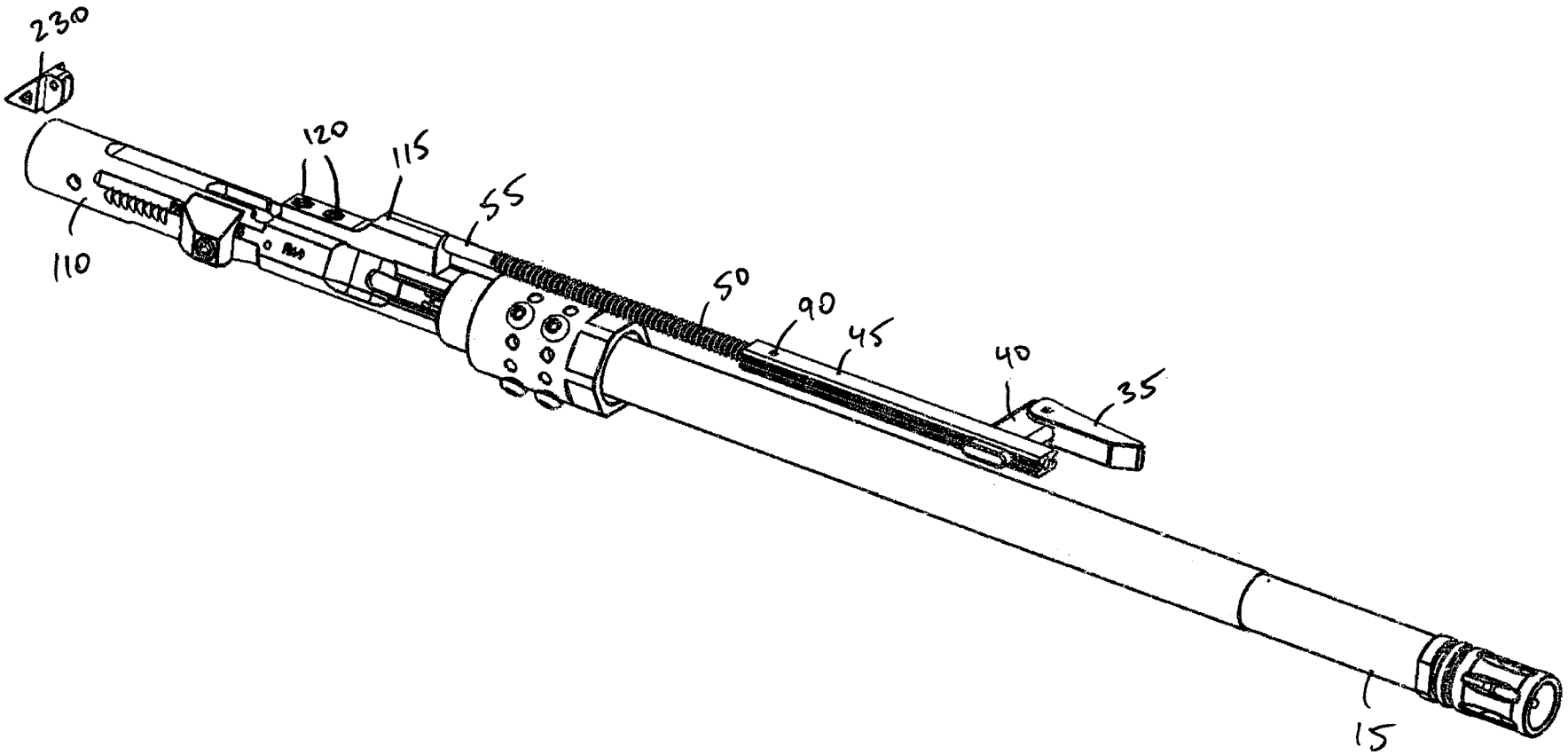
FIG. 3 depicts another partially disassembled view of the upper receiver assembly shown in FIG. 2*a*.
Figure 11:
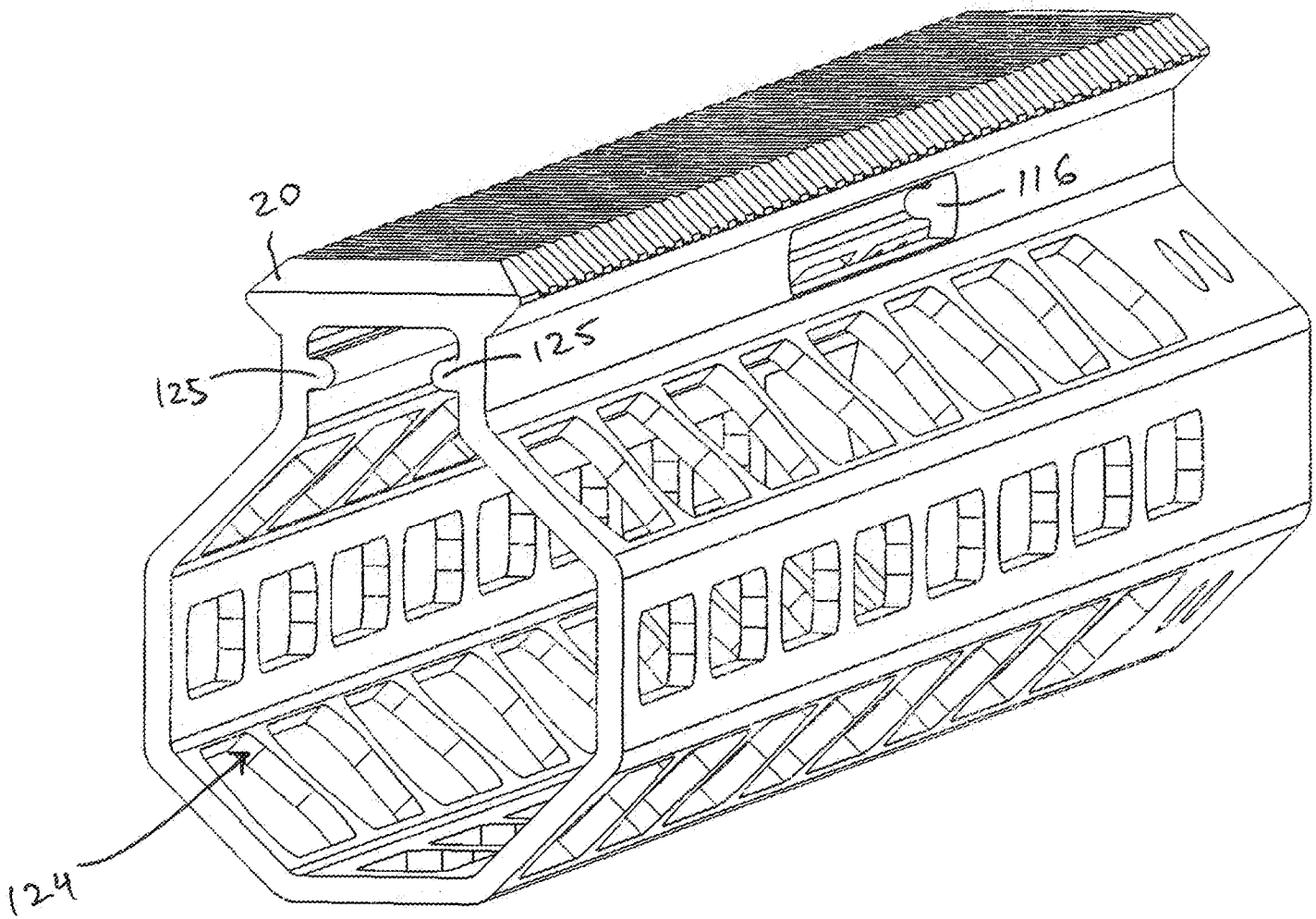
FIGS. 11-12 depict a hand guard according to the present disclosure.

According to some embodiments presently disclosed, the charging base 40 is positioned to protrude though an opening 116 of the hand guard 20 (as shown in FIGS. 1 and 11). According to some embodiments presently disclosed, the charging base 40 is positioned adjacent to the barrel 15 as shown in FIGS. 2-3. According to some embodiments presently disclosed, the charging base 40 is positioned away from the upper receiver 25 as shown in FIGS. 2-3. According to some embodiments presently disclosed, the charging base 40 is positioned away from the upper receiver 25 and towards the front of the firearm and as shown in FIGS. 2-3.

According to some embodiments presently disclosed, the hand guard 20 comprises an opening 124 configured to accommodate the barrel 15 (shown in FIGS. 2*a* and 11). According to some embodiments presently disclosed, the hand guard 20 comprises one or more rails 125 extending into the opening 124. According to some embodiments presently disclosed, the one or more rails 125 are formed during manufacturing of the hand guard 20. According to some embodiments presently disclosed, the one or more rails 125 are extruded during manufacturing of the hand guard 20. According to some embodiments presently disclosed, the one or more rails 125 run along the entire length of the hand guard 20. According to some embodiments presently disclosed, the one or more rails 125 run along a portion of the hand guard 20.

Figure 12:
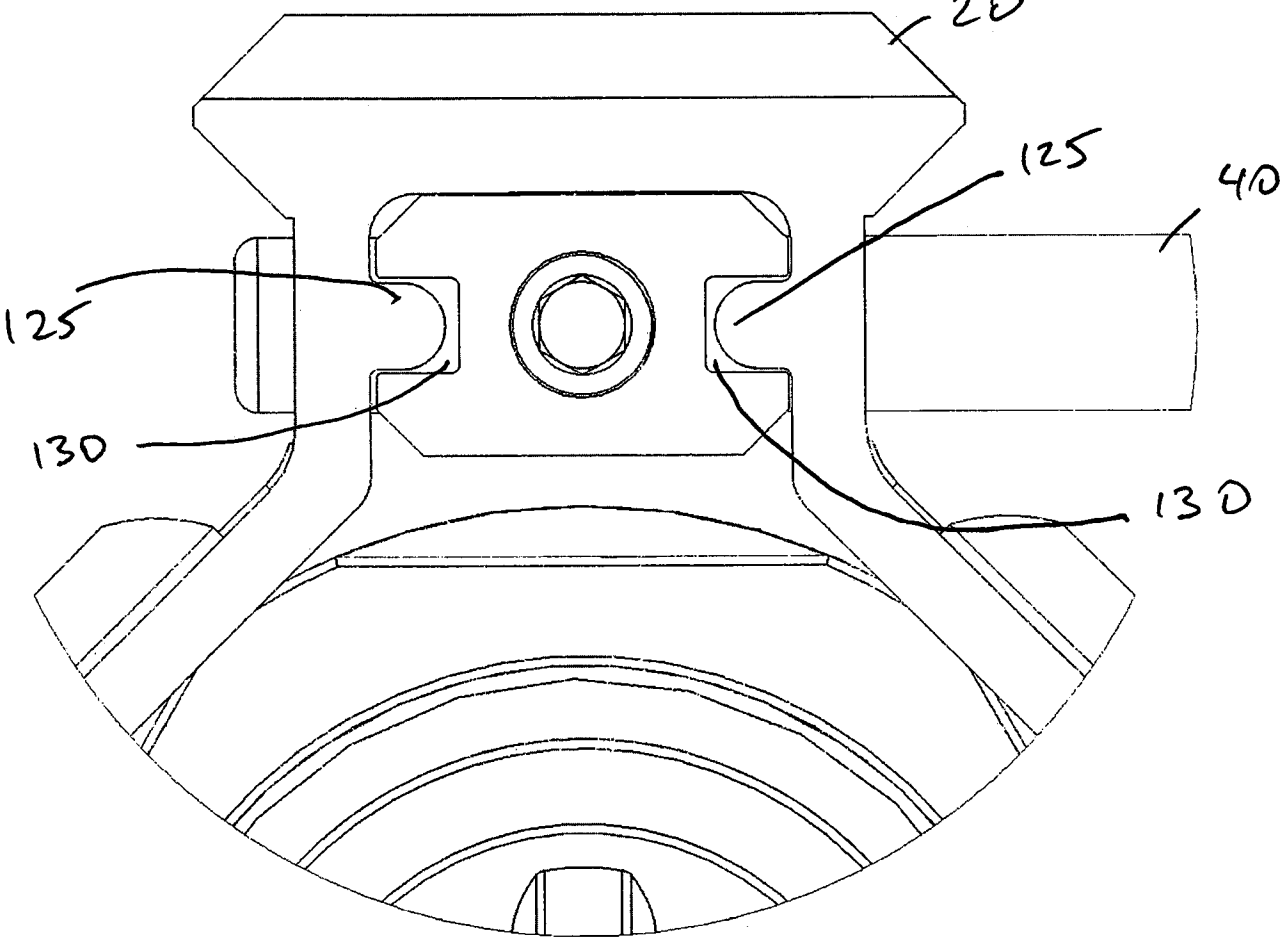

According to some embodiments presently disclosed, the charging trolley 45 comprises one or more channels 130 (shown in FIGS. 5 and 12) configured to accommodate the one or more rails 125 as shown in FIG. 12. According to some embodiments presently disclosed, the one or more channels 130 run along the entire length of the charging trolley 45 as shown in FIG. 5. The charging trolley 45 is configured to slide along the one or more rails 125 from a first (rest) position to a second (charging) position and back to the first (rest) position.

According to some embodiments presently disclosed, moving the charging trolley 45 towards the second (charging) position causes rod 55's rear portion 58 to abut (i.e. engage) the carrier key 115. According to some embodiments presently disclosed, moving the charging trolley 45 towards the second (charging) position causes rod 55's rear portion 58 to engage the carrier key 115 and move the bolt carrier assembly 110 from the first (locked) position to the second (unlocked) position. According to some embodiments presently disclosed, moving the charging trolley 45 towards the second (charging) position causes rod 55's rear portion 58 to move the bolt carrier assembly 110 from the first (locked) position to the second (unlocked) position. According to some embodiments presently disclosed, moving the charging trolley 45 towards the second (charging) position causes rod 55's rear portion 58 to engage the carrier key 115 and move the bolt carrier assembly 110 away from the barrel 15.

According to some embodiments presently disclosed, the charging trolley 45's second (charging) position is position in which the charging trolley 45 is positioned closer to the upper receiver 25. According to some embodiments presently disclosed, the charging trolley 45's first (rest) position is position in which the charging trolley 45 is positioned closer to the front of the firearm and away from the upper receiver 25. According to some embodiments presently disclosed, the charging trolley 45's second (charging) position is position in which the rod 55 moves the bolt carrier assembly 110 to the second (unlocked) position. According to some embodiments presently disclosed, the charging trolley 45's first (rest) position is position in which the rod 55 allows the bolt carrier assembly 110 to return to the first (locked) position. According to some embodiments presently disclosed, the charging trolley 45's first (rest) position is position in which the rod 55 is positioned away from the carrier key 115.

According to some embodiments presently disclosed, the lower receiver 26 comprises a bolt hold open 145 shown in FIG. 8. The bolt hold open 145 is configured to move from a first (open) position to a second (blocking) position. According to some embodiments presently disclosed, at least a portion of the bolt hold open 145 moves vertically from the first (open) position to the second (blocking) position. When the bolt hold open 145 is in the first (open) position (as shown in FIG. 10), the bolt carrier assembly 110 is able to freely move between the first (locking) position and the second (unlocked) position. When the bolt hold open 145 is in the second (blocking) position (as shown in FIG. 8), the bolt carrier assembly 110 is prevented from moving forward to the first (locking) position.

According to some embodiments presently disclosed, moving the charging trolley 45 towards the second (charging) position causes rod 55's rear portion 58 to engage the carrier key 115 and move the bolt carrier assembly 110 away from the bolt hold open 145 thereby allowing the bolt hold open 145 to move to the first (open) position. Allowing the bolt hold open 145 to move to the first (open) position allows the bolt carrier assembly 110 to move towards the first (locked) position when the charging trolley 45 is moved towards the first (rest) position.

According to some embodiments presently disclosed, rod 55's rear portion 58 is a first distance from the carrier key 115 when the charging trolley 45 is in the first (rest) position and the bolt carrier assembly 110 is in the first (locked) position. According to some embodiments presently disclosed, the first distance is about 0.05 inches. According to some embodiments presently disclosed, rod 55's rear portion 58 is spaced away from the carrier key 115 when the charging trolley 45 is in the first (rest) position and the bolt carrier assembly 110 is in the first (locked) position.

According to some embodiments presently disclosed, the charging trolley 45 is moved towards the second (charging) position by applying a first force on the charging base 40 towards the second (charging) position. According to some embodiments presently disclosed, the charging trolley 45 is moved towards the second (charging) position by applying a first force on the charging base 40 towards a butstock 160 located at the rear of the firearm (shown in FIG. 8).

According to some embodiments presently disclosed, the upper receiver 25 comprises a through opening 150 to allow the rod 55 to pass though and be able to engage the carrier key 115.

Figure 13:
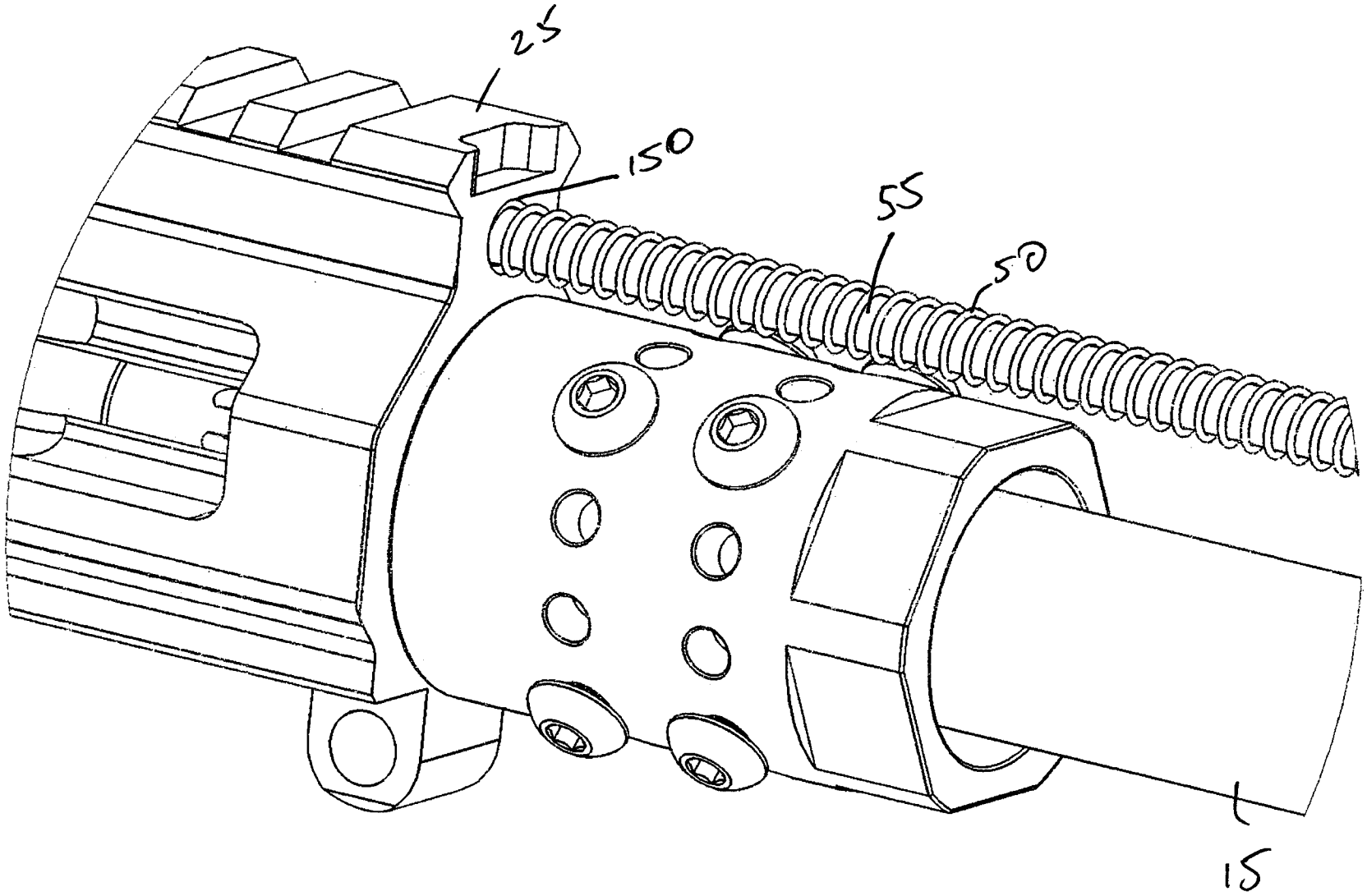
FIG. 13 depicts forward charging system according to the present disclosure.

According to some embodiments presently disclosed, the rod 55 passes through the return spring 50 that is positioned between the upper receiver 25 and the charging trolley 45 as shown in FIGS. 2*b* and 13. According to some embodiments presently disclosed, moving the charging trolley 45 towards the second (charging) position compresses the return spring 50 between the charging trolley 45 and the upper receiver 25. According to some embodiments presently disclosed, applying the first force to the charging base 40 compresses the return spring 50 between the charging trolley 45 and the upper receiver 25. Removing the first force causes the compressed return spring 50 to return the charging trolley 45 back to the first (rest) position. According to some embodiments presently disclosed, the return spring 50 prevents the charging trolley 45 from moving from the first (rest) position towards the second (charging position). According to some embodiments presently disclosed, the return spring 50 prevents the charging trolley 45 from moving from the first (rest) position towards the second (charging position) during normal operations of the firearm.

Although the charging base 40 can be used to move the charging trolley 45 from the first (rest) position towards the second (charging) position, the forward charging system 30 may further comprise a charging handle 35 coupled with the charging base 40. The charging handle 35 may be pivotally coupled with the charging base 40. According to some embodiments presently disclosed, the charging trolley 45 is moved towards the second (charging) position by applying a second force on the charging handle 35 towards the second (charging) position. According to some embodiments presently disclosed, the charging trolley 45 is moved towards the second (charging) position by applying a second force on the charging handle 35 towards the butstock 160 located at the rear of the firearm (shown in FIG. 8).

According to some embodiments presently disclosed, the charging handle 35 comprises a channel (i.e. an opening) 180 configured to accommodate at least a portion of the charging base 40 (as shown in FIG. 5). According to some embodiments presently disclosed, the charging handle 35 comprises a U-shaped channel 180 comprising a first sidewall 182, a second sidewall 184 and a top wall 186 connecting the sidewalls 182 and 184. The U-shaped channel 180 is configured to accommodate at least a portion of the charging base 40 (as shown in FIG. 5).

Figure 4:
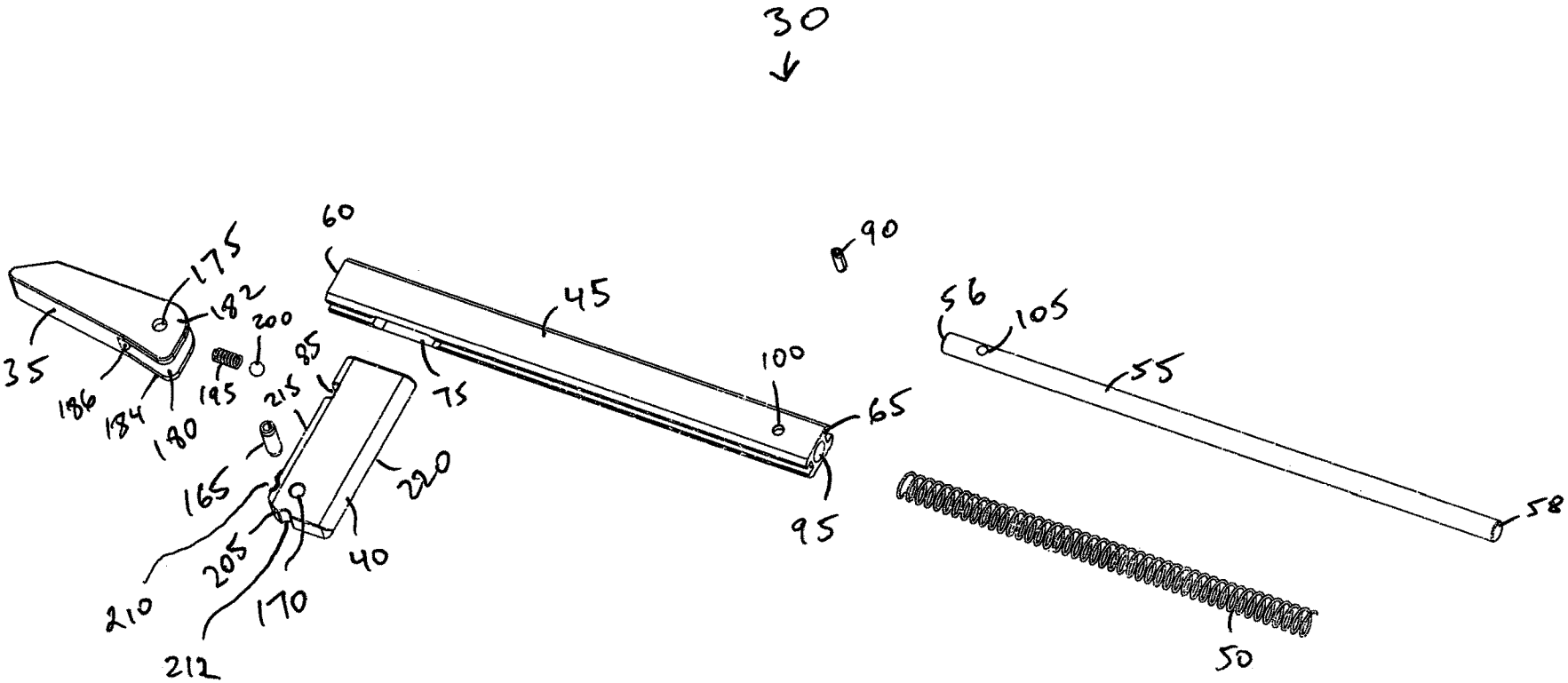
FIG. 4 depicts a forward charging system according to the present disclosure.
Figure 5:
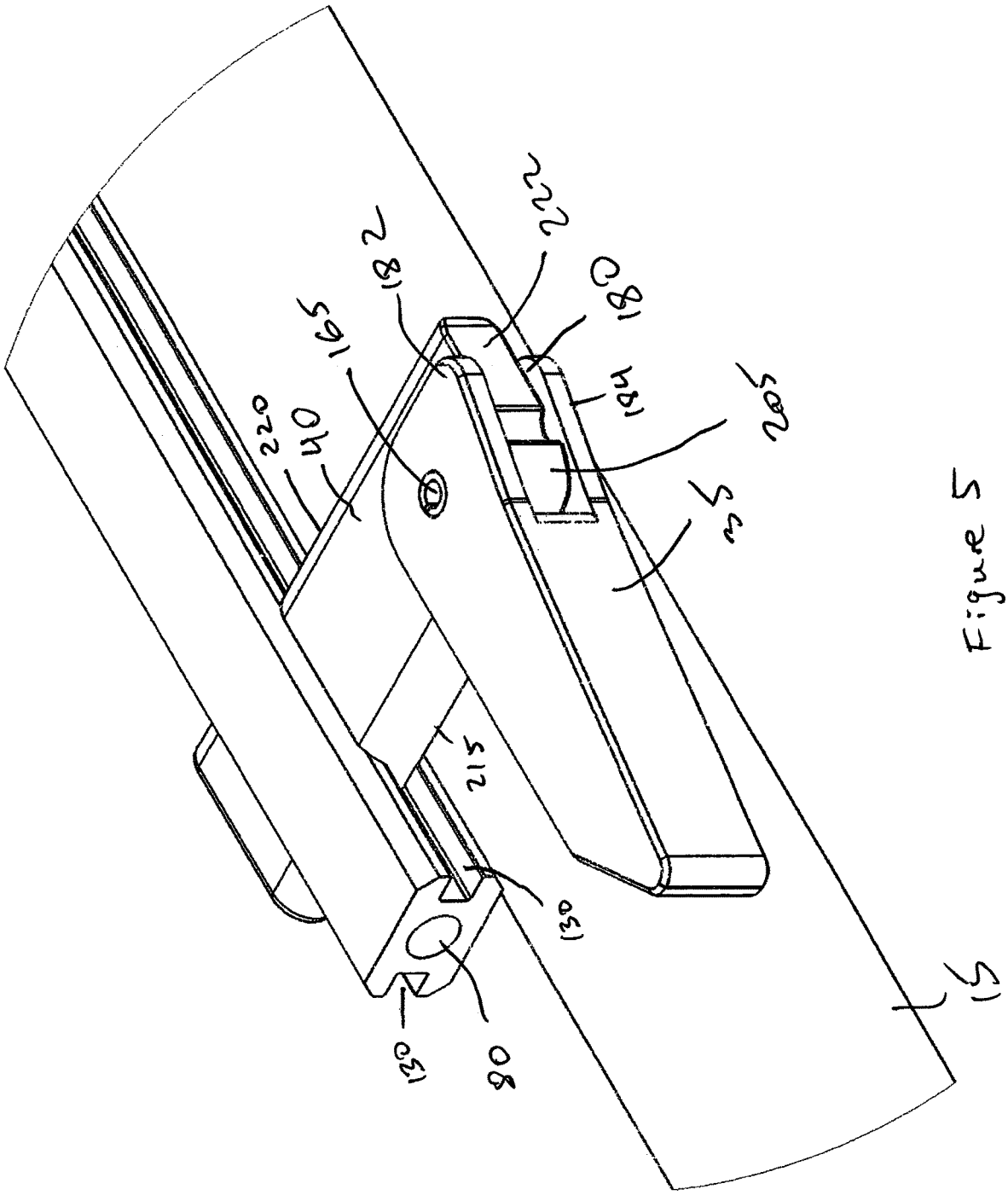
FIGS. 5-7 depict a close up view of the forward charging system according to the present disclosure.

According to some embodiments presently disclosed, the charging handle 35 is coupled with the charging base 40 using, for example, a fastener 165 shown in FIG. 4. The fastener 165 may be a pin, a spring pin, a screw, a set screw, a full dog point set screw, or a dogleg set screw. According to some embodiments presently disclosed, the charging base 40 comprises an opening 170 and the first sidewall 182 comprises an opening 175. The openings 170 and 175 are configured to accommodate the fastener 165. According to some embodiments presently disclosed, the second sidewall 184 also comprises an opening (not shown) configured to accommodate the fastener 165.

Figure 7:
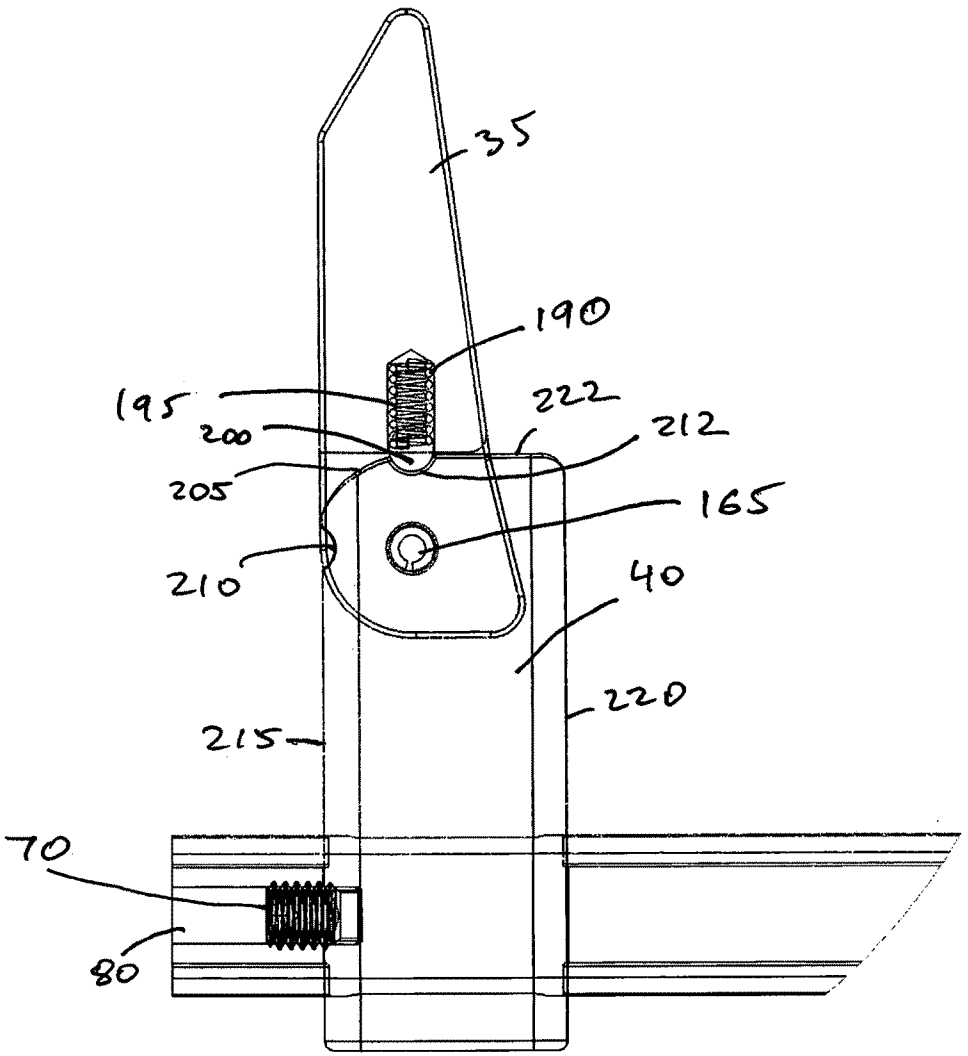

According to some embodiments presently disclosed, the charging handle 35 is configured to pivot about the fastener 165. According to some embodiments presently disclosed, the charging handle 35 is configured to pivot about the fastener 165 from a first (folded) position to a second (extended) position and back to the first (folded) position. According to some embodiments presently disclosed, the first (folded) position is position in which the charging handle 35 is substantially parallel to the barrel 15 (shown in FIGS. 2*a-b*, 3 and 5). According to some embodiments presently disclosed, the second (extended) position is any position other than the first (folded) position as shown in FIG. 7. According to some embodiments presently disclosed, the second (extended) position is position in which the charging handle 35 is substantially perpendicular to the charging base 40 as shown in FIG. 7.

According to some embodiments presently disclosed, the charging base 40 comprises a forward edge 215, a rear edge 220, a side edge 222, a semi circular edge 205 between the forward edge 215 and the side edge 222, and a first cavity 210 disposed on the forward edge 215. According to some embodiments presently disclosed, the charging base 40 may comprise a second cavity 212 disposed on the side edge 222.

Figure 6:
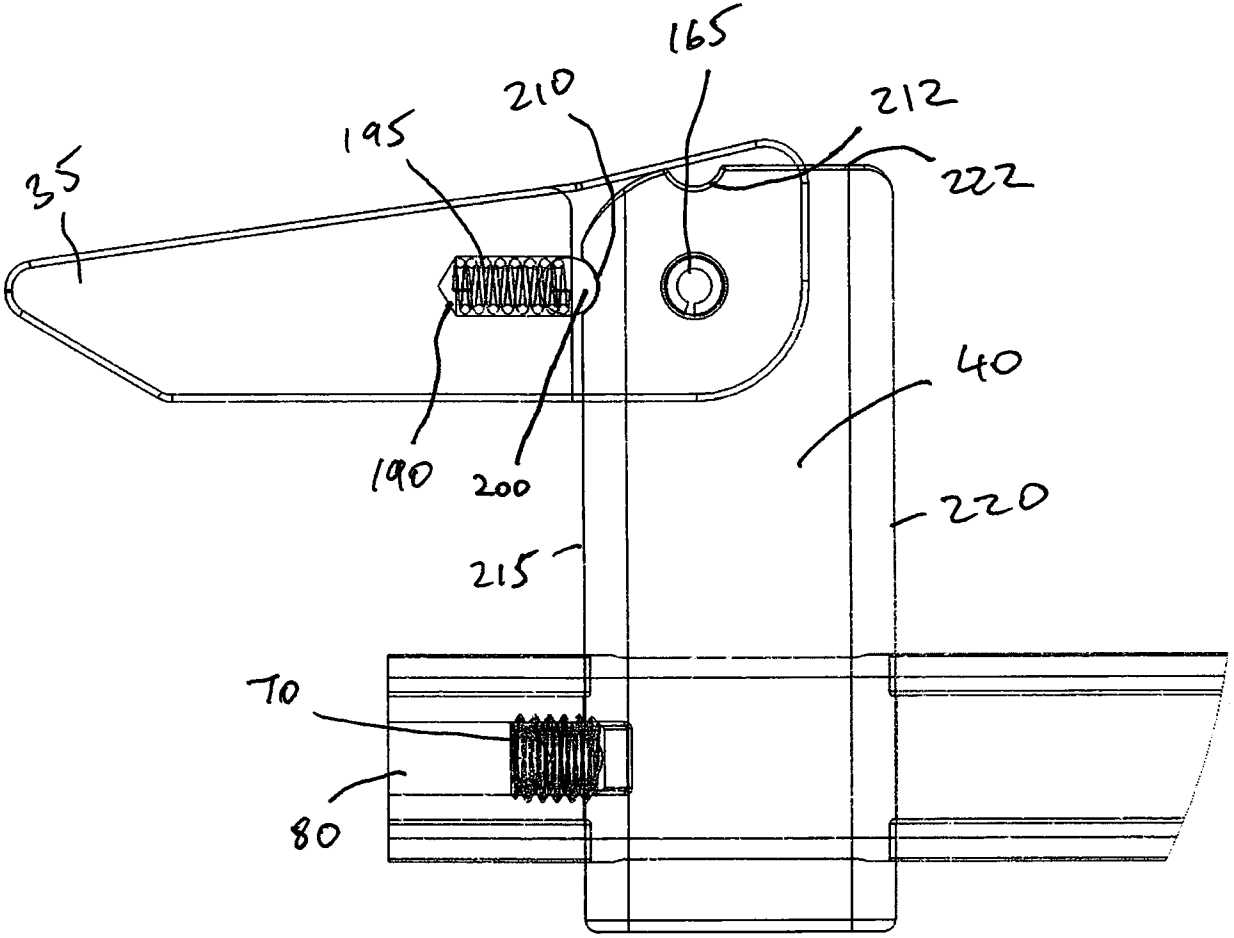

According to some embodiments presently disclosed, the top wall 186 of the U-shaped channel 180 comprises an opening 190 configured to accommodate a spring 195 and a ball bearing 200 as shown in FIGS. 4, 6-7. According to some embodiments presently disclosed, the spring 195 is disposed in the opening 190 and the ball bearing 200 is disposed between the spring 195 and the charging base 40. When the charging handle 35 is in the first (folded) position, the ball bearing 200 is positioned in the first cavity 210 to prevent the charging handle 35 from moving to the second (extended) position. According to some embodiments presently disclosed, after applying a third force to the charging handle 35, the ball bearing 200 is pushed out of the first cavity 210 and rolls along the semi-circular edge 205 until the top wall 186 abuts the side edge 222 and/or until the charging handle 35 reaches the second (extended) position. According to some embodiments presently disclosed, after applying a third force to the charging handle 35, the ball bearing 200 is pushed out of the cavity 210 and rolls along the semi-circular edge 205 until it is positioned in the second cavity 212. According to some embodiments presently disclosed, when the charging handle 35 is in the second (extended) position, the ball bearing 200 is positioned in the second cavity 212 to prevent the charging handle 35 from moving to the first (folded) position. According to some embodiments presently disclosed, a force of the spring 50 returning the charging trolley 45 back to the first (rest) position causes the charging handle 35 to move from the second (extended) position to the first (folded) position. According to some embodiments presently disclosed, a force of the spring 50 returning the charging trolley 45 back to the first (rest) position causes the charging handle 35 to move from the second (extended) position to the first (folded) position and position the ball bearing 200 in the cavity 210. According to some embodiments presently disclosed, a force of the spring 50 returning the charging trolley 45 back to the first (rest) position causes the ball bearing 200 to be pushed out of the cavity 212 and roll in to the cavity 210.

Figure 14:
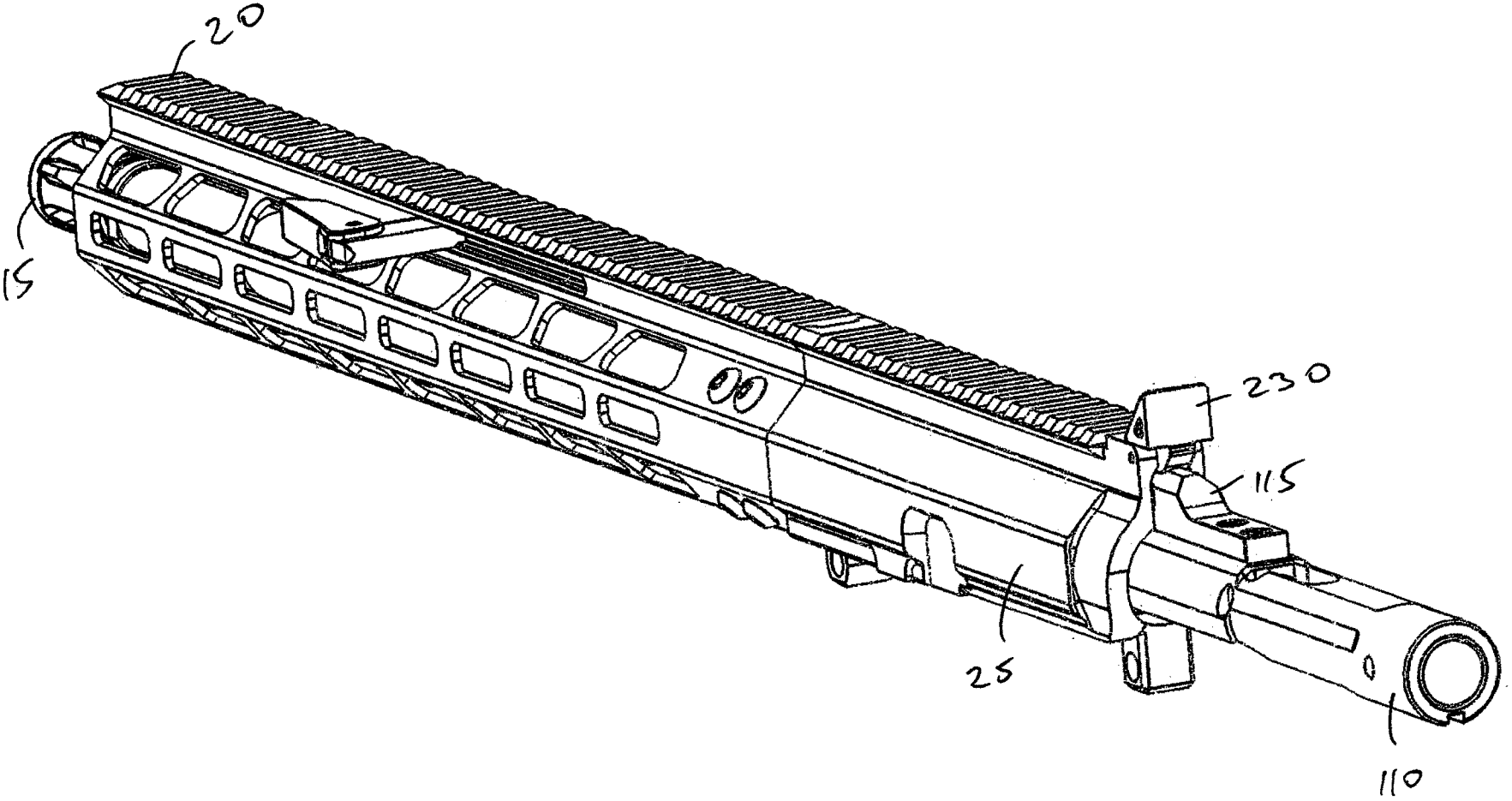
FIGS. 14-15 depict a trap door according to the present disclosure.
Figure 15:
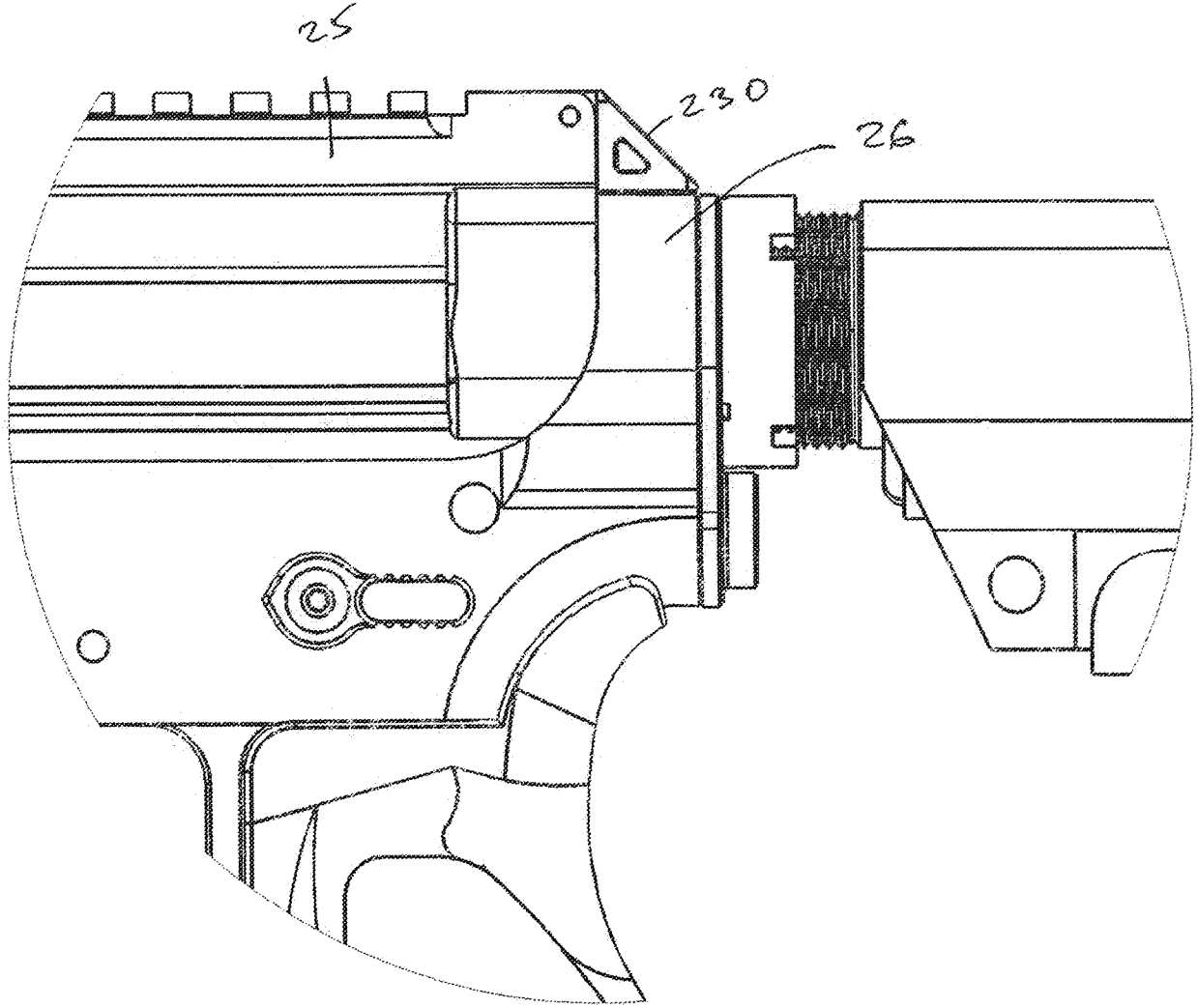

According to some embodiments presently disclosed, the upper receiver 25 comprises a trap door 230 (shown in FIGS. 14-15). The trap door 230 may be pivotally coupled with the upper receiver 25. The rap door 230 is pivotally movable from the first (open) position (shown in FIG. 14) to the second (closed) position (shown in FIG. 15) and back to the first (open) position. The trap door 230 may be moved to the first (open) position when the upper receiver 25 is at least partially removed (i.e. pivoted away) from the lower receiver 26. The carrier key 115 coupled with the bolt carrier assembly 110 may be removed from the upper receiver 25 when the trap door 230 is in the first (open) position as shown in FIG. 14. The trap door 230 is securely locked in the second (closed) position when the upper receiver 25 is coupled with the lower receiver 26 as shown in FIG. 15. The lower receiver 26 prevents the trap door 230 from moving towards the first (open) position when the upper receiver 25 is coupled with the lower receiver 26 as shown in FIG. 15.

It is to be understood that the forward charging system 30 described above may be implemented on different types of firearms. The forward charging system 30 described above may be implemented on firearms using a blowback system of operation, and/or firearm using a direct impingement system of operation, and/or firearm using piston system of operation. Blowback is a system of operation for self-loading firearms that obtains energy from the motion of the cartridge case as it is pushed to the rear by expanding gas crated by the ignition of the propellant charge. Direct impingement is a type of gas operation for a firearm that directs gas from a fired cartridge directly into the bolt carrier to cycle the action. Piston system uses gas pressure to mechanically move the bolt carrier to cycle the action. It is also to be understood that the forward charging system 30 described above may be implemented on M-16 and Armalite style rifles (ARs).

Figure 16:
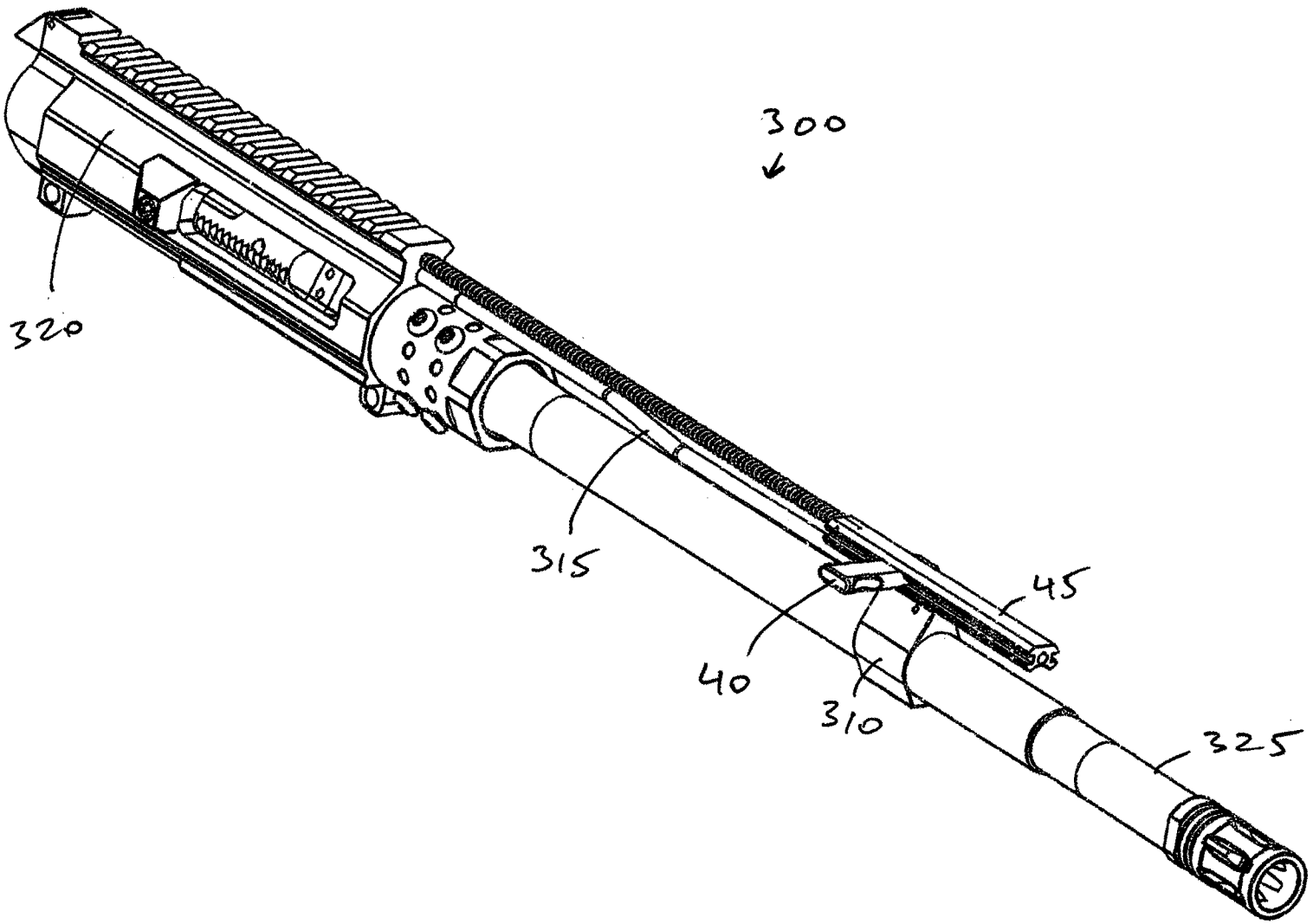
FIGS. 16-20 depict forward charging system according to the present disclosure on a firearm using direct impingement system.
Figure 17:
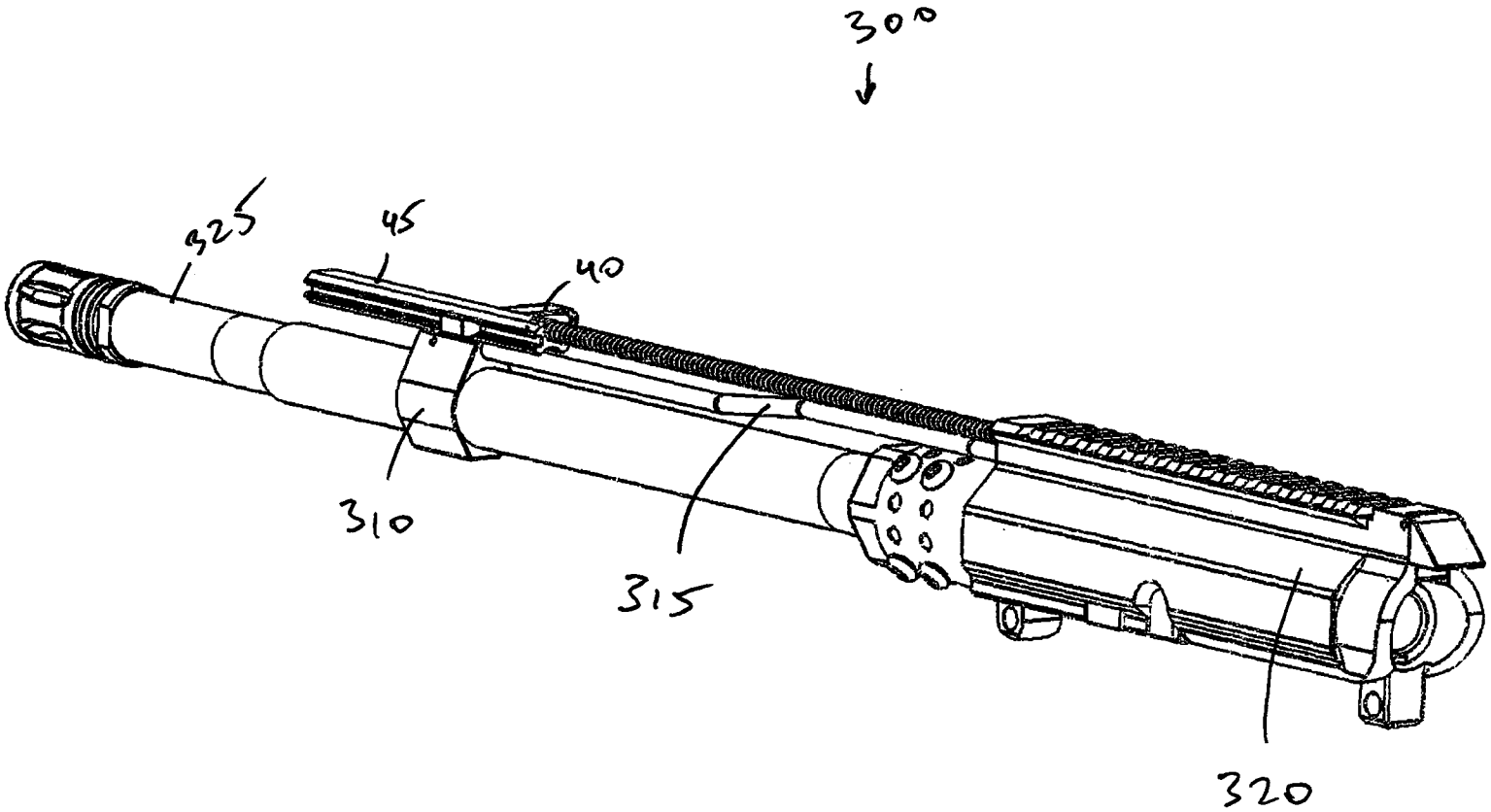

Referring to FIGS. 16-20, the forward charging system 30 is shown on an upper receiver assembly 300 using for example, a direct impingement system. Referring to FIGS. 16-17, the upper receiver assembly 300 is shown according to some embodiments presently disclosed. The upper receiver assembly 300 comprises a barrel 325, gas block 310 coupled with the barrel, gas tube 315, and an upper receiver 320. The upper receiver assembly 300 may comprise a hand guard 20 as shown in FIG. 11 and described above. According to some embodiments presently disclosed, the upper receiver assembly 300 comprises the forward charging system 30 as described above.

Figure 18:
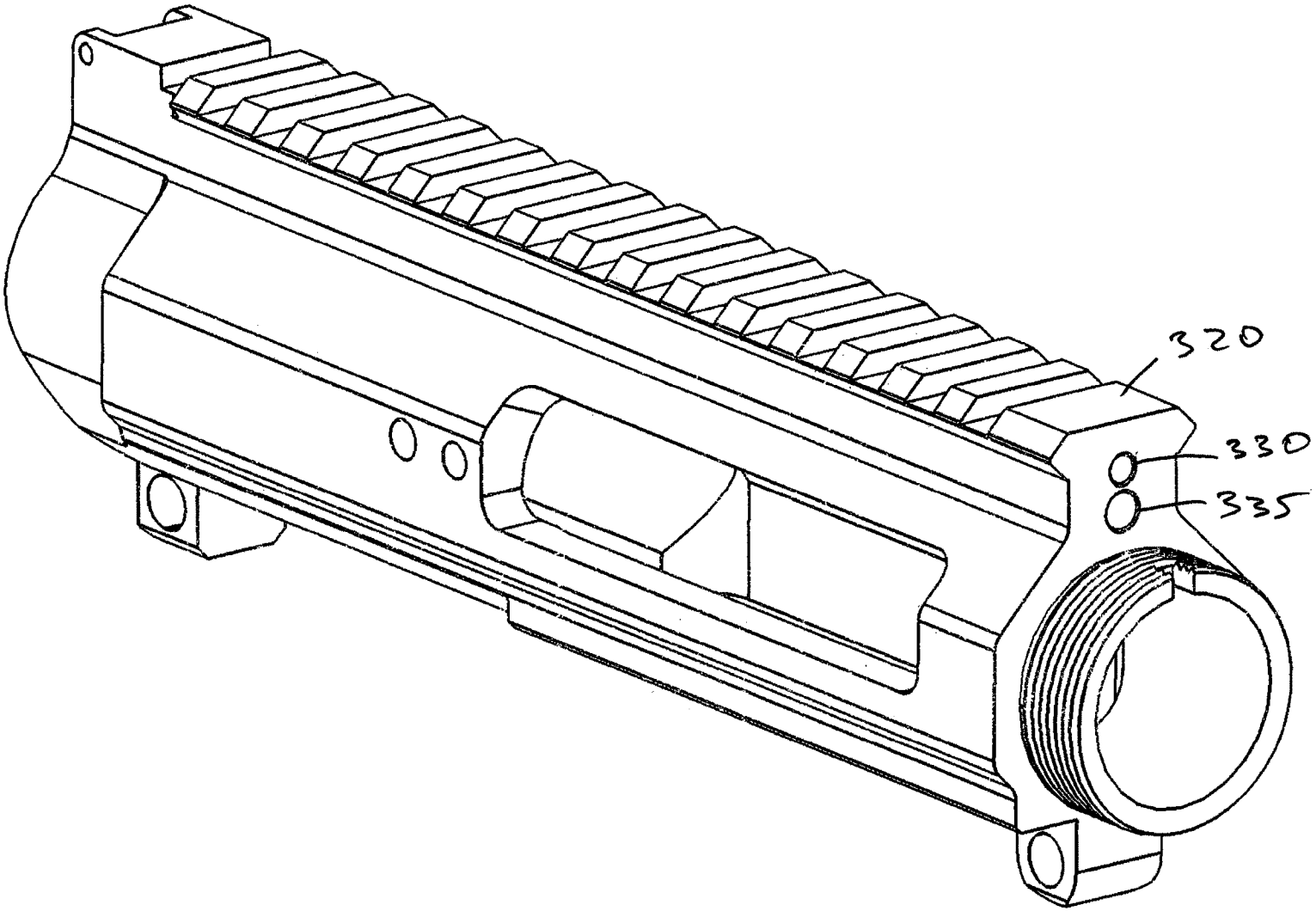
Figure 19:
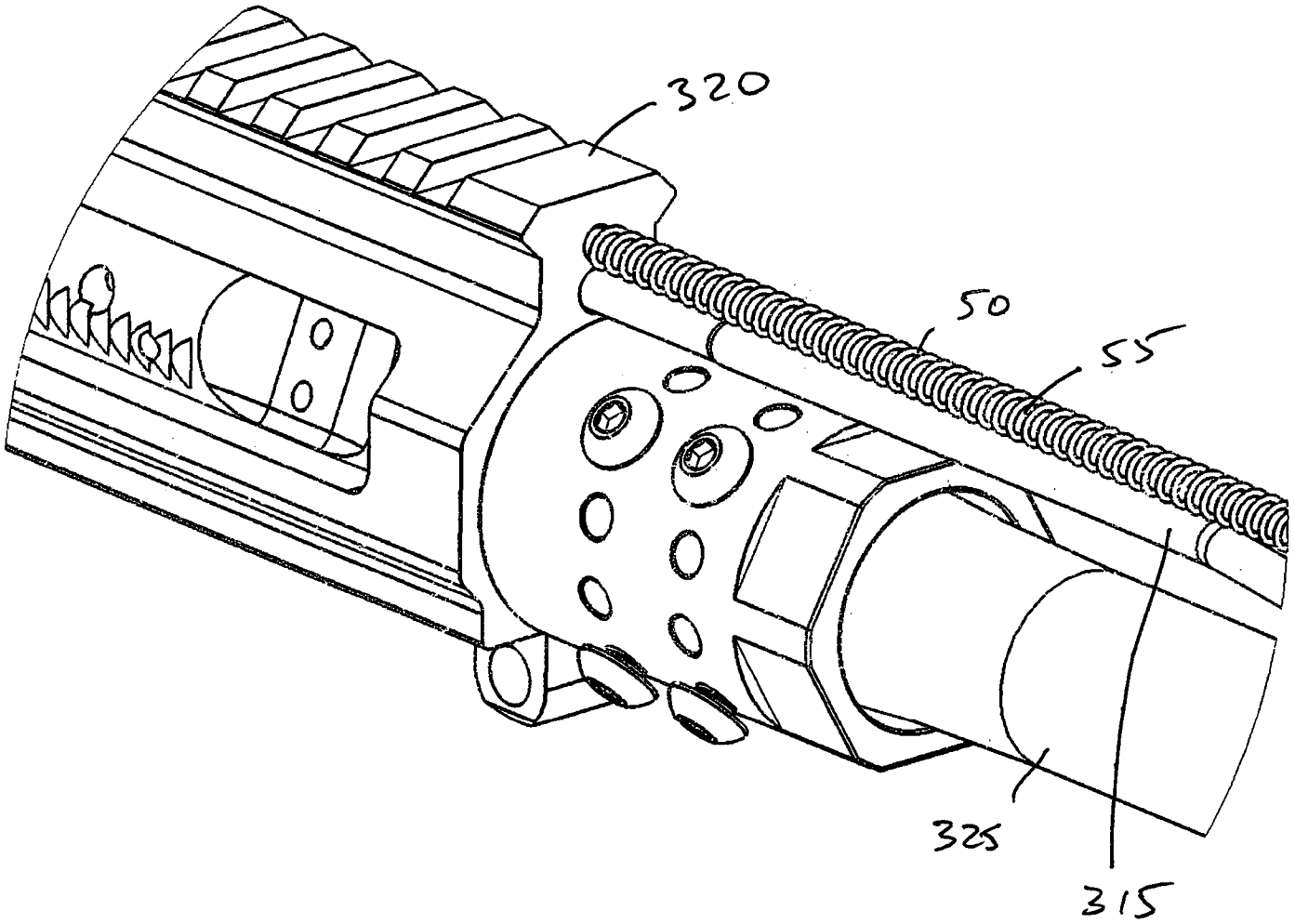
Figure 20:
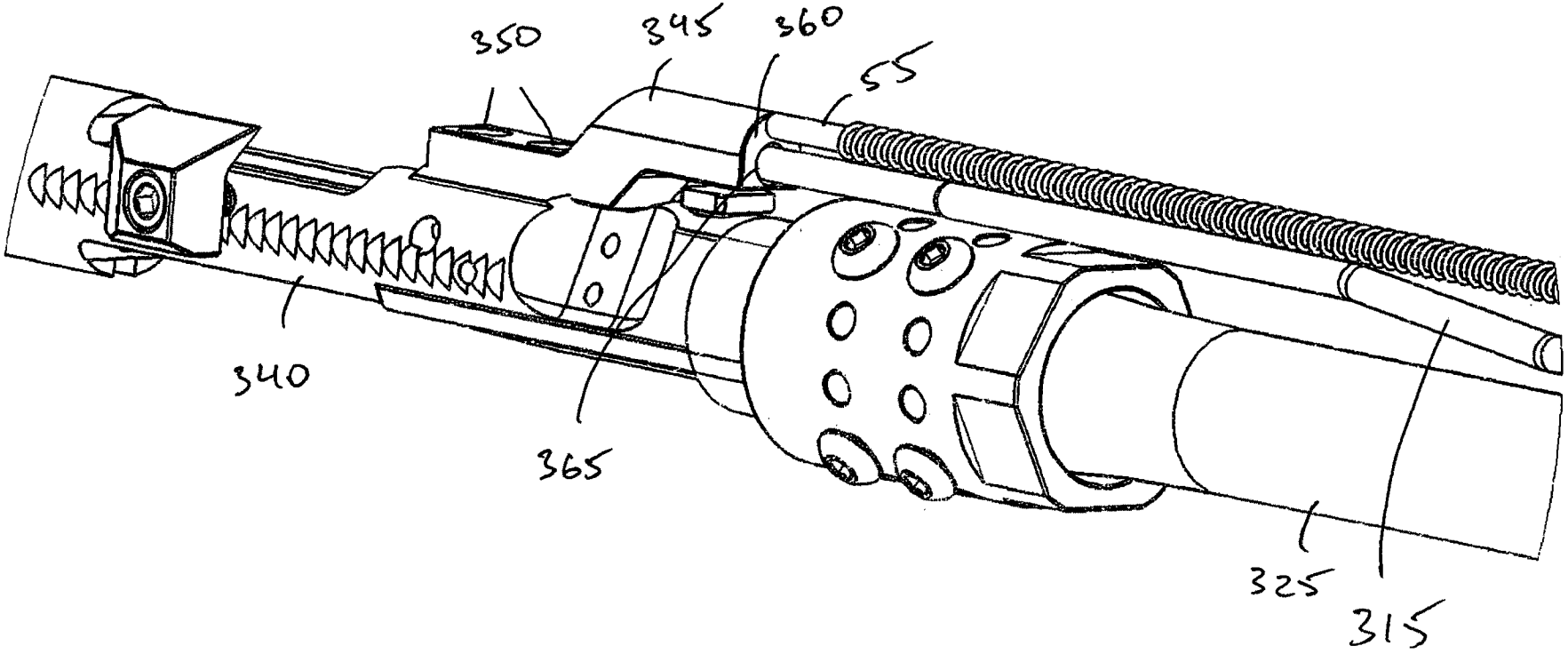
Figure 21:
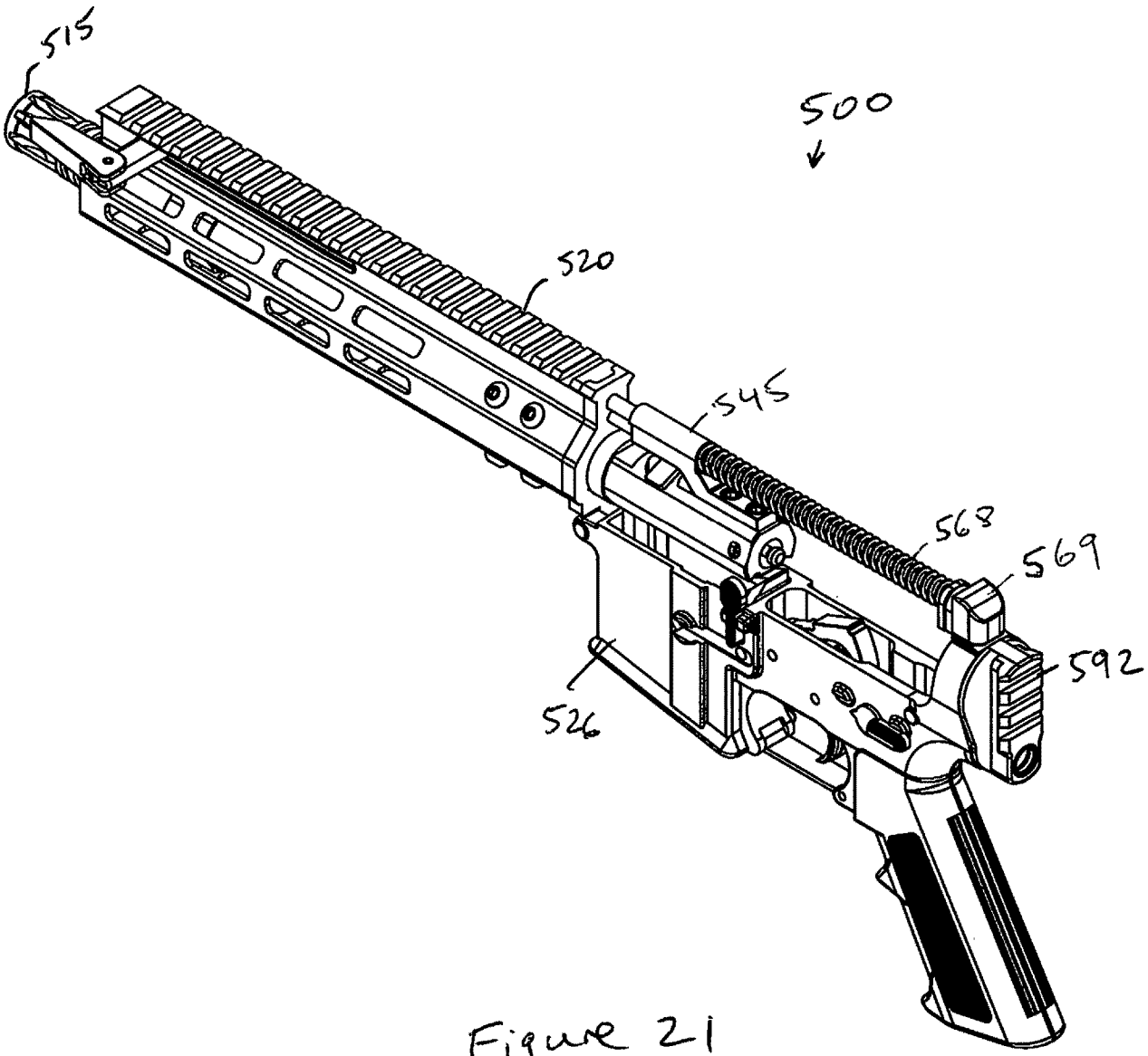
FIGS. 21-26 depict a partially disassembled view of a firearm according to some embodiments presently disclosed.
Figure 22:
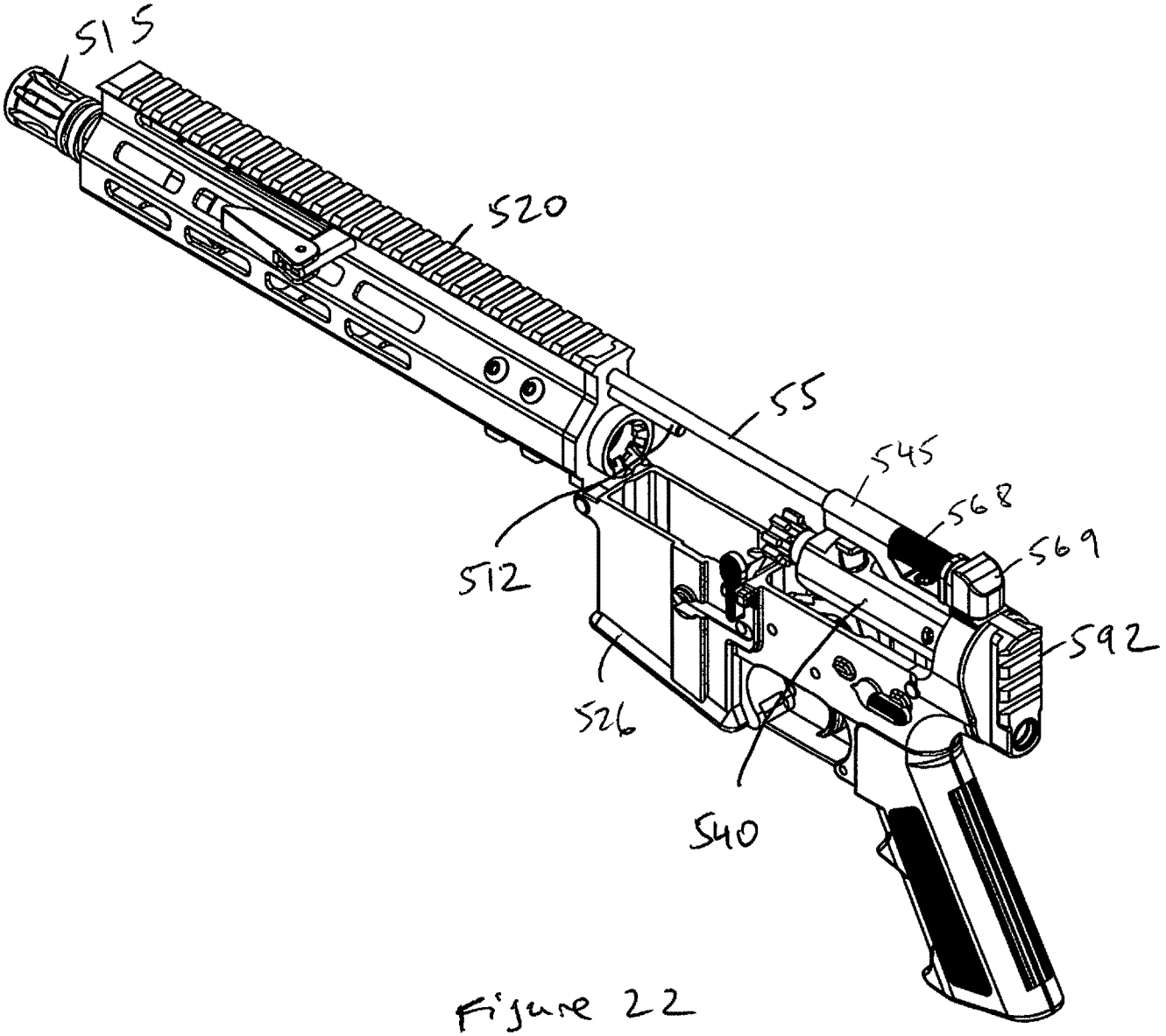

Referring to FIGS. 16-17, the charging trolley 45 may be positioned above the gas block 310. The rod 55 may be positioned above the gas tube 315. Referring to FIGS. 18-19, the upper receiver 320 comprises an opening 330 (shown in FIG. 18) to accommodate the rod 55 (shown in FIG. 19) and an opening 335 (shown in FIG. 18) to accommodate the gas tube 315 (shown in FIG. 19).

According to some embodiments presently disclosed, the upper receiver 320 comprises a bolt carrier assembly 340. The bolt carrier assembly 340 is movable between a first (i.e. locked) position and a second (i.e. unlocked) position. The bolt carrier assembly 340 supports and positions a bolt (not shown). The first (locked) position is position in which the bolt carrier 340 has positioned the bolt (not shown) for firing ammunition through the barrel 325. The second (unlocked) position is any position other than the first (locked) position.

According to some embodiments presently disclosed, the upper receiver 320 comprises a carrier key 345 coupled with a top portion of the bolt carrier assembly 340. One or more fasteners 350 may be used to couple the carrier key 345 with the bolt carrier assembly 340. The one or more fasteners 350 may be a pin, a screw, a set screw, a full dog point set screw, or a dogleg set screw. The carrier key 345 comprises a surface 360 configured to abut the rod 55 when the bolt carrier 340 is being moved from away from the first (locked) position. The surface 360 comprises an opening 365 configured to accommodate the gas tube 315.

According to some embodiments presently disclosed, the forward charging system 30 as described in detail above is configured to move the bolt carrier assembly 340 from the first (locked) position to the second (unlocked) position.

According to some embodiments presently disclosed, the hand guard 20 (shown in FIG. 11) may comprise opening 116 on either right side of the firearm or left side of the firearm or on both sides of the firearm. This allows the operator of the firearm to position the charging base 40 on either side of the firearm depending if the operator is right handed or left handed.

According to some embodiments presently disclosed, the hand guard 20 (shown in FIG. 11) may comprise multiple openings 116 along the hand guard 20. Having multiple opening 116 available along the hand guard 20 allow the operator to select how far the charging base 40 is from the upper receiver 25. If the operator of the firearm has long arms, the charging base 40 may be placed through an opening 116 located farther away from the upper receiver 25. If the operator of the firearm has short arms, the charging base 40 may be placed through an opening 116 located closer to the upper receiver 25. According to some embodiments presently disclosed, the forward charging system 30 may be provided with different length rods 55 to accommodate operators with different arm lengths. According to some embodiments presently disclosed, the forward charging system 30 may be provided with the rod 55 having adjustable length to accommodate operators with different arm lengths. According to some embodiments presently disclosed, the forward charging system 30 may be provided with the rod 55 that can be shortened to accommodate operators with shorter arm.

Figure 23:
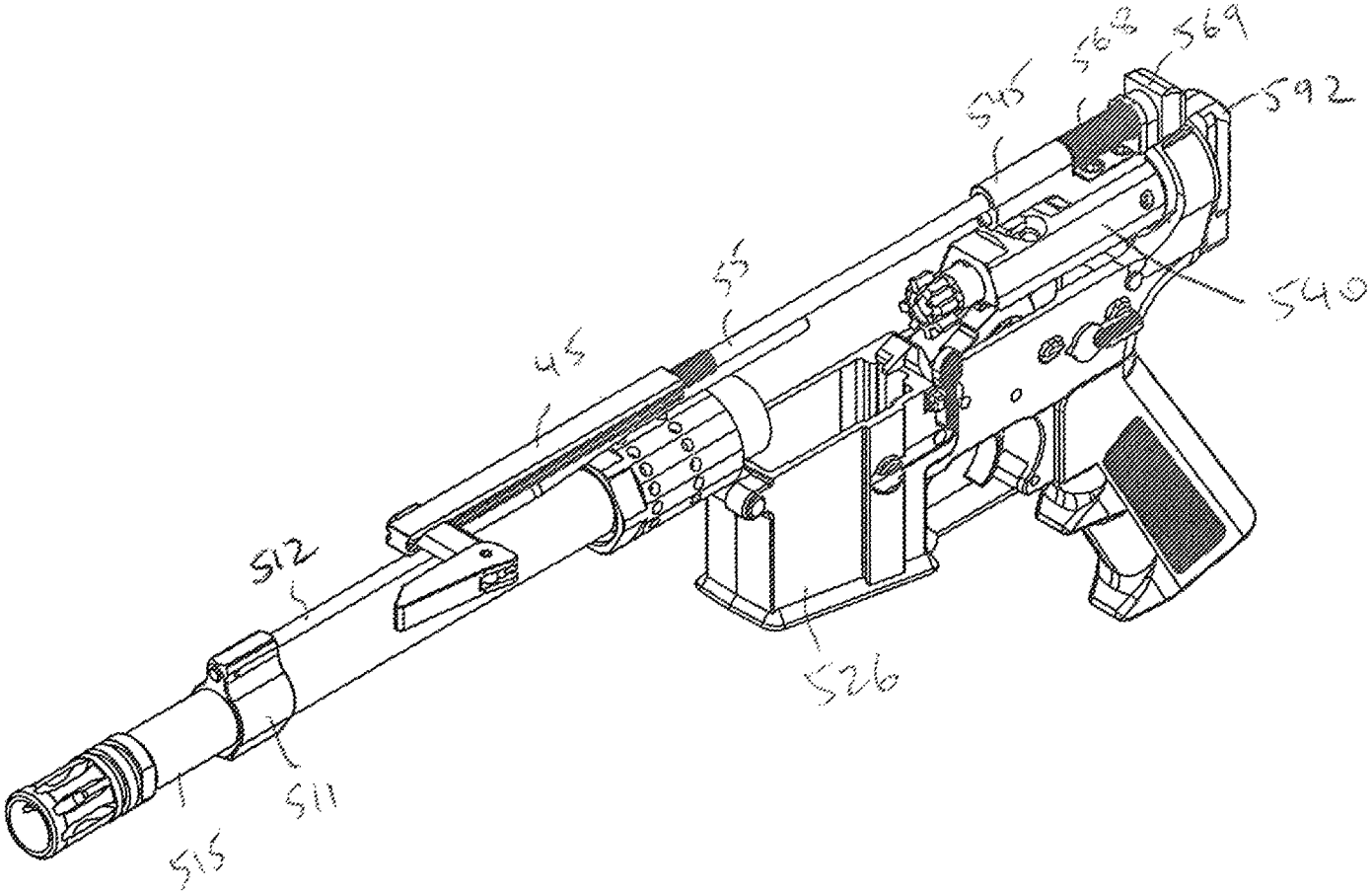
Figure 24:
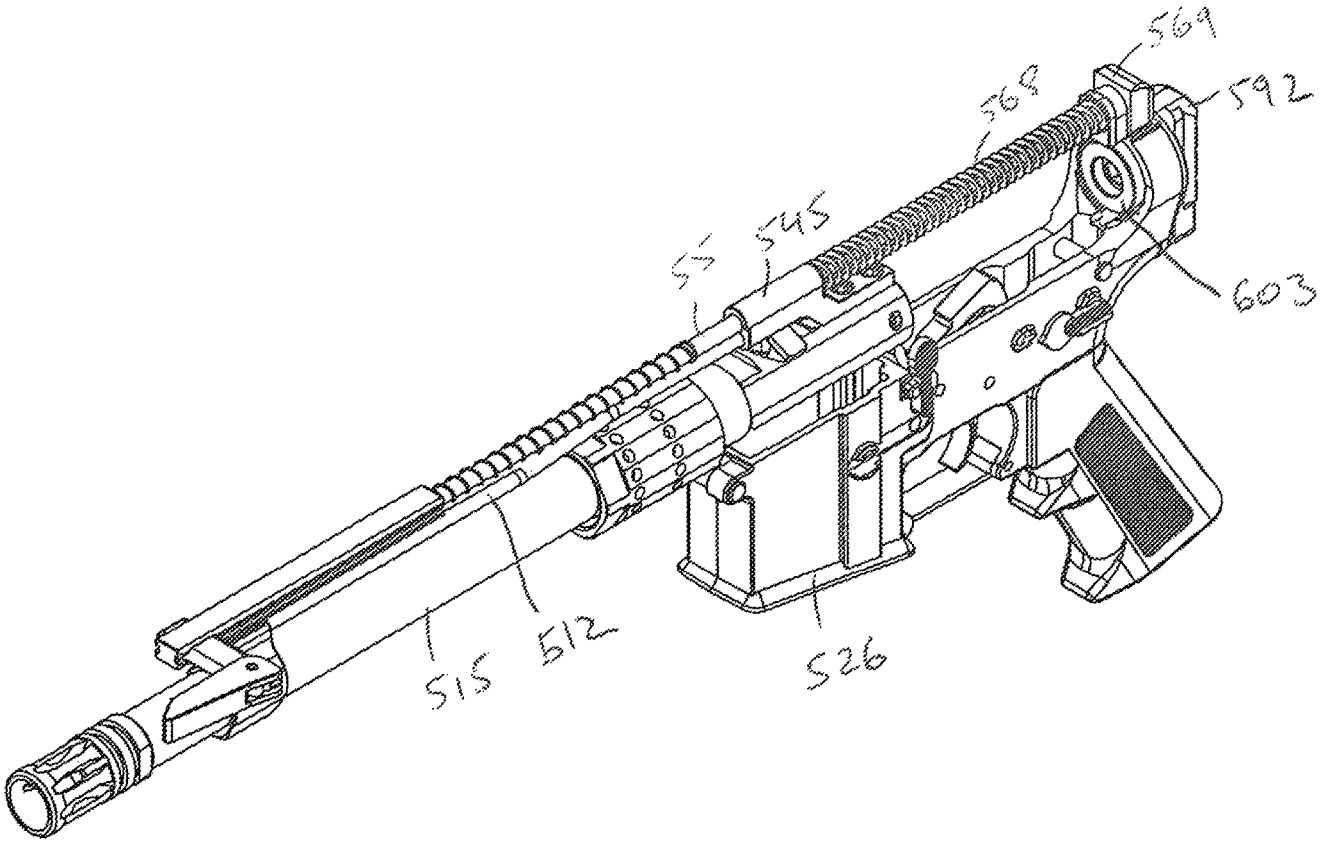

Referring to FIGS. 21-26, a portion of a firearm 500 is shown according to some embodiments presently disclosed. The firearm 500 may comprise a barrel 515, a hand guard 520 and an upper receiver 525 (shown in FIG. 27). According to some embodiments, the upper receiver 525 may be removably coupled to a lower receiver 526. According to some embodiments, the hand guard 520 may removably encircle the barrel 515. According to some embodiments the upper receiver 525 may be removably coupled with the barrel 515. According to some embodiments the upper receiver 525 may be removably coupled with the hand guard 520. According to some embodiments the hand guard 520 may be removably coupled with the barrel 515 as shown in FIGS. 23-24. According to some embodiments presently disclosed, the firearm 500 comprises, for example, a direct impingement system. Direct impingement is a type of gas operation for a firearm that directs gas from a fired cartridge directly into the bolt carrier to cycle the action. The firearm 500 comprises a gas block 511 coupled with the barrel 515, and a gas tube 512 (FIG. 23).

Referring to FIGS. 23-26, the firearm 500 comprises the forward charging system 30 according to some embodiments presently disclosed. According to some embodiments presently disclosed, the firearm 500 comprises the forward charging system 30 as described above.

Figure 25:
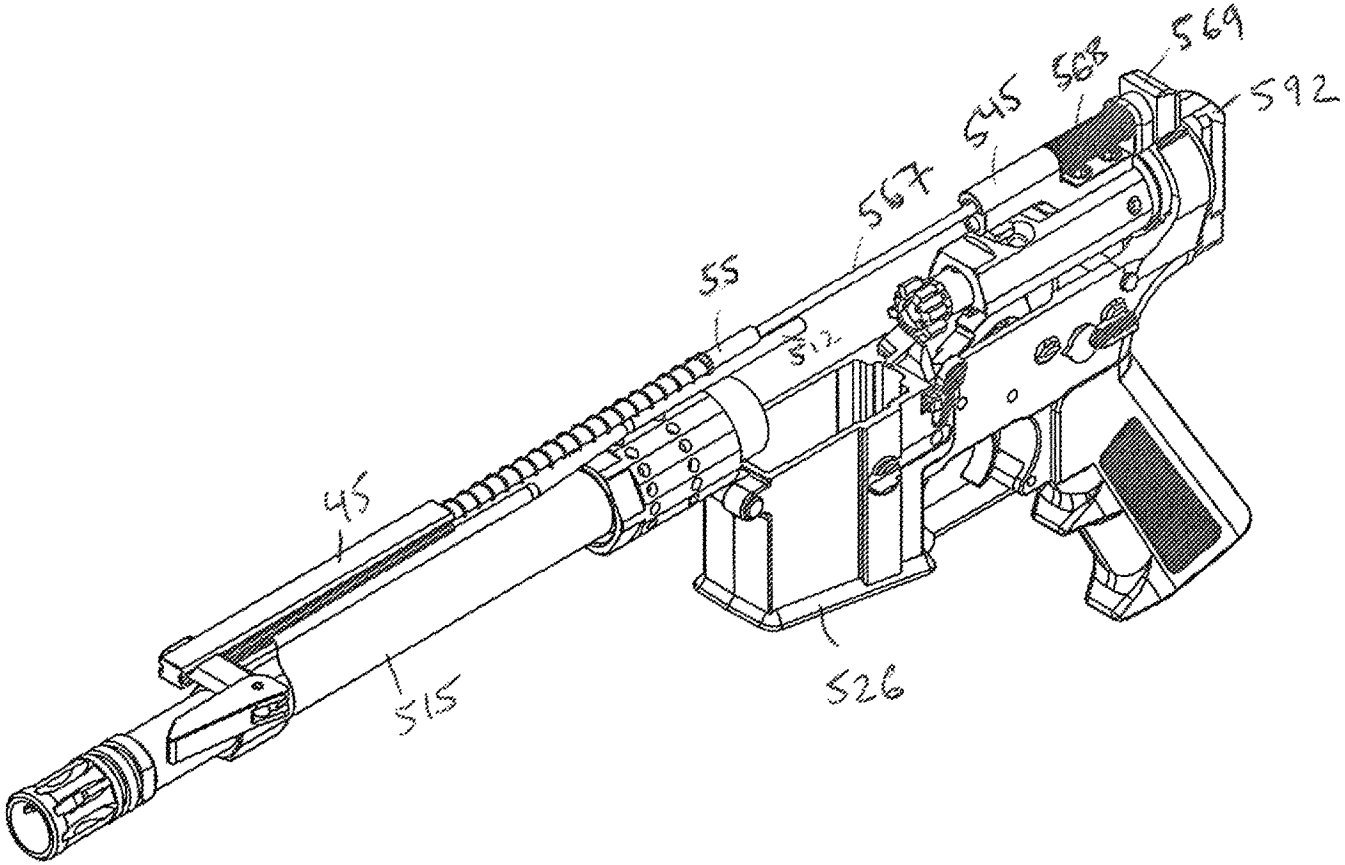
Figure 26:
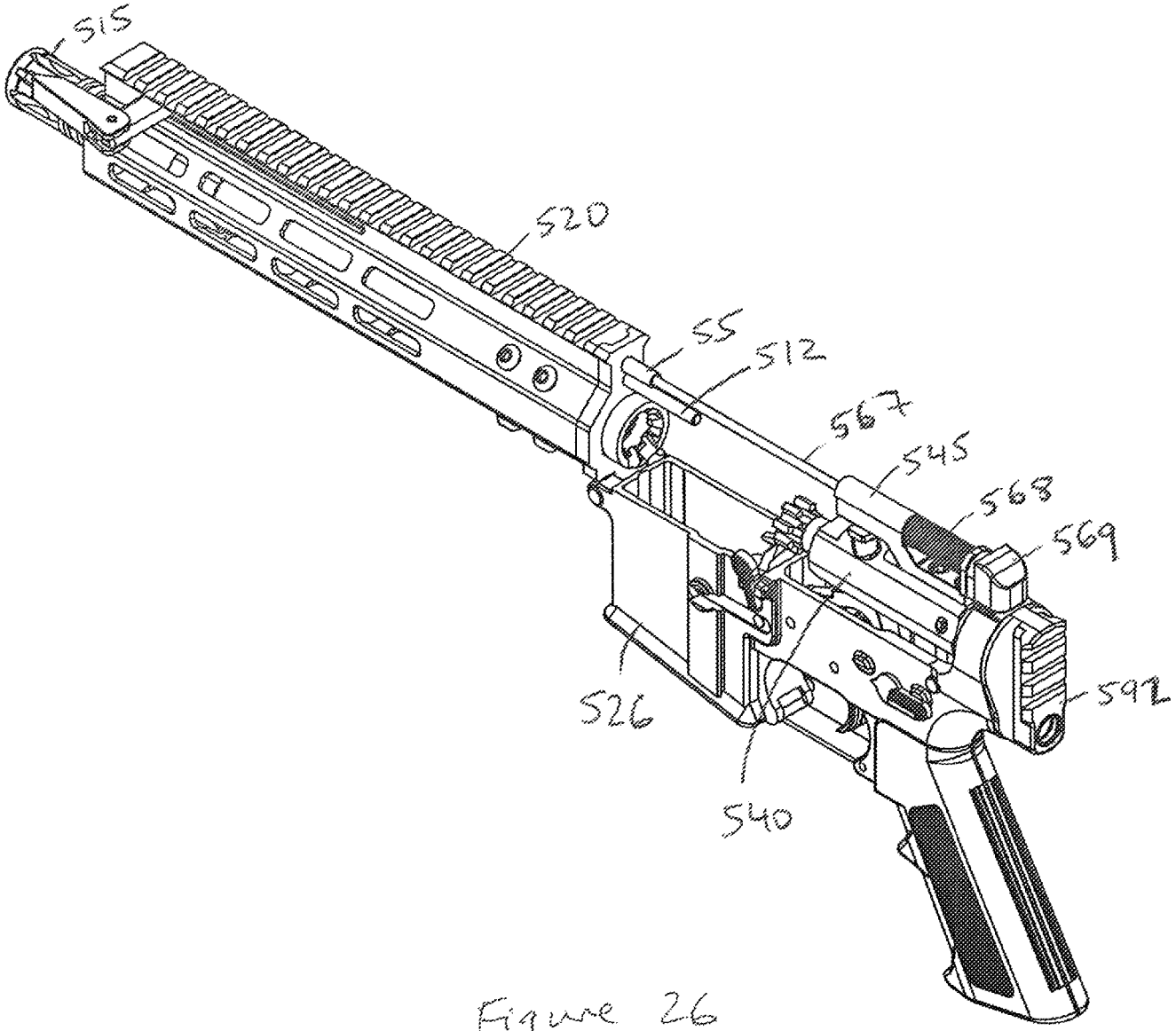
Figure 27:
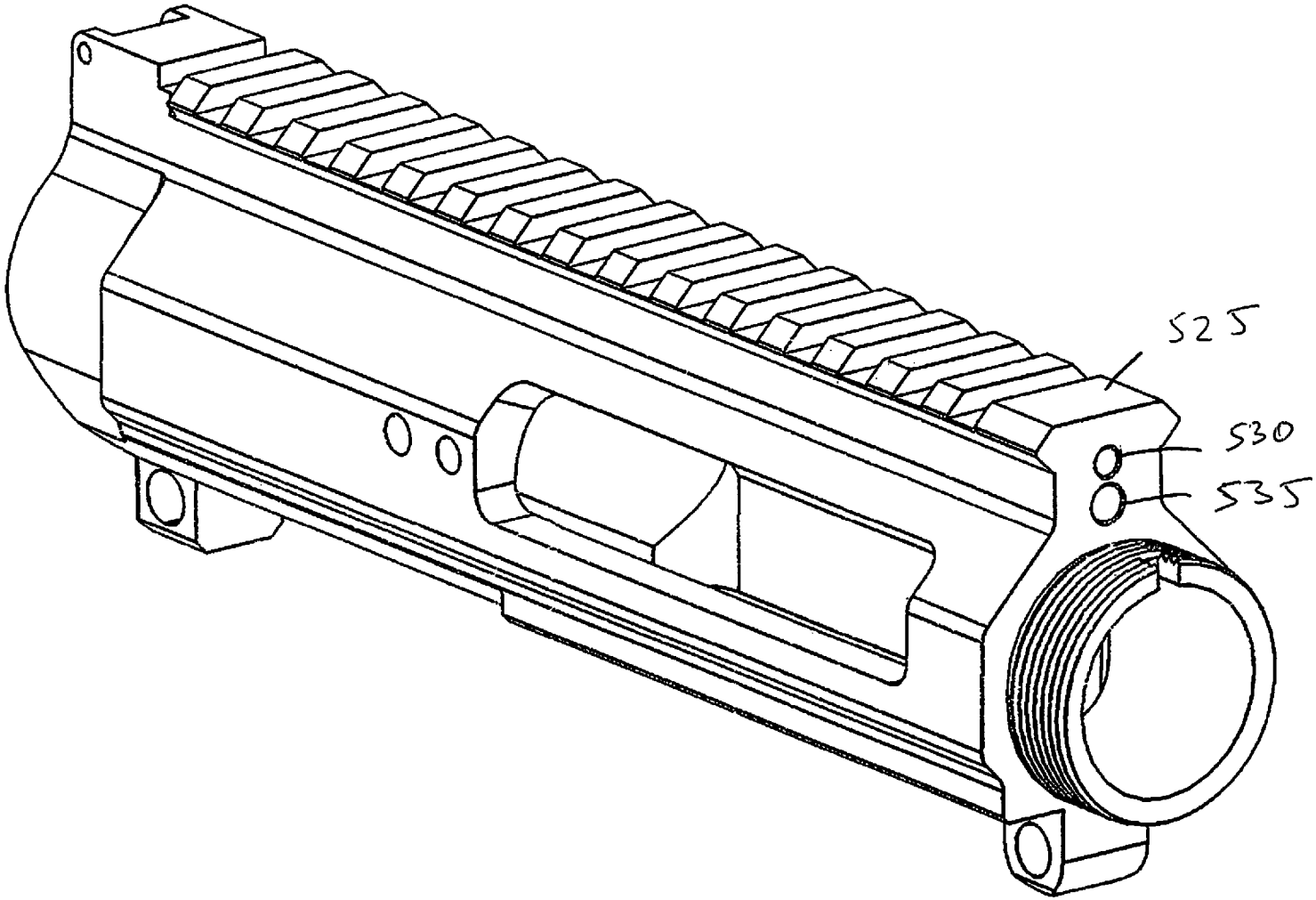
FIG. 27 depicts an upper receiver according to some embodiments presently disclosed.
Figure 28:
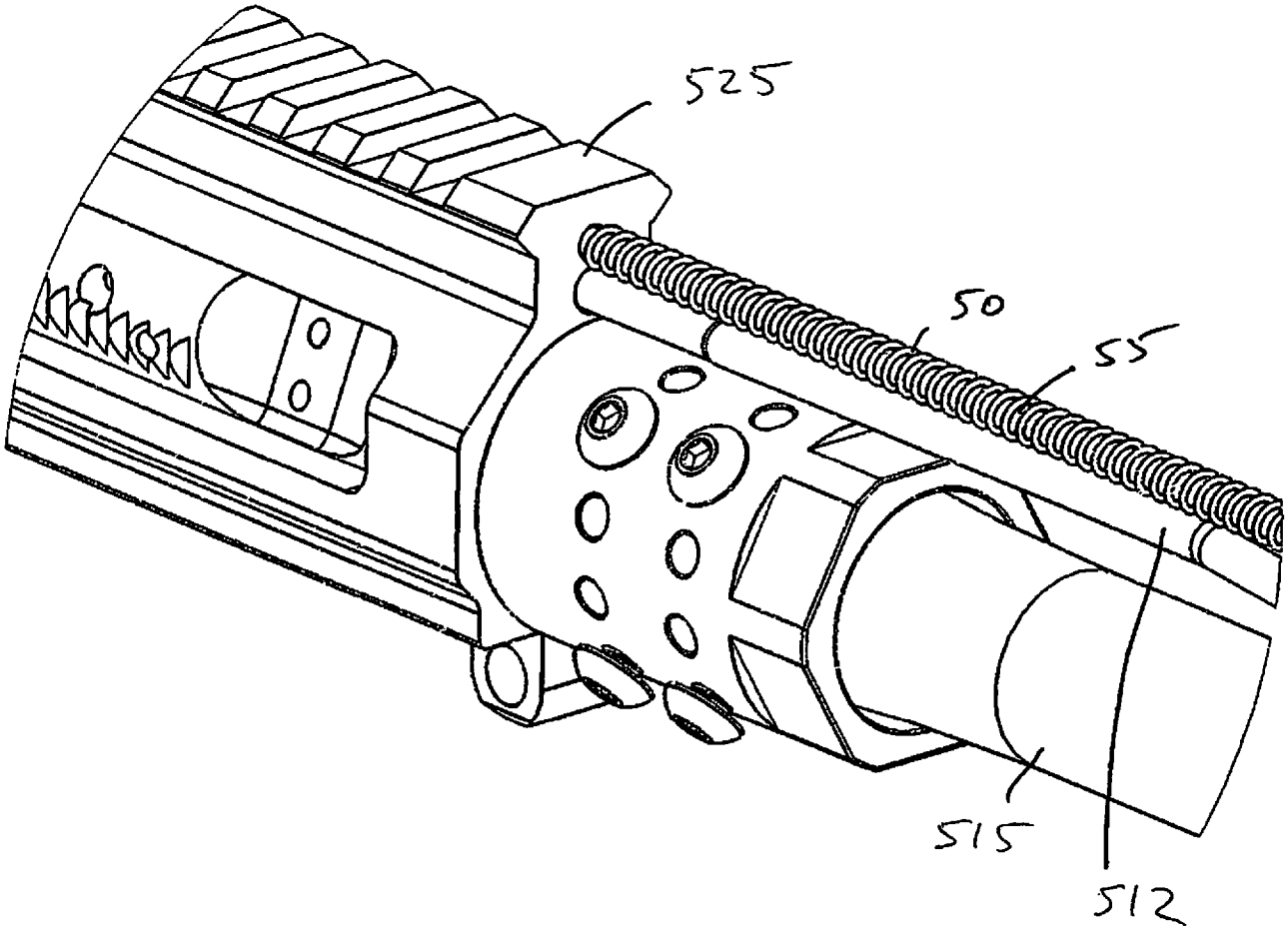
FIG. 28 depicts a partially disassembled view of a firearm according to some embodiments presently disclosed.

Referring to FIGS. 23-26, the charging trolley 45 may be positioned above the gas block 511. The rod 55 may be positioned above the gas tube 512. Referring to FIGS. 27-28, the upper receiver 525 comprises an opening 530 (shown in FIG. 27) to accommodate the rod 55 (shown in FIG. 28) and an opening 535 (shown in FIG. 27) to accommodate the gas tube 512 (shown in FIG. 28).

Figure 50:
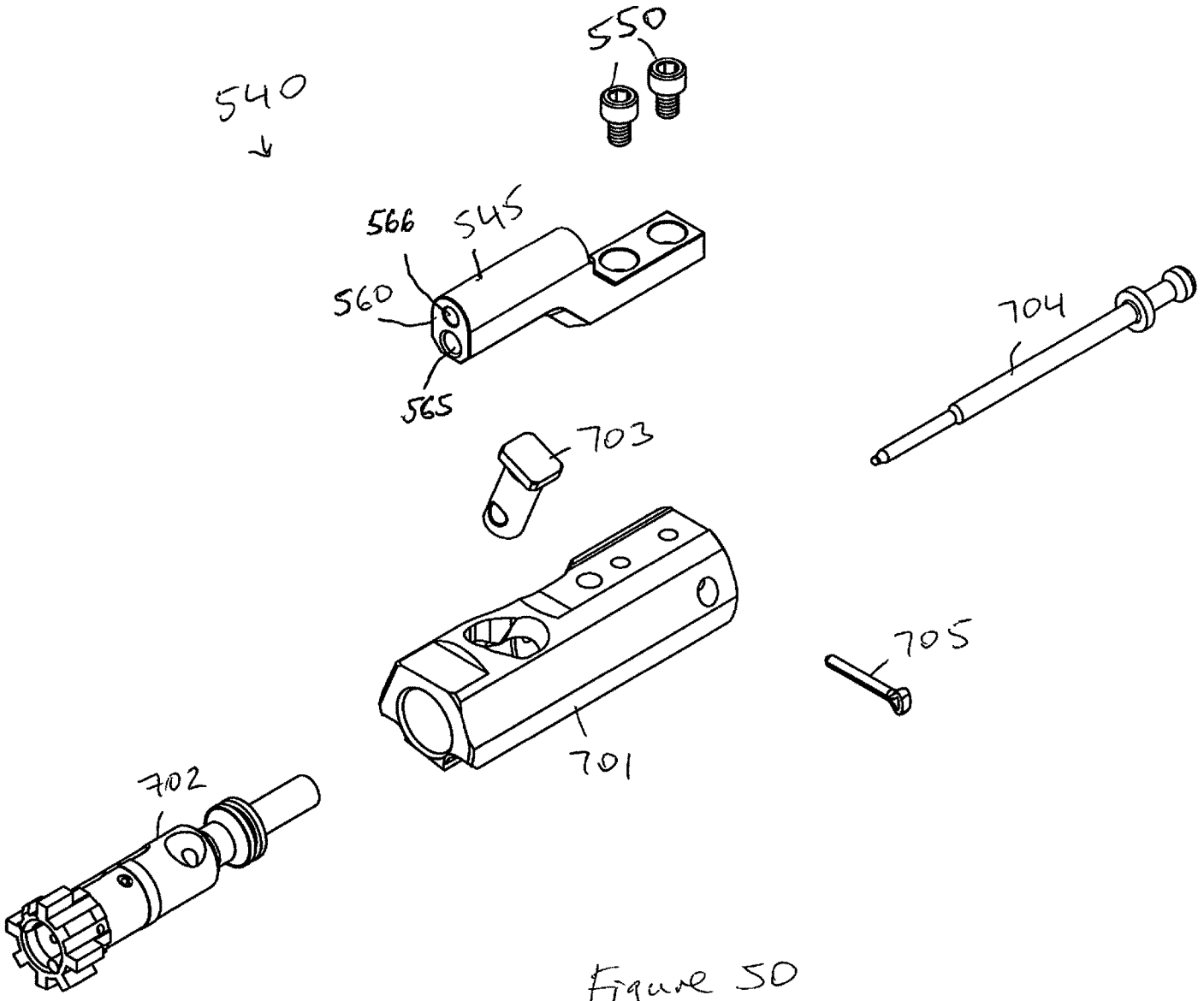
FIG. 50 depicts an exploded view of an exemplary embodiment presently disclosed.

According to some embodiments presently disclosed, the firearm 500 comprises a bolt carrier assembly 540 (FIGS. 23 and 50). According to some embodiments presently disclosed, the bolt carrier assembly 540 is movable between a first (i.e. locked) position (shown in FIGS. 21, 24, 73 and 75) and a second (i.e. unlocked) position (shown in FIGS. 22, 23, 74 and 76). According to some embodiments presently disclosed, the bolt carrier assembly 540 is movable between a first (i.e. locked) position (shown in FIGS. 21, 24, 73 and 75) and a second (i.e. unlocked) position (shown in FIGS. 22, 23, 74 and 76) by the forward charging system 30.

The bolt carrier assembly 540 comprises a bolt carrier 701, a bolt assembly 702, a cam pin 703, a firing pin 704, a firing pin retaining pin 705, a carrier key 545 (FIG. 50). The bolt carrier assembly 540 supports and positions the bolt assembly 702. Referring to FIGS. 21, 24, 73 and 75, according to some embodiments, the first (locked) position is position in which the bolt carrier assembly 540 has positioned the bolt assembly 702 for firing ammunition through the barrel 515. Referring to FIGS. 21, 24, 73 and 75, according to some embodiments, the first (locked) position is position in which the bolt carrier assembly 540 locks the bolt assembly 702 into battery. Referring to FIGS. 21, 24, 73 and 75, according to some embodiments, the first (locked) position is position in which the bolt carrier assembly 540 is locked into battery. Referring to FIGS. 22, 23, 74 and 76, according to some embodiments, the second (unlocked) position is any position other than the first (locked) position.

According to some embodiments presently disclosed, the forward charging system 30 as described in detail above is configured to move the bolt carrier assembly 540 from the first (locked) position to the second (unlocked) position.

Figure 29:
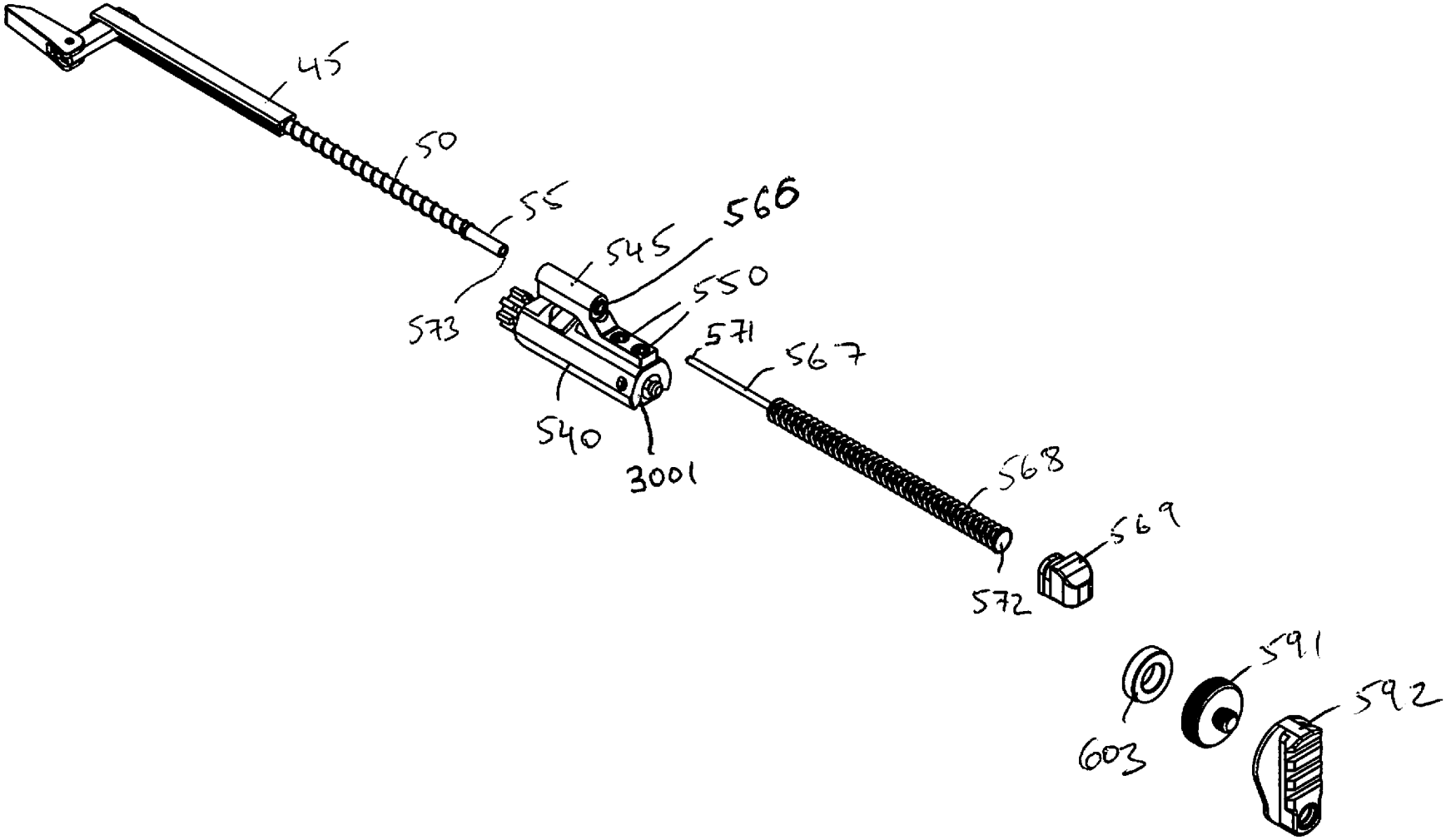
FIGS. 29-30 depict an exploded view of an exemplary embodiment presently disclosed.
Figure 30:
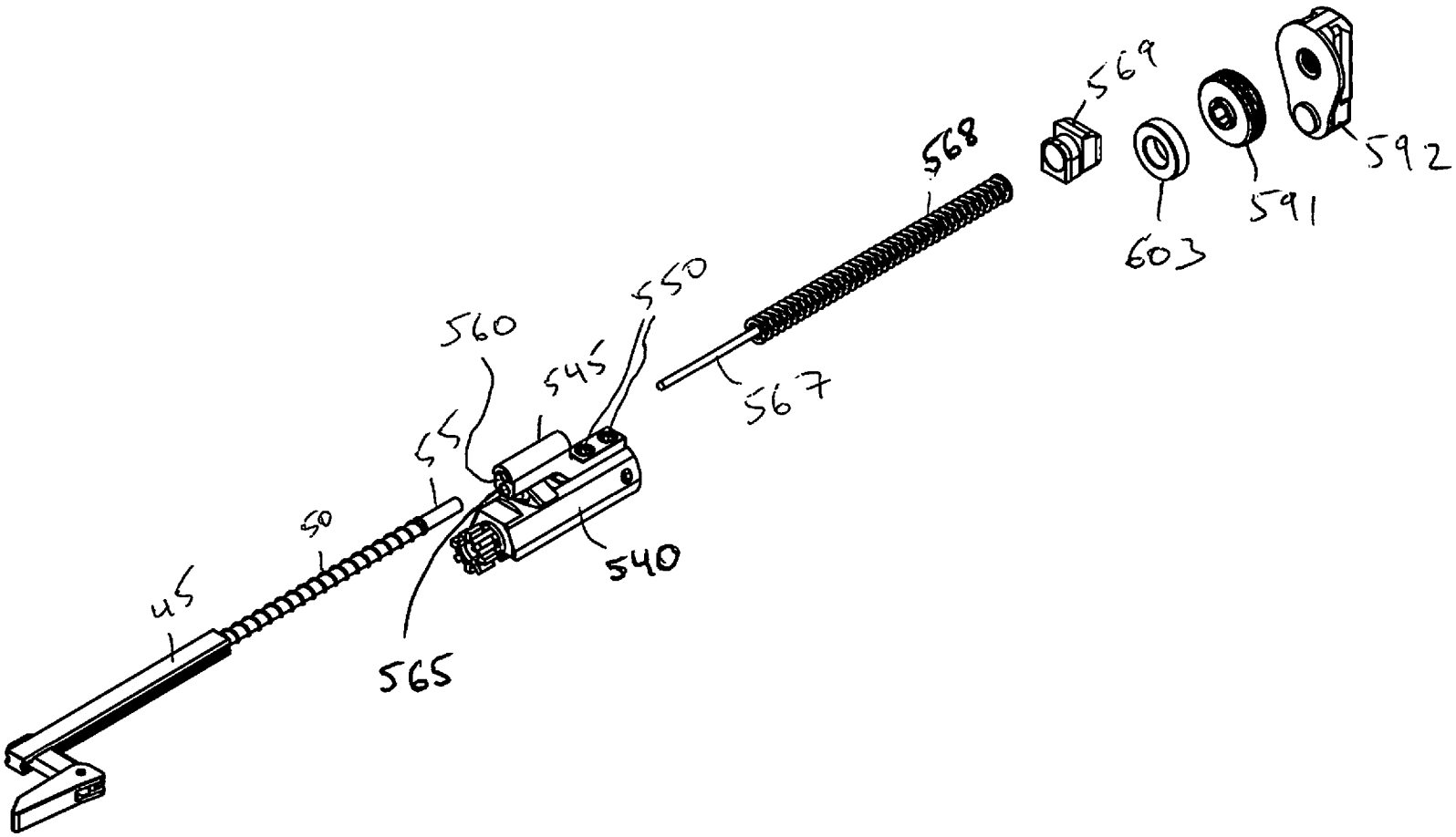

Referring to FIGS. 29-30 and 50, according to some embodiments presently disclosed, the carrier key 545 is removably coupled with a top portion of the bolt carrier 701. One or more fasteners 550 may be used to couple the carrier key 545 with the bolt carrier assembly 540. The one or more fasteners 550 may be a pin, a screw, a set screw, a full dog point set screw, or a dogleg set screw.

Figure 51:
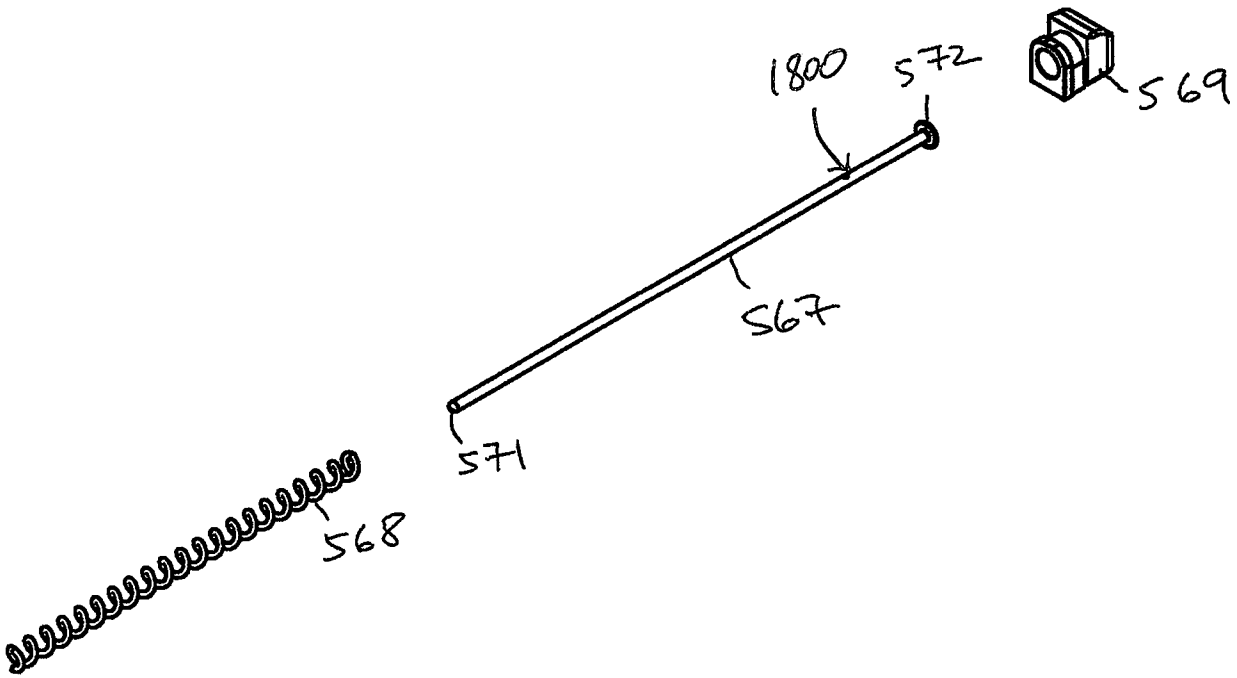
FIG. 51 depicts an exploded view of an exemplary embodiment presently disclosed.

According to some embodiments presently disclosed, the carrier key 545 comprises a surface 560 configured to abut the rod 55 when the bolt carrier assembly 540 is being moved away from the first (locked) position. According to some embodiments presently disclosed, the surface 560 comprises an aperture (i.e. opening) 565 configured to accommodate the gas tube 512. According to some embodiments presently disclosed, the surface 560 may also comprise a through aperture 566 configured to accommodate a recoil spring guide rod 567 described in more detail below. According to some embodiments, the through aperture 566 is a through-opening. According to some embodiments, the diameter of the rod 55 is larger than the diameter of the aperture 566. Referring to FIGS. 29-30 and 51, according to some embodiments presently disclosed, the firearm 500 comprises the recoil spring guide rod 567, recoil spring 568, and a plug 569.

According to some embodiments presently disclosed, the rod 55 comprises an aperture 573 (FIG. 29). According to some embodiments presently disclosed, the rod 55 is a hollow tube that defines the aperture 573. According to some embodiments presently disclosed, the aperture 573 goes through a portion of the rod 55. According to some embodiments presently disclosed, the aperture 573 goes through an entire length of the rod 55.

The recoil spring guide rod 567 comprises a forward portion 571 and a rear portion 572. According to some embodiments presently disclosed, the recoil spring guide rod 567's forward portion 571 is configured to go through the aperture 566 and into the aperture 573. According to some embodiments presently disclosed, the recoil spring guide rod 567's rear portion 572 is configured to abut the plug 569. According to some embodiments presently disclosed, the recoil spring guide rod 567 passes through the recoil spring 568. According to some embodiments presently disclosed, the recoil spring guide rod 567 passes through the recoil spring 568 and the recoil spring 568 is positioned between the carrier key 545 and the plug 566.

According to some embodiments presently disclosed, the recoil spring guide rod 567's rear portion 572 has a diameter that is larger than the diameter of the rest of the recoil spring guide rod 567. According to some embodiments presently disclosed, the recoil spring guide rod 567 passes through the recoil spring 568 and the recoil spring 568 is positioned between the carrier key 545 and larger diameter of the recoil spring guide rod 567's rear portion 572.

According to some embodiments, the bolt carrier assembly 540 is configured to slide along the recoil spring guide rod 567 between the first (i.e. locked) position and a second (i.e. unlocked) position.

Figure 31:
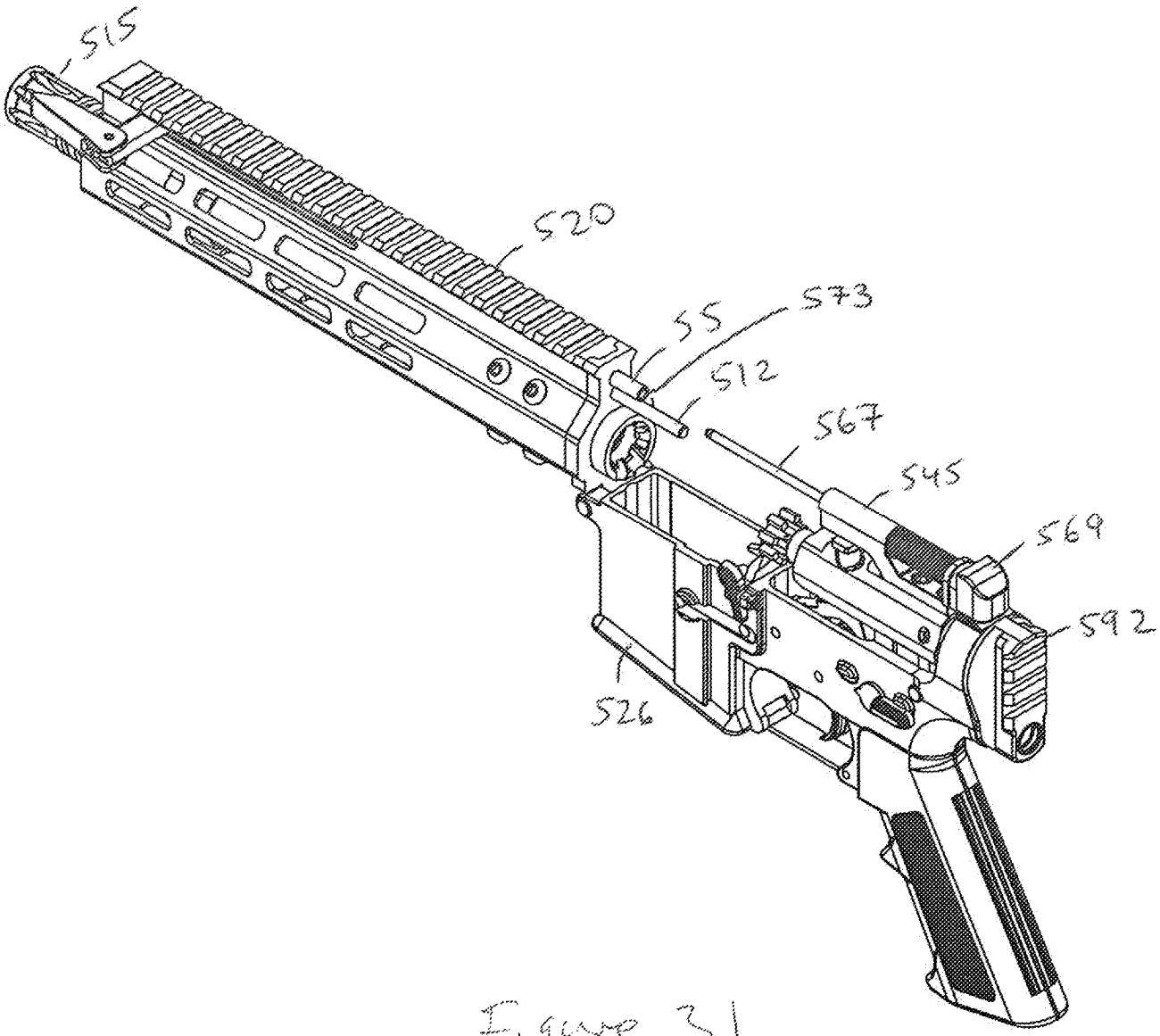
FIGS. 31-32 depict a partially disassembled view of a firearm according to some embodiments presently disclosed.
Figure 32:
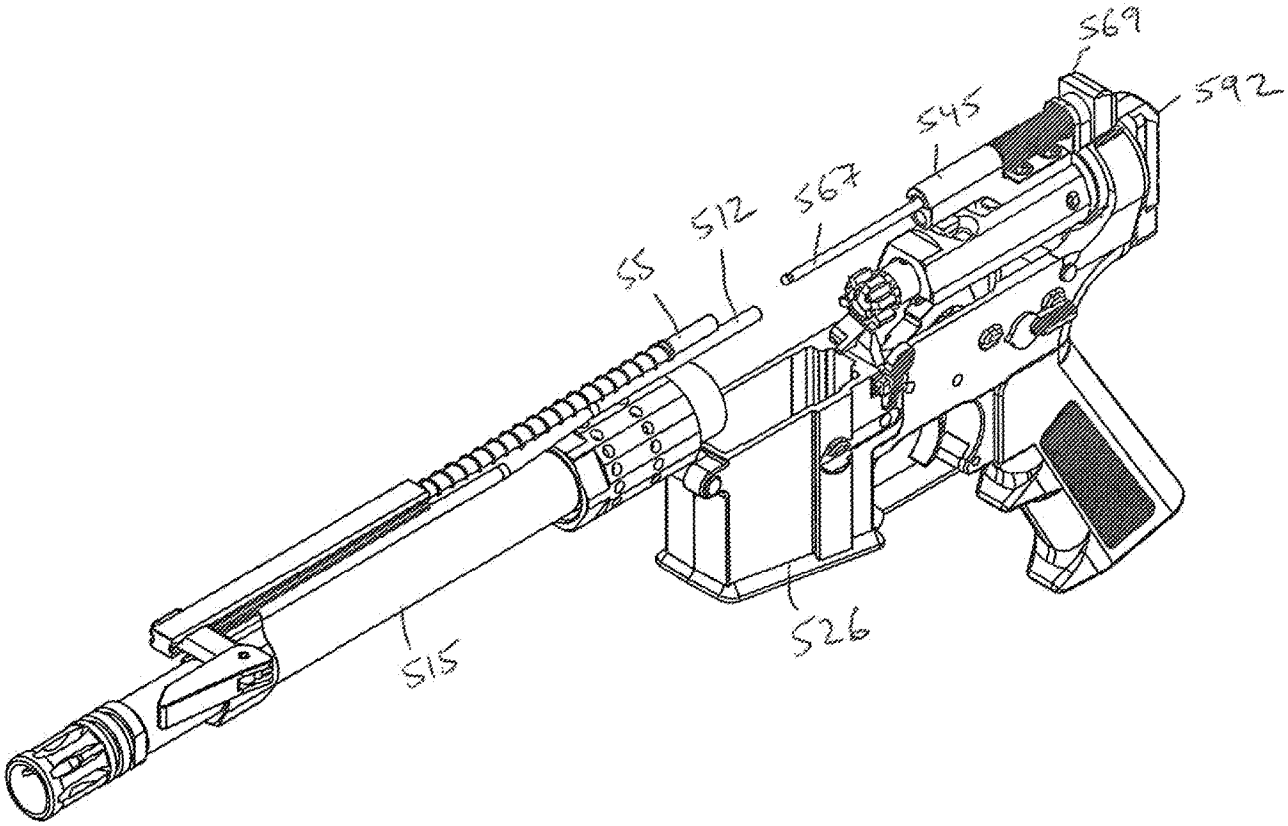

According to some embodiments presently disclosed, the recoil spring guide rod 567's forward portion 571 always resides in the aperture 573. According to some embodiments presently disclosed, the recoil spring guide rod 567's forward portion 571 resides in the aperture 573 when the bolt carrier assembly 540 is in the first (i.e. locked) position and when the bolt carrier assembly 540 is in the second (i.e. unlocked) position (FIGS. 25-26). According to some embodiments presently disclosed, the recoil spring guide rod 567's forward portion 571 resides in the aperture 573 when the bolt carrier assembly 540 is in the second (i.e. unlocked) position (FIGS. 31-32). According to some embodiments presently disclosed, the recoil spring guide rod 567 extends across the entire lengths of the upper receiver 525. According to some embodiments presently disclosed, the recoil spring guide rod 567 extends across the entire lengths of the lower receiver 526. According to some embodiments presently disclosed, the recoil spring guide rod 567's forward portion 571 extends into the aperture 530 through the aperture 573 (FIGS. 25-26).

According to some embodiments presently disclosed, the recoil spring guide rod 567 extends across a portion of the upper receiver 525 (FIGS. 31-32). According to some embodiments presently disclosed, the recoil spring guide rod 567 extends across a portion of the lower receiver 526 (FIGS. 31-32).

According to some embodiments presently disclosed, the recoil spring guide rod 567's forward portion 571 resides in the aperture 573 only when the charging trolley 45 is in the second (charging) position.

According to some embodiments presently disclosed, the recoil spring guide rod 567's rear portion 572 does not extend beyond the upper receiver 525. According to some embodiments presently disclosed, the recoil spring guide rod 567's rear portion 572 does not extend beyond the lower receiver 526.

According to some embodiments, the bolt carrier assembly 540 does not extend beyond the lower receiver 526 when in the second (i.e. unlocked) position.

According to some embodiments presently disclosed, moving the bolt carrier assembly 540 towards the second (unlocked) position compresses the recoil spring 568 between the bolt carrier assembly 540 and the plug 569. According to some embodiments presently disclosed, applying a first force to the bolt carrier assembly 540 compresses the recoil spring 568 between the bolt carrier assembly 540 and the plug 569. According to some embodiments presently disclosed, applying a first force to the bolt carrier assembly 540 compresses the recoil spring 568 between the bolt carrier assembly 540 and the larger diameter of the recoil spring guide rod 567's rear portion 572. Removing the first force causes the compressed recoil spring 568 to move the bolt carrier assembly 540 towards the first (locked) position.

Figure 33:
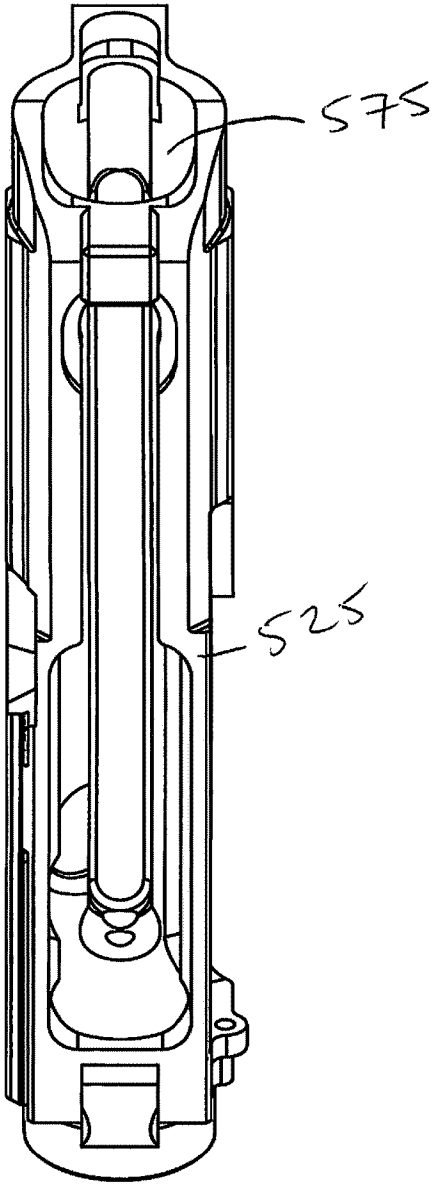
FIG. 33 depicts an upper receiver according to some embodiments presently disclosed.
Figure 34:
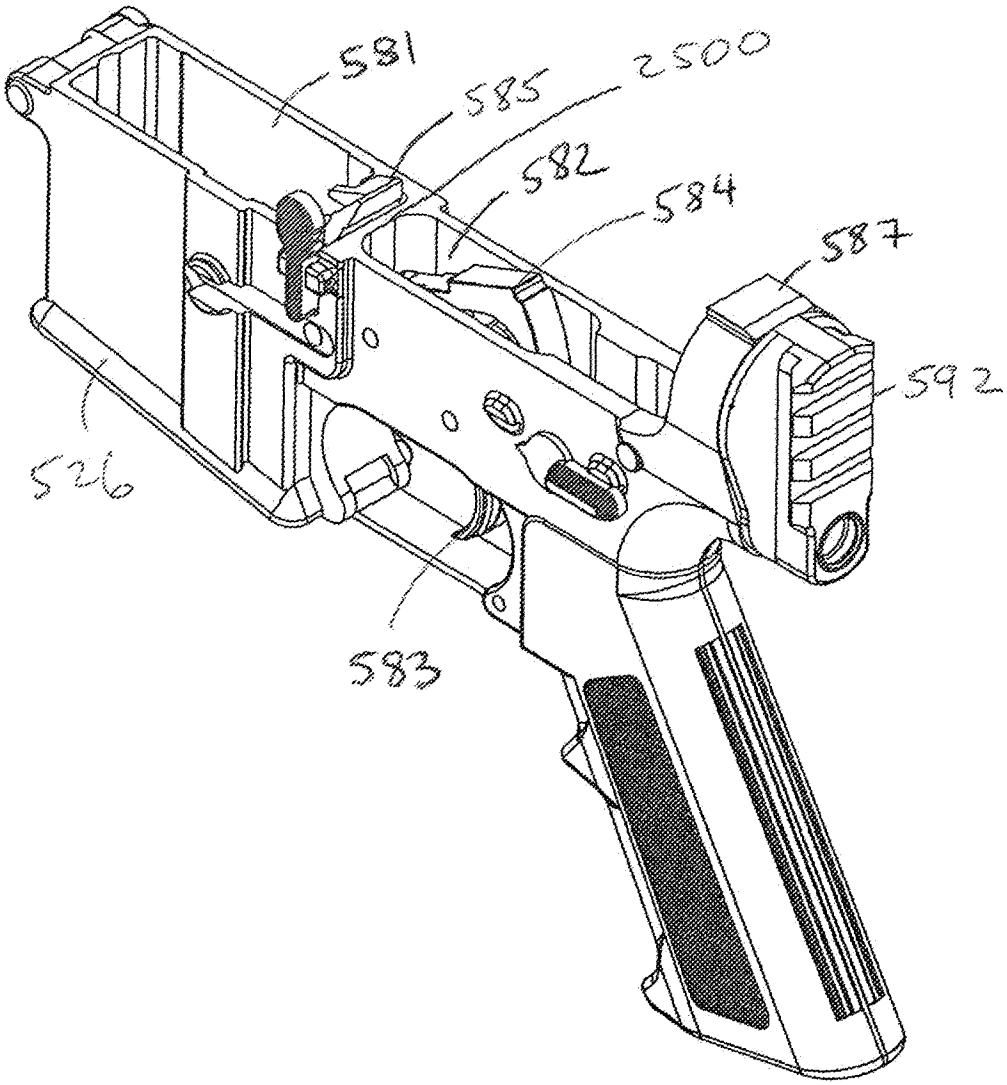
FIGS. 34-37 depict a partially disassembled view of a firearm according to some embodiments presently disclosed.
Figure 35:
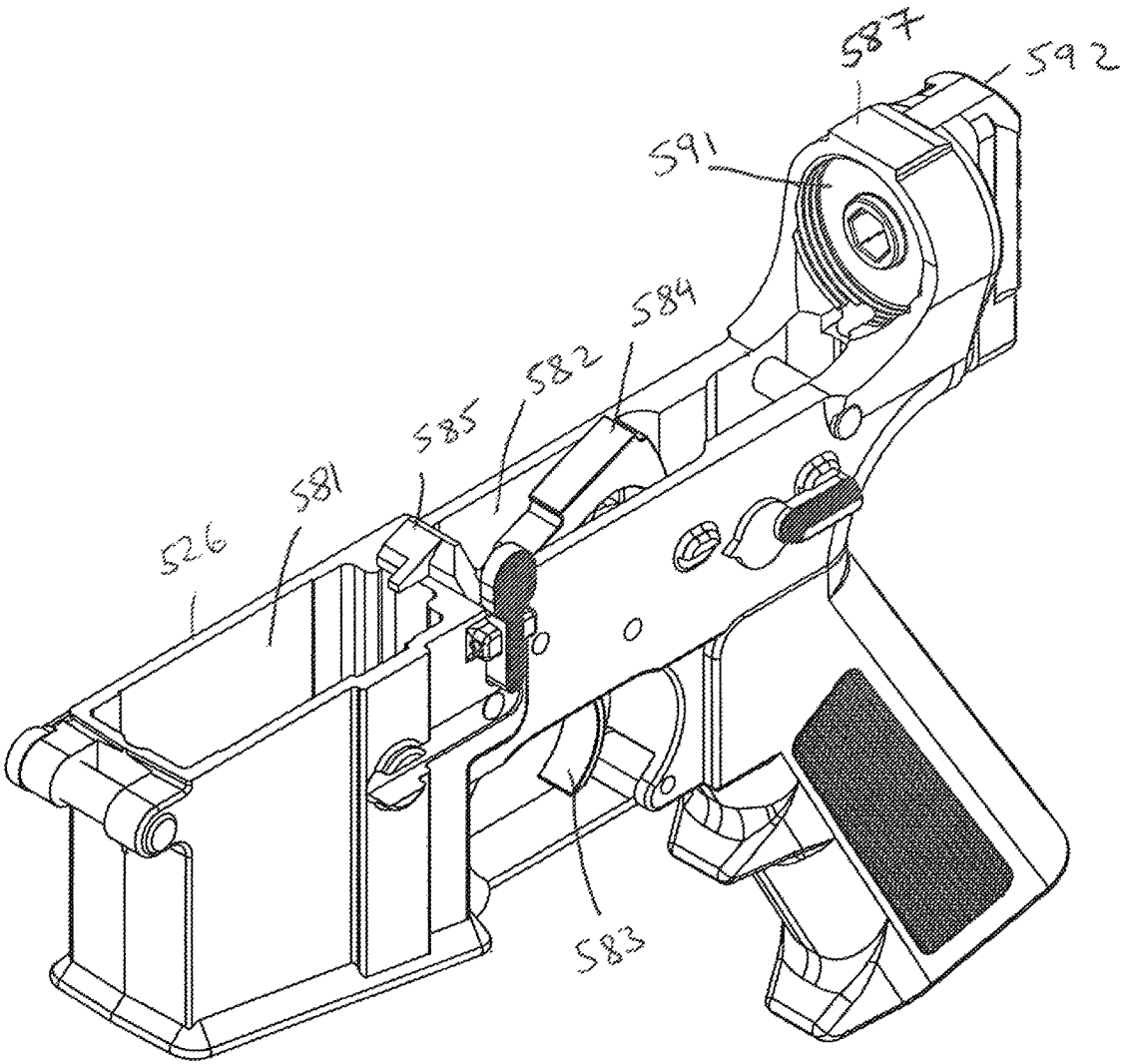

According to some embodiments presently disclosed, the upper receiver 525 comprises an aperture 575 (FIG. 33) configured to accommodate the bolt carrier assembly 540, the recoil spring 568, and the recoil spring guide rod 567. According to some embodiments presently disclosed, the plug 569 abuts the upper receiver 525 to prevent the bolt carrier assembly 540, the recoil spring 568, and the recoil spring guide rod 567 from being removed from the upper receiver 525.

Referring to FIGS. 34-37 and 73-76, according to some embodiments presently disclosed, the lower receiver 526 comprises openings for accepting the internal mechanisms required to operate the firearm. For example, the lower receiver 526 may comprise an opening 581 configured to accept an ammunition magazine (not shown) and associated hardware to direct rounds loaded within the magazine into a chamber in an upper receiver 525. The lower receiver 526 may also comprise an opening 582 configured to accommodate a firing mechanism (i.e. standard trigger group). According to some embodiments, the firing mechanism (i.e.

standard trigger group) comprises a trigger mechanism 583 and a hammer mechanism 584.

Referring to FIGS. 34-37 and 73-76, according to some embodiments presently disclosed, the lower receiver 526 comprises a bolt hold open 585, an opening 586 configured to accommodate the bolt hold open 585. Referring to FIGS. 73-76, according to some embodiments presently disclosed, the opening 582 is separated from the opening 586 by a wall 2500.

Figure 36:
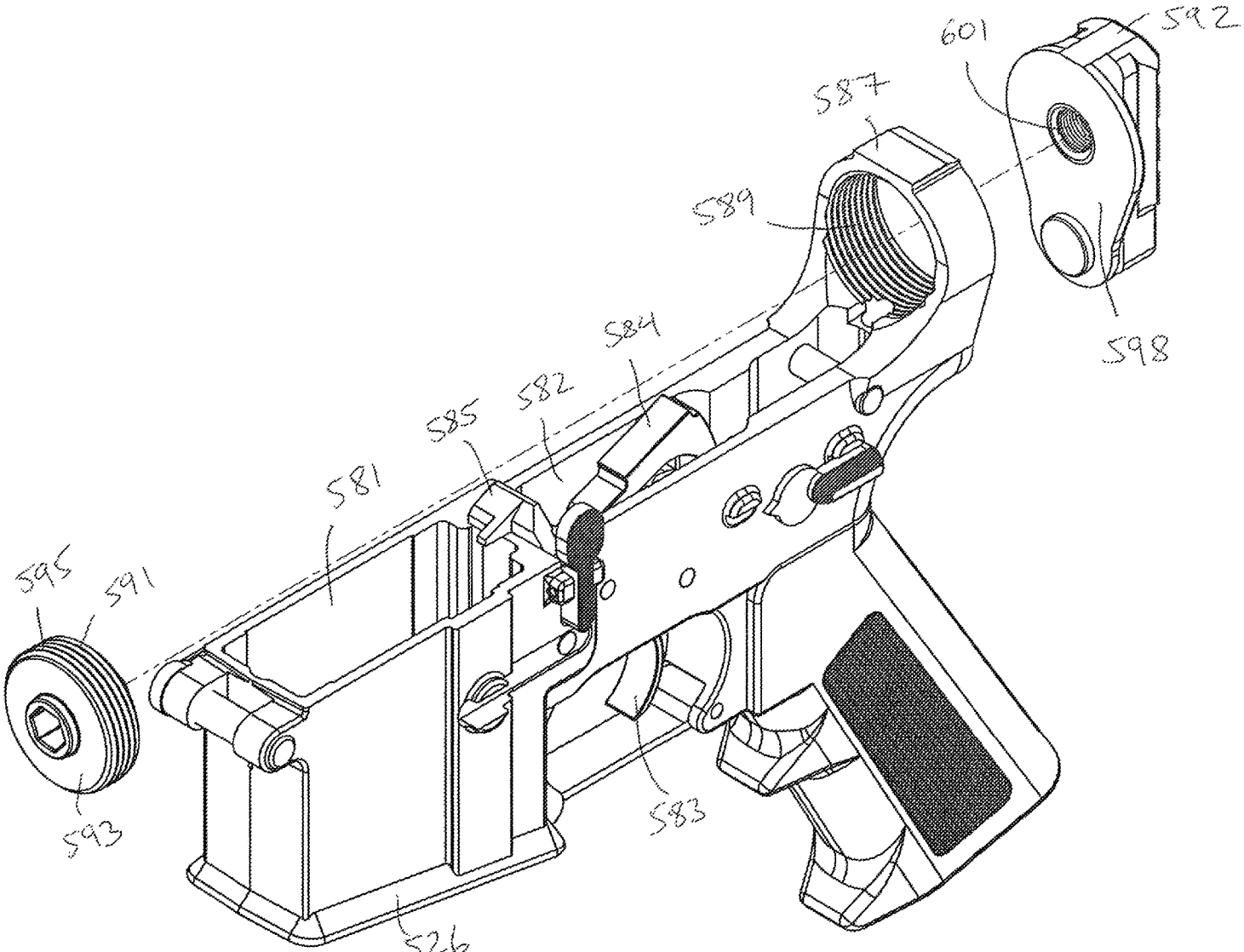
Figure 37:
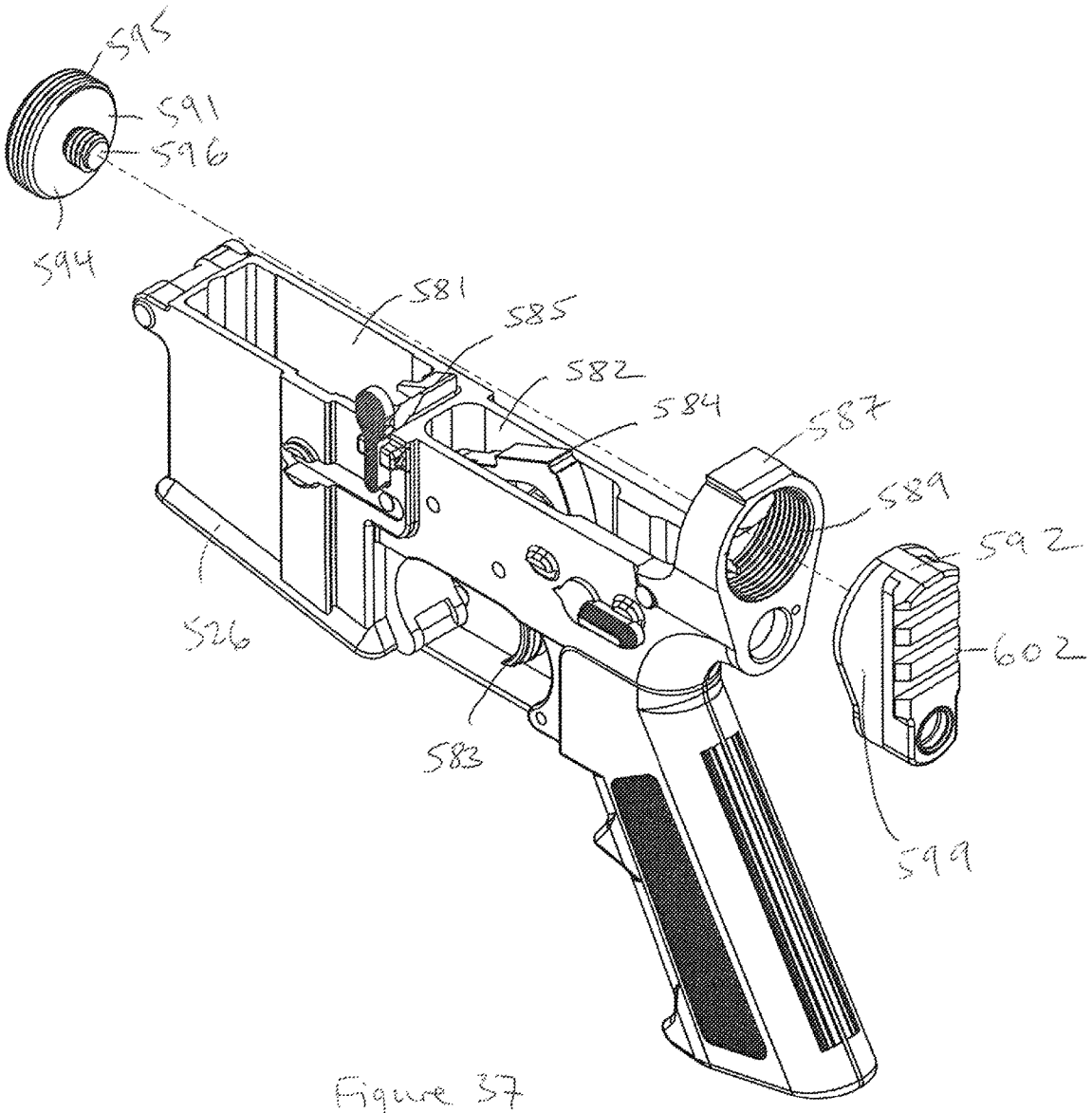
Figure 38:
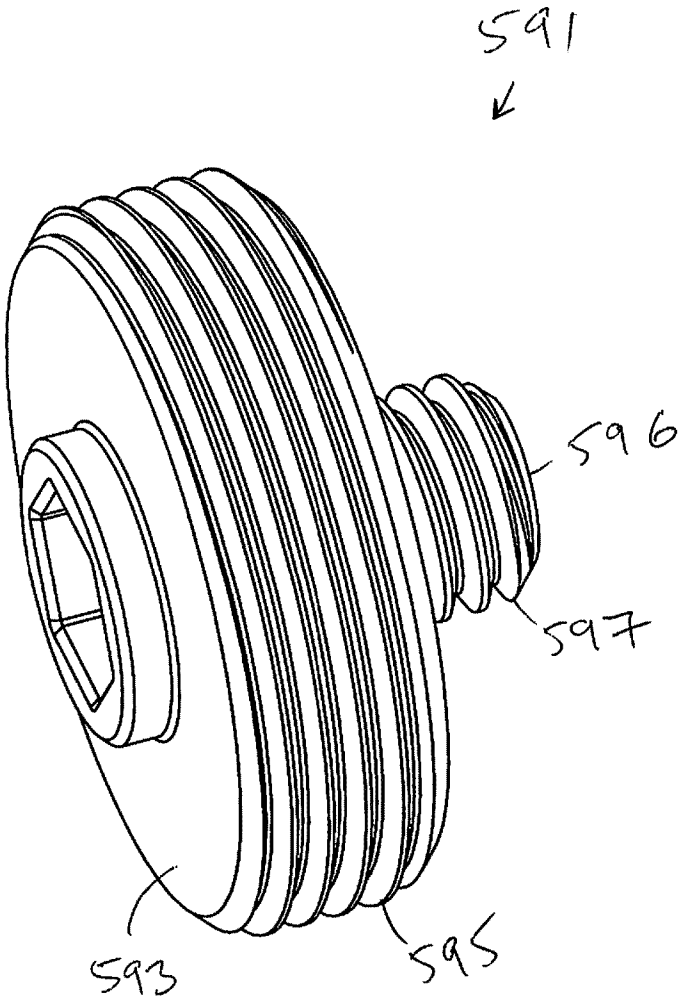
FIG. 38 depicts a perspective view of an exemplary embodiment presently disclosed.

Referring to FIGS. 36-37, according to some embodiments presently disclosed, the lower receiver 526 comprises an upwardly extending lobe 587. According to some embodiments, the upwardly extending lobe 587 is integrally coupled with the lower receiver 526. According to some embodiments, the upwardly extending lobe 587 extends from the lower receiver 526.

According to some embodiments, the upwardly extending lobe 587 is used to mount a buttstock (not shown) to the lower receiver 526. According to some embodiments, the upwardly extending lobe 587 comprises a generally circular threaded through-hole 589. According to some embodiments presently disclosed, the upwardly extending lobe 587 is configured to accommodate a portion of the bolt carrier assembly 540 when the bolt carrier assembly 540 is in the second (unlocked) position. According to some embodiments presently disclosed, the generally circular threaded through-hole 589 is configured to accommodate a portion of the bolt carrier assembly 540 when the bolt carrier assembly 540 is in the second (unlocked) position.

Referring to FIGS. 36-39, according to some embodiments presently disclosed, the firearm 500 comprises a first end plate 591 and a second end plate 592.

According to some embodiments presently disclosed, the first end plate 591 comprises a first surface 593 and a second surface 594 positioned opposite the first surface 593. According to some embodiments presently disclosed, the first end plate 591 comprises an outer threaded surface 595 adapted to mate with the generally circular threaded through-hole 589. According to some embodiments, the generally circular threaded through-hole 589 is adapted to receive the mating male threads 595 on the first end plate 591. According to some embodiments presently disclosed, the first end plate 591 is configured to be threaded into the generally circular threaded through-hole 589. According to some embodiments presently disclosed, the first end plate 591 is configured to be threaded into the generally circular threaded through-hole 589 from the side closest to the opening 582.

According to some embodiments presently disclosed, the first end plate 591 prevents the bolt carrier assembly 540 from being positioned beyond the lower receiver 526 when the bolt carrier assembly is in the second (unlocked) position.

According to some embodiments presently disclosed, the first end plate 591 comprises a protrusion 596 extending from the second surface 594. According to some embodiments presently disclosed, the protrusion 596 comprises an outer threaded surface 597.

According to some embodiments presently disclosed, the second end plate 592 comprises a first surface 598 and a second surface 599 positioned opposite the first surface 598. According to some embodiments presently disclosed, the first surface 598 of the second end plate 592 comprises a threaded aperture 601.

According to some embodiments presently disclosed, the threaded aperture 601 is adapted to mate with the protrusion 596. According to some embodiments, the threaded aperture 601 is adapted to receive the mating male threads 597 on the protrusion 596. According to some embodiments presently disclosed, the first end plate 591 is configured to be threaded into the second end plate 592. According to some embodiments presently disclosed, the second end plate 592 is coupled with the upwardly extending lobe 587 with the first end plate 591. According to some embodiments presently disclosed, the second end plate 592 is coupled to the upwardly extending lobe 587 from the side that is farthest from the opening 582.

According to some embodiments presently disclosed, the second surface 599 comprises one or more rails 602 configured to accommodate one or more accessories. According to some embodiments presently disclosed, the second surface 599 comprises one or more rails 602 to allow coupling of one or more accessories to the lower receiver 526.

Referring to FIGS. 29-30, according to some embodiments presently disclosed, the firearm 500 comprises a recoil buffer 603. The recoil buffer 603 may be positioned to abut the first surface 593 of the first end plate 591. According to some embodiments presently disclosed, the recoil buffer 603 may be used to prevent prevents the bolt carrier assembly 540 from being slammed into the first end plate 591 when the bolt carrier assembly 540 is in the second (unlocked) position.

Figure 40:
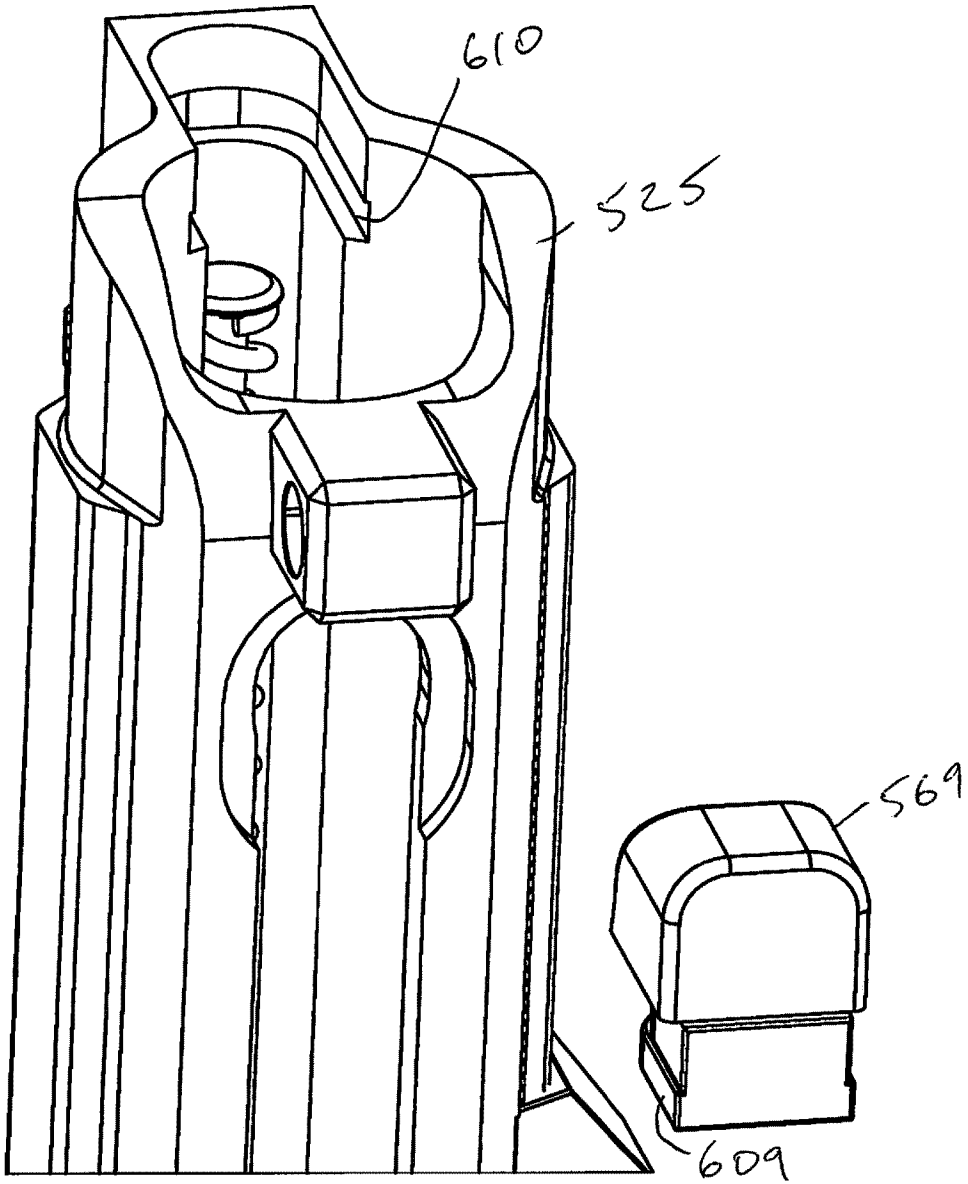
FIGS. 40-41 depict an upper receiver according to some embodiments presently disclosed.
Figure 41:
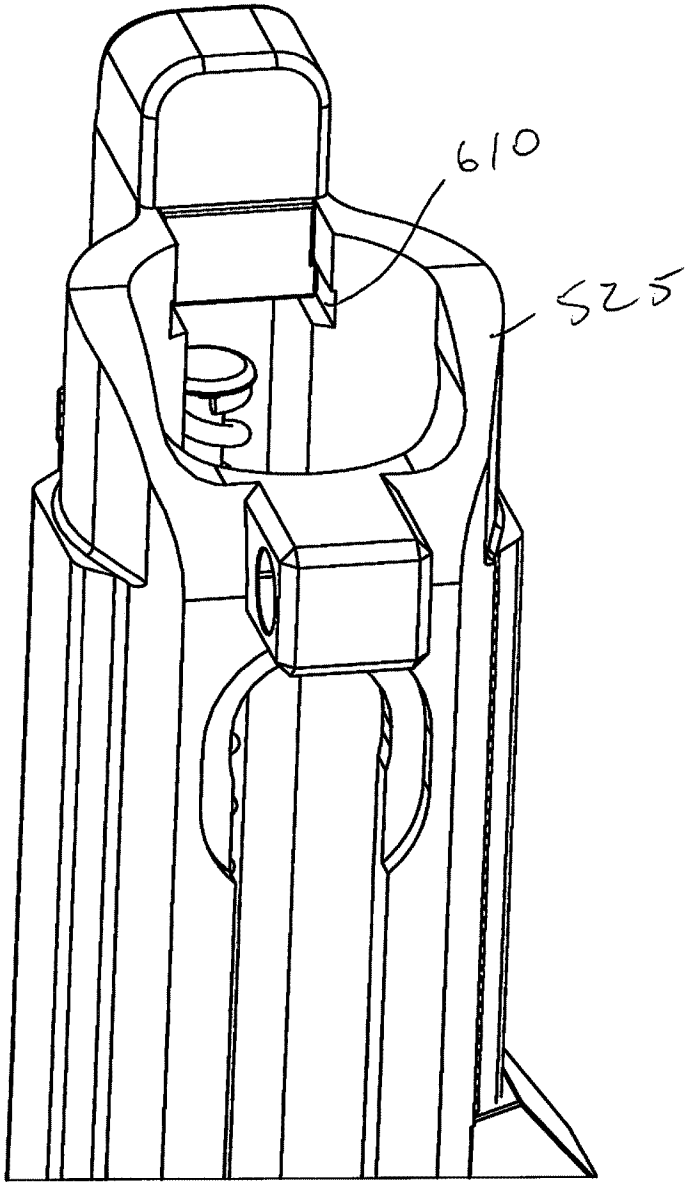
Figure 42:
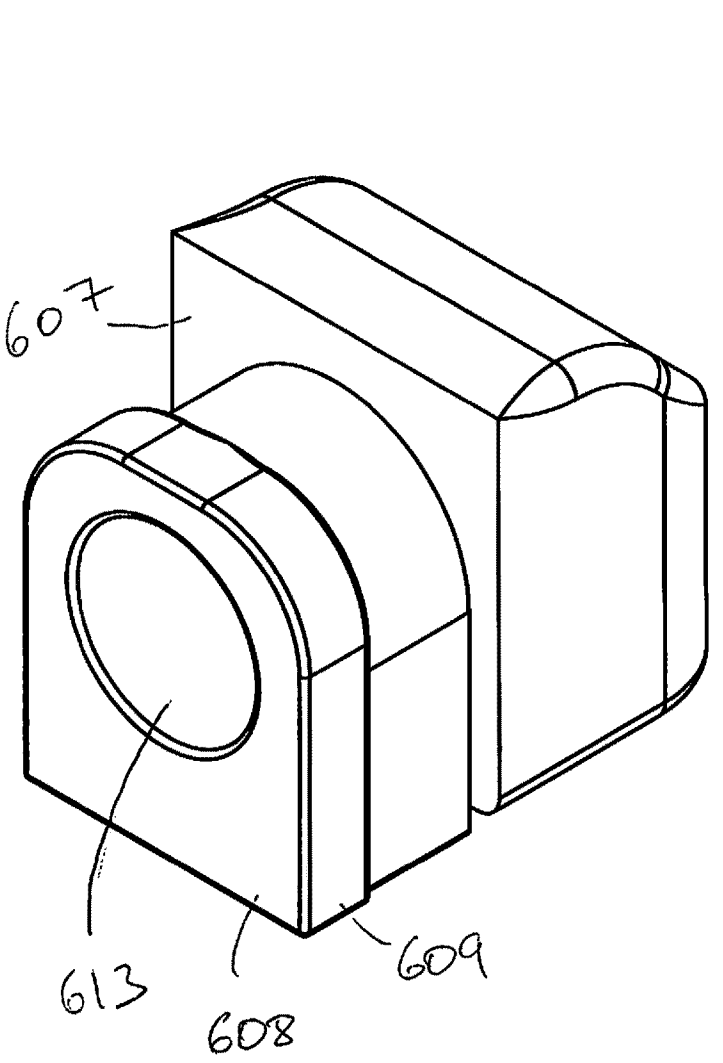
FIG. 42 depicts a perspective view of an exemplary embodiment presently disclosed.

Referring to FIGS. 40-42, according to some embodiments presently disclosed, the plug 569 is removably coupled with the upper receiver 525. The plug 569 compromises a first side 607 and a protrusion 608 extending from the first side 607. The protrusion 608 may comprise a wider portion 609 extending outwardly from the protrusion 608.

According to some embodiments presently disclosed, the upper receiver 525 comprises a channel 610 configured to accommodate the wider portion 609 of the plug 569.

According to some embodiments presently disclosed, the protrusion 608 comprises an indentation 613 configured to accommodate the larger diameter of the recoil spring guide rod 567's rear portion 572. According to some embodiments presently disclosed, the protrusion 608 comprises an aperture 613 configured to accommodate the larger diameter of the recoil spring guide rod 567's rear portion 572.

Figure 44:
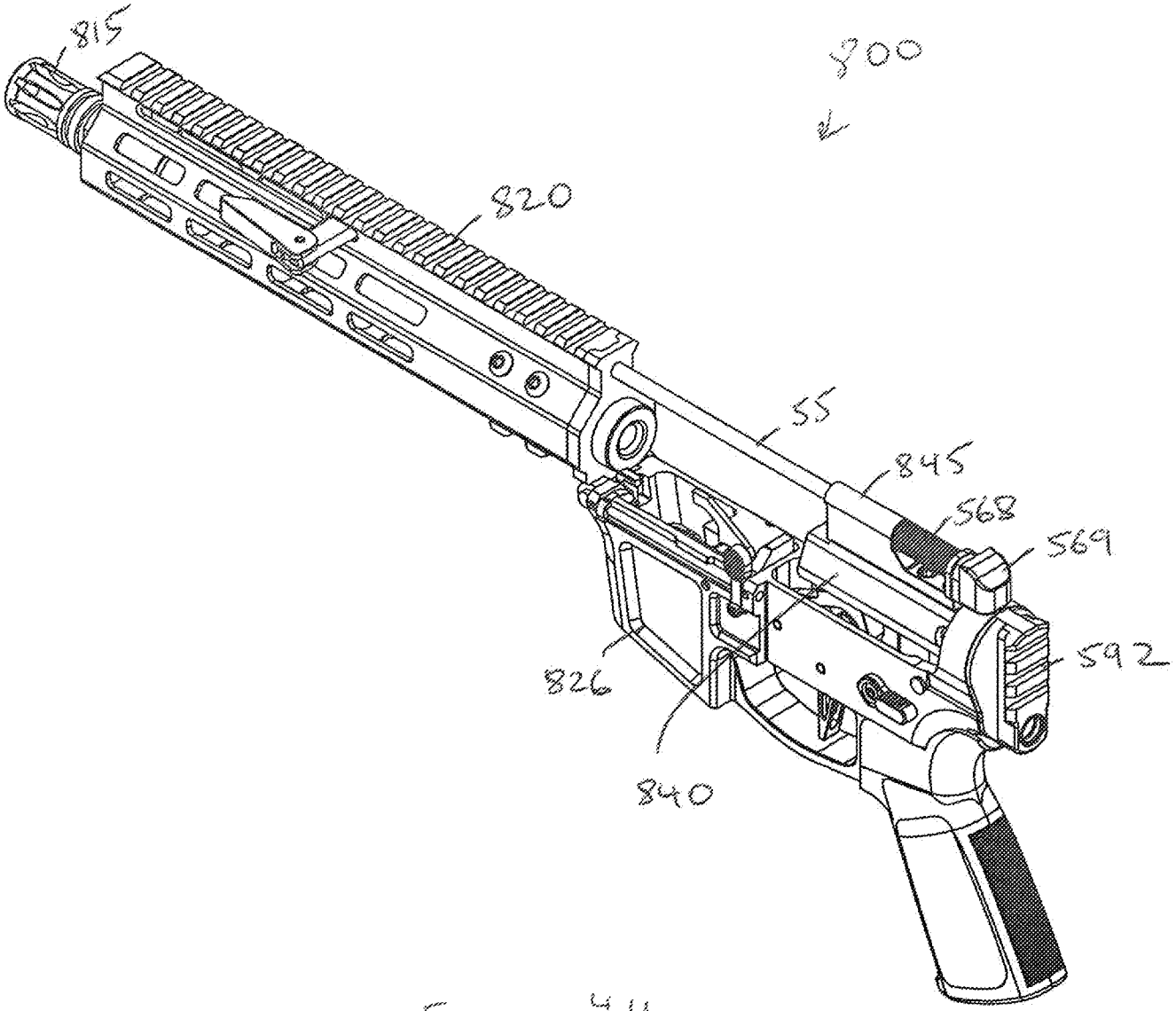
Figure 45:
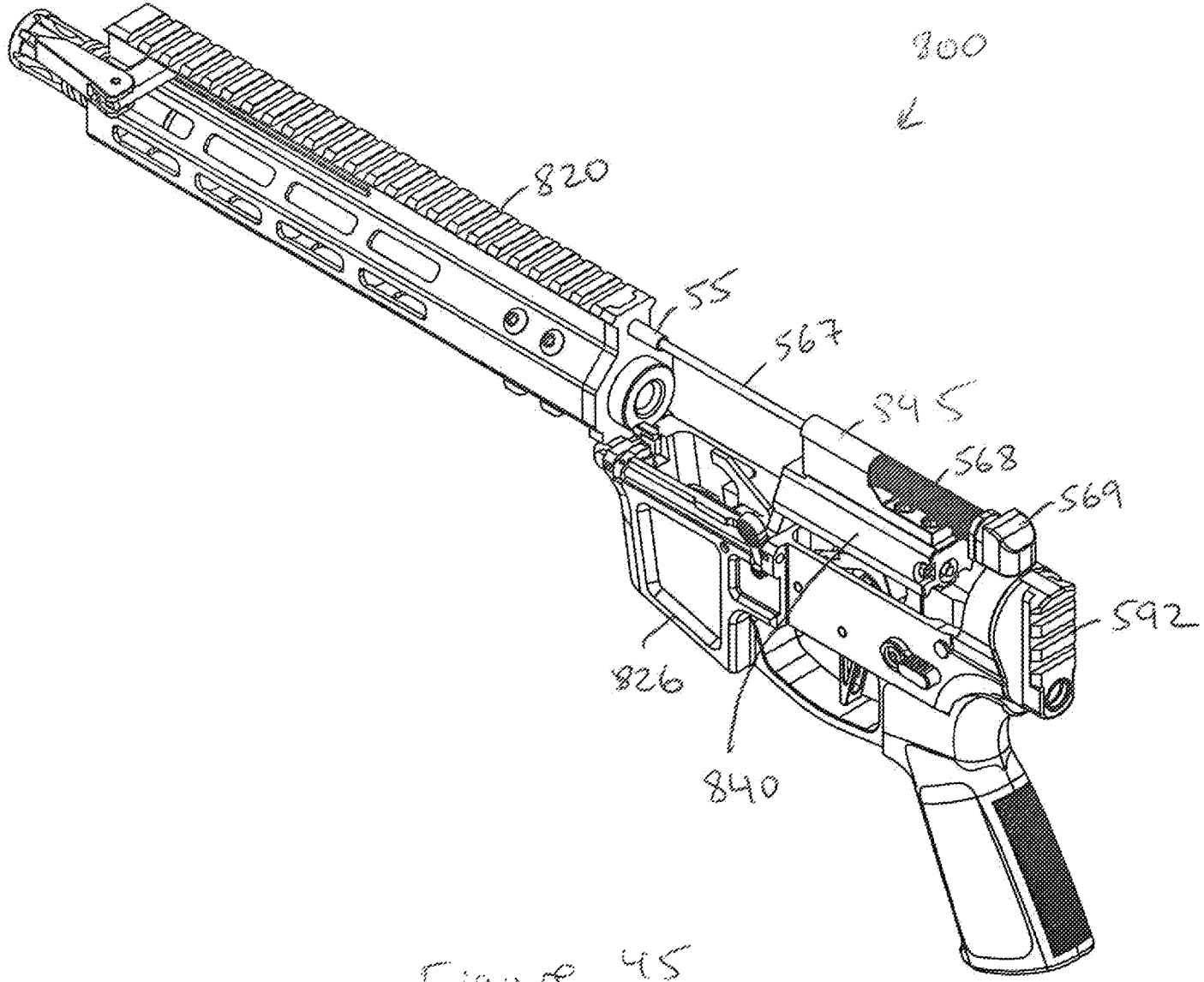
Figure 46:
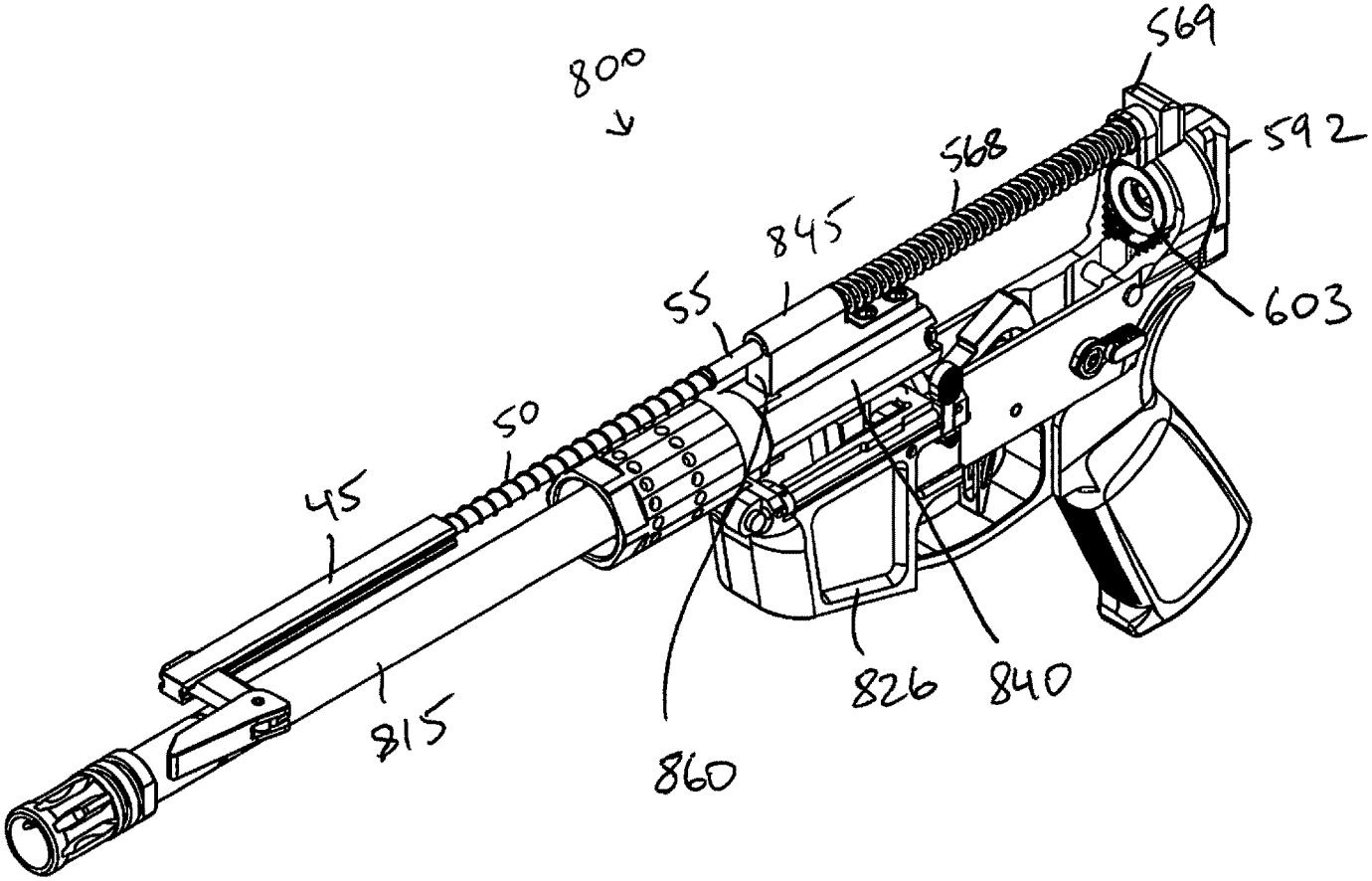
Figure 47:
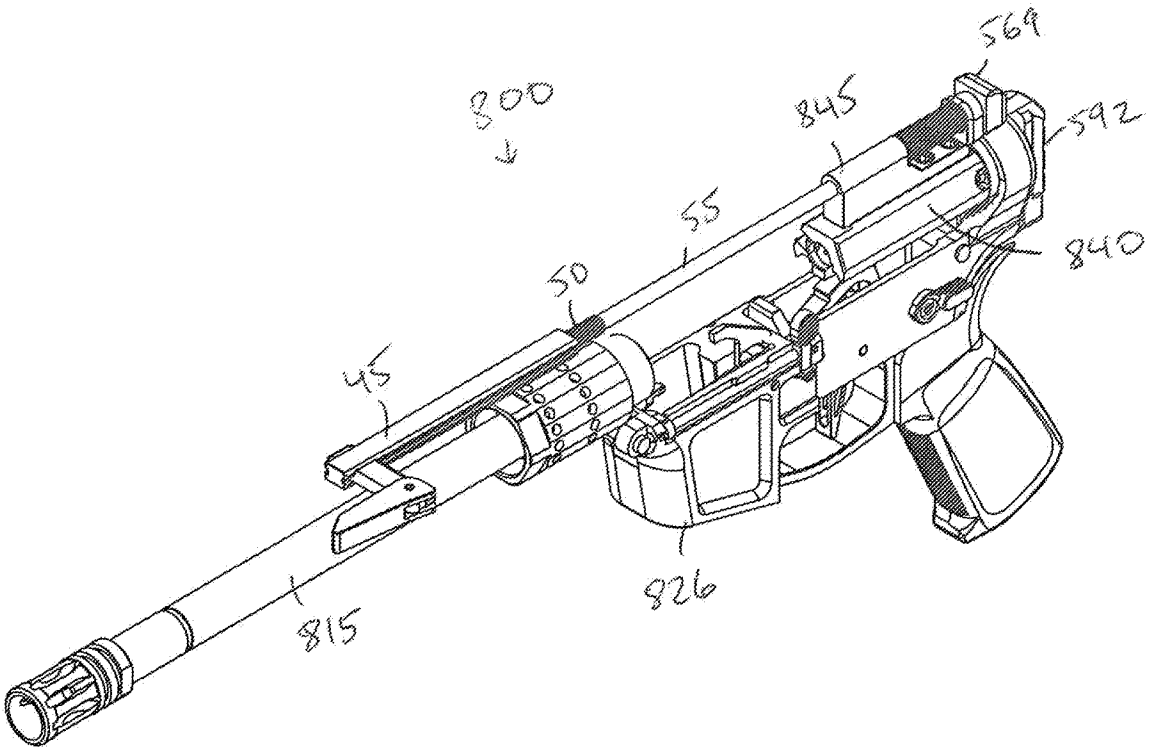
Figure 48:
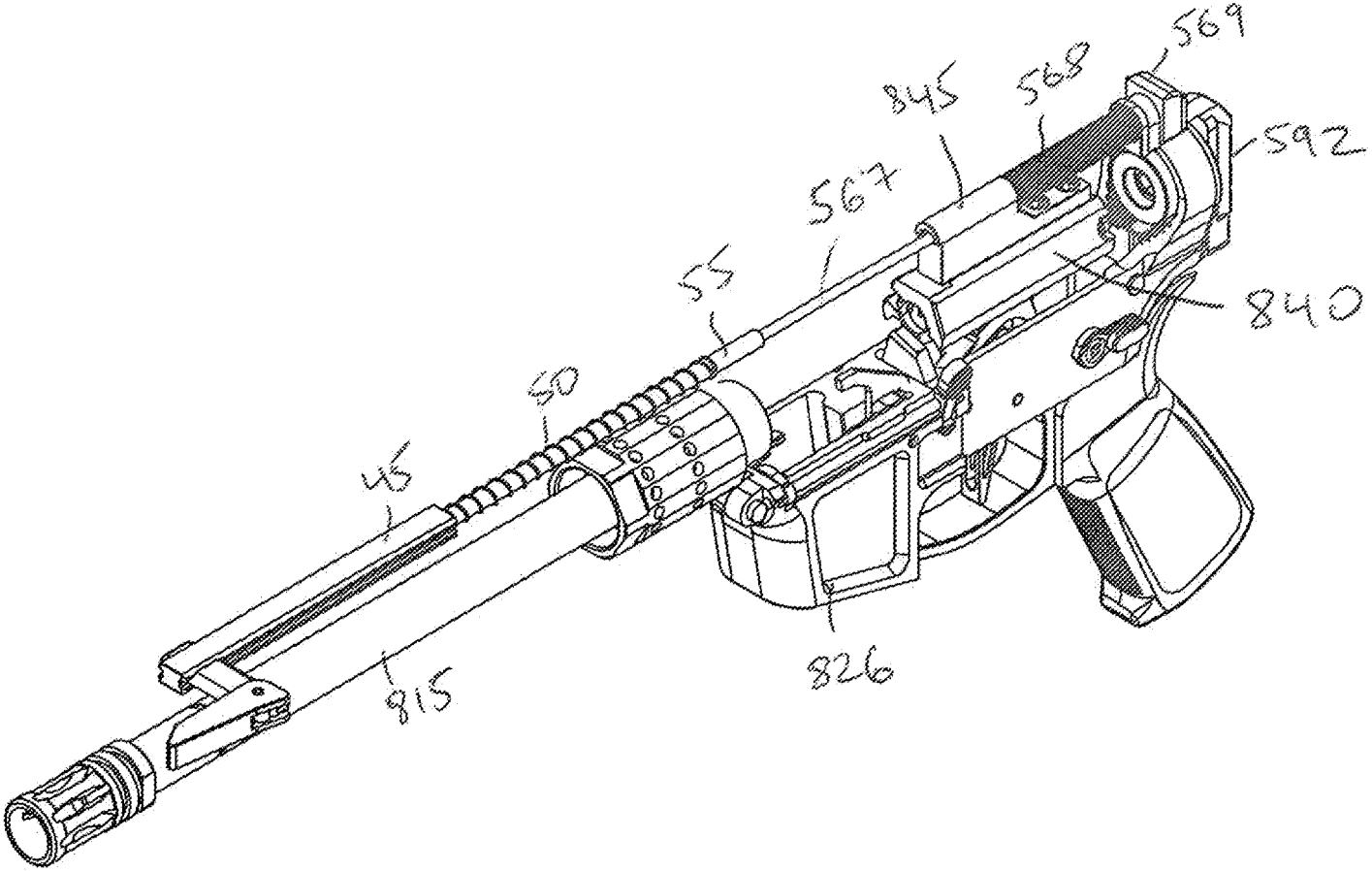

Referring to FIGS. 43-49, a portion of a firearm 800 is shown according to some embodiments presently disclosed. The firearm 800 may comprise a barrel 815, a hand guard 820 and an upper receiver 825 (shown in FIG. 49). According to some embodiments, the upper receiver 825 may be coupled to a lower receiver 826. According to some embodiments, the hand guard 820 may removably encircle the barrel 815. According to some embodiments the upper receiver 825 may be removably coupled with the barrel 815. According to some embodiments the upper receiver 825 may be removably coupled with the hand guard 820. According to some embodiments the hand guard 820 may be removably coupled with the barrel 815 as shown in FIGS. 46-48.

According to some embodiments presently disclosed, the firearm 800 uses a blowback system of operation. Blowback is a system of operation for self-loading firearms that obtains energy from the motion of the cartridge case as it is pushed to the rear by expanding gas crated by the ignition of the propellant charge.

Referring to FIGS. 46-48, the firearm 800 comprises the forward charging system 30 according to some embodiments presently disclosed. According to some embodiments presently disclosed, the firearm 800 comprises the forward charging system 30 as described above.

Figure 49:
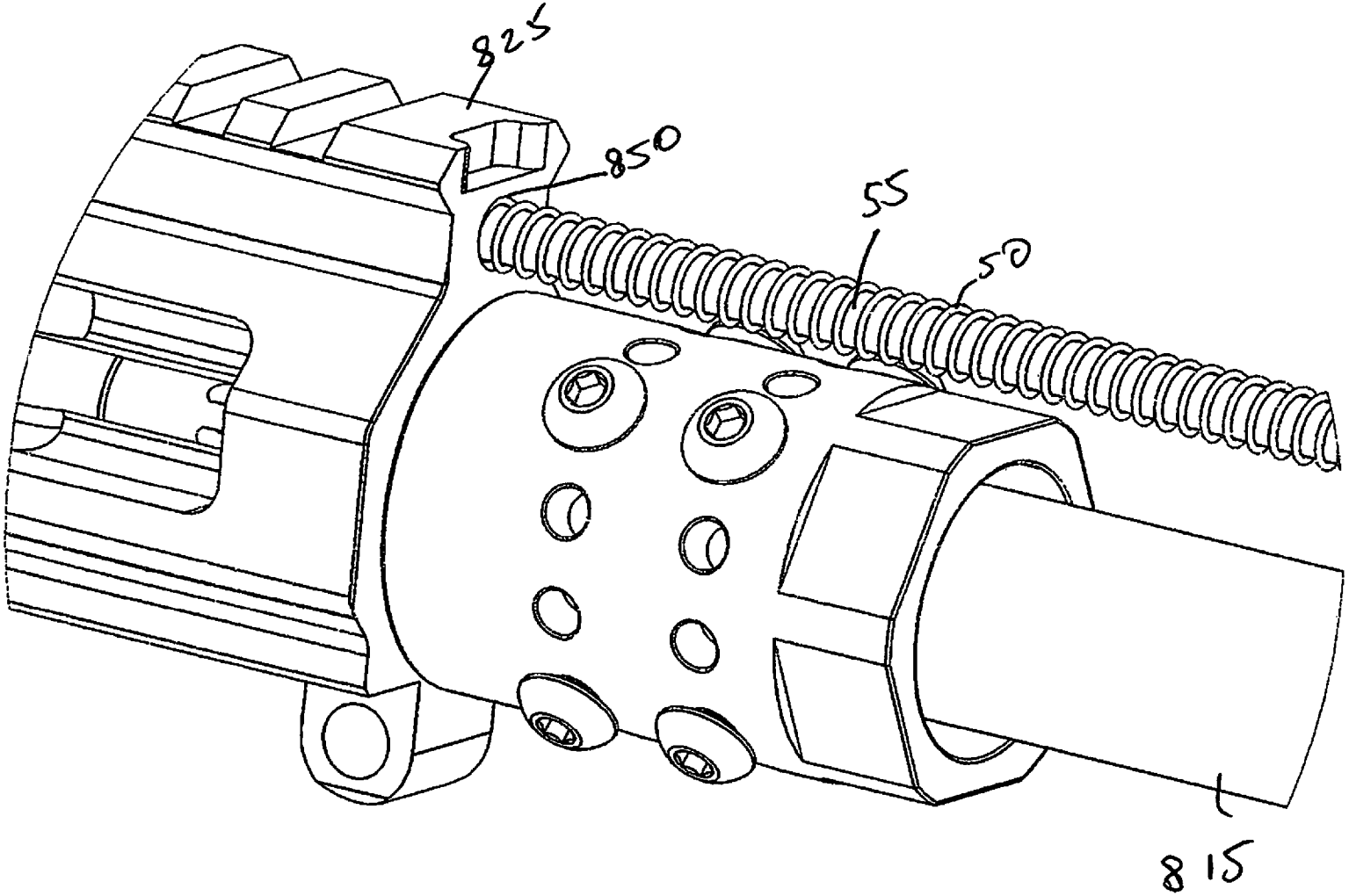

Referring to FIG. 49, the upper receiver 825 comprises an opening 850 to accommodate the rod 55.

Figure 52:
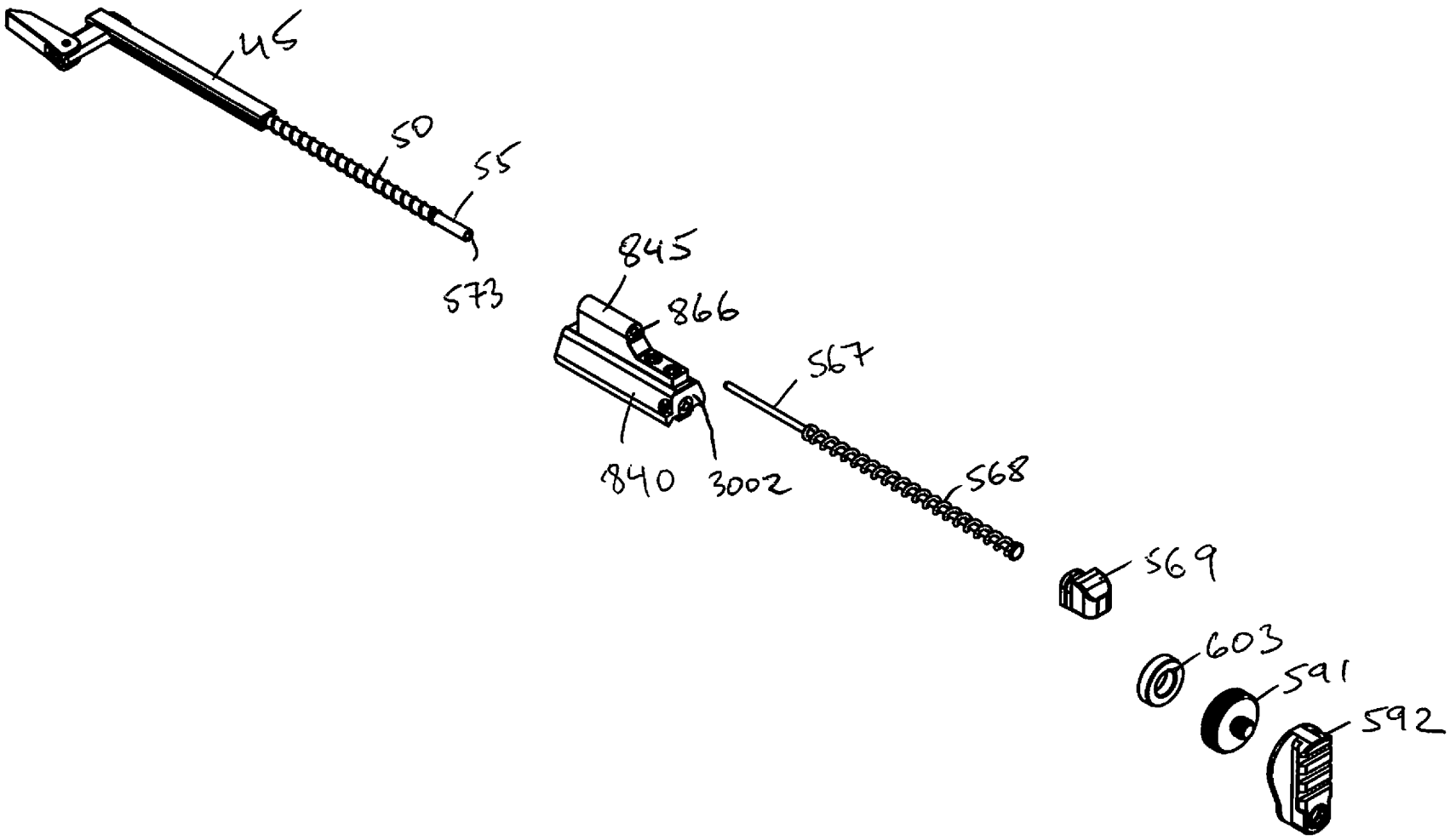
FIGS. 52-53 depict an exploded view of an exemplary embodiment presently disclosed.
Figure 53:
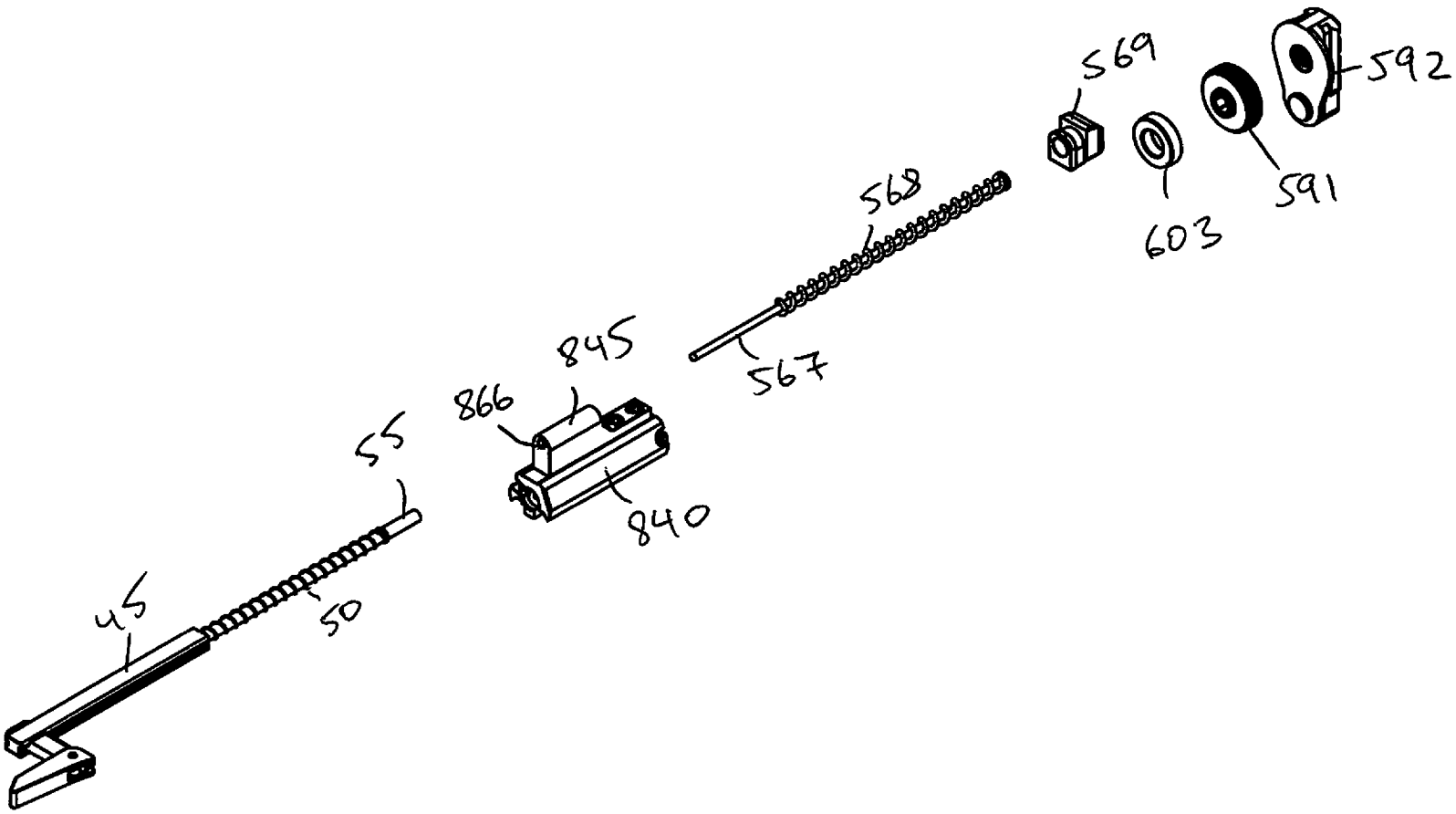
Figure 54:
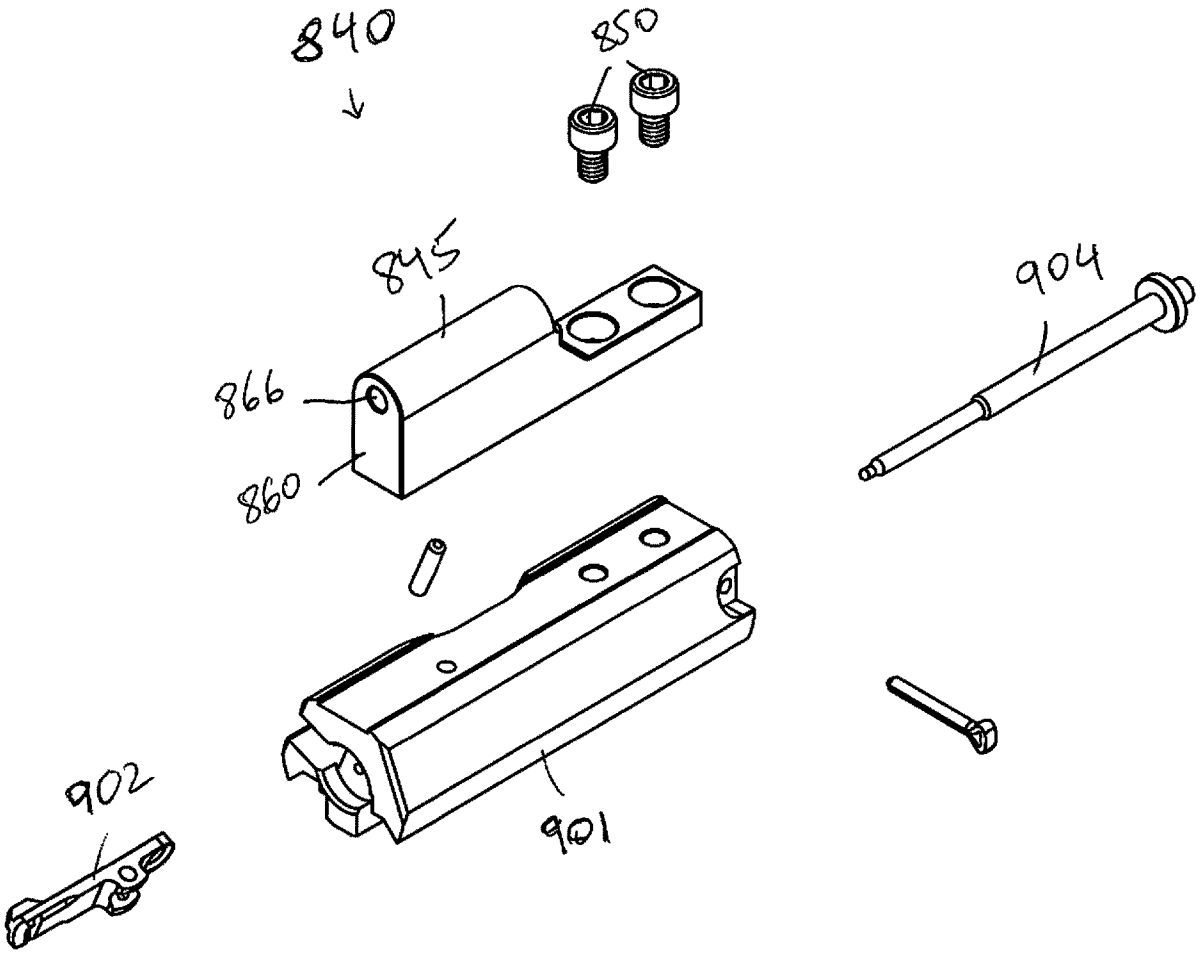
FIG. 54 depicts an exploded view of an exemplary embodiment presently disclosed.

According to some embodiments presently disclosed, the firearm 800 comprises a bolt carrier assembly 840 (FIGS. 52-54). According to some embodiments presently disclosed, the bolt carrier assembly 840 is movable between a first (i.e. locked) position (shown in FIGS. 43, 46 and 77) and a second (i.e. unlocked) position (shown in FIGS. 44-45, 47-48 and 78). According to some embodiments presently disclosed, the bolt carrier assembly 840 is movable between a first (i.e. locked) position (shown in FIGS. 43, 46 and 77) and a second (i.e. unlocked) position (shown in FIGS. 44-45, 47-48 and 78) by the forward charging system 30.

Figure 43:
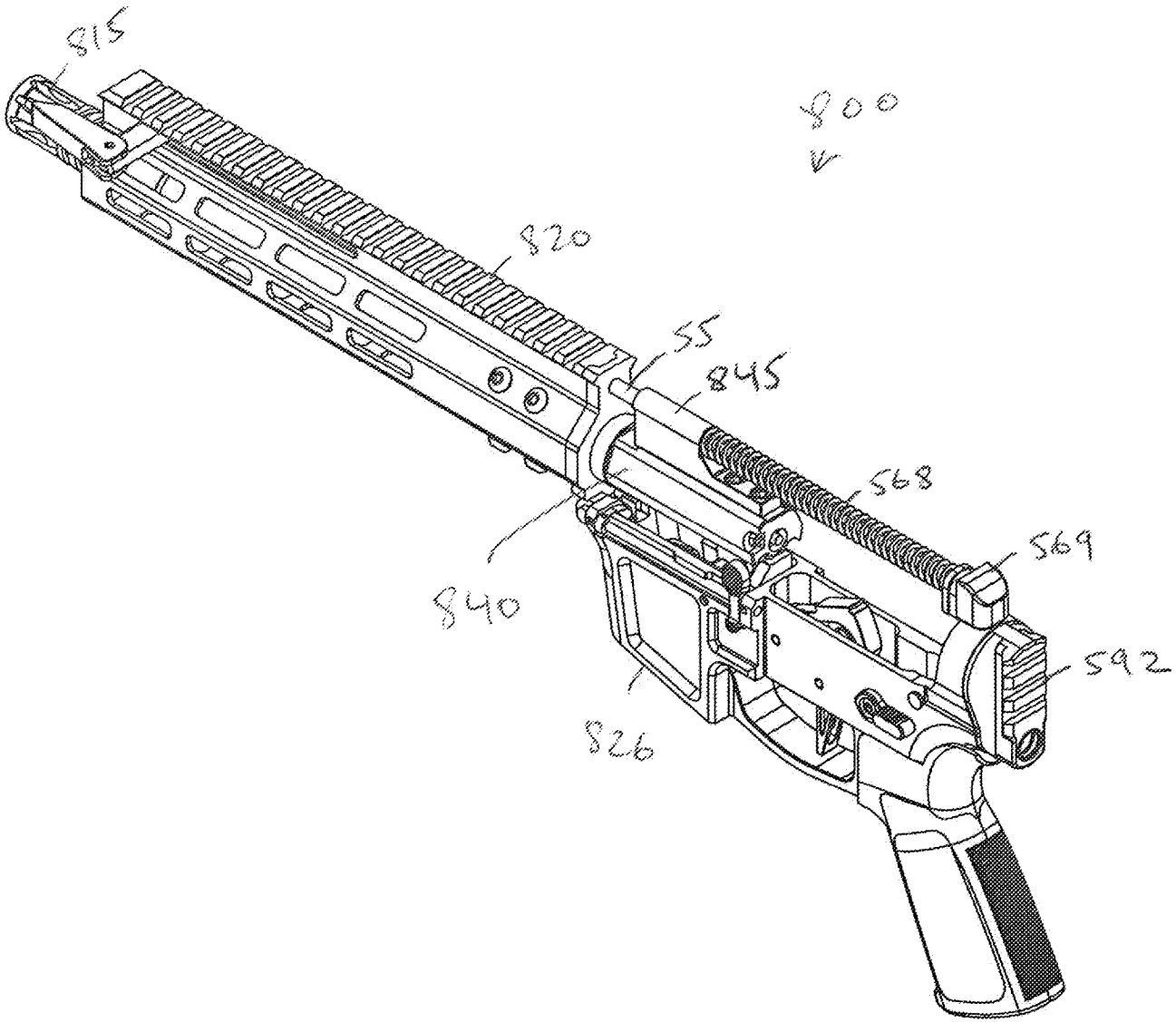
FIGS. 43-49 depict a partially disassembled view of a firearm according to some embodiments presently disclosed.
Figure 55:
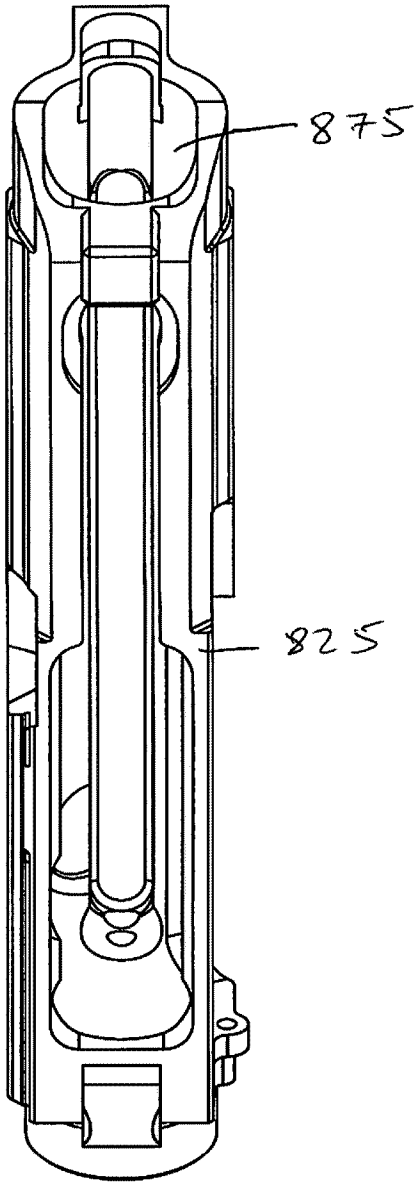
FIG. 55 depicts an upper receiver according to some embodiments presently disclosed.
Figure 56:
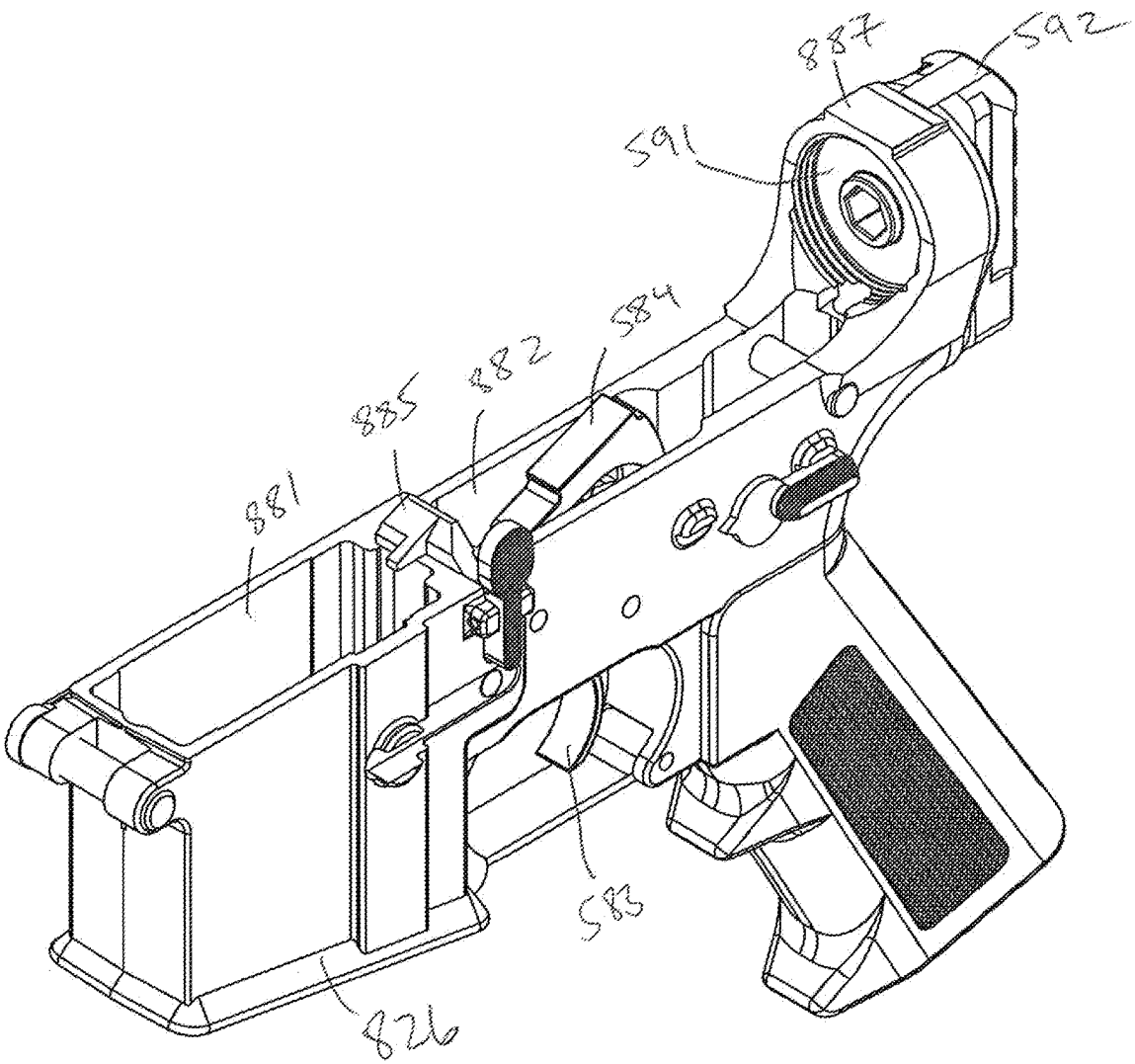
FIGS. 56-58 depict a partially disassembled view of a firearm according to some embodiments presently disclosed.
Figure 57:
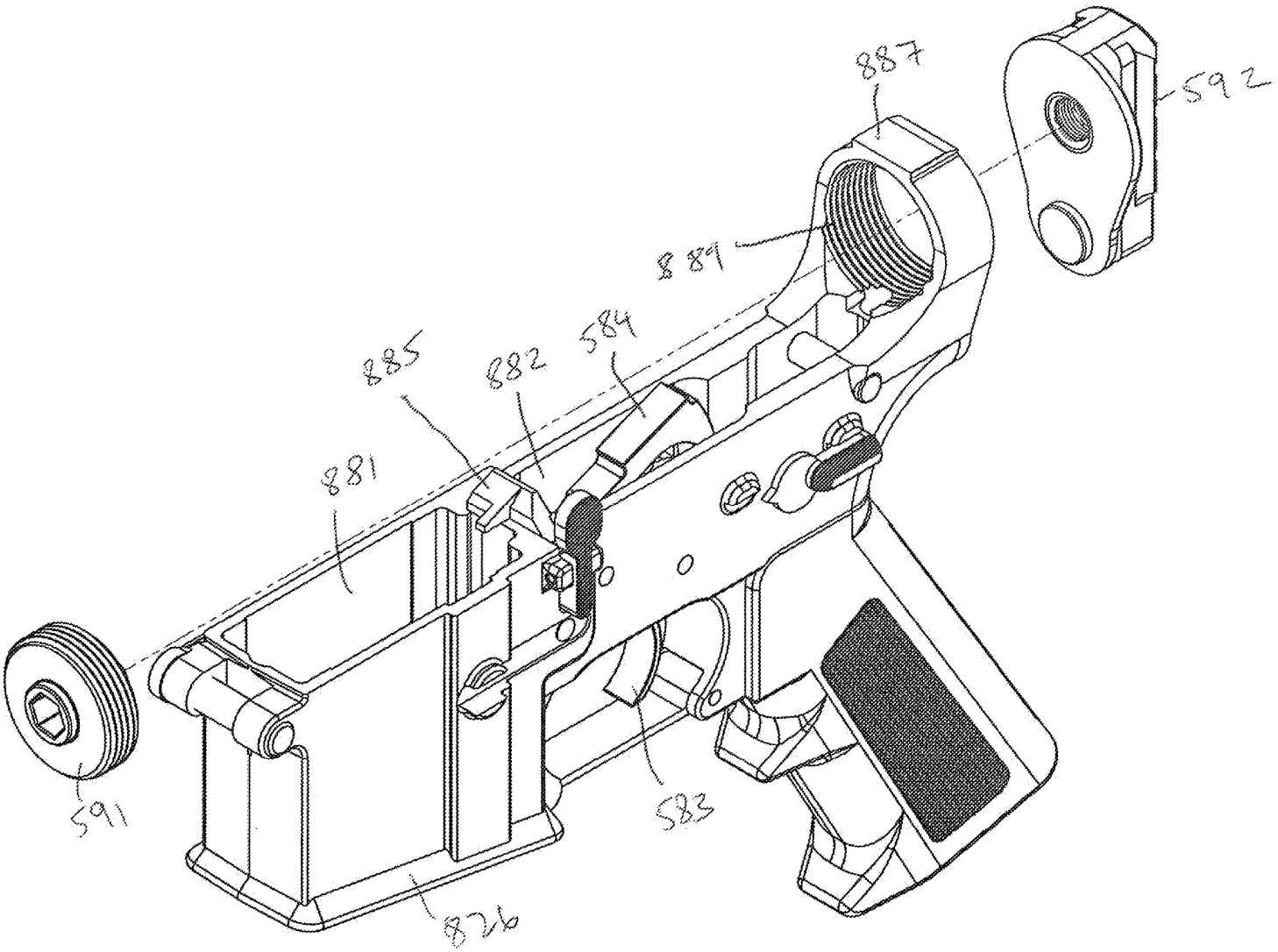
Figure 58:
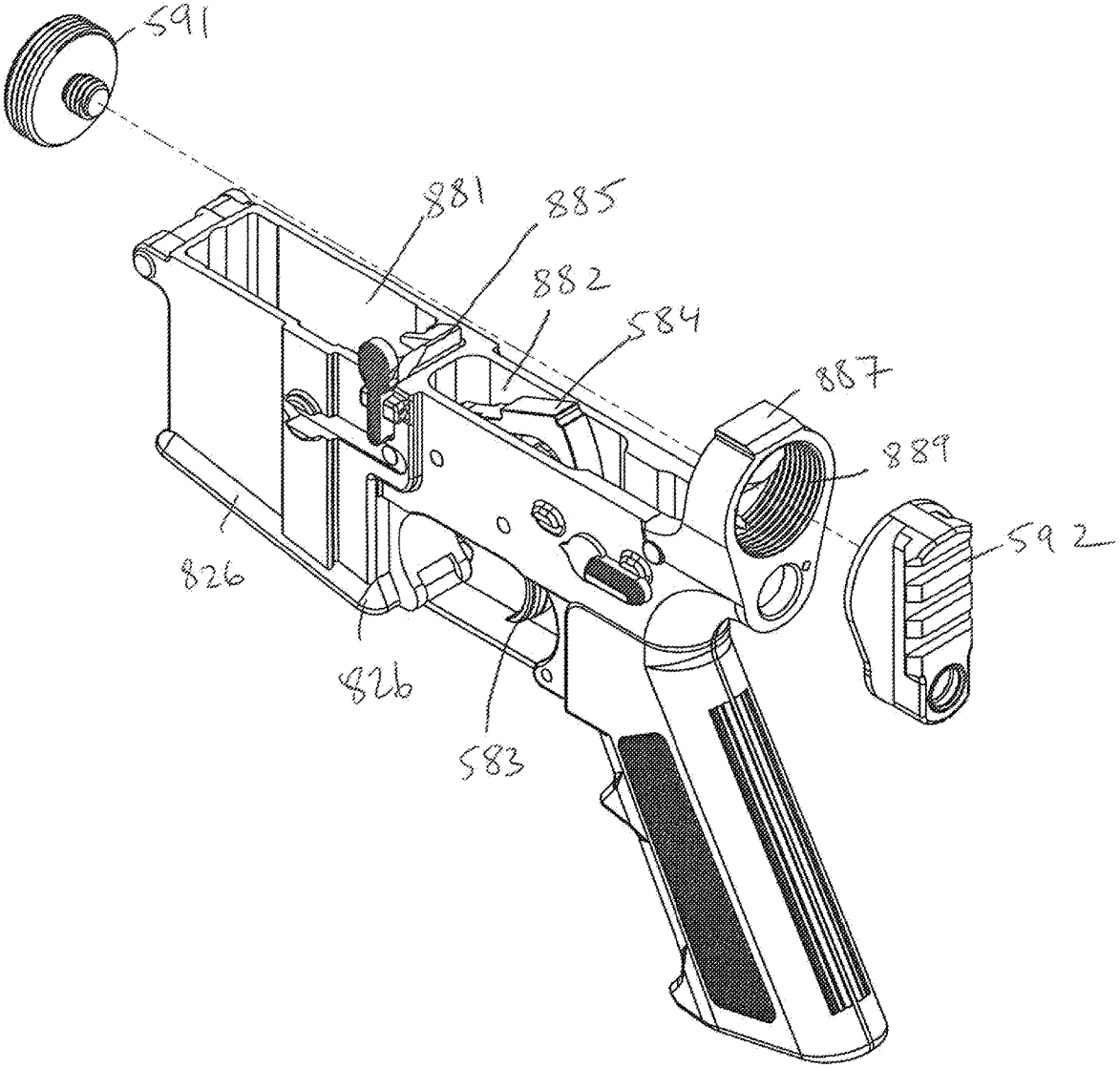
Figure 59:
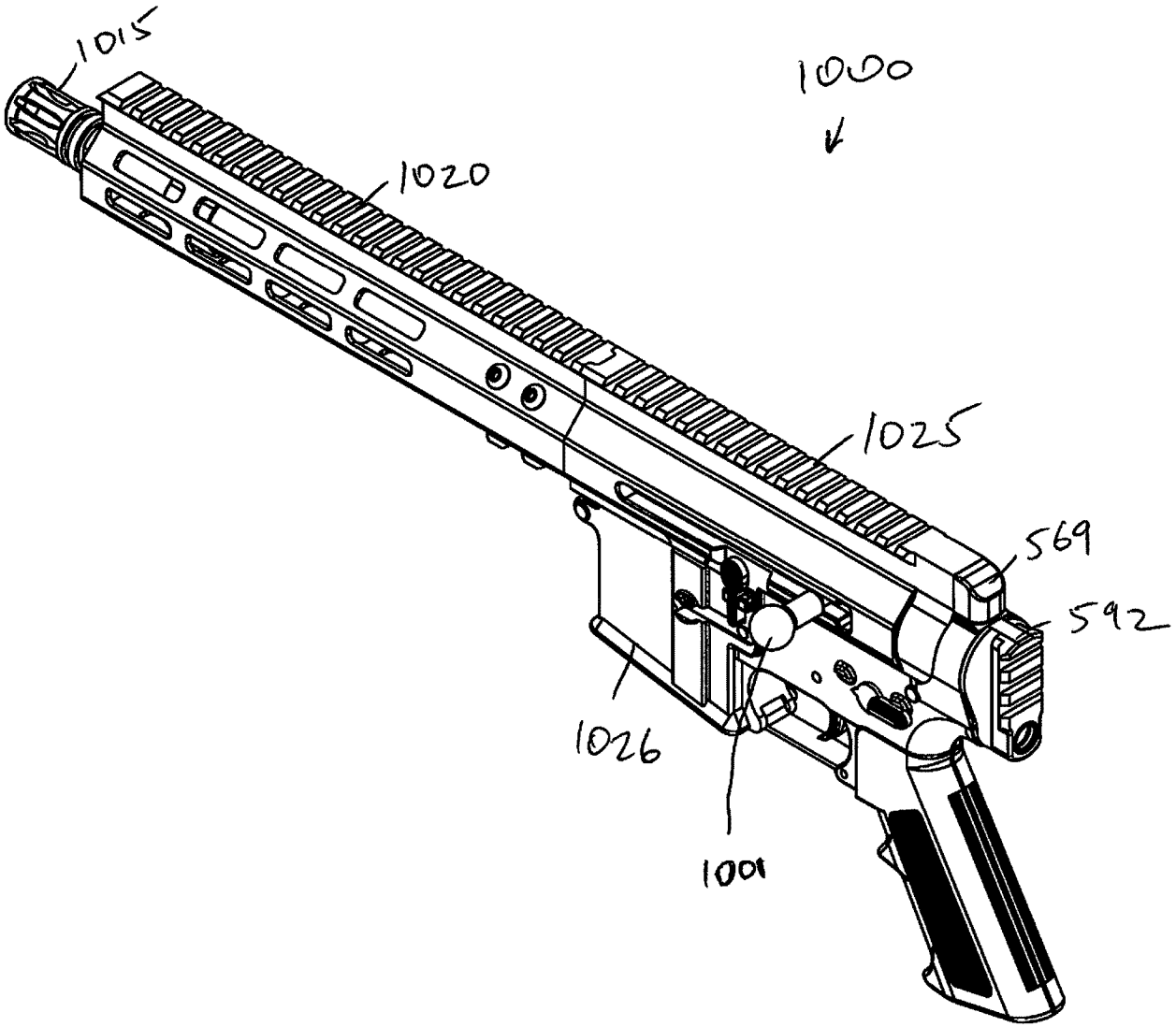
Figure 77:
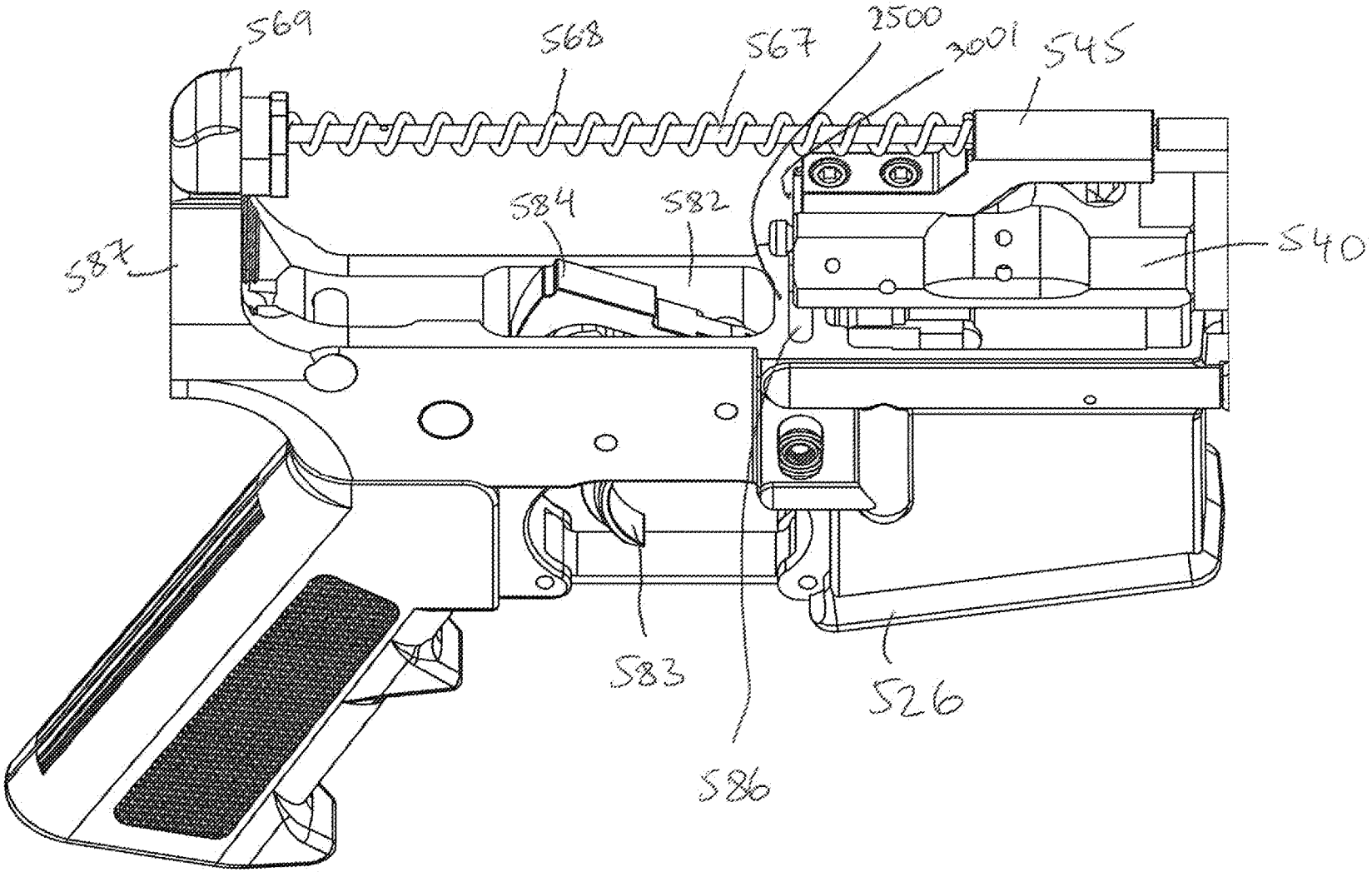
Figure 74:
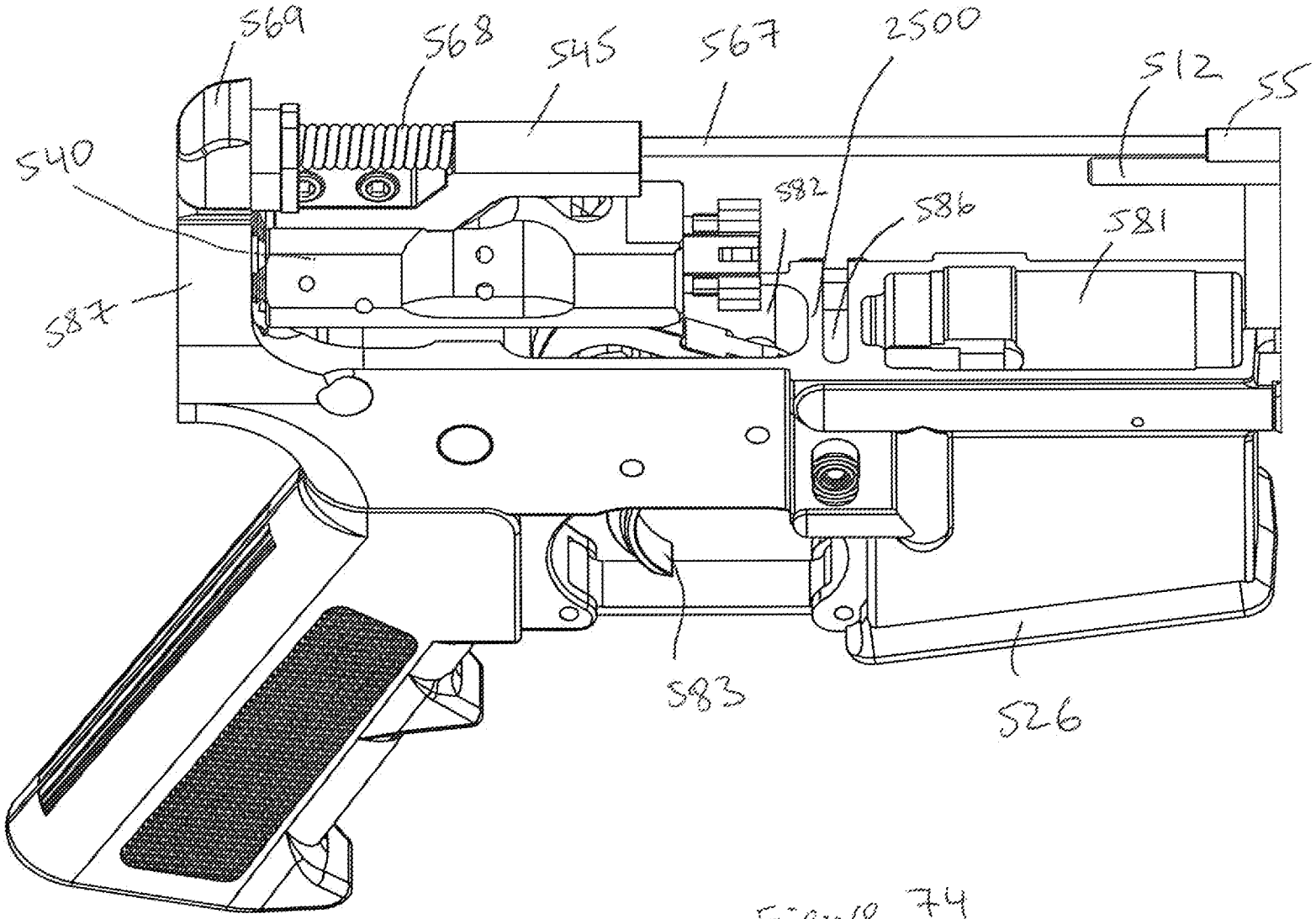

The bolt carrier assembly 840 comprises a bolt carrier 901, an extractor 902, a cam pin 703, a firing pin 904, a carrier key 845 (FIG. 55). The bolt carrier assembly 840 supports and positions the bolt carrier 901. Referring to FIGS. 43 and 46, the first (locked) position is position in which the bolt carrier assembly 840 has positioned the bolt carrier 901 for firing ammunition through the barrel 815. Referring to FIGS. 43, 46 and 77, according to some embodiments, the first (locked) position is position in which the bolt carrier assembly 840 is locked into battery. Referring to FIGS. 44-45, 47-48 and 78, the second (unlocked) position is any position other than the first (locked) position.

According to some embodiments presently disclosed, the forward charging system 30 as described in detail above is configured to move the bolt carrier assembly 840 from the first (locked) position to the second (unlocked) position.

Referring to FIG. 54, according to some embodiments presently disclosed, the carrier key 845 is removably coupled with a top portion of the bolt carrier 901. One or more fasteners 850 may be used to couple the carrier key 845 with the bolt carrier assembly 840. The one or more fasteners 850 may be a pin, a screw, a set screw, a full dog point set screw, or a dogleg set screw.

According to some embodiments presently disclosed, the carrier key 845 comprises a surface 860 configured to abut the rod 55 when the bolt carrier assembly 840 is being moved away from the first (locked) position. According to some embodiments presently disclosed, the surface 860 comprises a through aperture 866 configured to accommodate a recoil spring guide rod 567 described in more detail below. According to some embodiments, the through aperture 866 is a through-opening. According to some embodiments, the diameter of the rod 55 is larger than the diameter of the aperture 866.

Referring to FIGS. 51-53, according to some embodiments presently disclosed, the firearm 800 comprises the recoil spring guide rod 567, the recoil spring 568, and the plug 569 as described in detail above and below.

According to some embodiments presently disclosed, the firearm 800 comprises the rod 55 wherein the rod 55 comprises an aperture 573 (FIG. 52). According to some embodiments presently disclosed, the rod 55 is a hollow tube that defines the aperture 573. According to some embodiments presently disclosed, the aperture 573 goes through a portion of the rod 55. According to some embodiments presently disclosed, the aperture 573 goes through an entire length of the rod 55.

According to some embodiments presently disclosed, the recoil spring guide rod 567's forward portion 571 is configured to go through the aperture 566 and into the aperture 573. According to some embodiments presently disclosed, the recoil spring guide rod 567's rear portion 572 is configured to abut the plug 569. According to some embodiments presently disclosed, the recoil spring guide rod 567 passes through the recoil spring 568. According to some embodiments presently disclosed, the recoil spring guide rod 567 passes through the recoil spring 568 and the recoil spring 568 is positioned between the carrier key 545 and the plug 566.

According to some embodiments presently disclosed, the recoil spring guide rod 567's rear portion 572 has a diameter that is larger than the diameter of the rest of the recoil spring guide rod 567. According to some embodiments presently disclosed, the recoil spring guide rod 567 passes through the recoil spring 568 and the recoil spring 568 is positioned between the carrier key 545 and larger diameter of the recoil spring guide rod 567's rear portion 572.

According to some embodiments, the bolt carrier assembly 840 is configured to slide along the recoil spring guide rod 567 between the first (i.e. locked) position and a second (i.e. unlocked) position.

According to some embodiments presently disclosed, the recoil spring guide rod 567's forward portion 571 always resides in the aperture 573. According to some embodiments presently disclosed, the recoil spring guide rod 567's forward portion 571 resides in the aperture 573 when the bolt carrier assembly 840 is in the first (i.e. locked) position and when the bolt carrier assembly 840 is in the second (i.e. unlocked) position (FIGS. 43-44). According to some embodiments presently disclosed, the recoil spring guide rod 567's forward portion 571 resides in the aperture 573 when the bolt carrier assembly 540 is in the second (i.e. unlocked) position (FIG. 48). According to some embodiments presently disclosed, the recoil spring guide rod 567 extends across the entire lengths of the upper receiver 825. According to some embodiments presently disclosed, the recoil spring guide rod 567 extends across the entire lengths of the lower receiver 826. According to some embodiments presently disclosed, the recoil spring guide rod 567's forward portion 571 extends into the aperture 850 through the aperture 573 (FIG. 45).

According to some embodiments presently disclosed, the recoil spring guide rod 567 extends across a portion of the upper receiver 825. According to some embodiments presently disclosed, the recoil spring guide rod 567 extends across a portion of the lower receiver 826.

According to some embodiments presently disclosed, the recoil spring guide rod 567's forward portion 571 resides in the aperture 573 only when the charging trolley 45 is in the second (charging) position.

According to some embodiments presently disclosed, the recoil spring guide rod 567's rear portion 572 does not extend beyond the upper receiver 825. According to some embodiments presently disclosed, the recoil spring guide rod 567's rear portion 572 does not extend beyond the lower receiver 826.

According to some embodiments, the bolt carrier assembly 840 does not extend beyond the lower receiver 826 when in the second (i.e. unlocked) position.

According to some embodiments presently disclosed, moving the bolt carrier assembly 840 towards the second (unlocked) position compresses the recoil spring 568 between the bolt carrier assembly 840 and the plug 569. According to some embodiments presently disclosed, applying a first force to the bolt carrier assembly 840 compresses the recoil spring 568 between the bolt carrier assembly 840 and the plug 569. According to some embodiments presently disclosed, applying a first force to the bolt carrier assembly 840 compresses the recoil spring 568 between the bolt carrier assembly 840 and the larger diameter of the recoil spring guide rod 567's rear portion 572. Removing the first force causes the compressed recoil spring 568 to move the bolt carrier assembly 840 towards the first (locked) position.

According to some embodiments presently disclosed, the upper receiver 825 comprises an aperture 875 (FIG. 55) configured to accommodate the bolt carrier assembly 840, the recoil spring 568, and the recoil spring guide rod 567. According to some embodiments presently disclosed, the plug 569 abuts the upper receiver 825 to prevent the bolt carrier assembly 840, the recoil spring 568, and the recoil spring guide rod 567 from being removed from the upper receiver 825.

Referring to FIGS. 56-58 and 77-78, according to some embodiments presently disclosed, the lower receiver 826 comprises openings for accepting the internal mechanisms required to operate the firearm. For example, the lower receiver 826 may comprise an opening 881 configured to accept an ammunition magazine (not shown) and associated hardware to direct rounds loaded within the magazine into a chamber in an upper receiver 825. The lower receiver 826 may also comprise an opening 882 configured to accommodate a firing mechanism (i.e. standard trigger group). According to some embodiments, the firing mechanism (i.e. standard trigger group) comprises a trigger mechanism 583 and a hammer mechanism 584.

Figure 78:
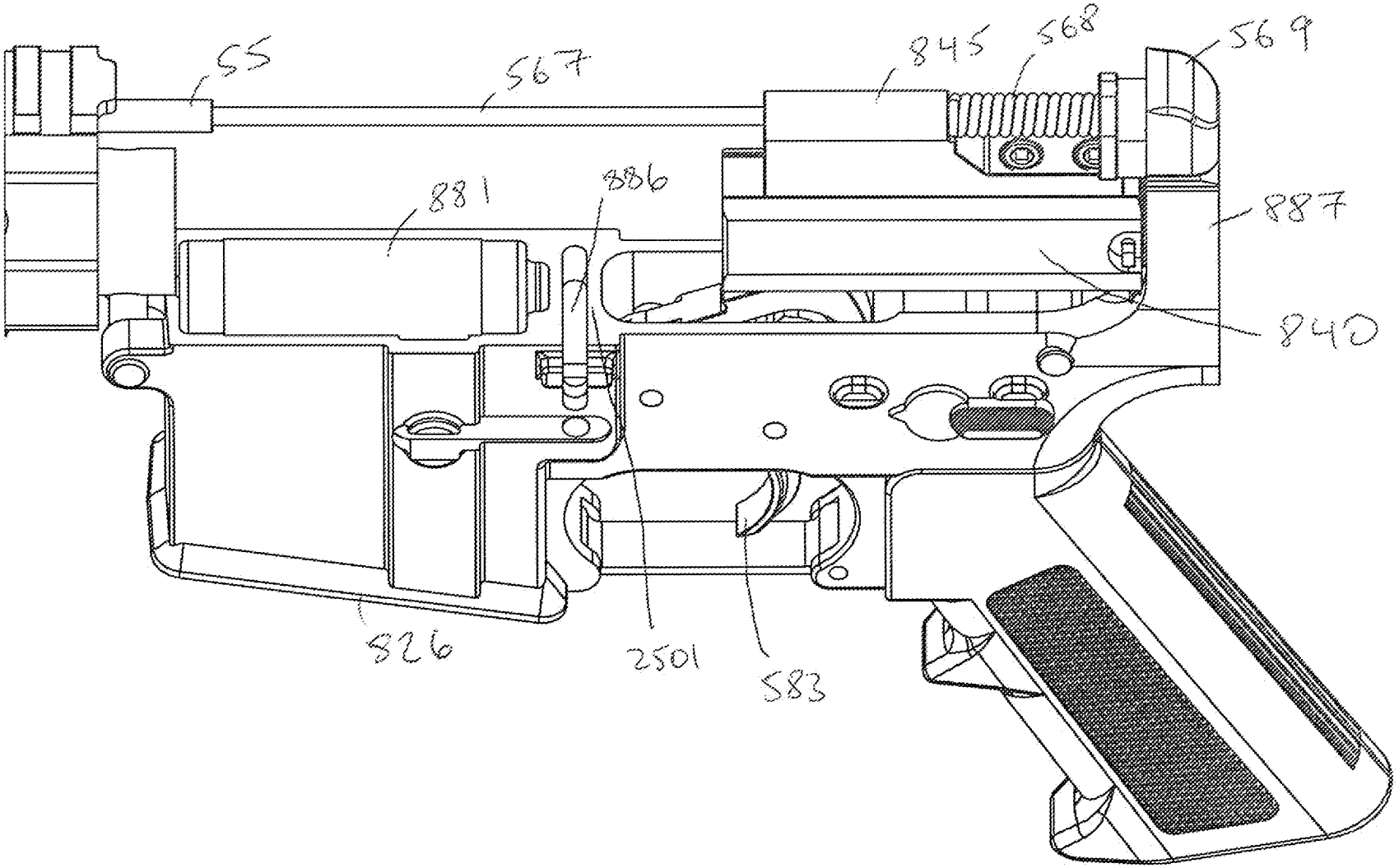

Referring to FIGS. 56-58 and 77-78, according to some embodiments presently disclosed, the lower receiver 826 comprises a bolt hold open 885, an opening 886 configured to accommodate the bolt hold open 885. Referring to FIGS. 77-78, according to some embodiments presently disclosed, the opening 882 is separated from the opening 886 by a wall 2501.

Referring to FIGS. 56-58 and 77-78, according to some embodiments presently disclosed, the lower receiver 826 comprises an upwardly extending lobe 887. According to some embodiments, the upwardly extending lobe 887 is integrally coupled with the lower receiver 826. According to some embodiments, the upwardly extending lobe 887 extends from the lower receiver 826.

According to some embodiments, the upwardly extending lobe 887 is used to mount a buttstock (not shown) to the lower receiver 826. According to some embodiments, the upwardly extending lobe 887 comprises a generally circular threaded through-hole 889.

According to some embodiments presently disclosed, the upwardly extending lobe 887 is configured to accommodate a portion of the bolt carrier assembly 840 when the bolt carrier assembly 840 is in the second (unlocked) position. According to some embodiments presently disclosed, the generally circular threaded through-hole 889 is configured to accommodate a portion of the bolt carrier assembly 840 when the bolt carrier assembly 840 is in the second (unlocked) position.

Referring to FIGS. 38-39 and 56-57, according to some embodiments presently disclosed, the firearm 800 comprises the first end plate 591 and the second end plate 592 as described in more detail above.

According to some embodiments presently disclosed, the first end plate 591 prevents the bolt carrier assembly 840 from being positioned beyond the lower receiver 826 when the bolt carrier assembly is in the second (unlocked) position.

According to some embodiments presently disclosed, the second end plate 592 is coupled with the upwardly extending lobe 887 with the first end plate 591. According to some embodiments presently disclosed, the second end plate 592 is coupled to the upwardly extending lobe 887 from the side that is farthest from the opening 882.

Referring to FIGS. 52-53, according to some embodiments presently disclosed, the firearm 800 comprises the recoil buffer 603 as described above.

Referring to FIGS. 52-53, according to some embodiments presently disclosed, the firearm 800 comprises the plug 569 removably coupled with the upper receiver 825.

Figure 59:
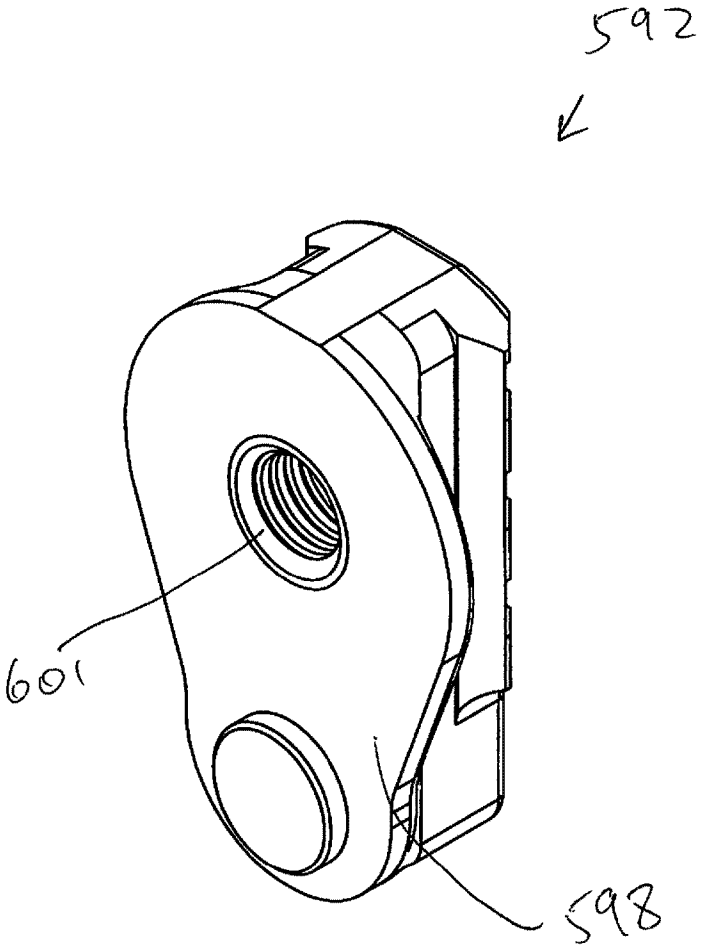
FIGS. 59-60 depict a perspective view of a firearm according to some embodiments presently disclosed.
Figure 60:
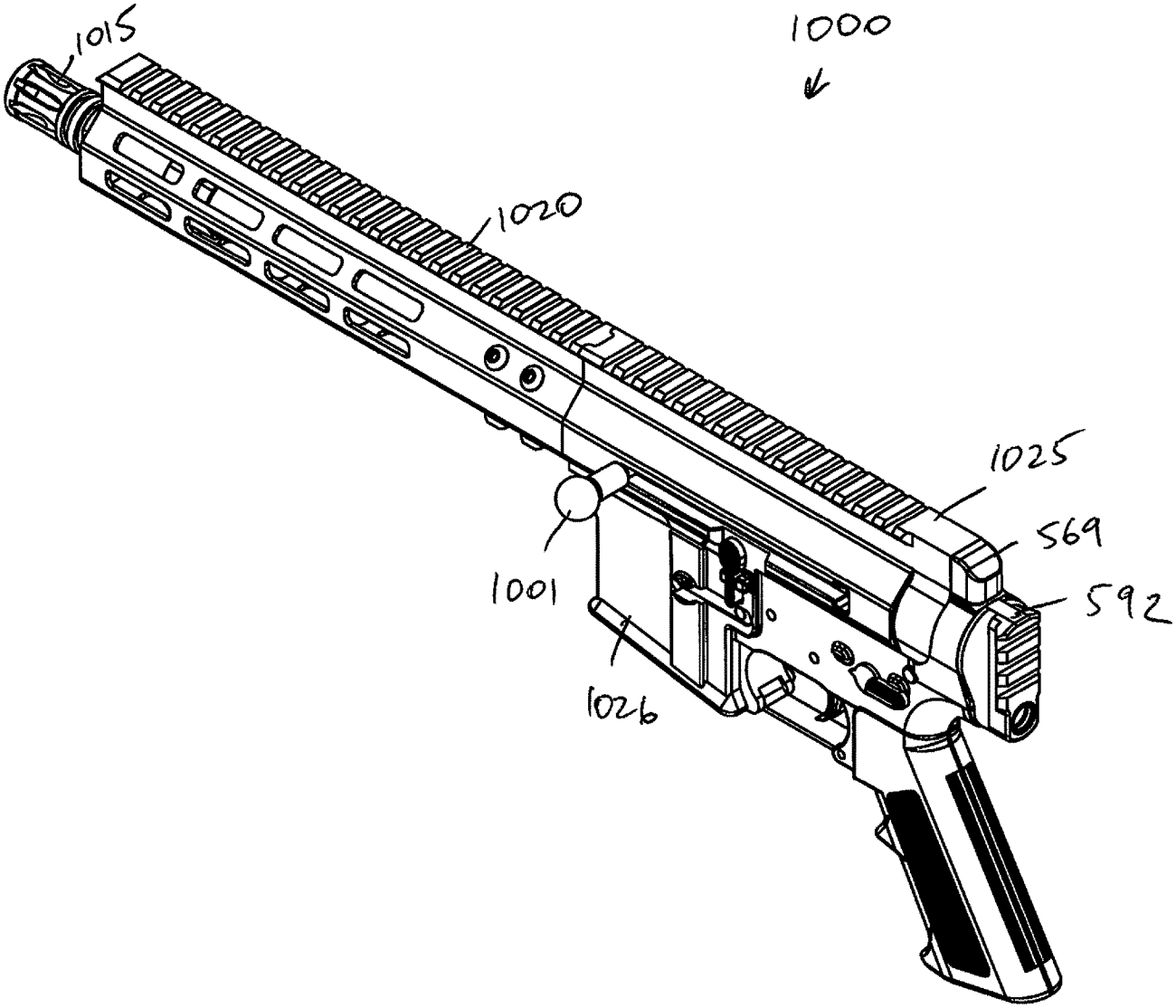
Figure 63:
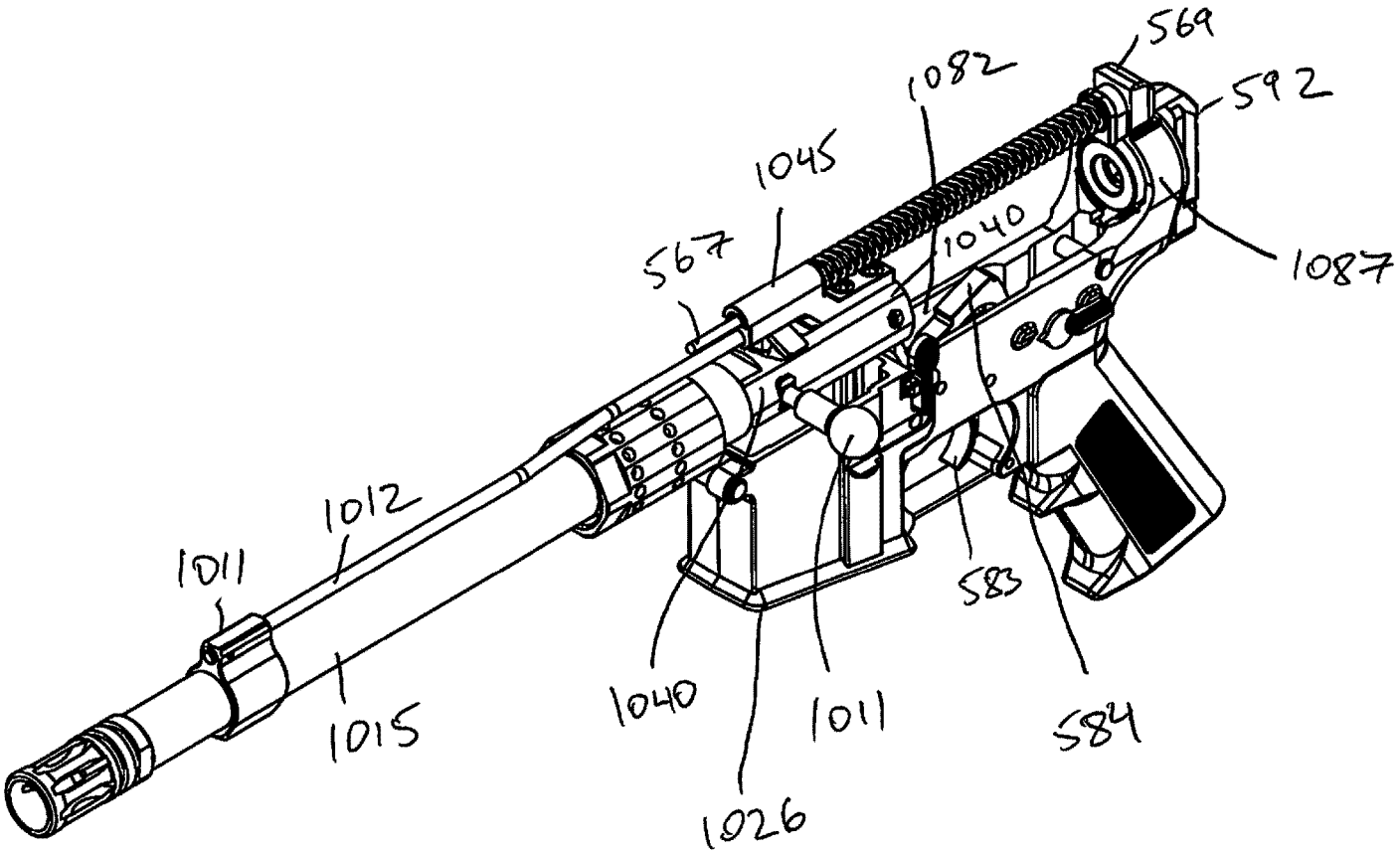
Figure 64:
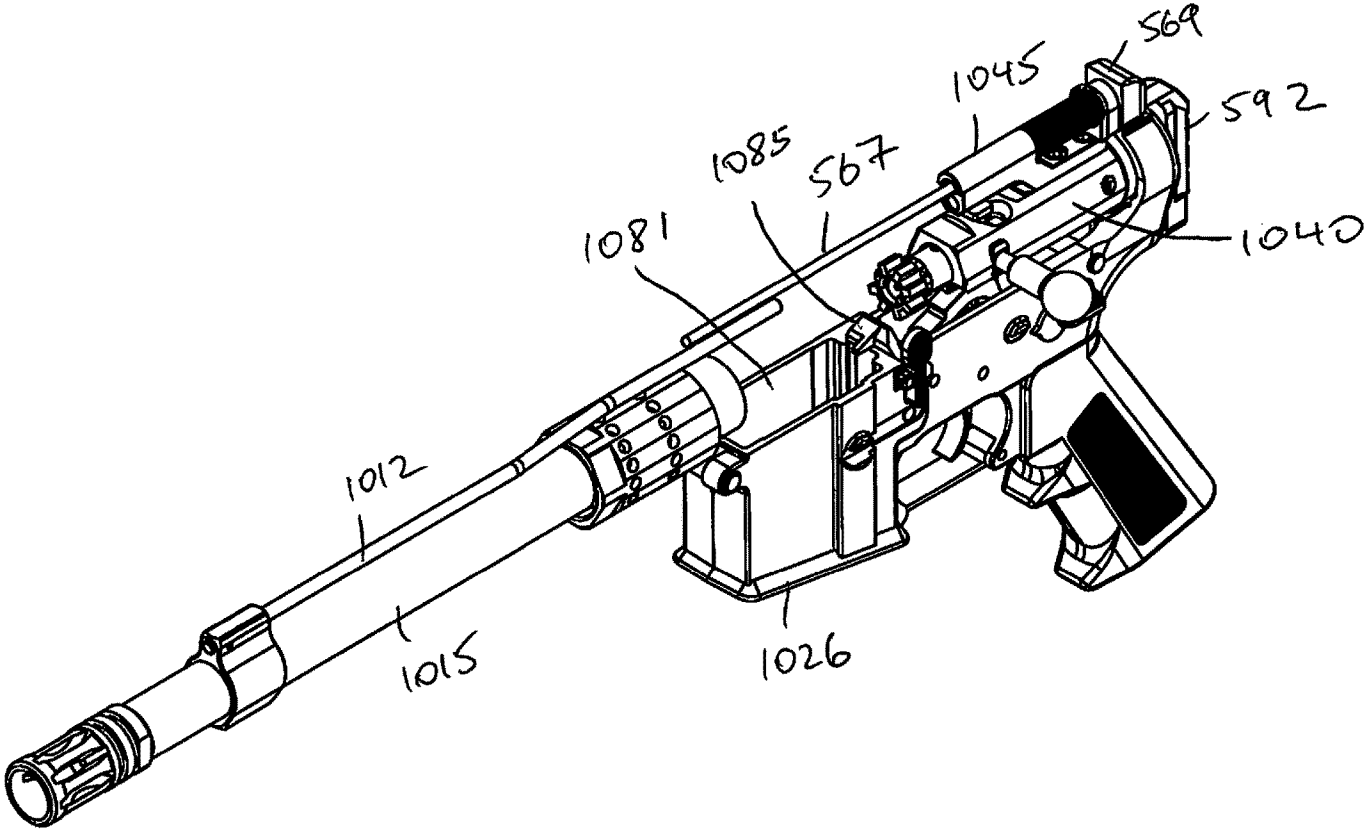

Referring to FIGS. 59-60, a firearm 1000 is shown according to some embodiments presently disclosed. The firearm 1000 may comprise a barrel 1015, a hand guard 1020 and an upper receiver 1025. According to some embodiments, the upper receiver 1025 may be coupled to a lower receiver 1026. According to some embodiments, the hand guard 1020 may removably encircle the barrel 1015. According to some embodiments the upper receiver 1025 may be removably coupled with the barrel 1015. According to some embodiments the upper receiver 1025 may be removably coupled with the hand guard 1020. According to some embodiments the hand guard 1020 may be removably coupled with the barrel 1015 as shown in FIGS. 63-64.

According to some embodiments presently disclosed, the firearm 1000 comprises, for example, a direct impingement system. Direct impingement is a type of gas operation for a firearm that directs gas from a fired cartridge directly into the bolt carrier to cycle the action. The firearm 1000 comprises a gas block 1011 coupled with the barrel 1015, and a gas tube 1012 (FIGS. 63-64).

Referring to FIGS. 59-64, the firearm 1000 comprises a removable side charging handle 1001 according to some embodiments presently disclosed. According to some embodiments presently disclosed, the firearm 1000 comprises the side charging handle 1001 coupled with the bolt carrier assembly 1040 as described below. According to some embodiments presently disclosed, the side charging handle 1001 protrudes from the upper receiver 1025 (FIGS. 59-60).

Figure 62:
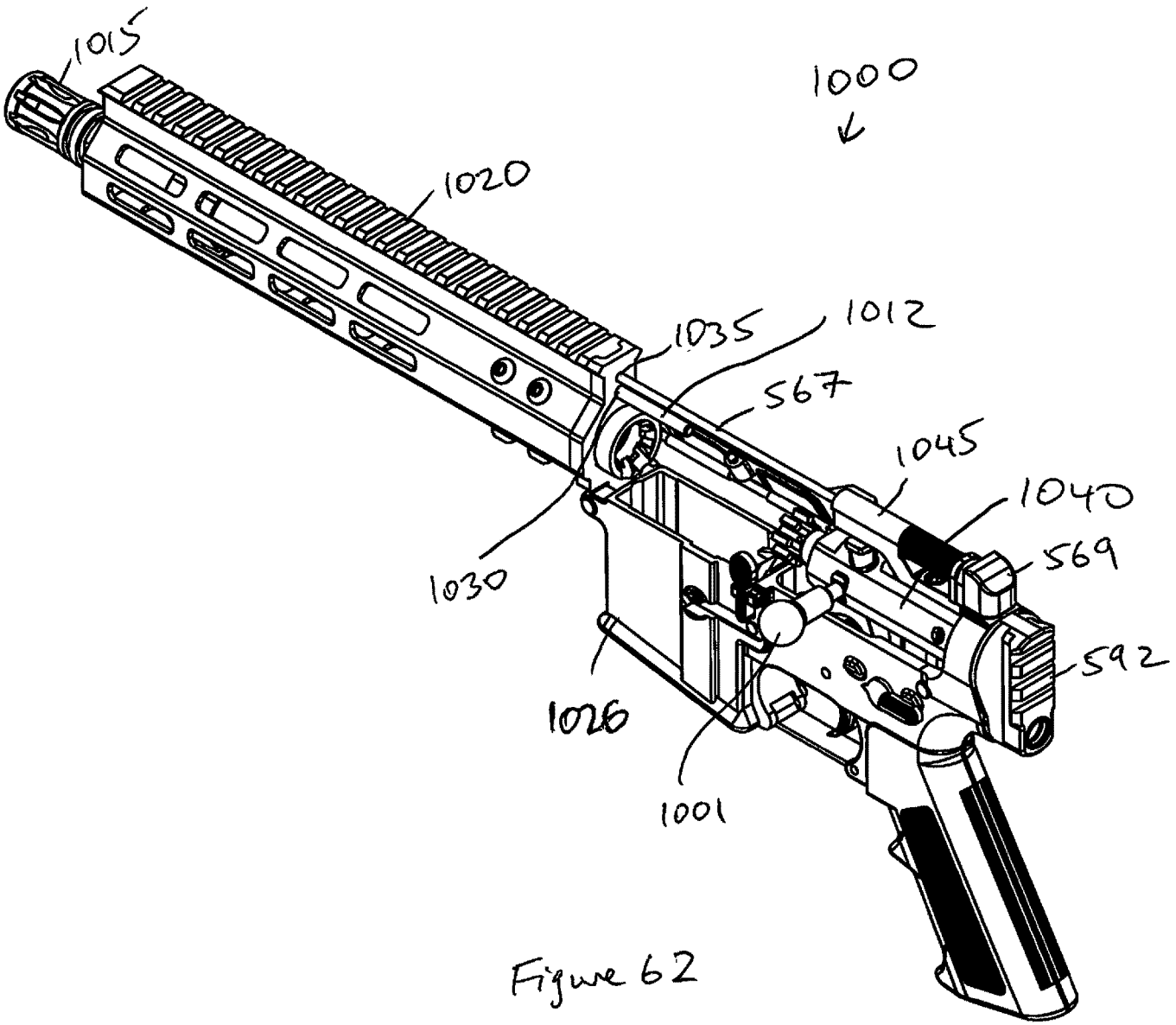

According to some embodiments, the upper receiver 1025 comprises an opening 1030 (shown in FIG. 62) to accommodate the gas tube 512 and an opening 1035 (shown in FIG. 62) to accommodate a recoil spring guide rod 567 described in more detail above and below (shown in FIG. 62).

Figure 65:
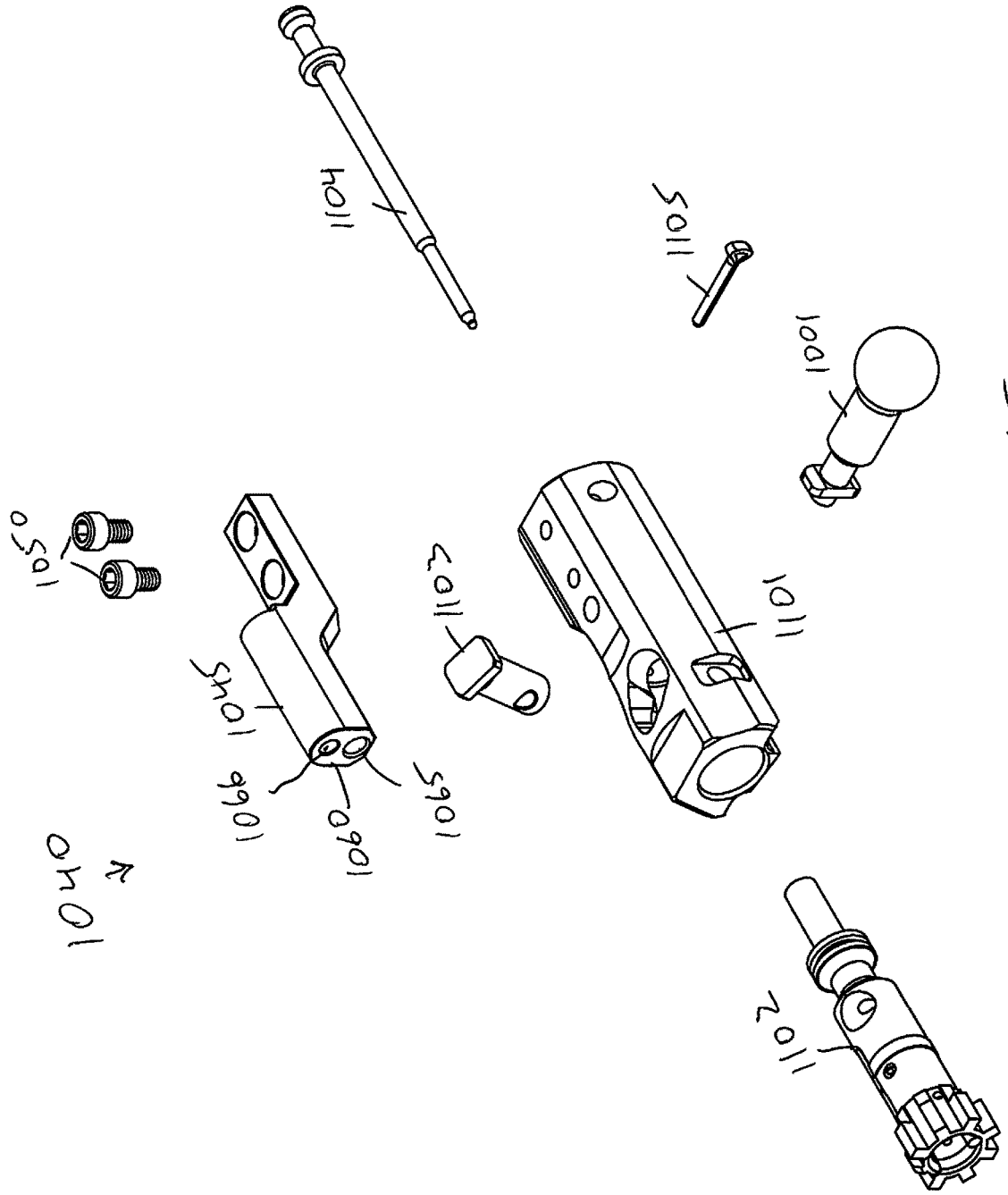
FIG. 65 depicts an exploded view of an exemplary embodiment presently disclosed.

According to some embodiments presently disclosed, the firearm 1000 comprises the bolt carrier assembly 1040 (FIG. 65). According to some embodiments presently disclosed, the bolt carrier assembly 1040 is movable between a first (i.e. locked) position (shown in FIGS. 61, 63 and 79) and a second (i.e. unlocked) position (shown in FIGS. 62, 64 and 80). According to some embodiments presently disclosed, the bolt carrier assembly 1040 is movable between a first (i.e. locked) position (shown in FIGS. 61, 63 and 79) and a second (i.e. unlocked) position (shown in FIGS. 62, 64 and 80) by the side charging handle 1001.

Figure 61:
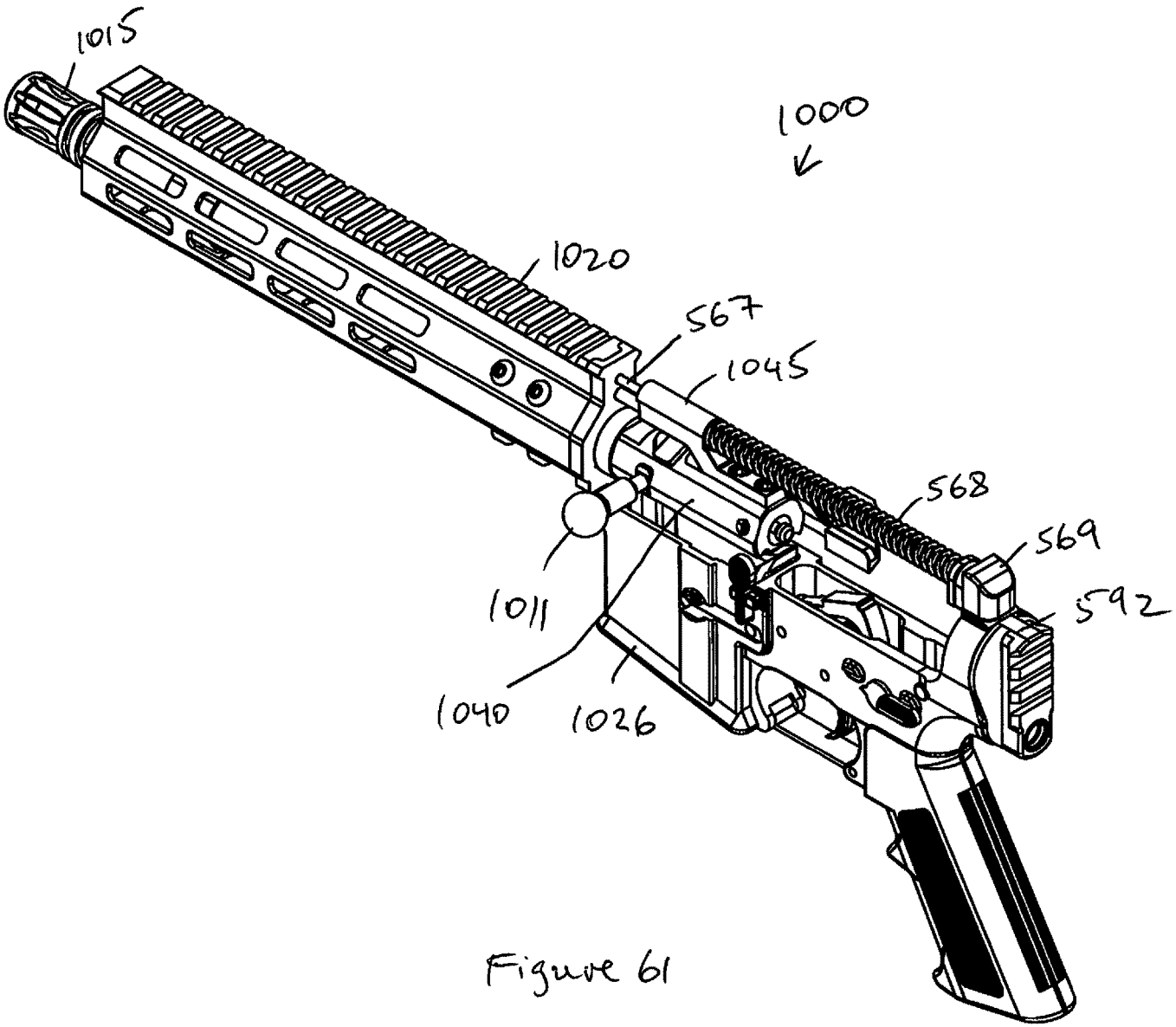
FIGS. 61-64 depict a partially disassembled view of a firearm according to some embodiments presently disclosed.
Figure 79:
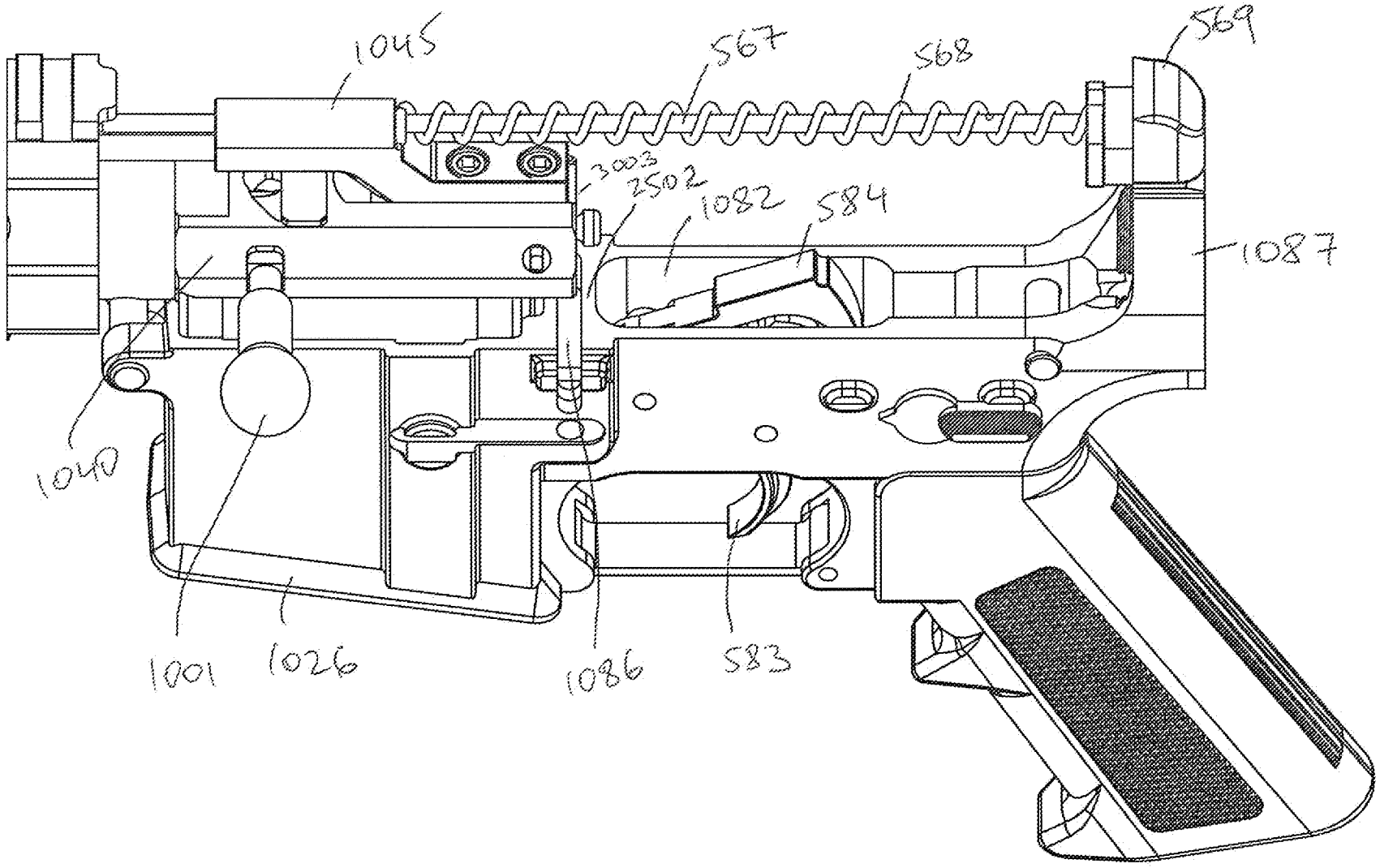
Figure 80:
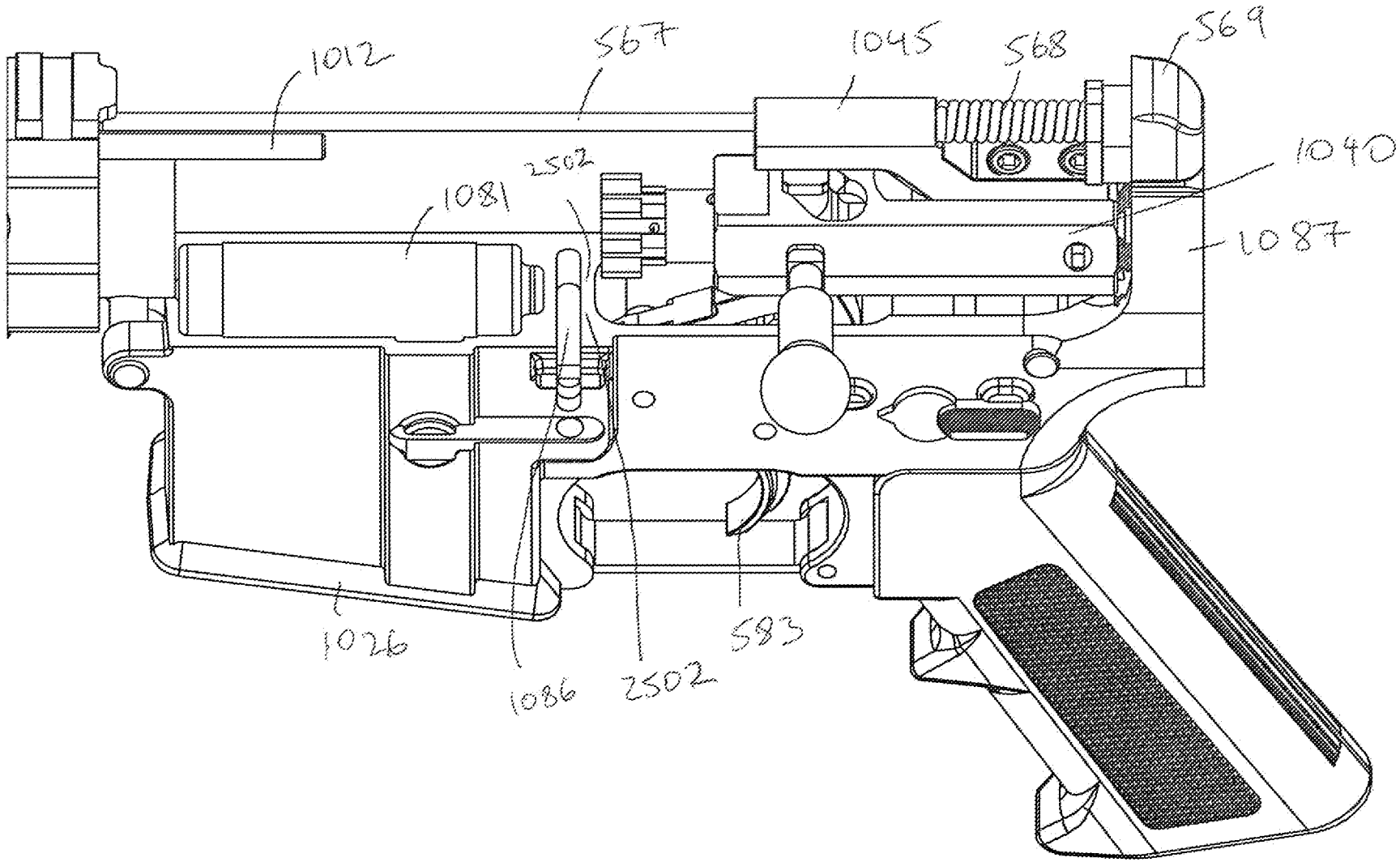

The bolt carrier assembly 1040 comprises a bolt carrier 1101, a bolt assembly 1102, a cam pin 1103, a firing pin 1104, a firing pin retaining pin 1105, a carrier key 1045 (FIG. 65). The bolt carrier assembly 1040 supports and positions the bolt assembly 1102. Referring to FIGS. 61 and 63, the first (locked) position is position in which the bolt carrier assembly 1040 has positioned the bolt assembly 1102 for firing ammunition through the barrel 1015. Referring to FIGS. 61, 63 and 79, according to some embodiments, the first (locked) position is position in which the bolt carrier assembly 1040 locks the bolt assembly 1102 into battery. Referring to FIGS. 61, 63 and 79, according to some embodiments, the first (locked) position is position in which the bolt carrier assembly 1040 is locked into battery. Referring to FIGS. 62, 64 and 80, the second (unlocked) position is any position other than the first (locked) position.

According to some embodiments presently disclosed, the side charging handle 1001 is configured to move the bolt carrier assembly 1040 from the first (locked) position to the second (unlocked) position. According to some embodiments presently disclosed, the firearm 1000 also comprises the forward charging system 30 as described in detail above. According to some embodiments presently disclosed, the firearm 1000 also comprises the forward charging system 30 as described in detail above, wherein the forward charging system 30 and the side charging handle 1001 are configured to move the bolt carrier assembly 1040 from the first (locked) position to the second (unlocked) position.

Referring to FIG. 65, according to some embodiments presently disclosed, the carrier key 1045 is removably coupled with a top portion of the bolt carrier 1101. One or more fasteners 1050 may be used to couple the carrier key 1045 with the bolt carrier assembly 1040. The one or more fasteners 1050 may be a pin, a screw, a set screw, a full dog point set screw, or a dogleg set screw.

According to some embodiments presently disclosed, the carrier key 1045 comprises a surface 1060. According to some embodiments presently disclosed, the surface 1060 comprises an aperture (i.e. opening) 1065 configured to accommodate the gas tube 1012. According to some embodiments presently disclosed, the surface 1060 may also comprise a through aperture 1066 configured to accommodate a recoil spring guide rod 567 described in more detail below. According to some embodiments, the through aperture 1066 is a through-opening.

Figure 66:
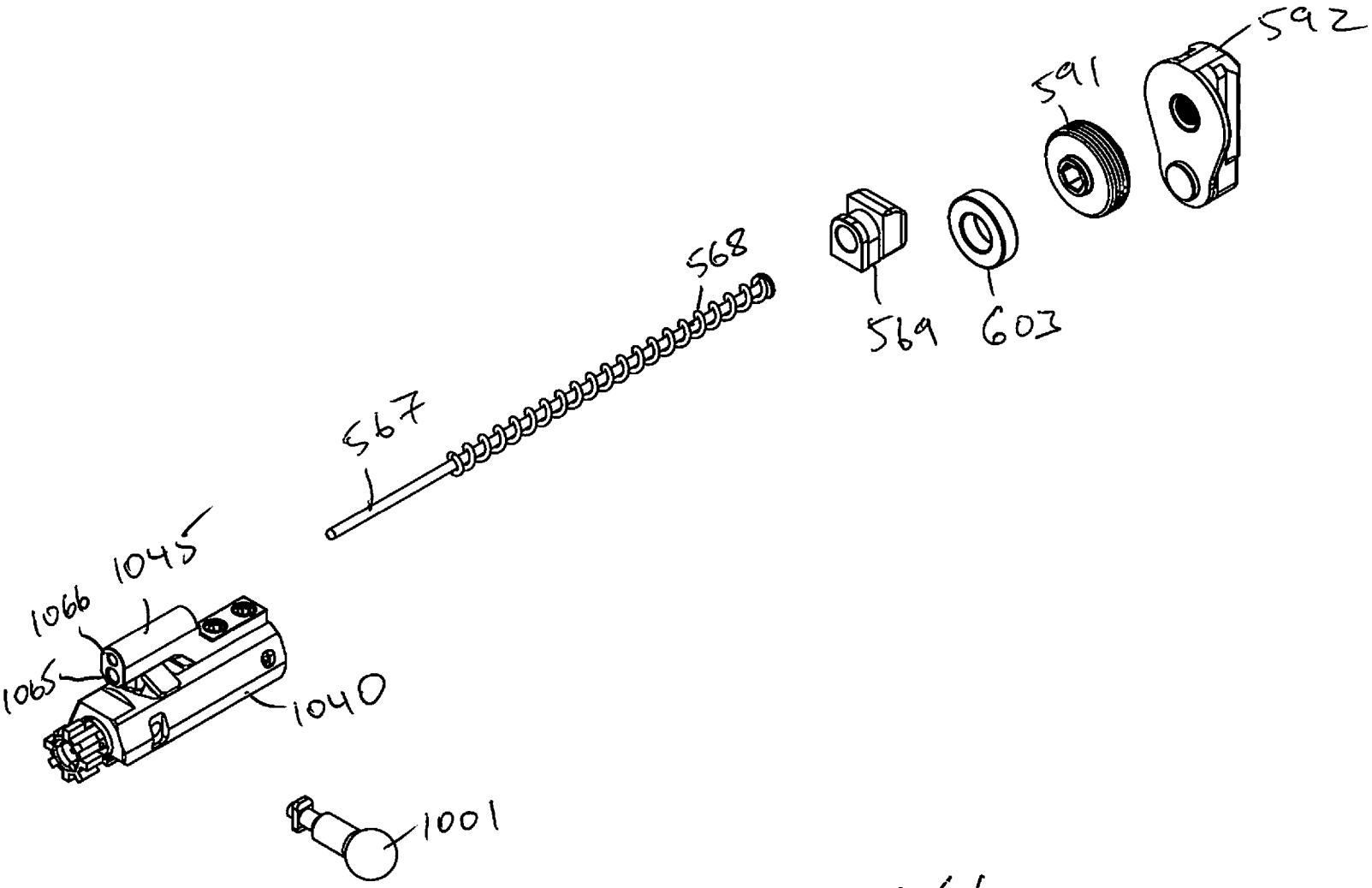
FIGS. 66-67 depict an exploded view of an exemplary embodiment presently disclosed.
Figure 67:
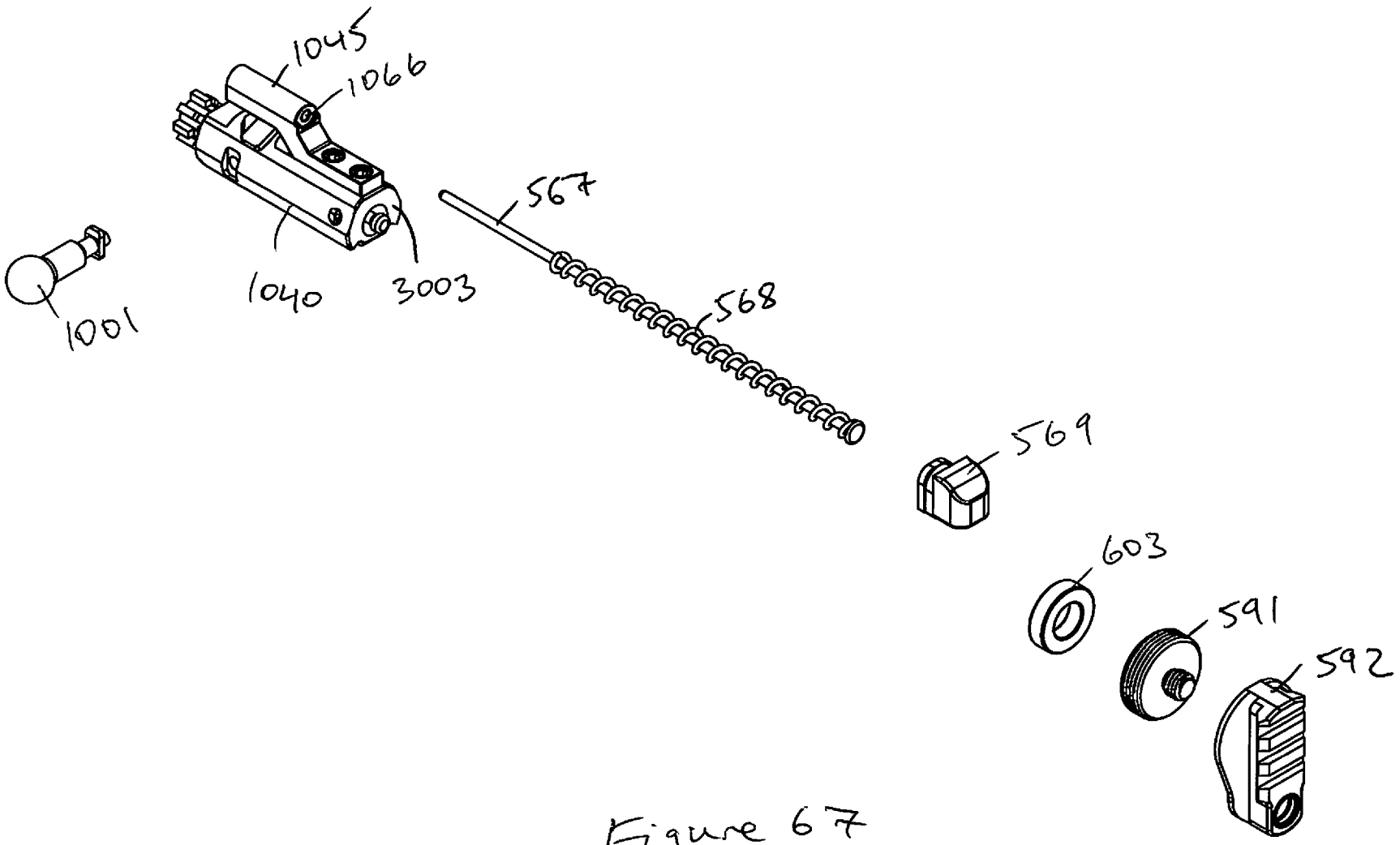

Referring to FIGS. 66-67, according to some embodiments presently disclosed, the firearm 1000 comprises the recoil spring guide rod 567, the recoil spring 568, and the plug 569 as described above and below.

The recoil spring guide rod 567 comprises a forward portion 571 and a rear portion 572. According to some embodiments presently disclosed, the recoil spring guide rod 567's forward portion 571 is configured to go through the aperture 1066 and into the aperture 1035. According to some embodiments presently disclosed, the recoil spring guide rod 567's rear portion 572 is configured to abut the plug 569. According to some embodiments presently disclosed, the recoil spring guide rod 567 passes through the recoil spring 568. According to some embodiments presently disclosed, the recoil spring guide rod 567 passes through the recoil spring 568 and the recoil spring 568 is positioned between the carrier key 1045 and the plug 566.

According to some embodiments presently disclosed, the recoil spring guide rod 567's rear portion 572 has a diameter that is larger than the diameter of the rest of the recoil spring guide rod 567. According to some embodiments presently disclosed, the recoil spring guide rod 567 passes through the recoil spring 568 and the recoil spring 568 is positioned between the carrier key 1045 and larger diameter of the recoil spring guide rod 567's rear portion 572.

According to some embodiments, the bolt carrier assembly 1040 is configured to slide along the recoil spring guide rod 567 between the first (i.e. locked) position and a second (i.e. unlocked) position.

According to some embodiments presently disclosed, the recoil spring guide rod 567 extends across the entire lengths of the upper receiver 1025. According to some embodiments presently disclosed, the recoil spring guide rod 567 extends across the entire lengths of the lower receiver 1026.

According to some embodiments presently disclosed, the recoil spring guide rod 567's rear portion 572 does not extend beyond the upper receiver 1025. According to some embodiments presently disclosed, the recoil spring guide rod 567's rear portion 572 does not extend beyond the lower receiver 1026.

According to some embodiments, the bolt carrier assembly 1040 does not extend beyond the lower receiver 1026 when in the second (i.e. unlocked) position.

According to some embodiments presently disclosed, moving the bolt carrier assembly 1040 towards the second (unlocked) position compresses the recoil spring 568 between the bolt carrier assembly 1040 and the plug 569. According to some embodiments presently disclosed, applying a first force to the bolt carrier assembly 1040 compresses the recoil spring 568 between the bolt carrier assembly 1040 and the plug 569. According to some embodiments presently disclosed, applying a first force to the bolt carrier assembly 1040 compresses the recoil spring 568 between the bolt carrier assembly 1040 and the larger diameter of the recoil spring guide rod 567's rear portion 572. Removing the first force causes the compressed recoil spring 568 to move the bolt carrier assembly 1040 towards the first (locked) position.

According to some embodiments presently disclosed, the upper receiver 1025 comprises an aperture configured to accommodate the bolt carrier assembly 1040, the recoil spring 568, and the recoil spring guide rod 567. According to some embodiments presently disclosed, the plug 569 abuts the upper receiver 1025 to prevent the bolt carrier assembly 1040, the recoil spring 568, and the recoil spring guide rod 567 from being removed from the upper receiver 1025.

Referring to FIGS. 63-64 and 79-80, according to some embodiments presently disclosed, the lower receiver 1026 comprises openings for accepting the internal mechanisms required to operate the firearm. For example, the lower receiver 1026 may comprise an opening 1081 configured to accept an ammunition magazine (not shown) and associated hardware to direct rounds loaded within the magazine into a chamber in an upper receiver 1025. The lower receiver 1026 may also comprise an opening 1082 configured to accommodate a firing mechanism (i.e. standard trigger group). According to some embodiments, the firing mechanism (i.e. standard trigger group) comprises a trigger mechanism 583 and a hammer mechanism 584.

Referring to FIGS. 63-64 and 79-80, according to some embodiments presently disclosed, the lower receiver 1026 comprises a bolt hold open 1085, an opening 1086 configured to accommodate the bolt hold open 1085. Referring to FIGS. 79-80, according to some embodiments presently disclosed, the opening 1082 is separated from the opening 1086 by a wall 2502.

Referring to FIGS. 63-64, according to some embodiments presently disclosed, the lower receiver 1026 comprises an upwardly extending lobe 1087. According to some embodiments, the upwardly extending lobe 1087 is integrally coupled with the lower receiver 1026. According to some embodiments, the upwardly extending lobe 1087 extends from the lower receiver 1026.

According to some embodiments, the upwardly extending lobe 1087 is used to mount a buttstock (not shown) to the lower receiver 1026. According to some embodiments, the upwardly extending lobe 1087 comprises a generally circular threaded through-hole.

According to some embodiments presently disclosed, the upwardly extending lobe 1087 is configured to accommodate a portion of the bolt carrier assembly 1040 when the bolt carrier assembly 1040 is in the second (unlocked)

position. According to some embodiments presently disclosed, the generally circular threaded through-hole is configured to accommodate a portion of the bolt carrier assembly 1040 when the bolt carrier assembly 1040 is in the second (unlocked) position.

Referring to FIGS. 66-67, according to some embodiments presently disclosed, the firearm 1000 comprises the first end plate 591 and the second end plate 592 as described above.

According to some embodiments presently disclosed, the first end plate 591 is configured to be threaded into the generally circular threaded through-hole from the side closest to the opening 1082.

According to some embodiments presently disclosed, the first end plate 591 prevents the bolt carrier assembly 1040 from being positioned beyond the lower receiver 1026 when the bolt carrier assembly is in the second (unlocked) position.

According to some embodiments presently disclosed, the second end plate 592 is coupled with the upwardly extending lobe 1087 with the first end plate 591. According to some embodiments presently disclosed, the second end plate 592 is coupled to the upwardly extending lobe 1087 from the side that is farthest from the opening 1082.

Referring to FIGS. 66-67, according to some embodiments presently disclosed, the firearm 1000 comprises the recoil buffer 603 as described above. The recoil buffer 603 may be positioned to abut the first end plate 591. According to some embodiments presently disclosed, the recoil buffer 603 may be used to prevent prevents the bolt carrier assembly 1040 from being slammed into the first end plate 591 when the bolt carrier assembly 1040 is in the second (unlocked) position.

Referring to FIGS. 66-67, according to some embodiments presently disclosed, the plug 569 (described above) is removably coupled with the upper receiver 1025.

Figure 68:
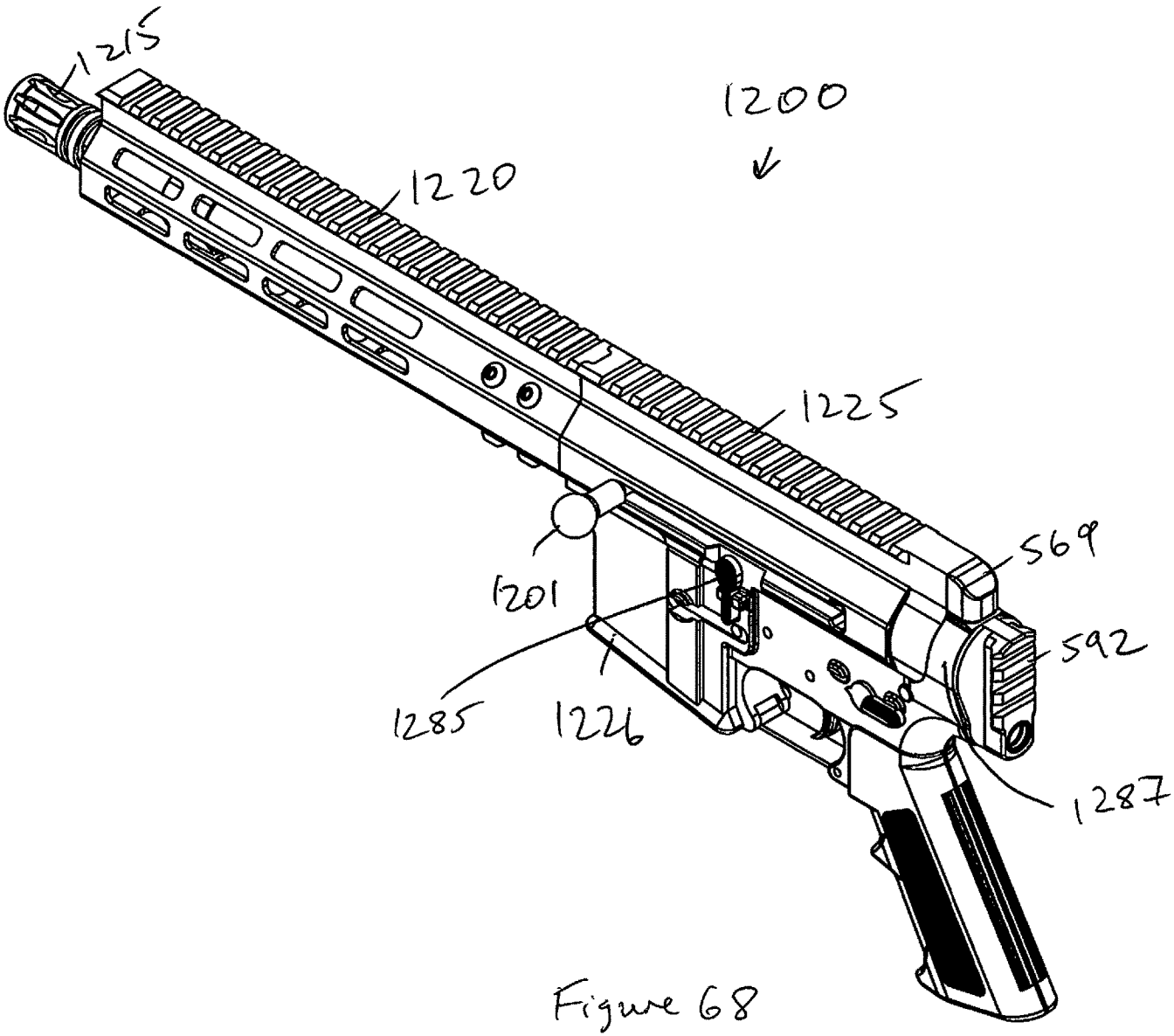
FIGS. 68-69 depict a perspective view of a firearm according to some embodiments presently disclosed.
Figure 69:
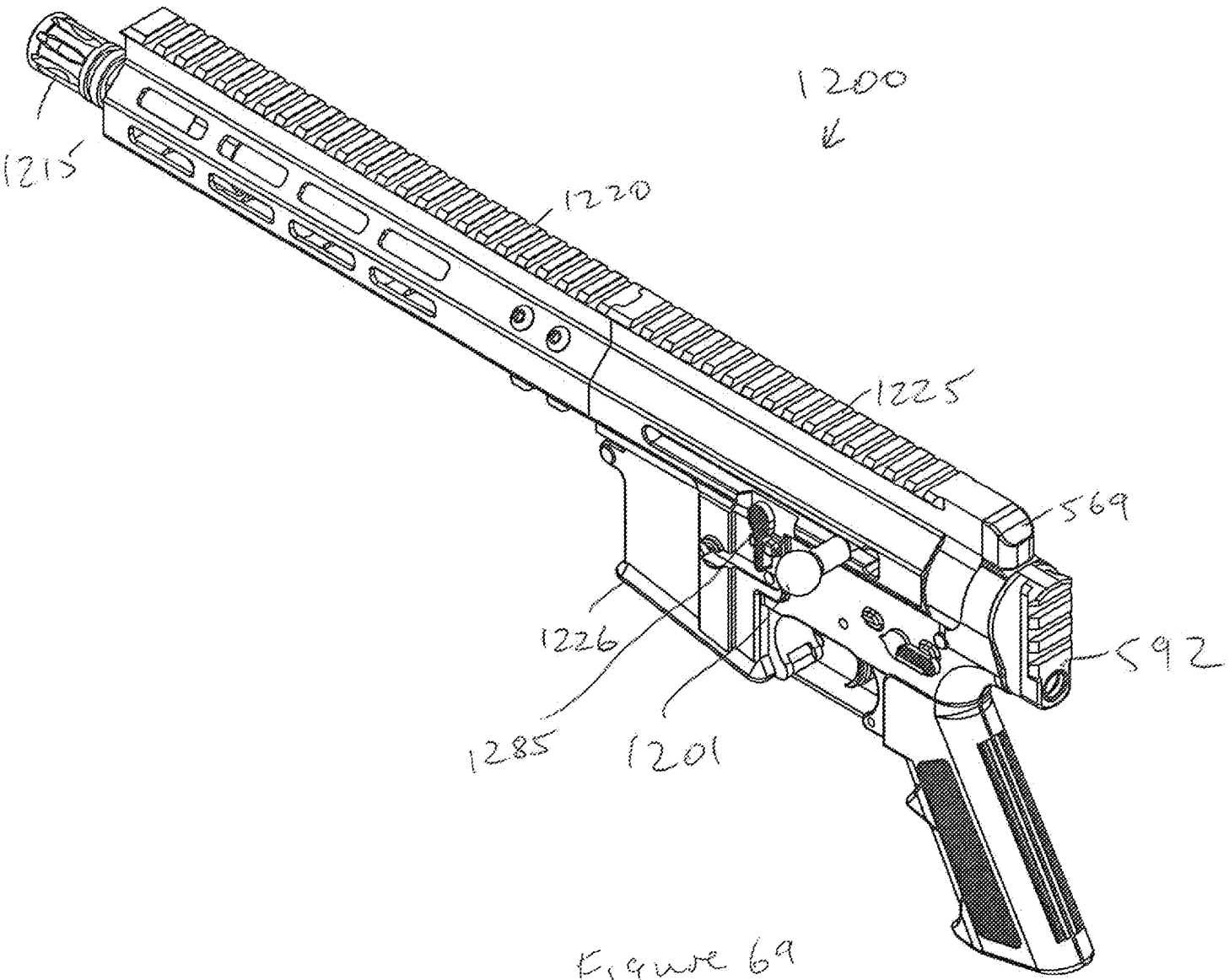

Referring to FIGS. 68-69, a firearm 1200 is shown according to some embodiments presently disclosed. The firearm 1000 may comprise a barrel 1215, a hand guard 1220 and an upper receiver 1225. According to some embodiments, the upper receiver 1025 may be coupled to a lower receiver 1226. According to some embodiments, the hand guard 1220 may removably encircle the barrel 1215. According to some embodiments the upper receiver 1025 may be removably coupled with the barrel 1215. According to some embodiments the upper receiver 1225 may be removably coupled with the hand guard 1220. According to some embodiments the hand guard 1220 may be removably coupled with the barrel 1215.

According to some embodiments presently disclosed, the firearm 1200 uses a blowback system of operation. Blowback is a system of operation for self-loading firearms that obtains energy from the motion of the cartridge case as it is pushed to the rear by expanding gas crated by the ignition of the propellant charge.

Referring to FIGS. 46-48, the firearm 1200 comprises a removable side charging handle 1201 according to some embodiments presently disclosed. According to some embodiments presently disclosed, the firearm 1200 comprises the side charging handle 1201 coupled with the bolt carrier assembly 1240 as described below. According to some embodiments presently disclosed, the side charging handle 1201 protrudes from the upper receiver 1225 (FIGS. 68-69).

According to some embodiments presently disclosed, the firearm 1200 may also comprise the forward charging system 30 as described above.

According to some embodiments presently disclosed, the firearm 1200 comprises a bolt carrier assembly 1240 (FIGS. 70-72 and 81-82). According to some embodiments presently disclosed, the bolt carrier assembly 1240 is movable between a first (i.e. locked) position (shown in FIGS. 68 and 81) and a second (i.e. unlocked) position (shown in FIGS. 69 and 82). According to some embodiments presently disclosed, the bolt carrier assembly 1240 is movable between a first (i.e. locked) position (shown in FIGS. 68 and 81) and a second (i.e. unlocked) position (shown in FIGS. 69 and 82) by the side charging handle 1201.

Figure 70:
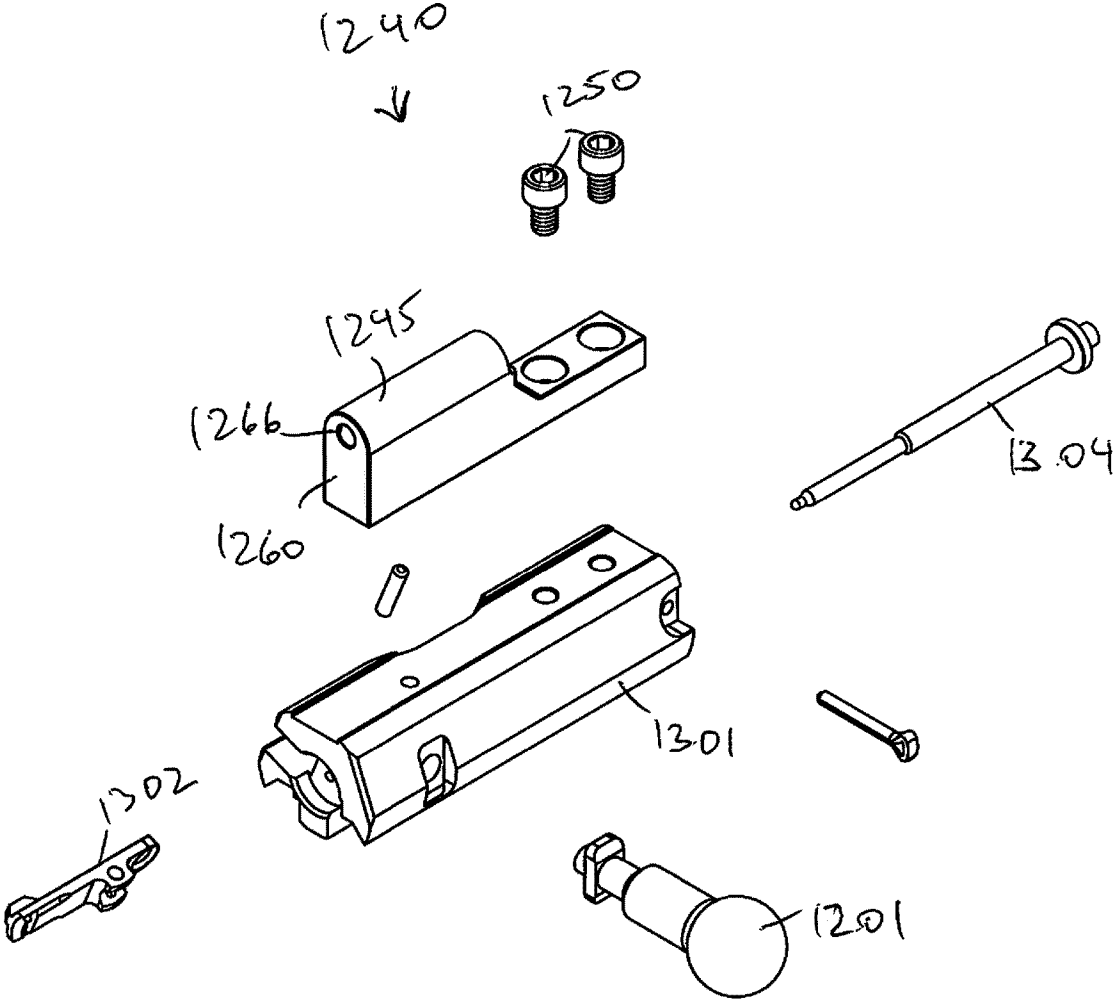
FIG. 70 depicts an exploded view of an exemplary embodiment presently disclosed.
Figure 81:
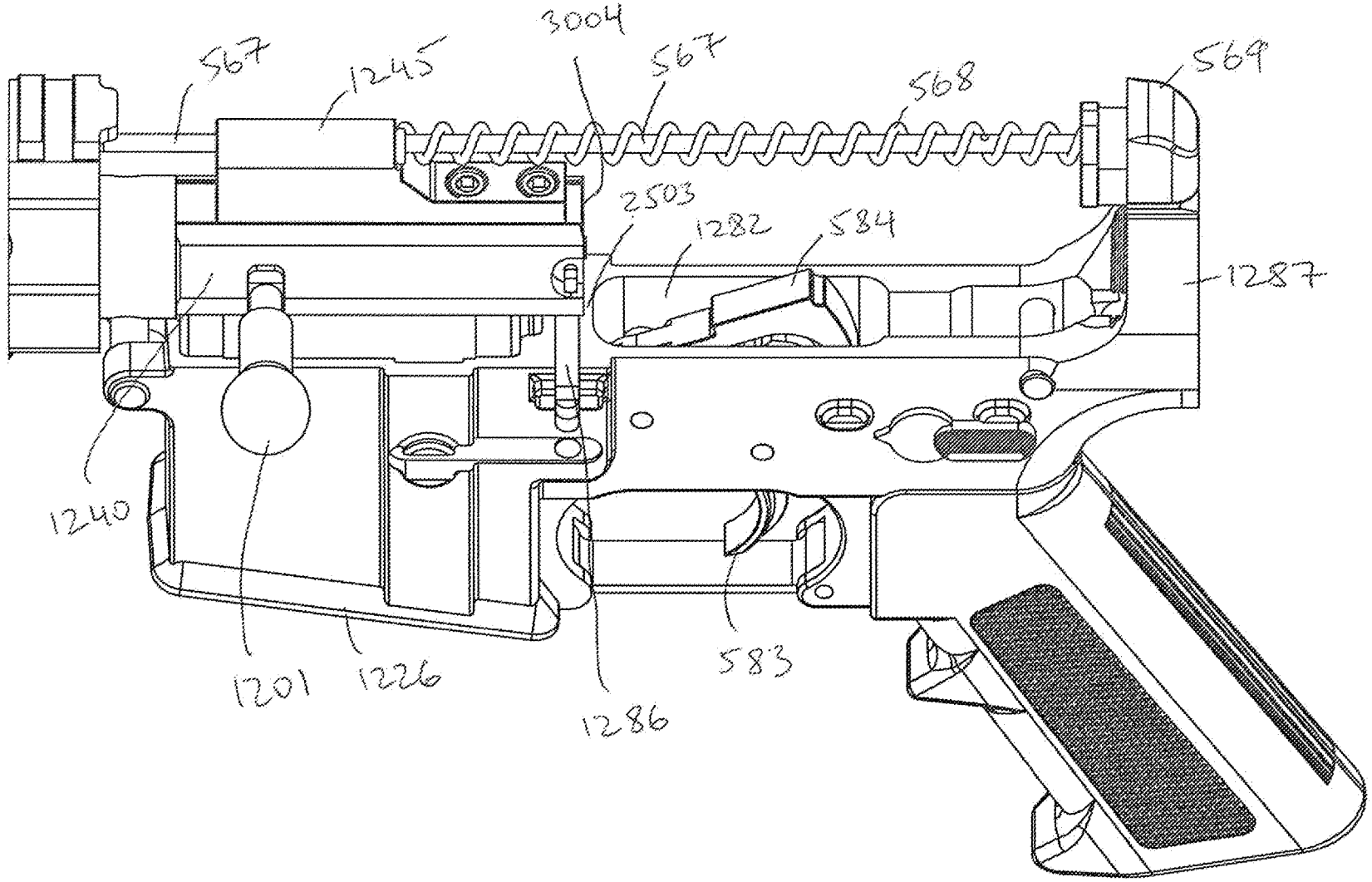

The bolt carrier assembly 1240 comprises a bolt carrier 1301, an extractor 1302, a cam pin 1303, a firing pin 1304, a carrier key 1245 (FIG. 70). The bolt carrier assembly 1240 supports and positions the bolt carrier 1301. The first (locked) position is position in which the bolt carrier assembly 1240 has positioned the bolt carrier 1301 for firing ammunition through the barrel 1215 (FIG. 81). Referring to FIG. 81, according to some embodiments, the first (locked) position is position in which the bolt carrier assembly 1240 is locked into battery. The second (unlocked) position is any position other than the first (locked) position (FIG. 82).

According to some embodiments presently disclosed, the side charging handle 1201 is configured to move the bolt carrier assembly 1240 from the first (locked) position to the second (unlocked) position. According to some embodiments presently disclosed, the firearm 1200 also comprises the forward charging system 30 as described in detail above. According to some embodiments presently disclosed, the firearm 1200 also comprises the forward charging system 30 as described in detail above, wherein the forward charging system 30 and the side charging handle 1201 are configured to move the bolt carrier assembly 1240 from the first (locked) position to the second (unlocked) position.

Figure 82:
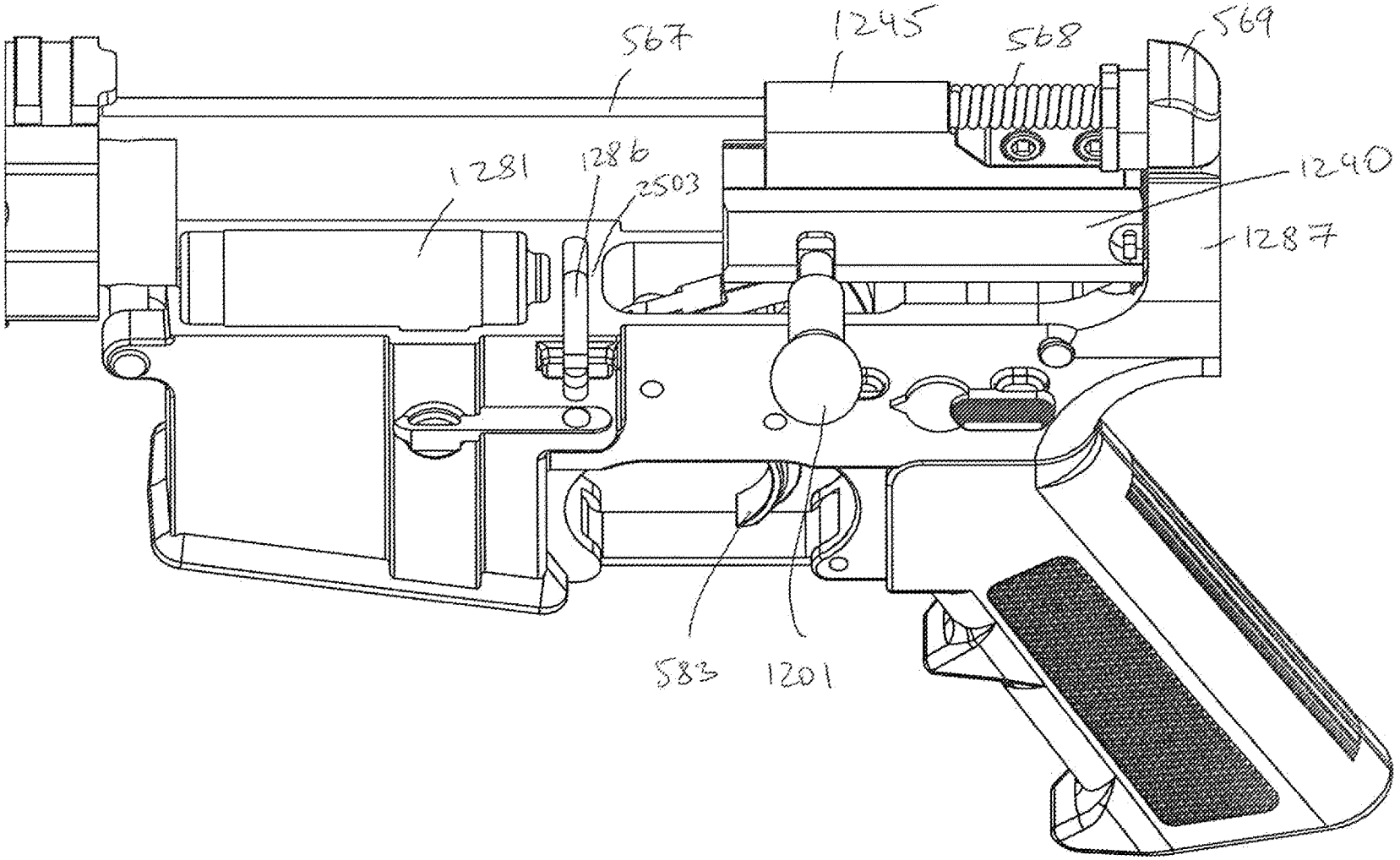

Referring to FIGS. 81-82, according to some embodiments presently disclosed, the lower receiver 1226 comprises openings for accepting the internal mechanisms required to operate the firearm. For example, the lower receiver 1226 may comprise an opening 1281 configured to accept an ammunition magazine (not shown) and associated hardware to direct rounds loaded within the magazine into a chamber in an upper receiver 1225. The lower receiver 1226 may also comprise an opening 1282 configured to accommodate a firing mechanism (i.e. standard trigger group). According to some embodiments, the firing mechanism (i.e. standard trigger group) comprises a trigger mechanism 583 and a hammer mechanism 584.

Referring to FIGS. 68-69 and 81-82, according to some embodiments presently disclosed, the lower receiver 826 comprises a bolt hold open 1285, an opening 1286 configured to accommodate the bolt hold open 1285. Referring to FIGS. 81-82, according to some embodiments presently disclosed, the opening 1282 is separated from the opening 1286 by a wall 2503.

Referring to FIG. 70, according to some embodiments presently disclosed, the carrier key 1245 is removably coupled with a top portion of the bolt carrier 1301. One or more fasteners 1250 may be used to couple the carrier key 1245 with the bolt carrier assembly 240. The one or more fasteners 1250 may be a pin, a screw, a set screw, a full dog point set screw, or a dogleg set screw.

According to some embodiments presently disclosed, the carrier key 1245 comprises a surface 1260. According to some embodiments presently disclosed, the surface 1260 comprises a through aperture 1266 configured to accommodate a recoil spring guide rod 567 described in more detail below. According to some embodiments, the through aperture 1266 is a through-opening.

Figure 71:
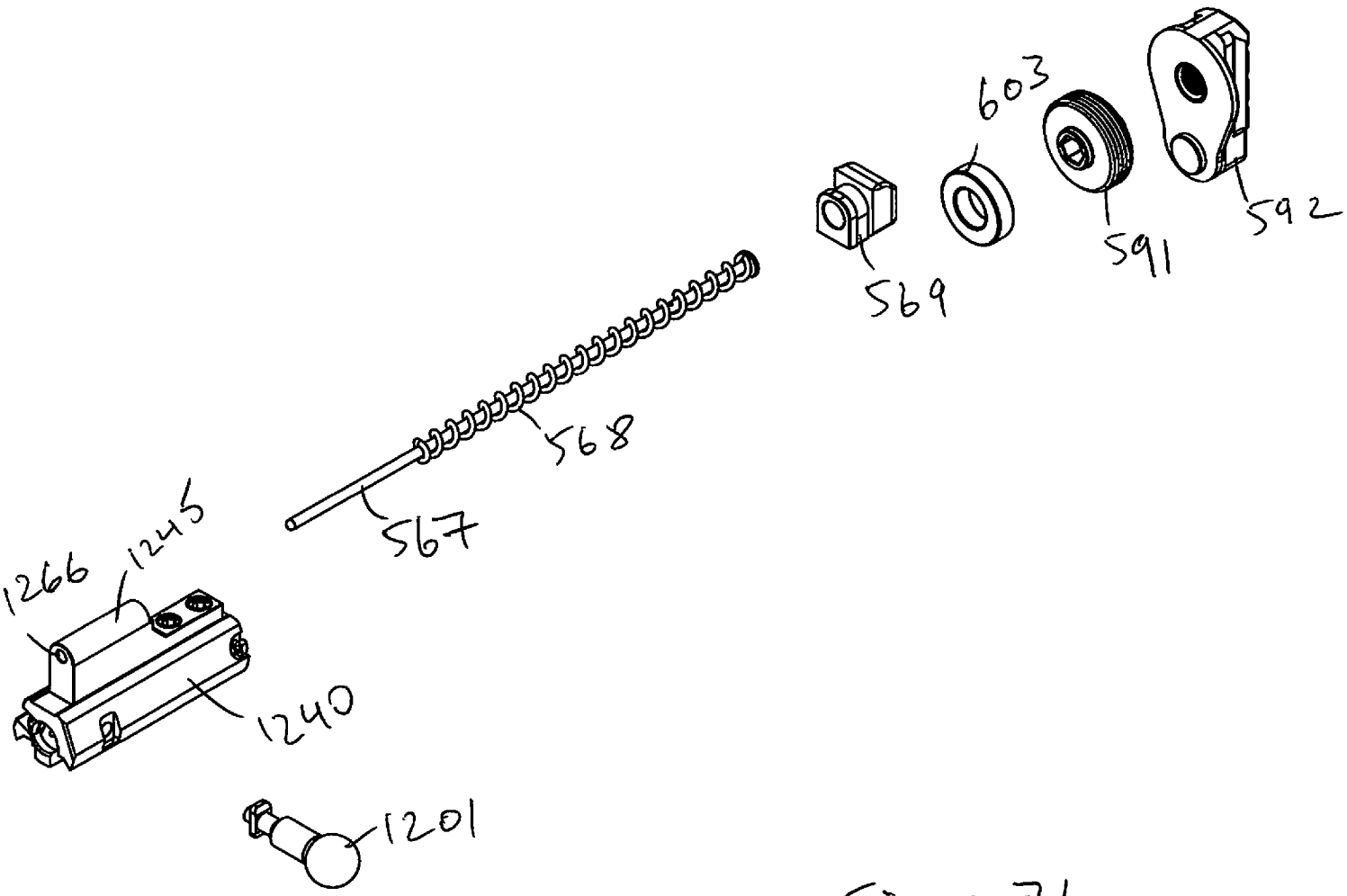
FIGS. 71-72 depict an exploded view of an exemplary embodiment presently disclosed.
Figure 72:
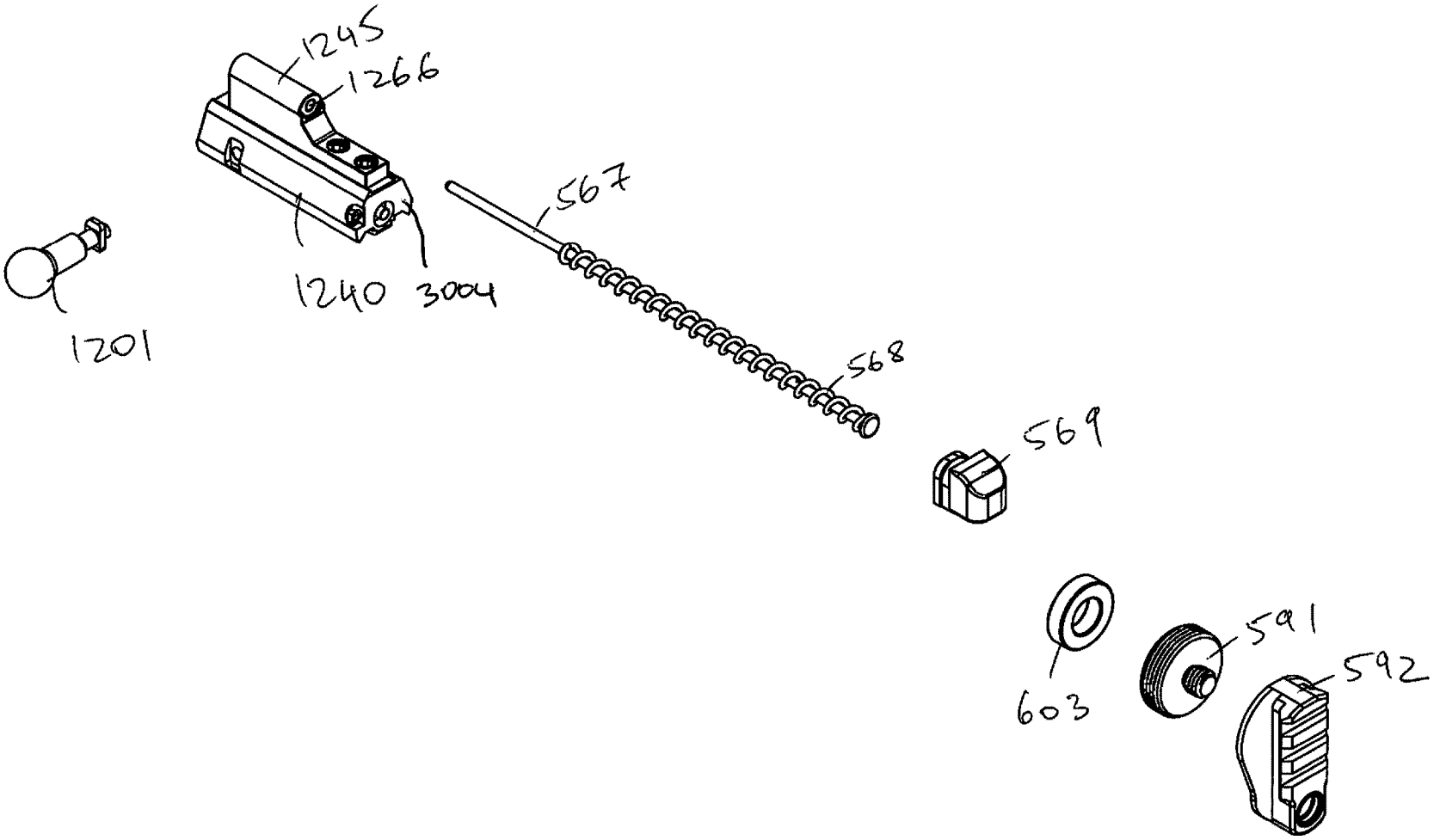

Referring to FIGS. 71-72, according to some embodiments presently disclosed, the firearm 1200 comprises the recoil spring guide rod 567, the recoil spring 568, and the plug 569 as described in detail above and below.

According to some embodiments presently disclosed, the recoil spring guide rod 567's forward portion 571 is configured to go through the aperture 1266 and into the aperture in the upper receiver 1225. According to some embodiments presently disclosed, the recoil spring guide rod 567's rear portion 572 is configured to abut the plug 569. According to some embodiments presently disclosed, the recoil spring guide rod 567 passes through the recoil spring 568. According to some embodiments presently disclosed, the recoil spring guide rod 567 passes through the recoil spring 568 and the recoil spring 568 is positioned between the carrier key 1245 and the plug 566.

According to some embodiments presently disclosed, the recoil spring guide rod 567's rear portion 572 has a diameter that is larger than the diameter of the rest of the recoil spring guide rod 567. According to some embodiments presently disclosed, the recoil spring guide rod 567 passes through the recoil spring 568 and the recoil spring 568 is positioned between the carrier key 545 and larger diameter of the recoil spring guide rod 567's rear portion 572.

According to some embodiments, the bolt carrier assembly 1240 is configured to slide along the recoil spring guide rod 567 between the first (i.e. locked) position and a second (i.e. unlocked) position.

According to some embodiments presently disclosed, the recoil spring guide rod 567's forward portion 571 always resides in the aperture of the upper receiver 1225.

According to some embodiments presently disclosed, the recoil spring guide rod 567's rear portion 572 does not extend beyond the upper receiver 1225. According to some embodiments presently disclosed, the recoil spring guide rod 567's rear portion 572 does not extend beyond the lower receiver 1226.

According to some embodiments, the bolt carrier assembly 1240 does not extend beyond the lower receiver 1226 when in the second (i.e. unlocked) position.

According to some embodiments presently disclosed, moving the bolt carrier assembly 1240 towards the second (unlocked) position compresses the recoil spring 568 between the bolt carrier assembly 1240 and the plug 569. According to some embodiments presently disclosed, applying a first force to the bolt carrier assembly 1240 compresses the recoil spring 568 between the bolt carrier assembly 1240 and the plug 569. According to some embodiments presently disclosed, applying a first force to the bolt carrier assembly 1240 compresses the recoil spring 568 between the bolt carrier assembly 1240 and the larger diameter of the recoil spring guide rod 567's rear portion 572. Removing the first force causes the compressed recoil spring 568 to move the bolt carrier assembly 1240 towards the first (locked) position.

According to some embodiments presently disclosed, the upper receiver 1225 comprises an aperture configured to accommodate the bolt carrier assembly 1240, the recoil spring 568, and the recoil spring guide rod 567. According to some embodiments presently disclosed, the plug 569 abuts the upper receiver 1225 to prevent the bolt carrier assembly 1240, the recoil spring 568, and the recoil spring guide rod 567 from being removed from the upper receiver 1225.

Referring to FIGS. 68-69 and 81-82, according to some embodiments presently disclosed, the lower receiver 1226 comprises an upwardly extending lobe 1287. According to some embodiments, the upwardly extending lobe 1287 is integrally coupled with the lower receiver 1226. According to some embodiments, the upwardly extending lobe 1287 extends from the lower receiver 1226.

According to some embodiments, the upwardly extending lobe 1287 is used to mount a buttstock (not shown) to the lower receiver 1226. According to some embodiments, the upwardly extending lobe 1287 comprises a generally circular threaded through-hole.

According to some embodiments presently disclosed, the upwardly extending lobe 1287 is configured to accommodate a portion of the bolt carrier assembly 1240 when the bolt carrier assembly 1240 is in the second (unlocked) position. According to some embodiments presently disclosed, the generally circular threaded through-hole is configured to accommodate a portion of the bolt carrier assembly 1240 when the bolt carrier assembly 1240 is in the second (unlocked) position.

Referring to FIGS. 71-72, according to some embodiments presently disclosed, the firearm 1200 comprises the first end plate 591 and the second end plate 592 as described in more detail above.

According to some embodiments presently disclosed, the first end plate 591 prevents the bolt carrier assembly 1240 from being positioned beyond the lower receiver 1226 when the bolt carrier assembly is in the second (unlocked) position.

According to some embodiments presently disclosed, the second end plate 592 is coupled with the upwardly extending lobe 1287 with the first end plate 591.

Referring to FIGS. 71-72, according to some embodiments presently disclosed, the firearm 1200 comprises the recoil buffer 603 as described above.

Referring to FIGS. 52-53, according to some embodiments presently disclosed, the firearm 1200 comprises the plug 569 removably coupled with the upper receiver 1225.

Figure 75:
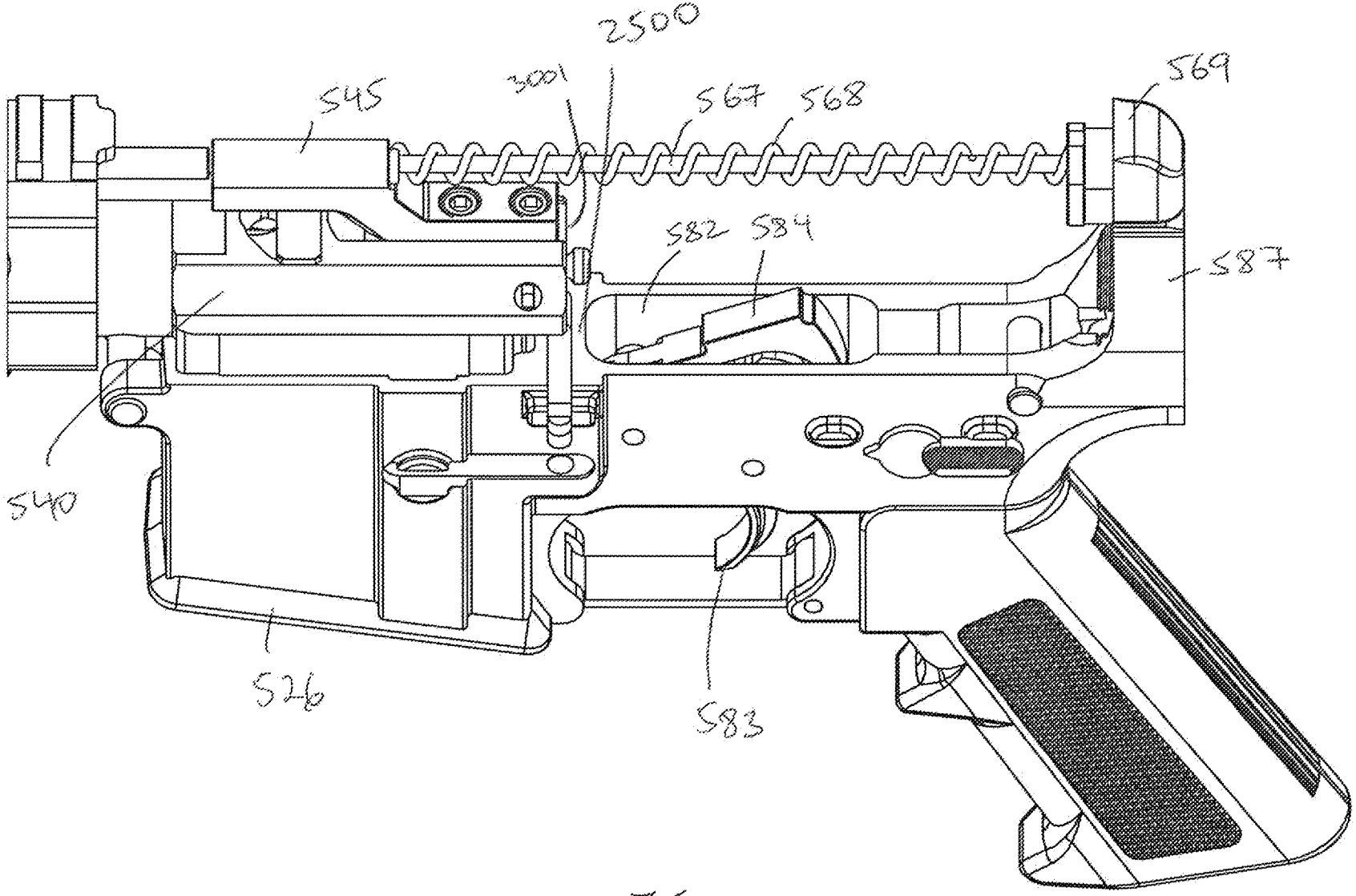
Figure 76:
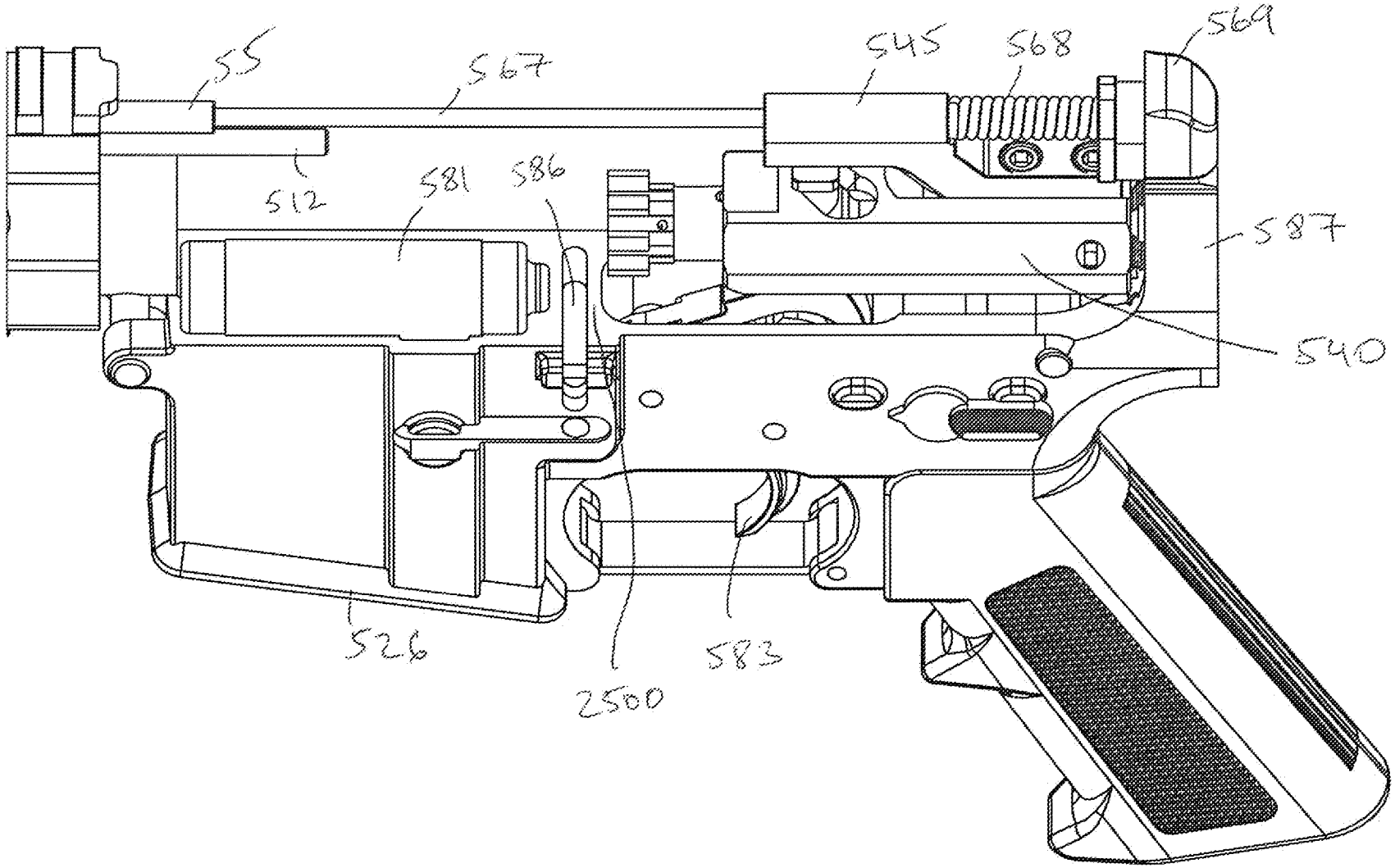
Figure 77:
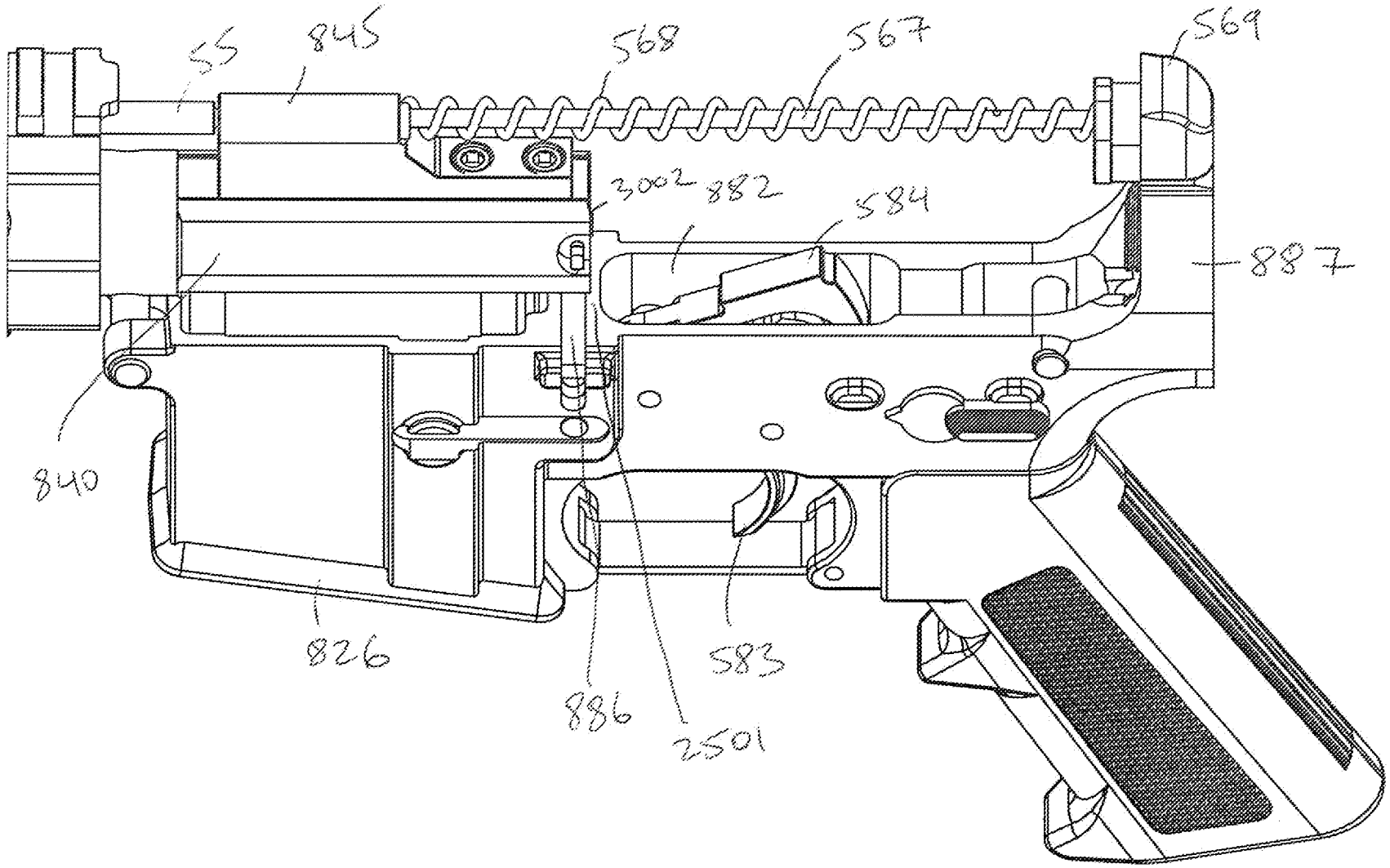

Referring to FIGS. 29, 73 and 75, according to some embodiments presently disclosed, the bolt carrier assembly 540 comprises a rear surface 3001. According to some embodiments presently disclosed, the rear surface 3001 of the bolt carrier assembly 540 does not extend beyond the wall 2500 and into the opening 582 when the bolt carrier assembly 540 is in the first (locked) position. According to some embodiments presently disclosed, the rear surface 3001 of the bolt carrier assembly 540 does not extend beyond the wall 2500 when the bolt carrier assembly 540 is in the first (locked) position. According to some embodiments presently disclosed, the rear surface 3001 of the bolt carrier assembly 540 is positioned between the opening 586 and the opening 582 when the bolt carrier assembly 540 is in the first (locked) position. According to some embodiments presently disclosed, the rear surface 3001 of the bolt carrier assembly 540 does not extend into the opening 582 when the bolt carrier assembly 540 is in the first (locked) position.

According to some embodiments presently disclosed, the rear surface 3001 of the bolt carrier assembly 540 does not extend beyond the upwardly extending lobe 587 when the bolt carrier assembly 540 is in the second (i.e. unlocked) position. According to some embodiments presently disclosed, the rear surface 3001 of the bolt carrier assembly 540 does not extend beyond the upwardly extending lobe 587 when the bolt carrier assembly 540 is at furthest possible position away from the first (locked) position. According to some embodiments presently disclosed, the rear surface 3001 of the bolt carrier assembly 540 extends into the upwardly extending lobe 587 but does not extend beyond the lower receiver 526 when the bolt carrier assembly 540 is in the second (i.e. unlocked) position. According to some embodiments presently disclosed, the rear surface 3001 of the bolt carrier assembly 540 extends into the upwardly extending lobe 587 but does not extend beyond the lower receiver 526 when the bolt carrier assembly 540 is at furthest possible position away from the first (locked) position. According to some embodiments presently disclosed, the rear surface 3001 of the bolt carrier assembly 540 does not extend beyond the lower receiver 526 when the bolt carrier assembly 540 is in the second (i.e. unlocked) position. According to some embodiments presently disclosed, the rear surface 3001 of the bolt carrier assembly 540 does not extend beyond the lower receiver 526 when the bolt carrier assembly 540 is at furthest possible position away from the first (locked) position.

Referring to FIGS. 52 and 77, according to some embodiments presently disclosed, the bolt carrier assembly 840 comprises a rear surface 3002. According to some embodiments presently disclosed, the rear surface 3002 of the bolt carrier assembly 840 does not extend beyond the wall 2501 and into the opening 882 when the bolt carrier assembly 840 is in the first (locked) position. According to some embodiments presently disclosed, the rear surface 3002 of the bolt carrier assembly 840 does not extend beyond the wall 2501 when the bolt carrier assembly 840 is in the first (locked) position. According to some embodiments presently disclosed, the rear surface 3002 of the bolt carrier assembly 840 is positioned between the opening 886 and the opening 882 when the bolt carrier assembly 840 is in the first (locked) position. According to some embodiments presently disclosed, the rear surface 3002 of the bolt carrier assembly 840 does not extend into the opening 882 when the bolt carrier assembly 840 is in the first (locked) position.

According to some embodiments presently disclosed, the rear surface 3002 of the bolt carrier assembly 840 does not extend beyond the upwardly extending lobe 887 when the bolt carrier assembly 840 is in the second (i.e. unlocked) position. According to some embodiments presently disclosed, the rear surface 3002 of the bolt carrier assembly 840 does not extend beyond the upwardly extending lobe 887 when the bolt carrier assembly 840 is at furthest possible position away from the first (locked) position. According to some embodiments presently disclosed, the rear surface 3002 of the bolt carrier assembly 840 extends into the upwardly extending lobe 887 but does not extend beyond the lower receiver 826 when the bolt carrier assembly 840 is in the second (i.e. unlocked) position. According to some embodiments presently disclosed, the rear surface 3002 of the bolt carrier assembly 840 extends into the upwardly extending lobe 887 but does not extend beyond the lower receiver 826 when the bolt carrier assembly 840 is at furthest possible position away from the first (locked) position. According to some embodiments presently disclosed, the rear surface 3002 of the bolt carrier assembly 840 does not extend beyond the lower receiver 826 when the bolt carrier assembly 840 is in the second (i.e. unlocked) position. According to some embodiments presently disclosed, the rear surface 3002 of the bolt carrier assembly 840 does not extend beyond the lower receiver 826 when the bolt carrier assembly 840 is at furthest possible position away from the first (locked) position.

Referring to FIGS. 67 and 79, according to some embodiments presently disclosed, the bolt carrier assembly 1040 comprises a rear surface 3003. According to some embodiments presently disclosed, the rear surface 3003 of the bolt carrier assembly 1040 does not extend beyond the wall 2502 and into the opening 1082 when the bolt carrier assembly 1040 is in the first (locked) position. According to some embodiments presently disclosed, the rear surface 3003 of the bolt carrier assembly 1040 does not extend beyond the wall 2502 when the bolt carrier assembly 1040 is in the first (locked) position. According to some embodiments presently disclosed, the rear surface 3003 of the bolt carrier assembly 1040 is positioned between the opening 1086 and the opening 1082 when the bolt carrier assembly 1040 is in the first (locked) position. According to some embodiments presently disclosed, the rear surface 3003 of the bolt carrier assembly 1040 does not extend into the opening 1082 when the bolt carrier assembly 1040 is in the first (locked) position.

According to some embodiments presently disclosed, the rear surface 3003 of the bolt carrier assembly 1040 does not extend beyond the upwardly extending lobe 1087 when the bolt carrier assembly 1040 is in the second (i.e. unlocked) position. According to some embodiments presently disclosed, the rear surface 3003 of the bolt carrier assembly 1040 does not extend beyond the upwardly extending lobe 1087 when the bolt carrier assembly 1040 is at furthest possible position away from the first (locked) position. According to some embodiments presently disclosed, the rear surface 3003 of the bolt carrier assembly 1040 extends into the upwardly extending lobe 1087 but does not extend beyond the lower receiver 1026 when the bolt carrier assembly 1040 is in the second (i.e. unlocked) position. According to some embodiments presently disclosed, the rear surface 3003 of the bolt carrier assembly 1040 extends into the upwardly extending lobe 1087 but does not extend beyond the lower receiver 1026 when the bolt carrier assembly 1040 is at furthest possible position away from the first (locked) position. According to some embodiments presently disclosed, the rear surface 3003 of the bolt carrier assembly 1040 does not extend beyond the lower receiver 1026 when the bolt carrier assembly 1040 is in the second (i.e. unlocked) position. According to some embodiments presently disclosed, the rear surface 3003 of the bolt carrier assembly 1040 does not extend beyond the lower receiver 1026 when the bolt carrier assembly 1040 is at furthest possible position away from the first (locked) position.

Referring to FIGS. 72 and 81, according to some embodiments presently disclosed, the bolt carrier assembly 1240 comprises a rear surface 3004. According to some embodiments presently disclosed, the rear surface 3004 of the bolt carrier assembly 1240 does not extend beyond the wall 2503 and into the opening 1282 when the bolt carrier assembly 1240 is in the first (locked) position. According to some embodiments presently disclosed, the rear surface 3004 of the bolt carrier assembly 1240 does not extend beyond the wall 2503 when the bolt carrier assembly 1240 is in the first (locked) position. According to some embodiments presently disclosed, the rear surface 3004 of the bolt carrier assembly 1240 is positioned between the opening 1286 and the opening 1282 when the bolt carrier assembly 1240 is in the first (locked) position. According to some embodiments presently disclosed, the rear surface 3004 of the bolt carrier assembly 1240 does not extend into the opening 1282 when the bolt carrier assembly 1240 is in the first (locked) position.

According to some embodiments presently disclosed, the rear surface 3004 of the bolt carrier assembly 1240 does not extend beyond the upwardly extending lobe 1287 when the bolt carrier assembly 1240 is in the second (i.e. unlocked) position. According to some embodiments presently disclosed, the rear surface 3004 of the bolt carrier assembly 1240 does not extend beyond the upwardly extending lobe 1287 when the bolt carrier assembly 1240 is at furthest possible position away from the first (locked) position. According to some embodiments presently disclosed, the rear surface 3004 of the bolt carrier assembly 1240 extends into the upwardly extending lobe 1287 but does not extend beyond the lower receiver 1226 when the bolt carrier assembly 1240 is in the second (i.e. unlocked) position. According to some embodiments presently disclosed, the rear surface 3004 of the bolt carrier assembly 1240 extends into the upwardly extending lobe 1287 but does not extend beyond the lower receiver 1226 when the bolt carrier assembly 1240 is at furthest possible position away from the first (locked) position. According to some embodiments presently disclosed, the rear surface 3004 of the bolt carrier assembly 1240 does not extend beyond the lower receiver 1226 when the bolt carrier assembly 1240 is in the second (i.e. unlocked) position. According to some embodiments presently disclosed, the rear surface 3004 of the bolt carrier assembly 1240 does not extend beyond the lower receiver 1226 when the bolt carrier assembly 1240 is at furthest possible position away from the first (locked) position.

According to some embodiments, the bolt carrier assemblies (540, 840, 1040, 1240) described presently are movable from the first (locked) position to the second (unlocked) position. According to some embodiments presently disclosed, the bolt carrier assemblies (540, 840, 1040, 1240) described presently are movable away the first (locked) position to another position. The another position is the furthest possible position away from the first (locked) position that the bolt carrier assemblies (540, 840, 1040, 1240) can be moved to. According to some embodiments presently disclosed, the furthest possible position away from the first (locked) position is dependent on the recoil spring 568. According to some embodiments presently disclosed, the furthest possible position away from the first (locked) position is dependent on a compression property of the recoil spring 568. According to some embodiments presently disclosed, the furthest possible position away from the first (locked) position is dependent on the plug 569. According to some embodiments presently disclosed, the bolt carrier assemblies (540, 840, 1040, 1240) are prevented from moving past the furthest possible position away from the first (locked) position by the plug 569. According to some embodiments presently disclosed, the bolt carrier assemblies (540, 840, 1040, 1240) are prevented from moving past the furthest possible position away from the first (locked) position by the recoil spring 568.

According to some embodiments presently disclosed, the bolt carrier assemblies (540, 840, 1040, 1240) may move to the furthest possible position away from the first (locked) position while firing a firearm. According to some embodiments presently disclosed, the bolt carrier assemblies (540, 840, 1040, 1240) may move to the furthest possible position away from the first (locked) position using a side charging handle 1001, 1201 as described herein. According to some embodiments presently disclosed, the bolt carrier assemblies (540, 840, 1040, 1240) may move to the furthest possible position away from the first (locked) position using the forward charging system 30 as described above Referring to FIG. 51, according to some embodiments presently disclosed the recoil spring guide rod 567 comprises an aperture 1800. The aperture 1800 may be configured to accommodate a portion of a first tool 1805 shown in FIGS. 83-90. According to some embodiments presently disclosed, the aperture 1800 is a through hole passing through the rod 567. According to some embodiments presently disclosed, the aperture 1800 is an indentation in the rod 567.

Figure 85:
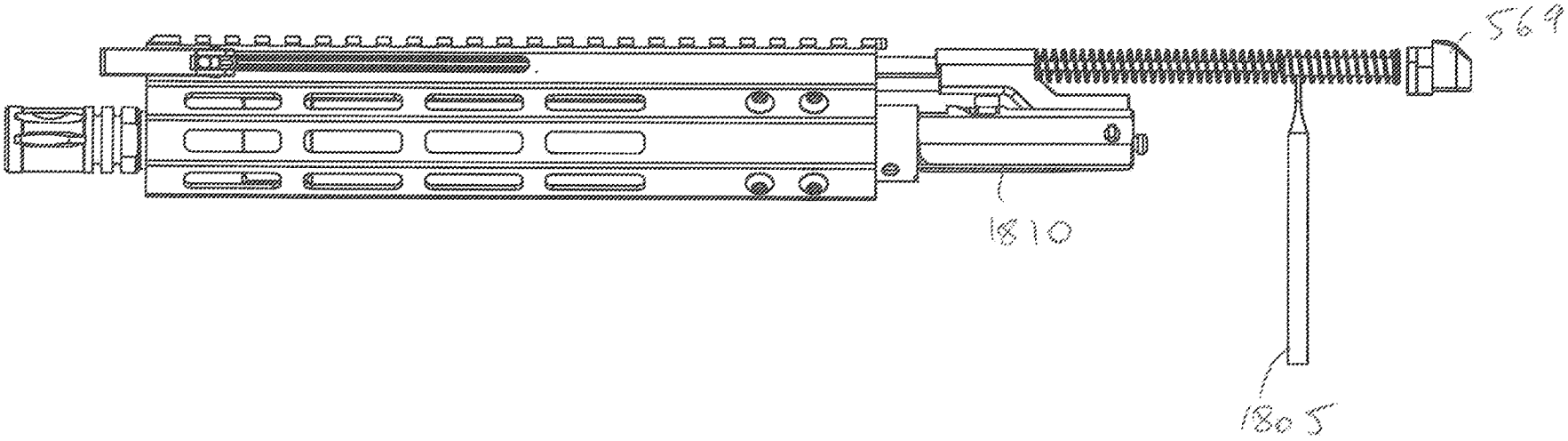
Figure 86:
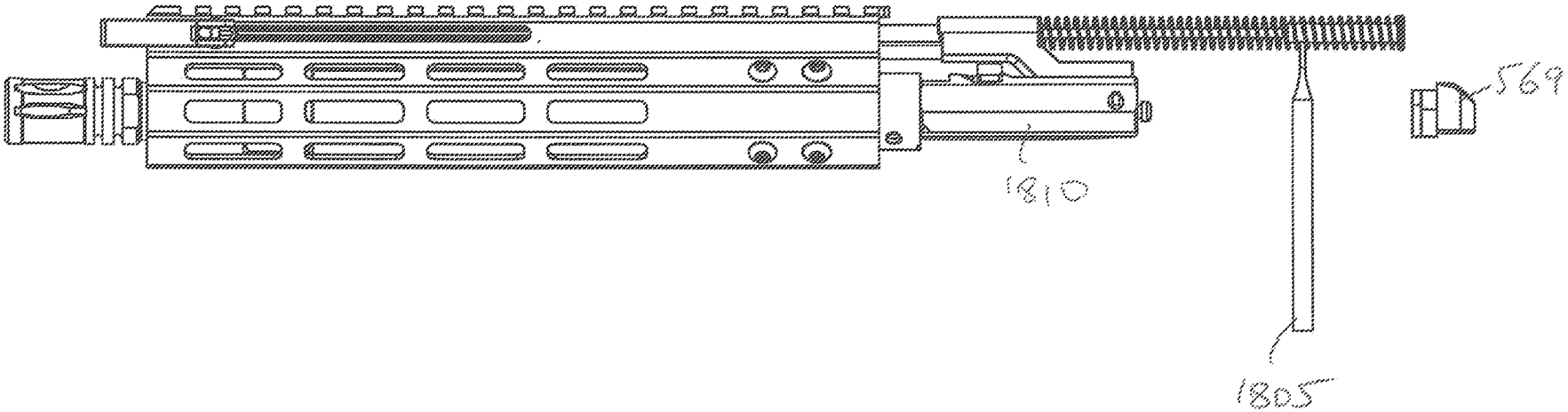

According to some embodiments presently disclosed, the first tool 1805 is used (i.e. configured) to allow a user of a firearm to at least partially disassemble the firearm. According to some embodiments presently disclosed, the first tool 1805 is used (i.e. configured) to allow a user to remove a bolt carrier assembly 1810 from an upper receiver 1815 as shown in FIGS. 83-90. FIGS. 84-86 do not depict the upper receiver 1815 for ease of reference. FIGS. 87-90 depict a cutaway of the upper receiver 1815 for ease of reference.

Figure 83:
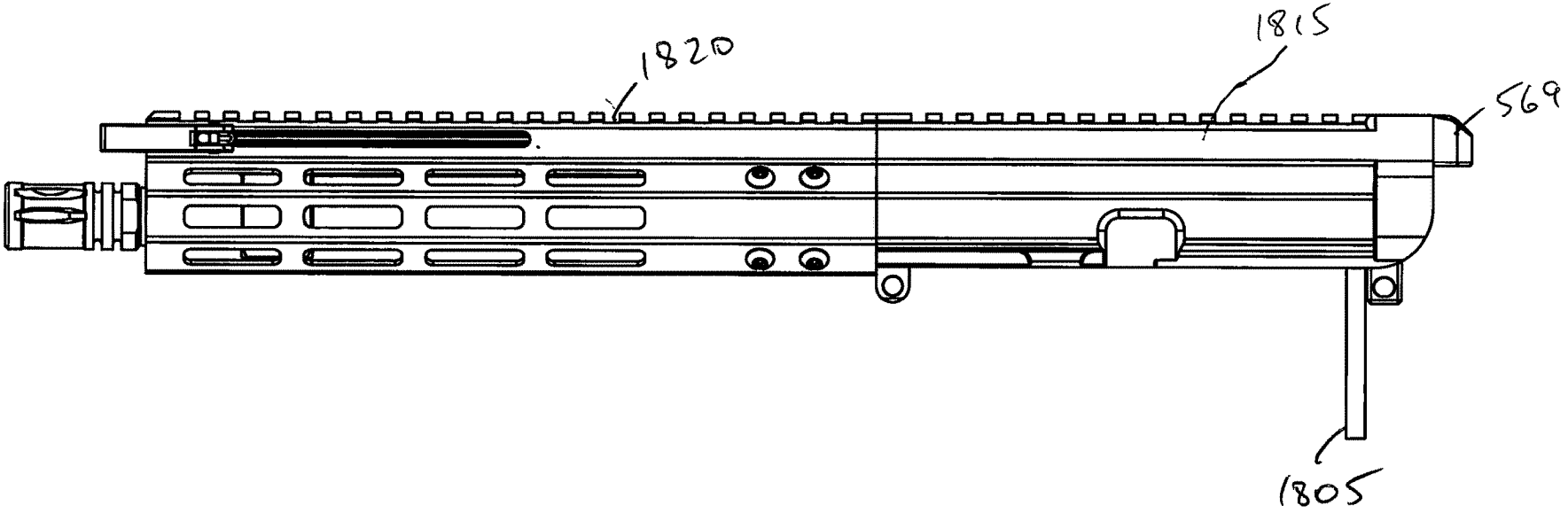
FIG. 83 depicts a partial view of a firearm according to some embodiments presently disclosed.
Figure 84:
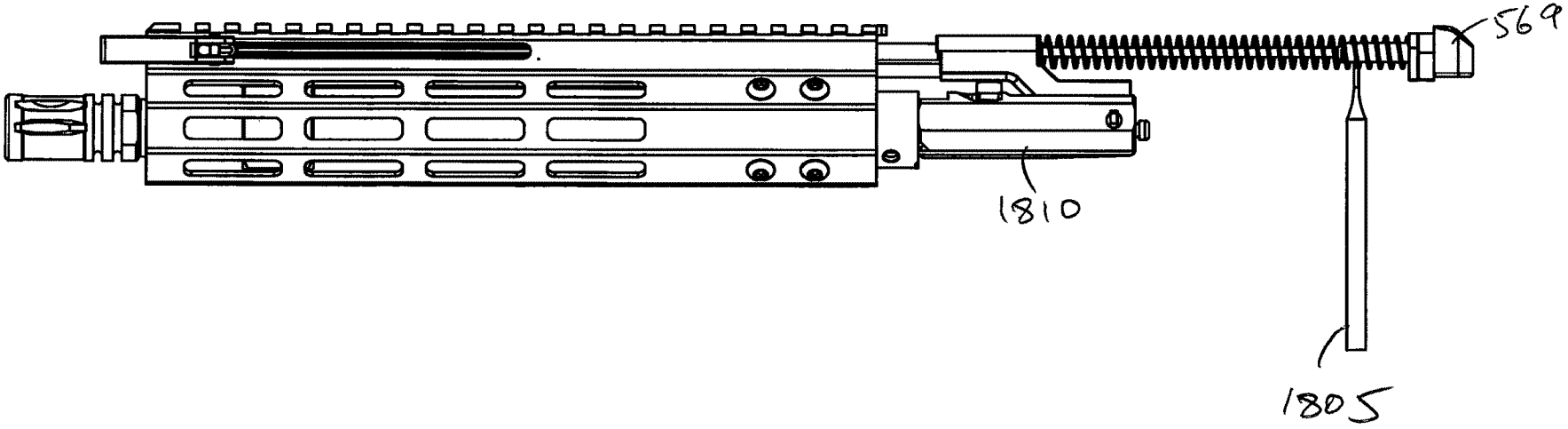
FIGS. 84-90 depict a partially disassembled view of a firearm according to some embodiments presently disclosed.
Figure 87:
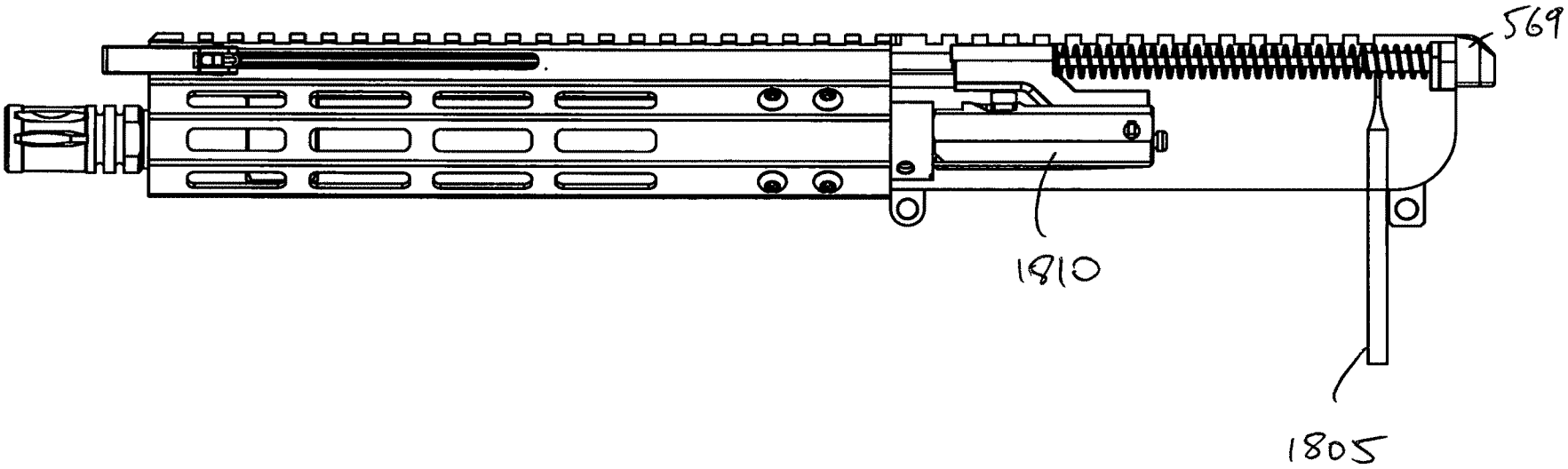
Figure 88:
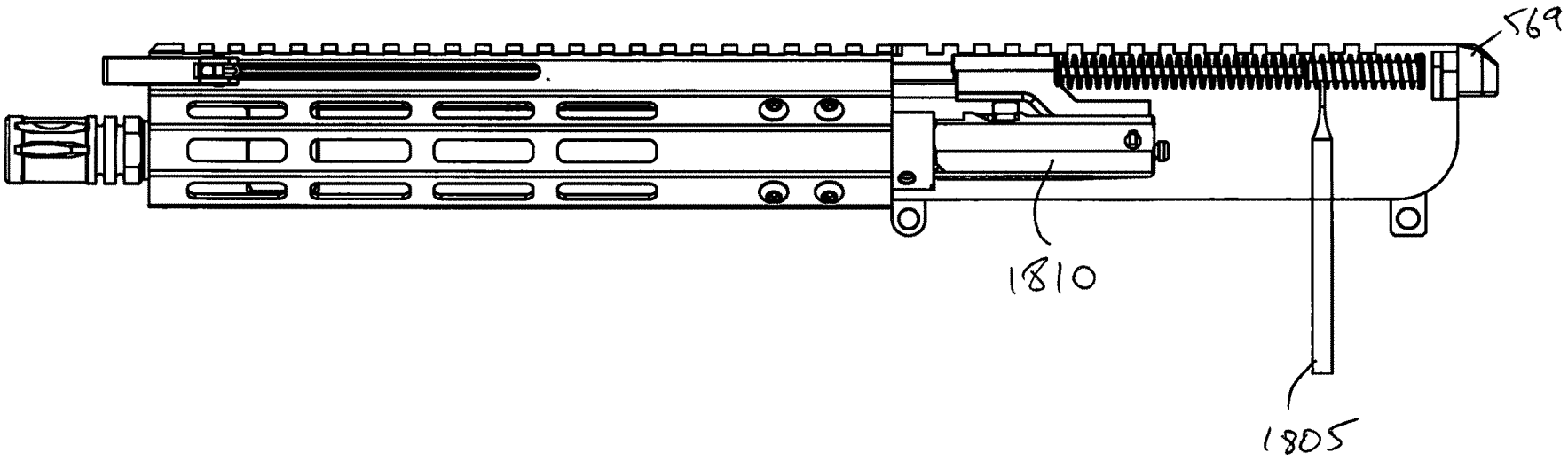

The tool 1805 may be inserted into the aperture 1800 of the rod 567 as shown in FIGS. 83, 84, 87 from the bottom of the upper receiver 1815. According to some embodiments presently disclosed, once inserted in the aperture 1800, the user may use the tool 1805 to move the rod 567 towards a handguard 1820 which would cause the recoil spring 568 to be compressed. According to some embodiments presently disclosed, once inserted in the aperture 1800, the user may use the tool 1805 to move the rod 567 towards the bolt carrier assembly 1810 which would cause the recoil spring 568 to be compressed between the tool 1805 and the bolt carrier assembly 1810 as shown in FIGS. 85 and 88. According to some embodiments presently disclosed, once inserted in the aperture 1800, the user may use the tool 1805 to move the rod 567 away from the plug 569 which would cause the recoil spring 568 to be compressed between the tool 1805 and the bolt carrier assembly 1810 as shown in FIGS. 85 and 88.

Figure 89:
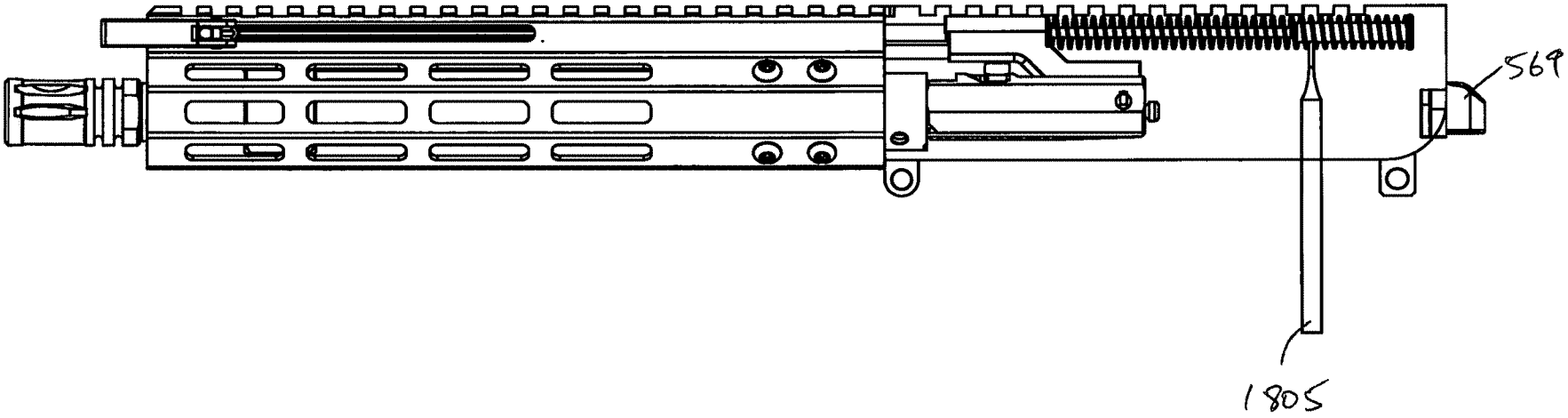
Figure 90:
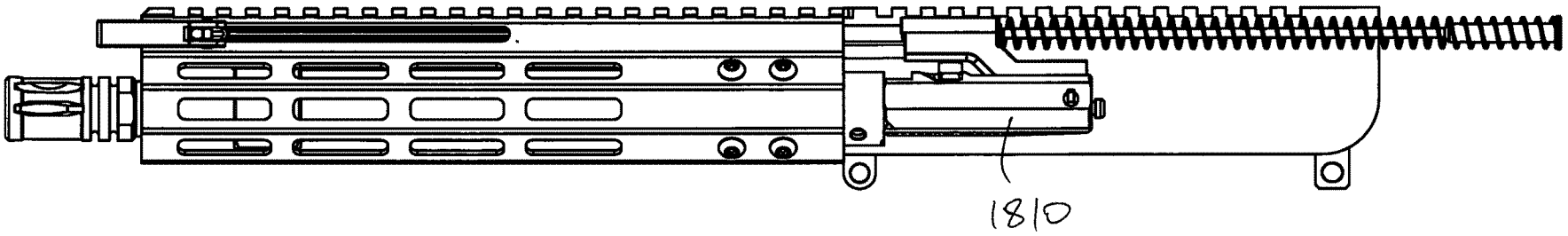

According to some embodiments presently disclosed, once the rod 567 is moved away from the plug 569, the plug 569 is free to be removed from the upper receiver 1815 as shown in FIGS. 86 and 89. According to some embodiments presently disclosed, once the rod 567 is moved away from the plug 569, the plug 569 is free to be removed from the channel 610 shown in FIG. 41. Once the plug 569 is removed from the upper receiver 1815, the rod 567, the recoil spring 568 and/or the bolt carrier assembly 1810 may be removed from the upper receiver 1815.

According to some embodiments presently disclosed, the first tool 1805 may also be used (i.e. configured) to allow a user to remove the bolt carrier assemblies (540, 840, 1040, 1240) from their respective upper receivers.

Figure 91:
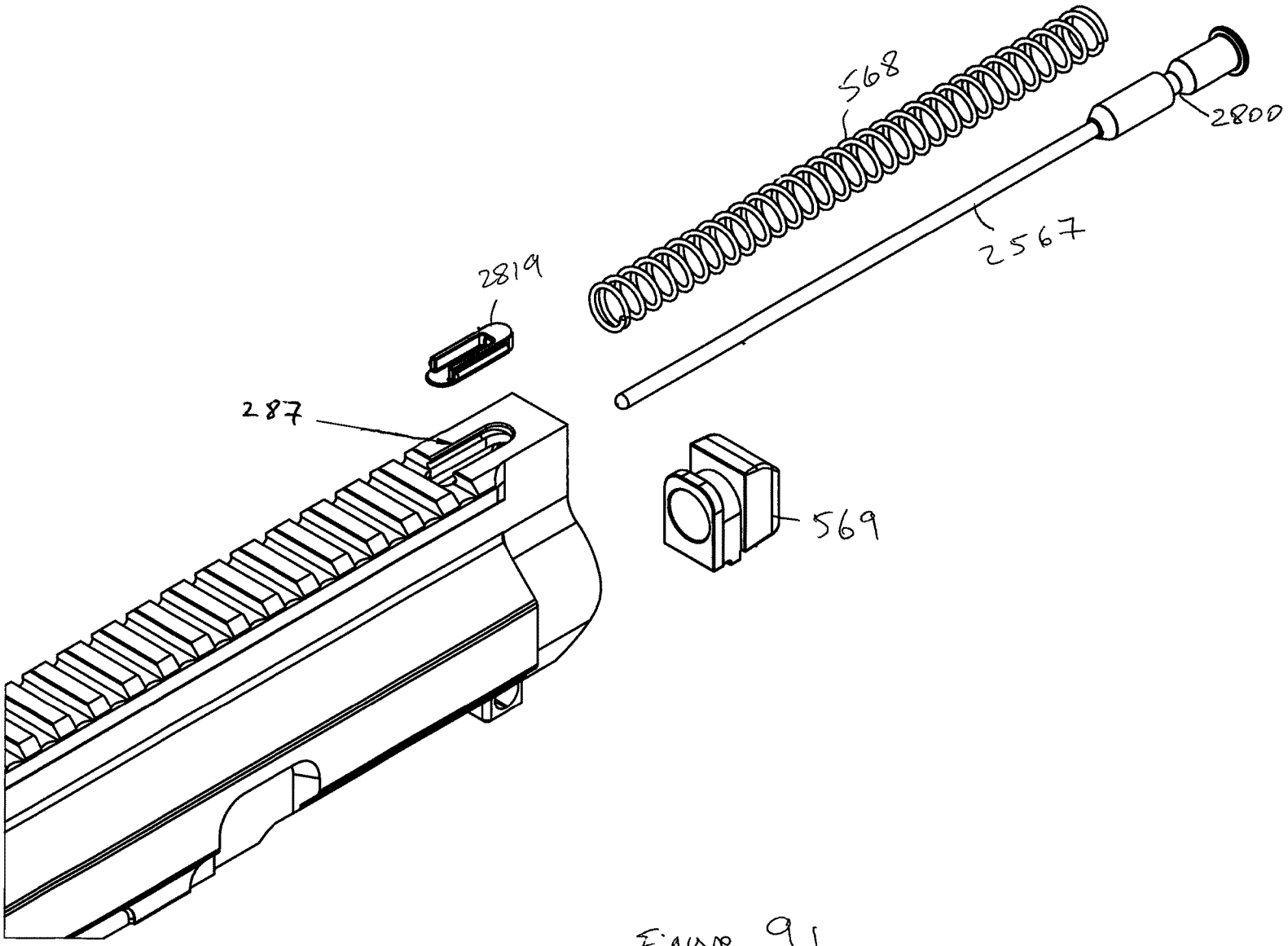
FIG. 91 depicts an exploded view of a firearm according to some embodiments presently disclosed.
Figure 92:
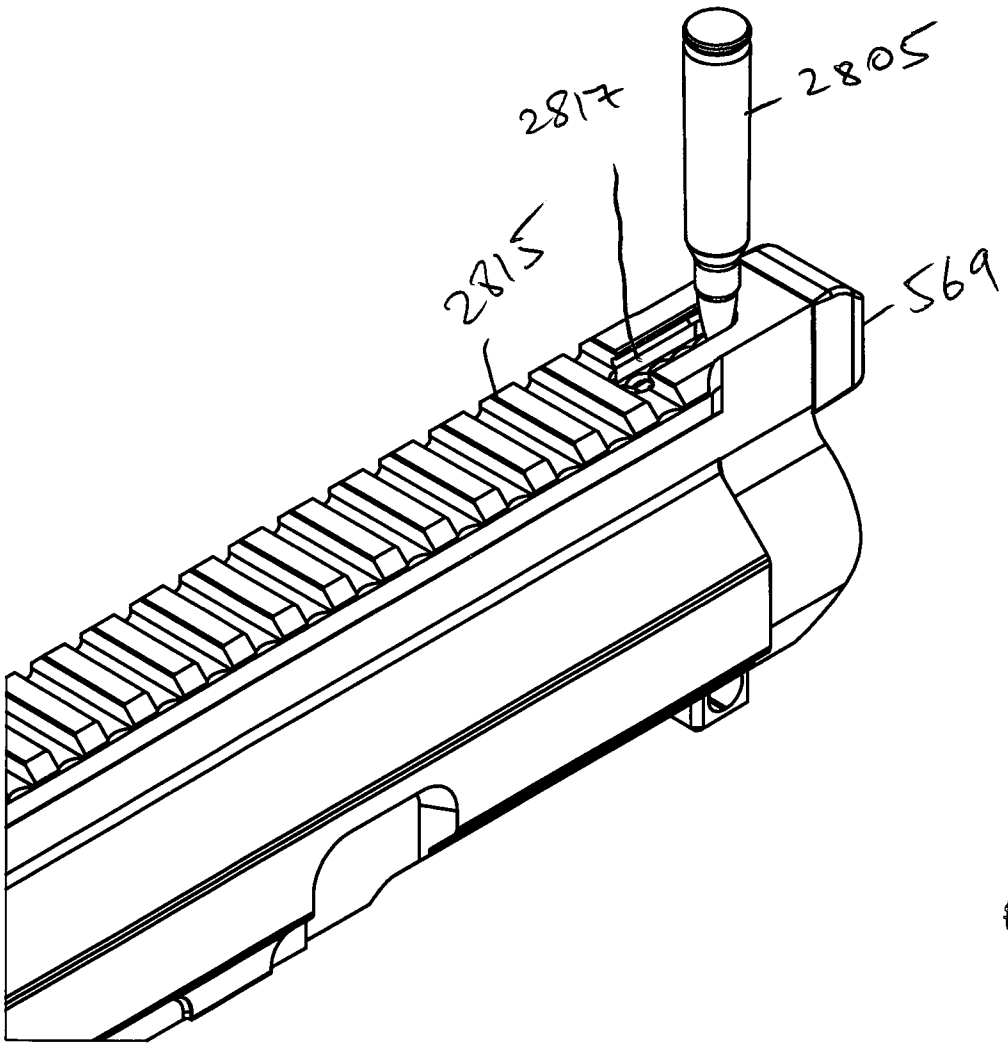
FIGS. 92-95 depict a partial view of a firearm according to some embodiments presently disclosed.
Figure 93:
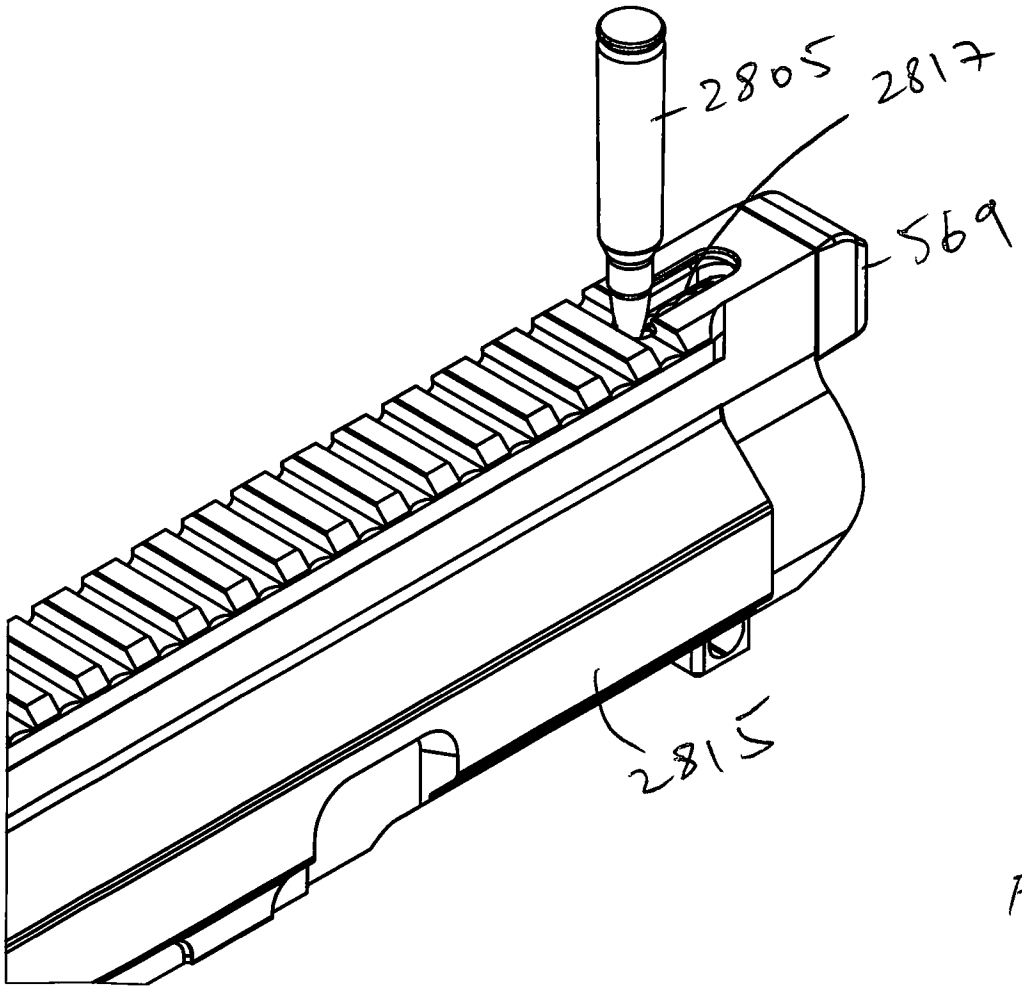

Referring to FIG. 91, according to some embodiments presently disclosed a recoil spring guide rod 2567 may be used instead of the recoil spring guide rod 567 as described above.

According to some embodiments presently disclosed, the recoil spring guide rod 2567 comprises a channel 2800. The channel 2800 may be configured to accommodate a portion of the first tool 1805 described above. The channel 2800 may be configured to accommodate a portion of a second tool 2805 shown in FIGS. 92-100. According to some embodiments presently disclosed, the channel 2800 is positioned alone the circumference of the rod 2567. According to some embodiments presently disclosed, the channel 2800 is an indentation in the rod 2567.

According to some embodiments presently disclosed, the tool 1805 or 2805 is used (i.e. configured) to allow a user of a firearm to at least partially disassemble the firearm. According to some embodiments presently disclosed, the tool 1805 or 2805 is used (i.e. configured) to allow a user to remove a bolt carrier assembly 2810 from an upper receiver 2815 as shown in FIGS. 92-98. FIGS. 92-95 depict the upper receiver 2815. FIGS. 96-99 do not depict the upper receiver 2815 for ease of reference.

Figure 94:
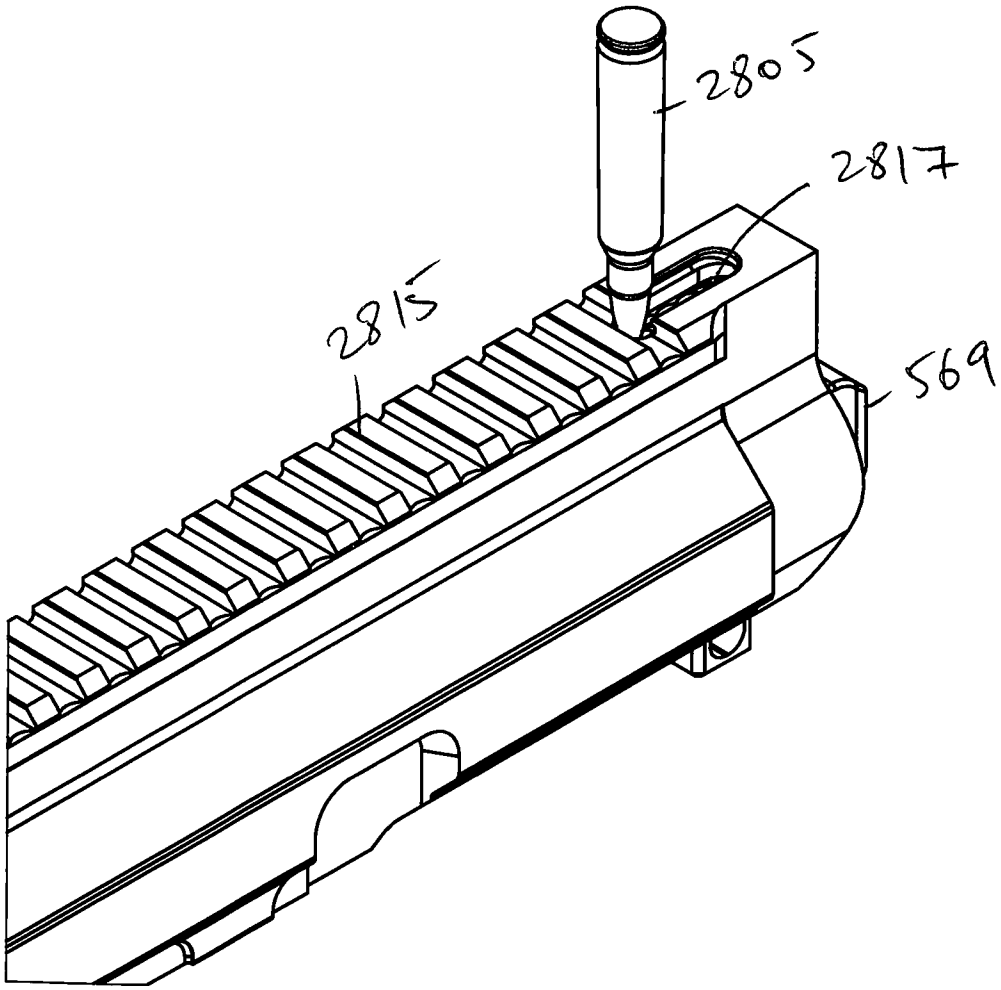
Figure 95:
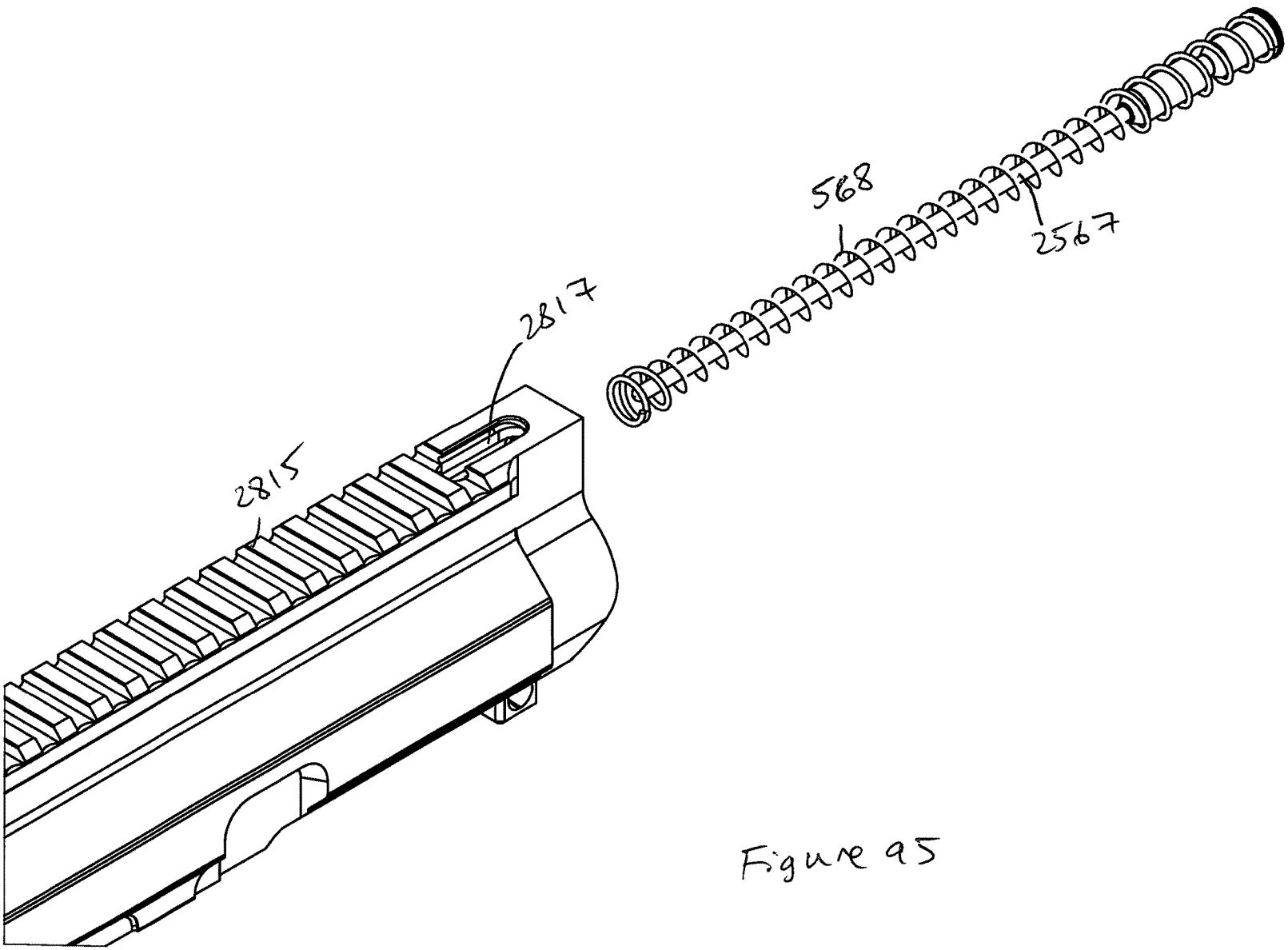
Figure 96:
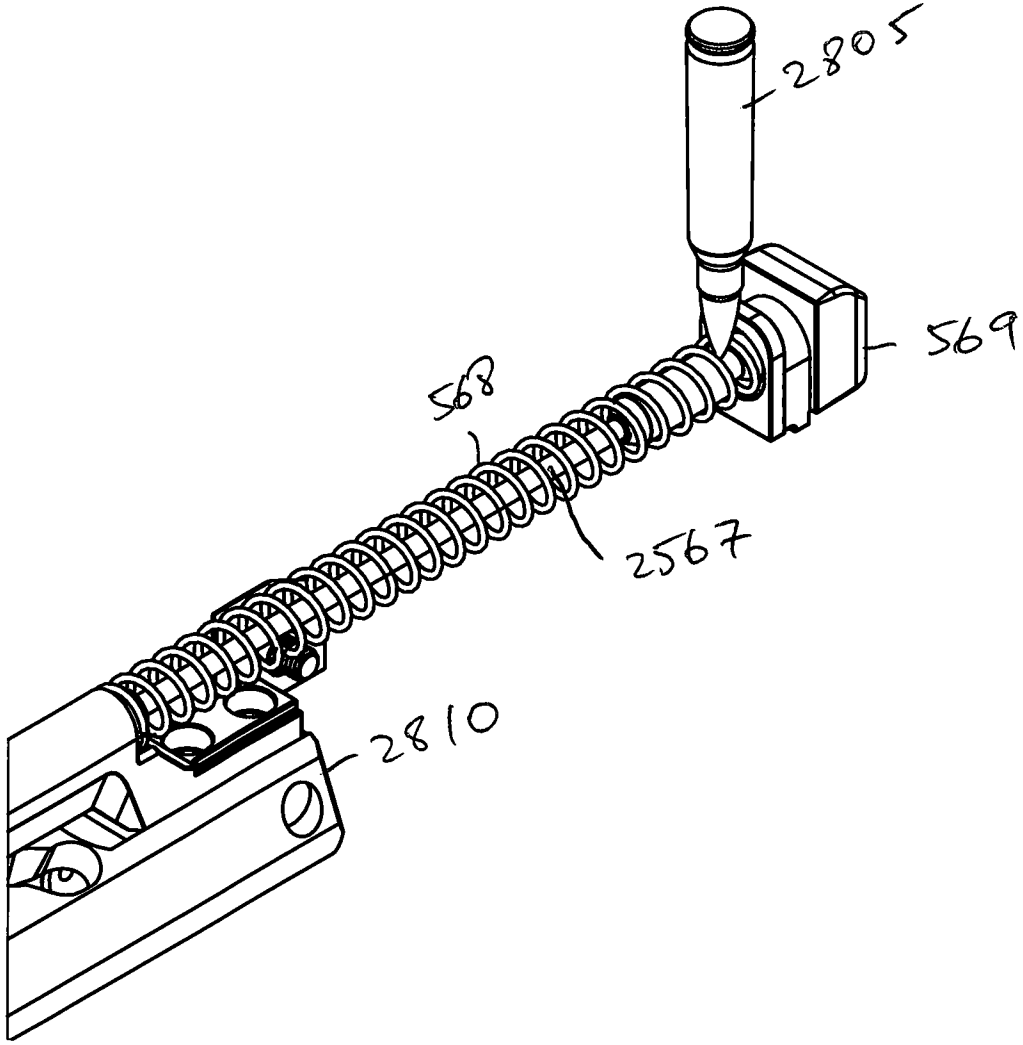
FIGS. 96-99 depict a partial, disassembled view of a firearm according to some embodiments presently disclosed.
Figure 97:
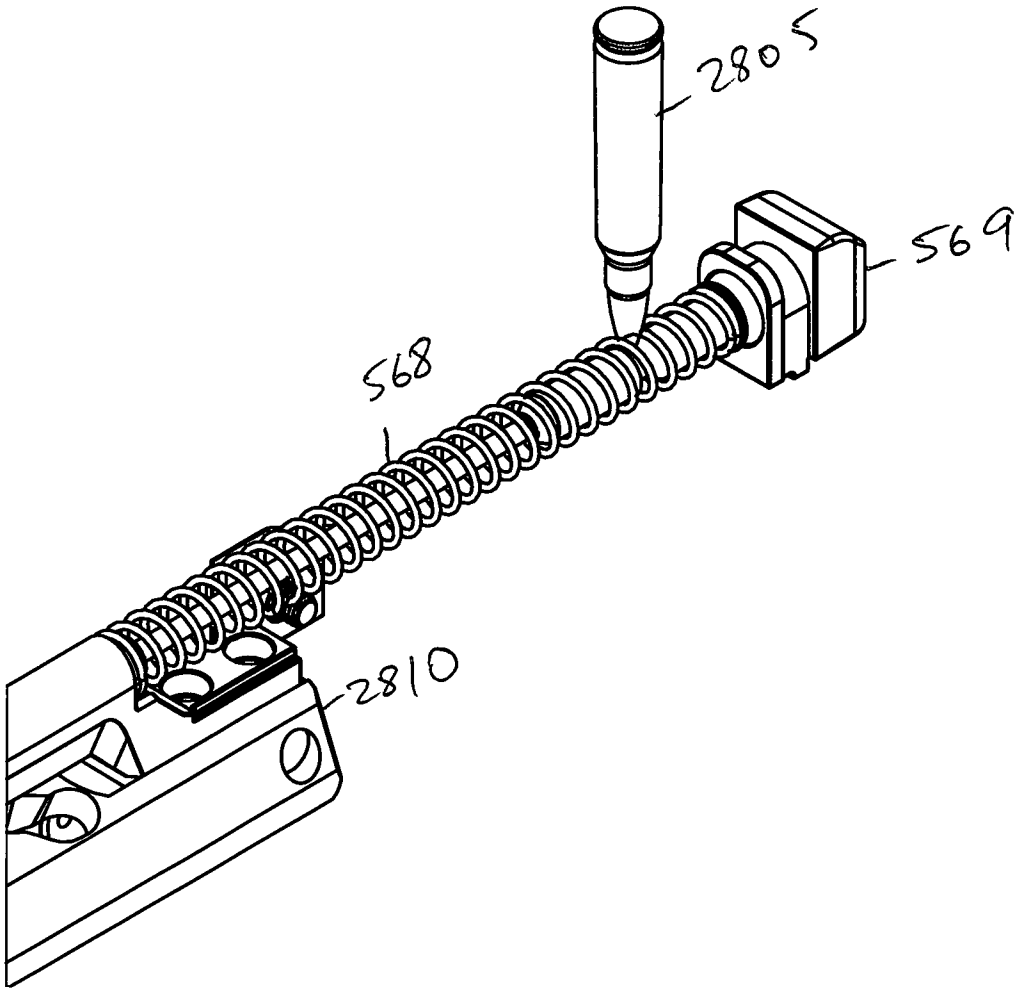
Figure 98:
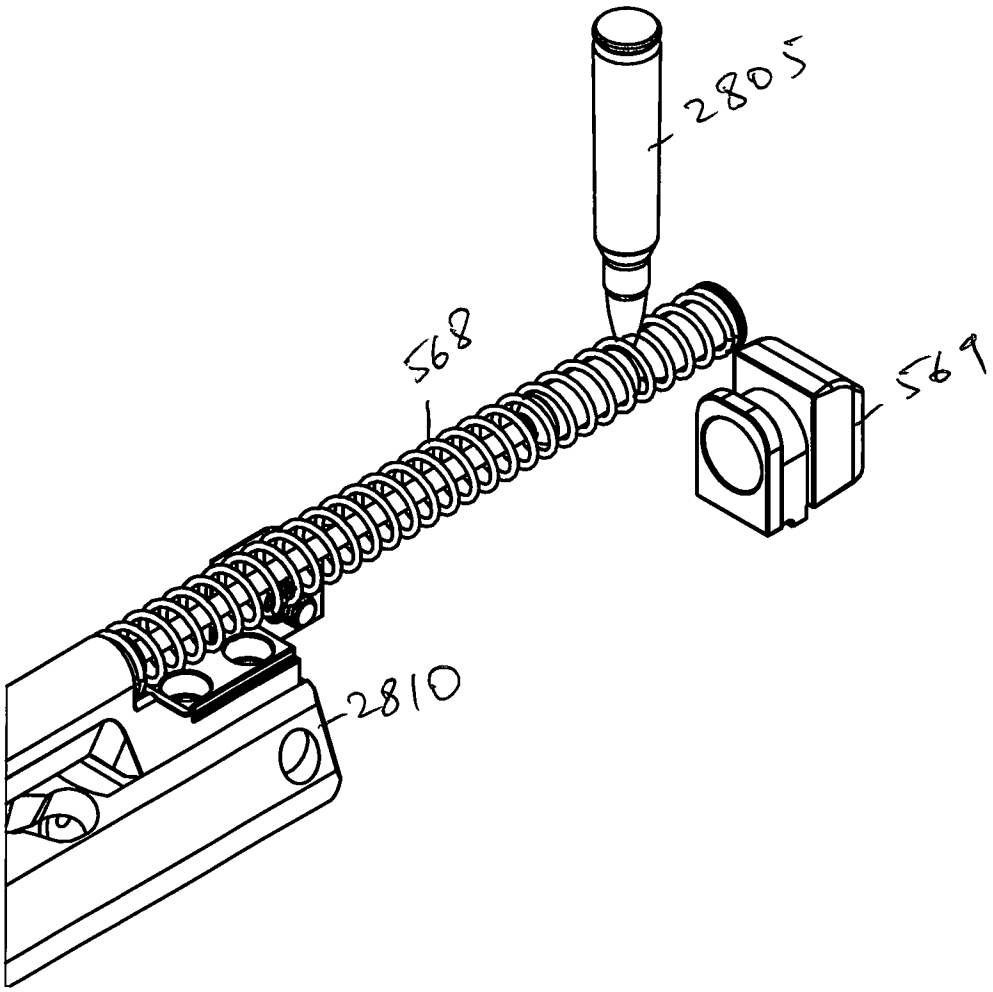

The tool 1805 or 2805 may be inserted into the channel 2800 of the rod 2567 as shown in FIGS. 96-98 from the top of the upper receiver 2815 through an aperture 2817 shown in FIGS. 92-95. According to some embodiments presently disclosed, once inserted in the channel 2800, the user may use the tool 1805 or 2805 to move the rod 2567 towards a handguard which would cause the recoil spring 568 to be compressed. According to some embodiments presently disclosed, once inserted in the channel 2800, the user may use the tool 1805 or 2805 to move the rod 2567 towards the bolt carrier assembly 2810 which would cause the recoil spring 568 to be compressed between the tool 2805 and the bolt carrier assembly 2810 as shown in FIGS. 96-98. According to some embodiments presently disclosed, once inserted in the channel 2800, the user may use the tool 1805 or 2805 to move the rod 2567 away from the plug 569 which would cause the recoil spring 568 to be compressed between the tool 2805 and the bolt carrier assembly 2810 as shown in FIGS. 96-98.

According to some embodiments presently disclosed, once the rod 2567 is moved away from the plug 569, the plug 569 is free to be removed from the upper receiver 2815 as shown in FIGS. 94 and 98. According to some embodiments presently disclosed, once the rod 2567 is moved away from the plug 569, the plug 569 is free to be removed from the channel 610 shown in FIG. 41. Once the plug 569 is removed from the upper receiver 2815, the rod 2567, the recoil spring 568 and/or the bolt carrier assembly 2810 may be removed from the upper receiver 2815 as shown in FIG. 95.

Figure 99:
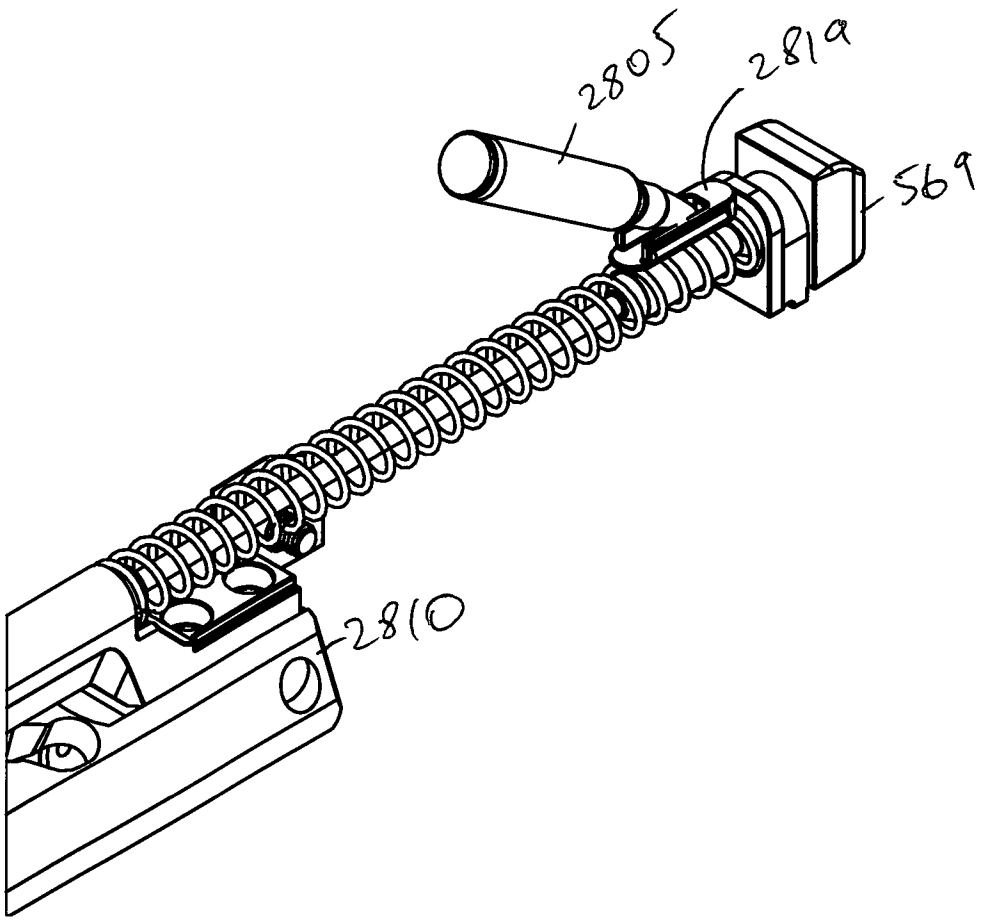
Figure 100:
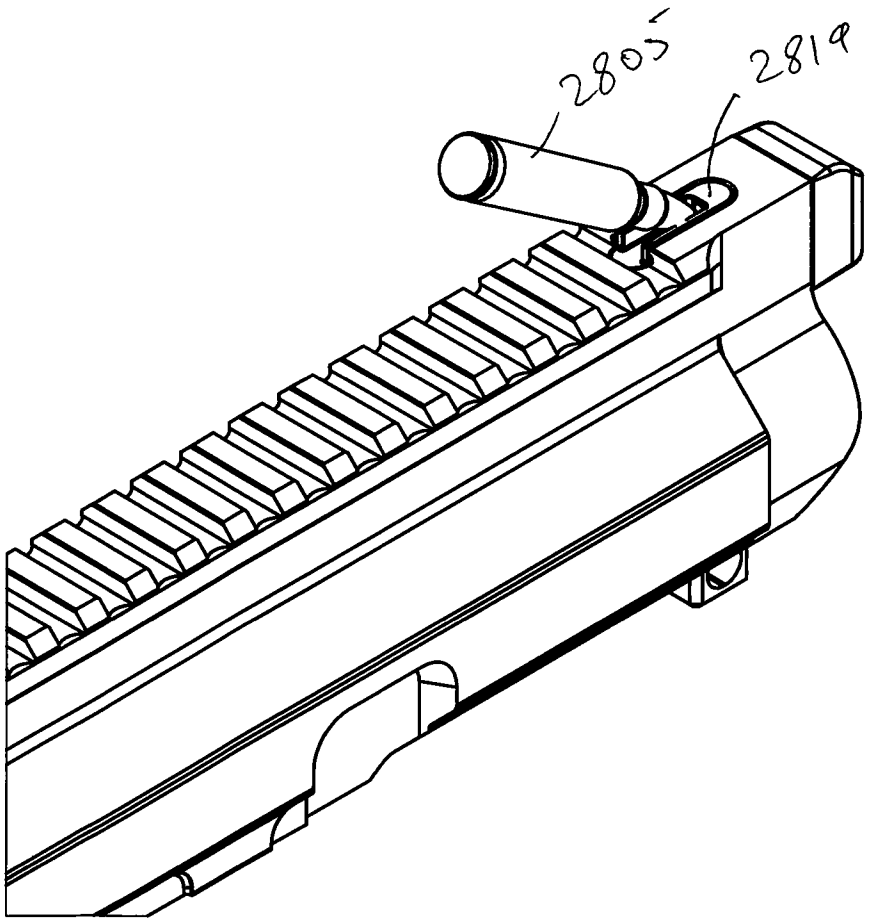
FIG. 100 depicts a partial view of a firearm according to some embodiments presently disclosed.

According to some embodiments presently disclosed, a plug 2819 is used to cover the aperture 2817. According to some embodiments presently disclosed, a plug 2819 is used to cover the aperture 2817 and prevent dirt from entering the upper receiver 2815. According to some embodiments presently disclosed, a plug 2819 is used to cover the aperture 2817 and prevent hot gasses from exiting the upper receiver 2815. According to some embodiments presently disclosed, the tool 1805 or 2805 may be used to remove the plug 2819 from the upper receiver 2815 and expose the aperture 2817 as shown in FIGS. 99-100.

Figure 101:
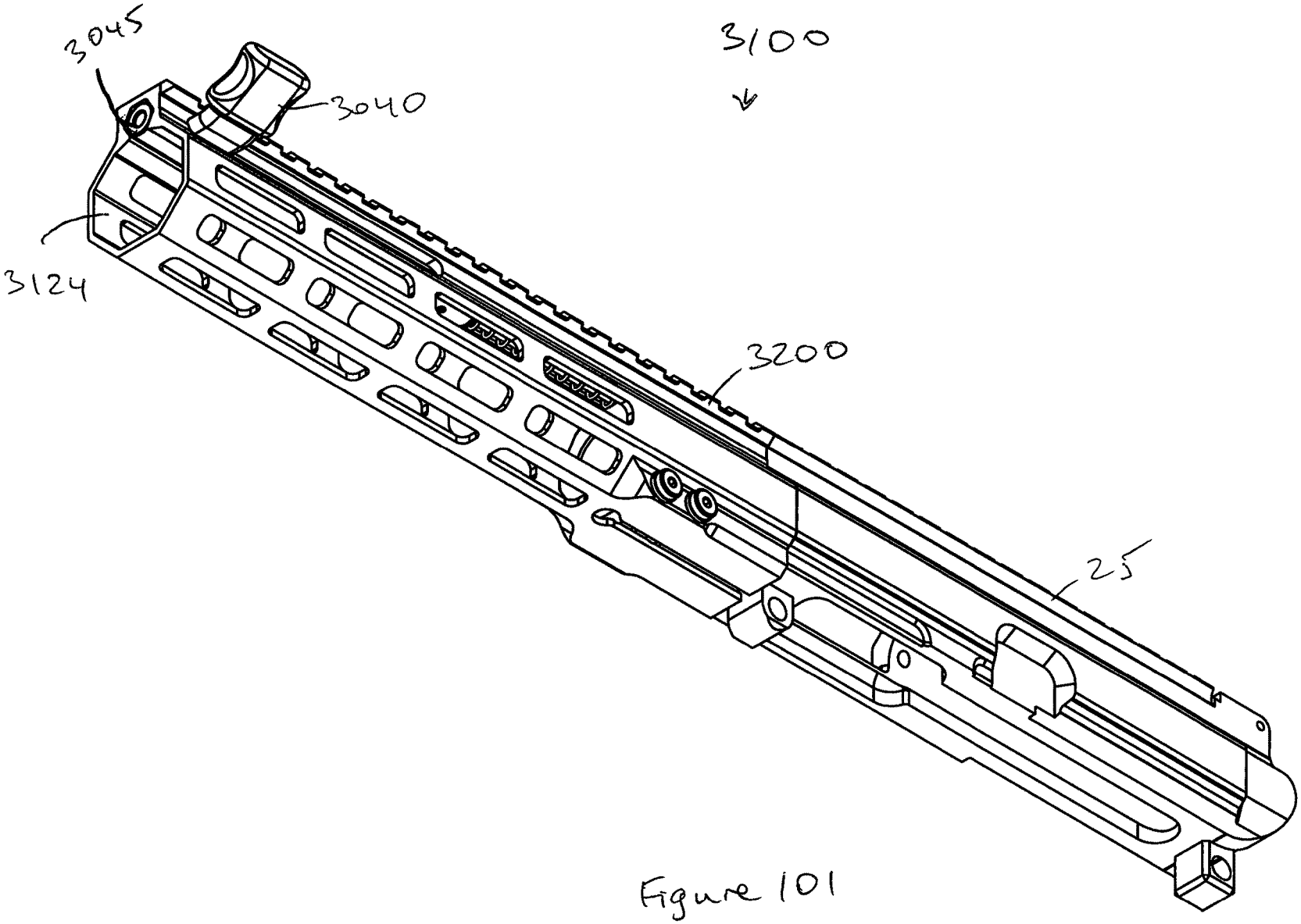
FIG. 101 depicts a partial view of a firearm according to some embodiments presently disclosed.
Figure 102:
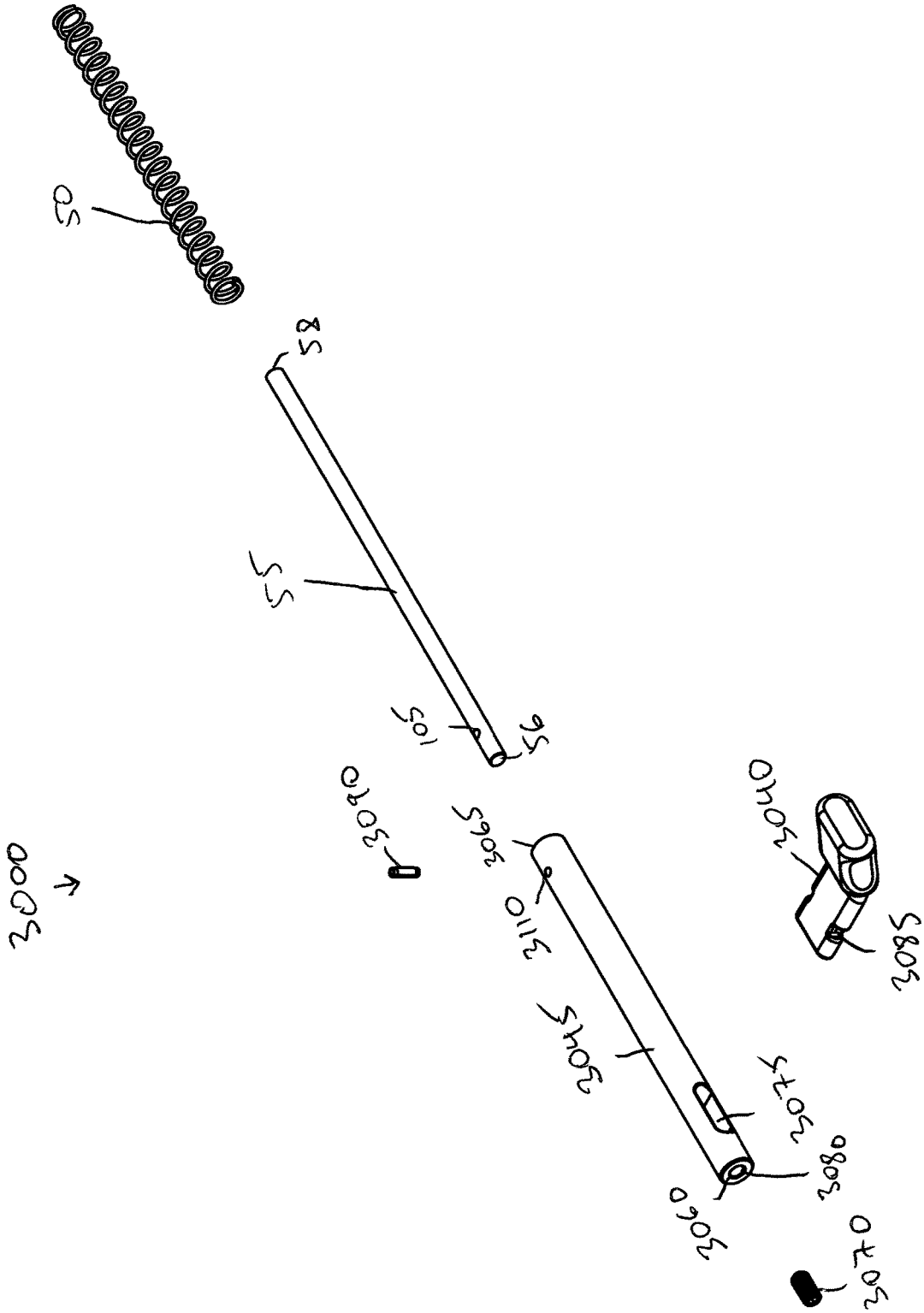
FIG. 102 depicts an exploded view of an exemplary embodiment presently disclosed.
Figure 103:
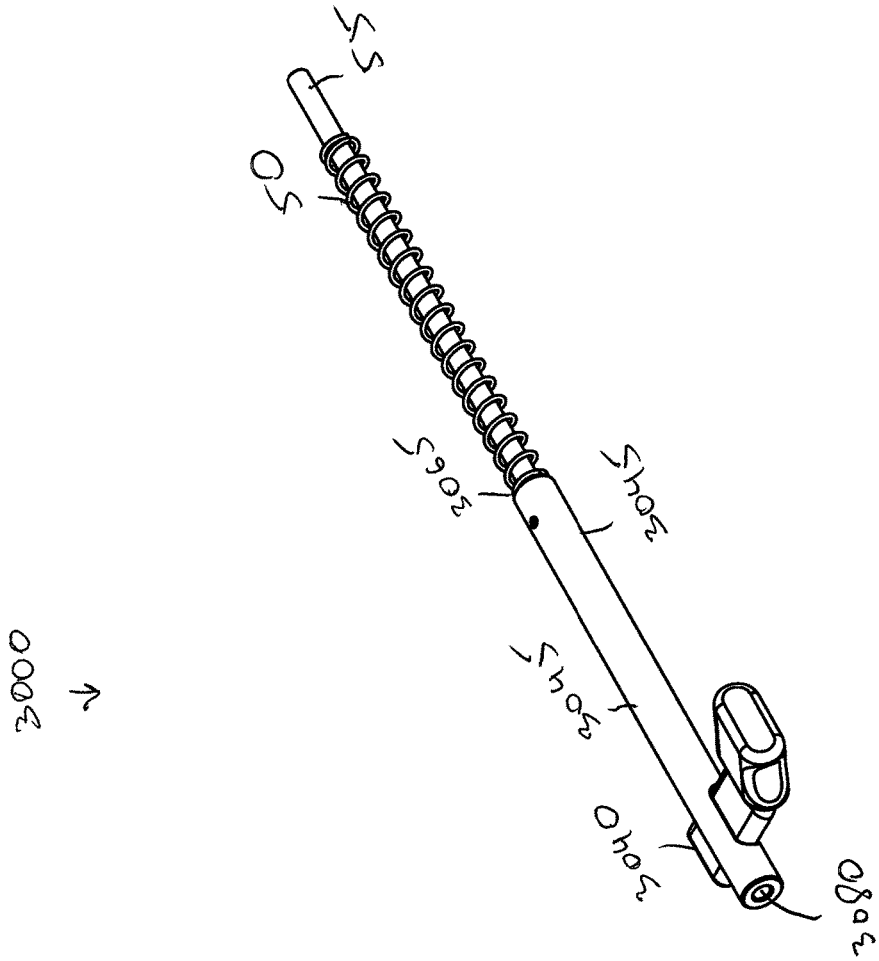
FIG. 103 depicts an assembled view of an exemplary embodiment presently disclosed.
Figure 104:
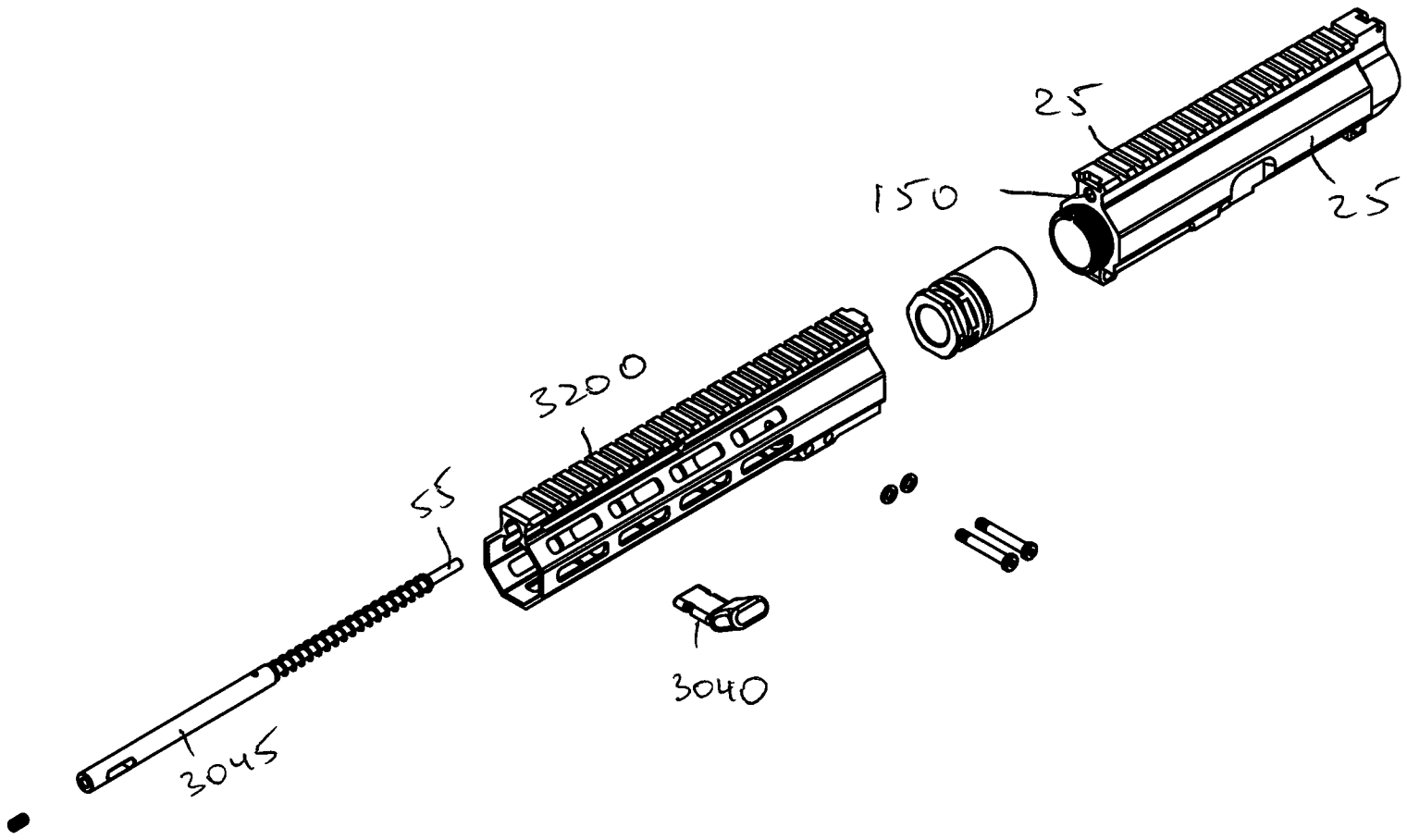
FIG. 104 depicts an exploded view of an exemplary embodiment presently disclosed.

Referring to FIGS. 101-103, an upper receiver assembly 3100 comprises a forward charging system 3000 (shown in FIGS. 102-103) according to some embodiments presently disclosed. The forward charging system 3000 comprises a charging trolley 3045 and the rod 55 as described above. The forward charging system 3000 may also comprise the return spring 50 as described above. The forward charging system 3000 may also comprise a removable charging handle 3040.

The charging trolley 3045 comprises a forward portion 3060 and a rear portion 3065. According to some embodiments presently disclosed, the charging handle 3040 is coupled with the charging trolley 3045's forward portion 3060. According to some embodiments presently disclosed, the charging handle 3040 is coupled with the charging trolley 3045 adjacent to the forward portion 3060. According to some embodiments presently disclosed, the charging trolley 3045 comprises an opening 3075 (shown in FIG. 102) configured to accommodate the charging handle 3040 as shown in FIG. 103. The opening 3075 may be a through opening to allow the charging handle 3040 to be inserted on either the right or left side of the charging trolley 3045 as shown in FIGS. 105-108. The opening 3075 may be a through opening to allow the charging handle 3040 to be inserted either pointing up or down as shown in FIGS. 105-108. The charging handle 3040 may be coupled with the charging trolley 3045 using, for example, a fastener 3070 shown in FIG. 102. The fastener 3070 may be a pin, a screw, a set screw, a full dog point set screw, or a dogleg set screw.

According to some embodiments presently disclosed, the charging trolley 3045 comprises an opening 3080 (shown in FIGS. 102-103) and the charging handle 3040 comprises an opening 3085 (shown in FIG. 102). The openings 3080 and 3085 are configured to accommodate the fastener 3070. A set screw may be fully threaded and does not have any head projecting out of the screw thread. According to some embodiments presently disclosed, the charging handle 3040 is coupled substantially perpendicular to the charging trolley 3045. According to some embodiments presently disclosed, the charging handle 3040 is coupled at an angle to the charging trolley 3045.

As described above, the rod 55 comprises the forward portion 56 and the rear portion 58. According to some embodiments presently disclosed, rod 55's forward portion 56 is coupled with the charging trolley 3045's rear portion 3065 as shown in FIG. 103. The rod 55 may be coupled with the charging trolley 3045 using, for example, a fastener 3090 shown in FIG. 102. The fastener 3090 may be a pin, a screw, a set screw, a full dog point set screw, or a dogleg set screw. According to some embodiments presently disclosed, the charging trolley 3045's rear portion 3065 comprises an opening configured to accommodate rod 55's forward portion 56. According to some embodiments presently disclosed, the charging trolley 3045 comprises an opening 3110 and the rod 55 comprises an opening 105. The openings 3110 and 105 are configured to accommodate the fastener 3090.

According to some embodiments presently disclosed, the upper receiver 25 comprises a bolt carrier assembly 110 as described above. The bolt carrier assembly 110 is movable between a first (locked) position and a second (unlocked) position. According to some embodiments presently disclosed, the forward charging system 3000 is configured to move the bolt carrier assembly 110 from the first (locked) position to the second (unlocked).

Figure 105:
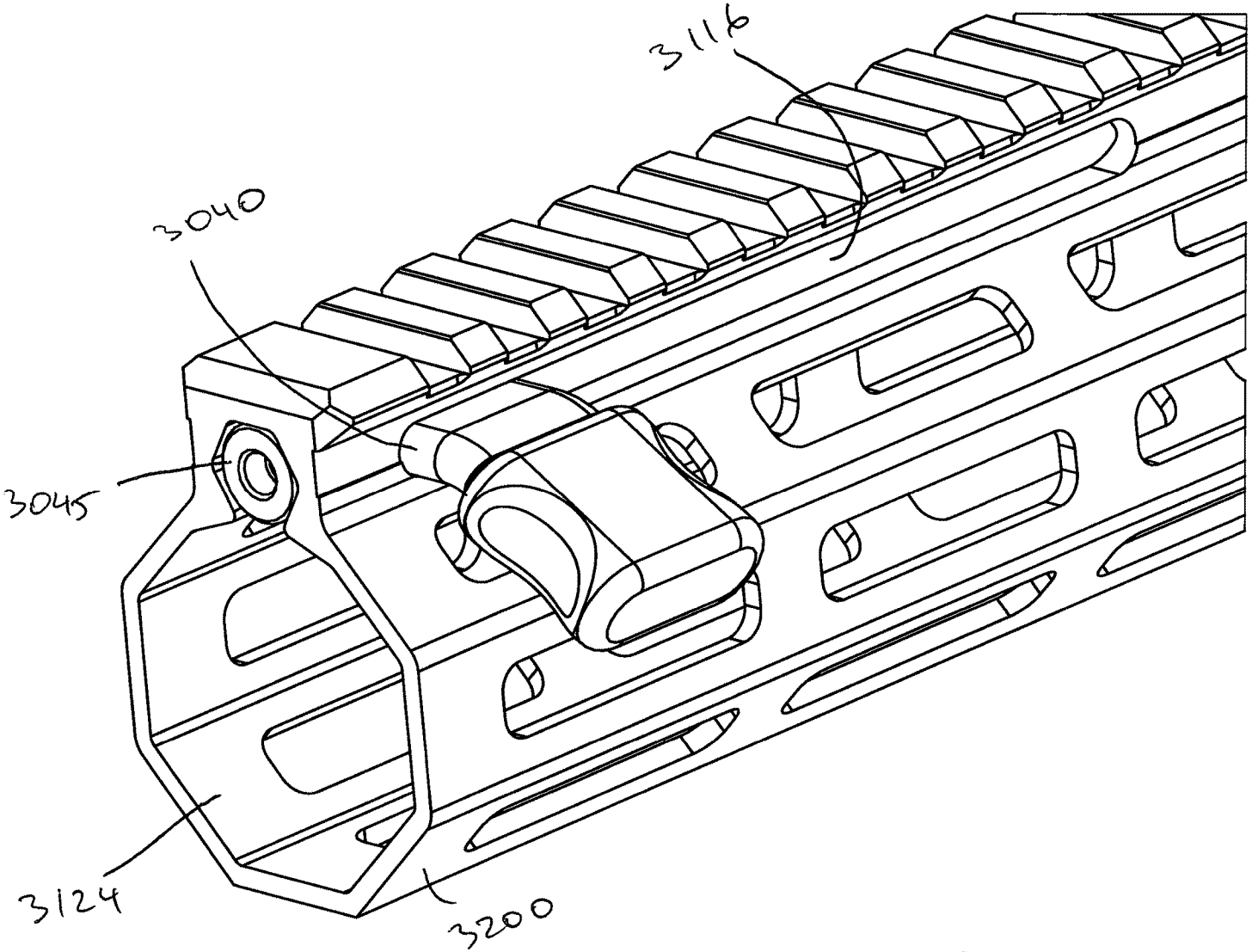
FIGS. 105-108 depict a partial view of a firearm according to some embodiments presently disclosed.
Figure 106:
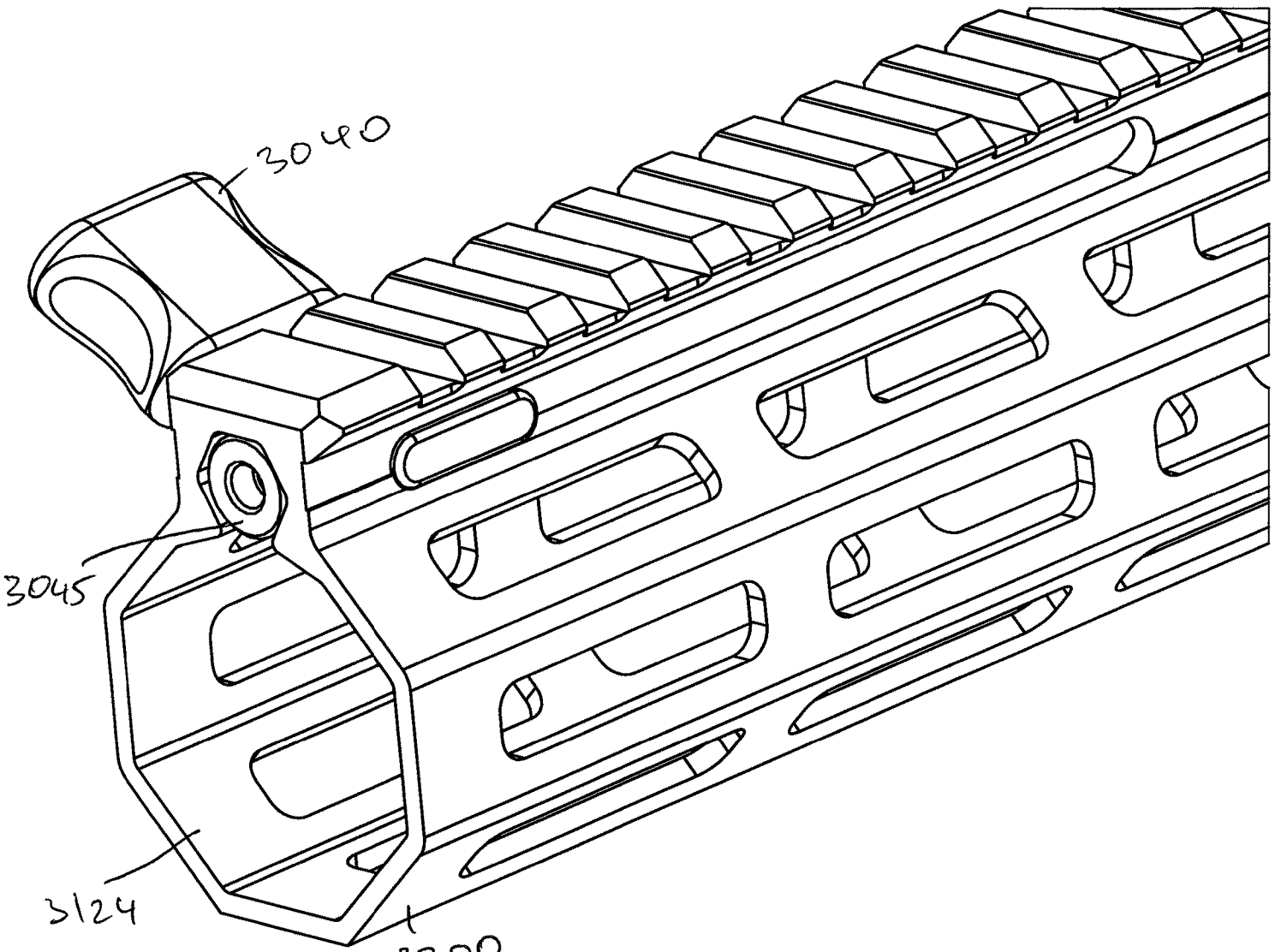
Figure 107:
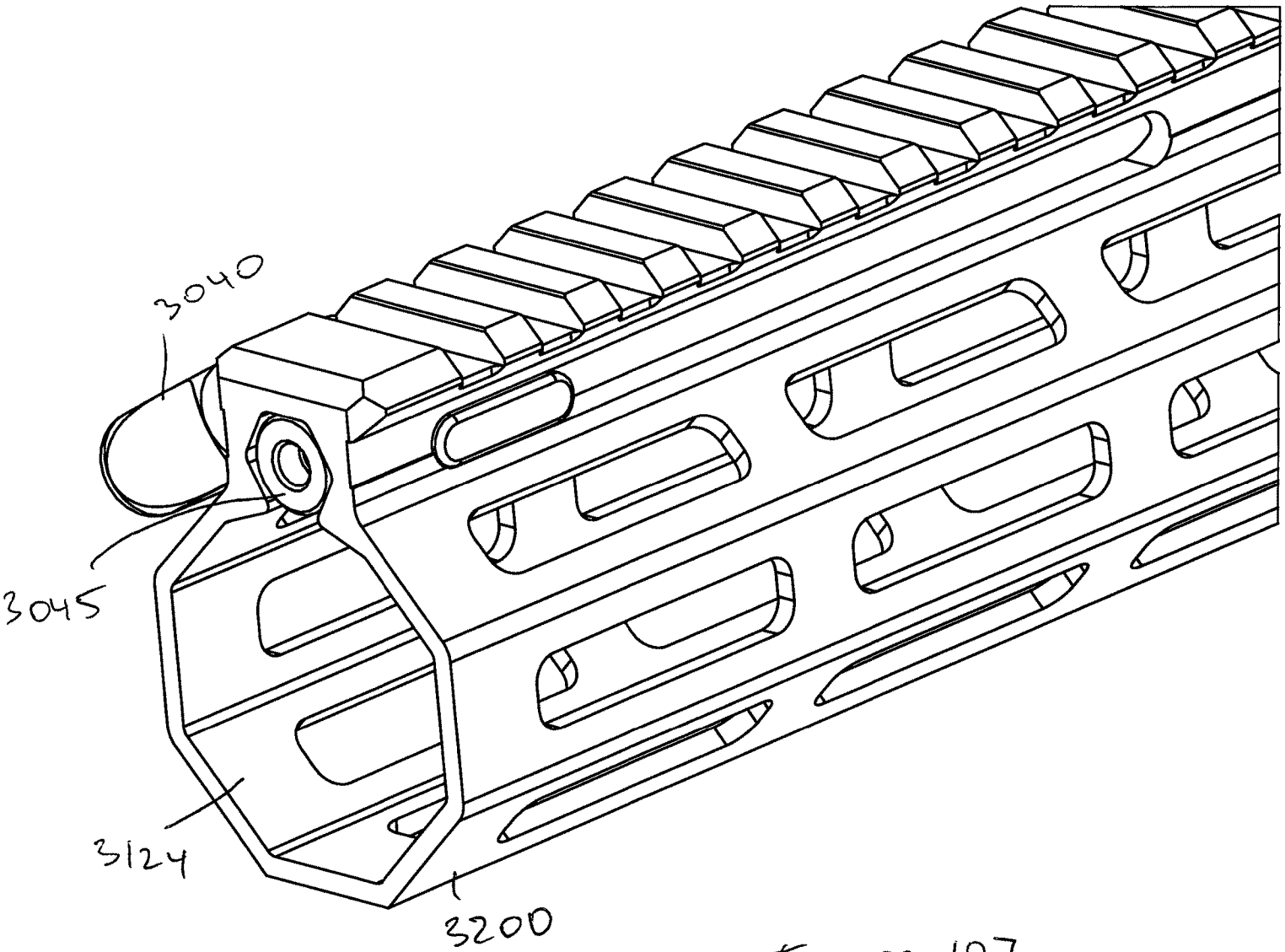
Figure 108:
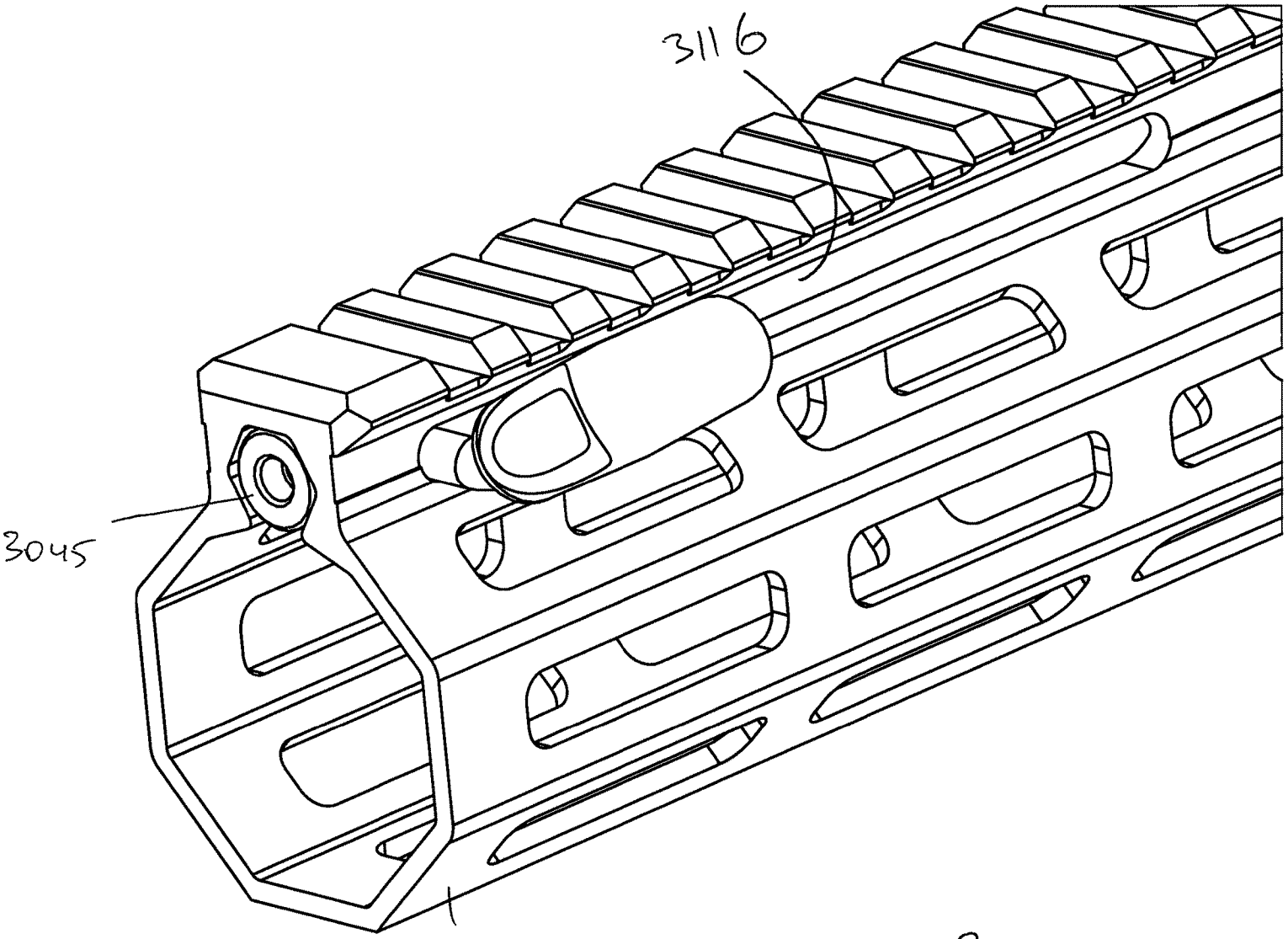

According to some embodiments presently disclosed, the charging handle 3040 is positioned to protrude though an opening 3116 of the hand guard 3200 (as shown in FIGS. 105 and 108). According to some embodiments presently disclosed, the charging handle 3040 is positioned adjacent to a barrel. According to some embodiments presently disclosed, the charging handle 3040 is positioned away from the upper receiver 25 as shown in FIG. 101. According to some embodiments presently disclosed, the charging base 3040 is positioned away from the upper receiver 25 and towards the front of the firearm and as shown in FIG. 101.

Figure 109:
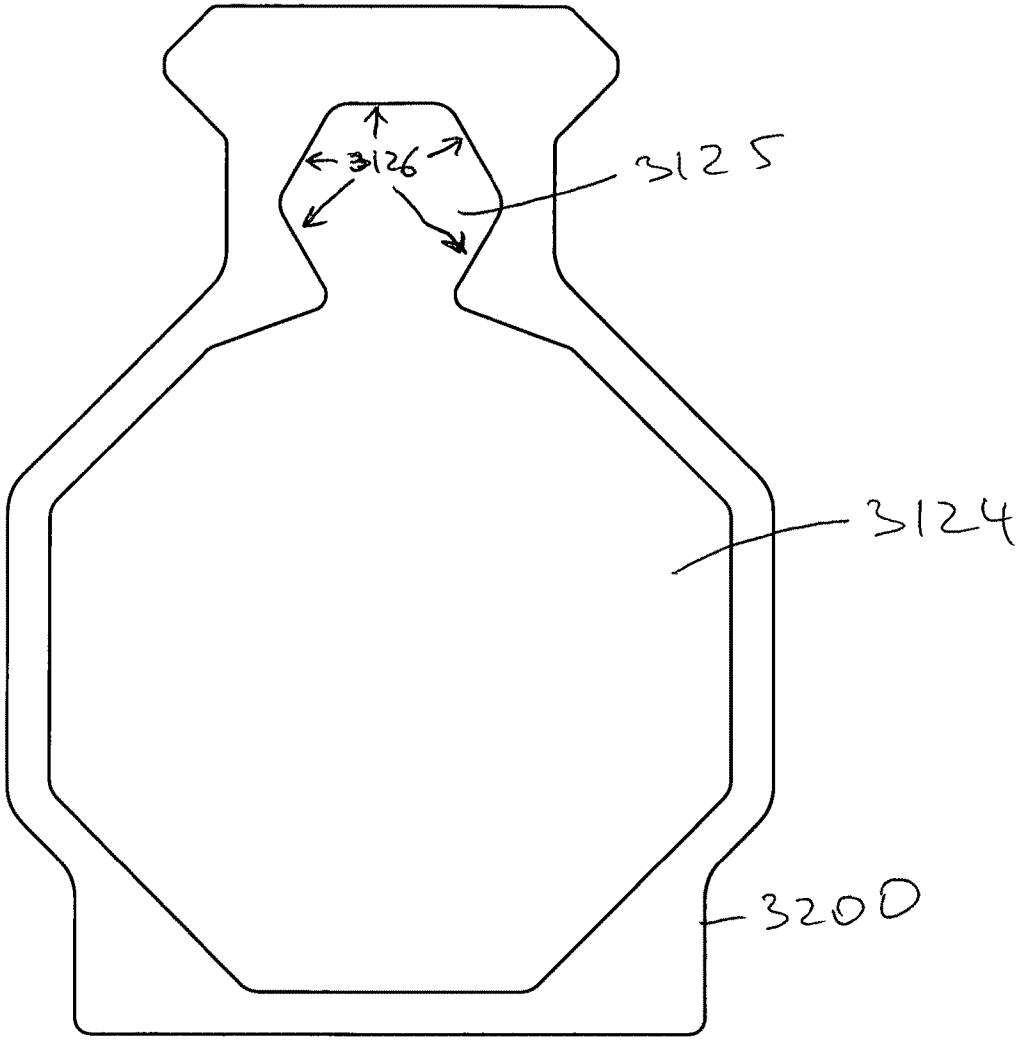
FIG. 109 depicts a front view of a handguard according to some embodiments presently disclosed.
Figure 110:
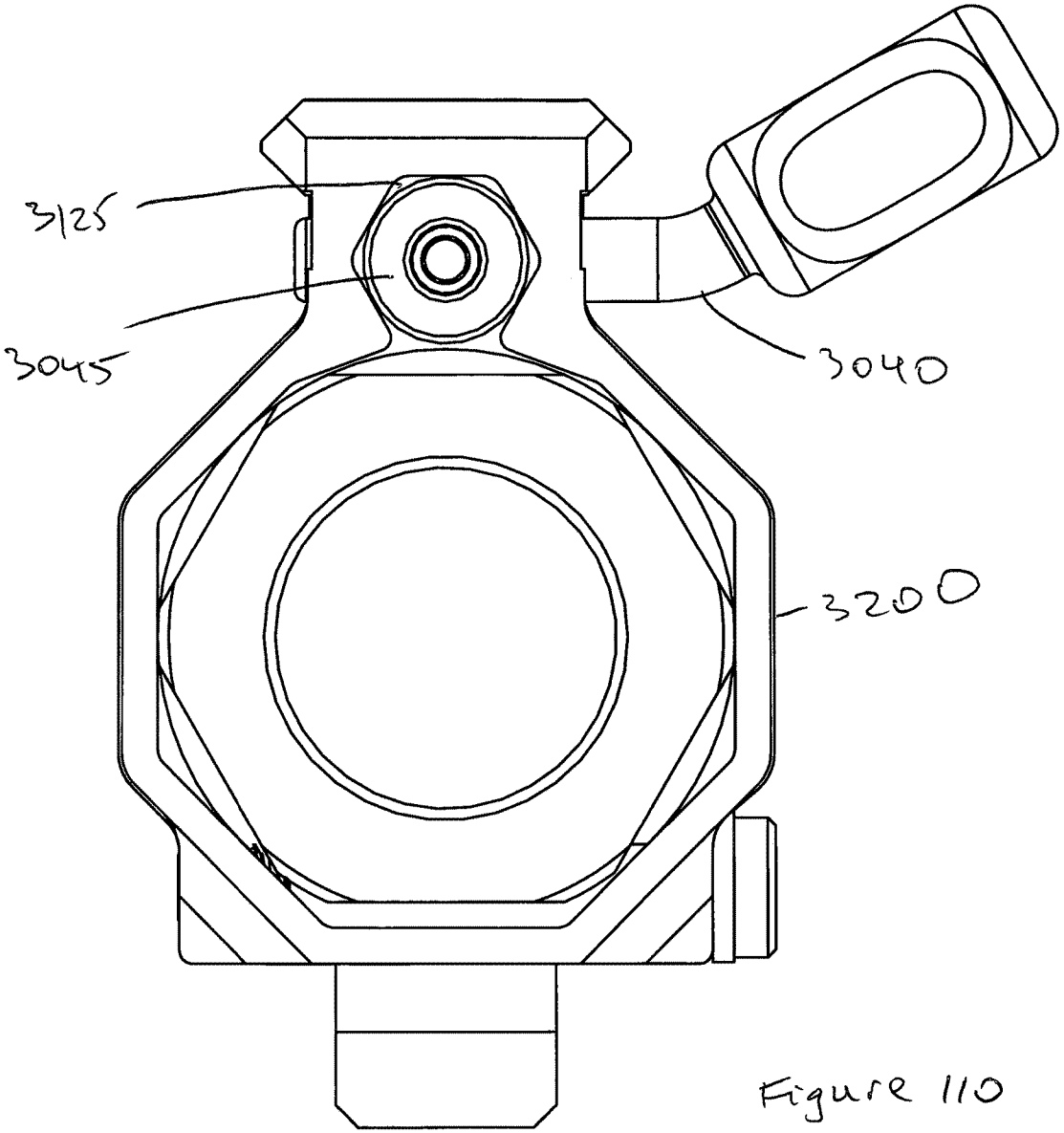
FIG. 110 depicts a partial view of a firearm according to some embodiments presently disclosed.
Figure 111:
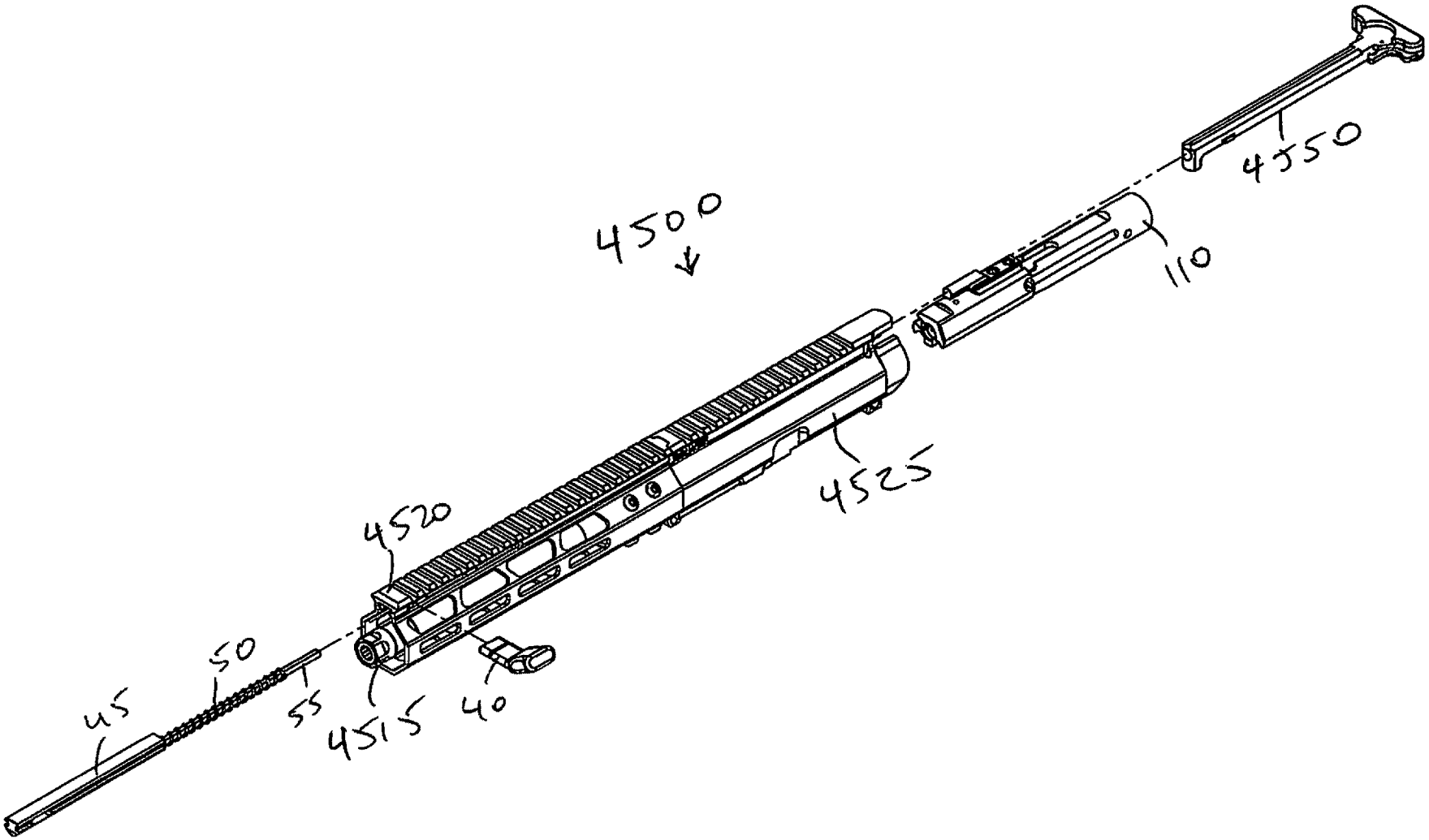
FIG. 111 depicts an exploded view of an exemplary embodiment presently disclosed.
Figure 112:
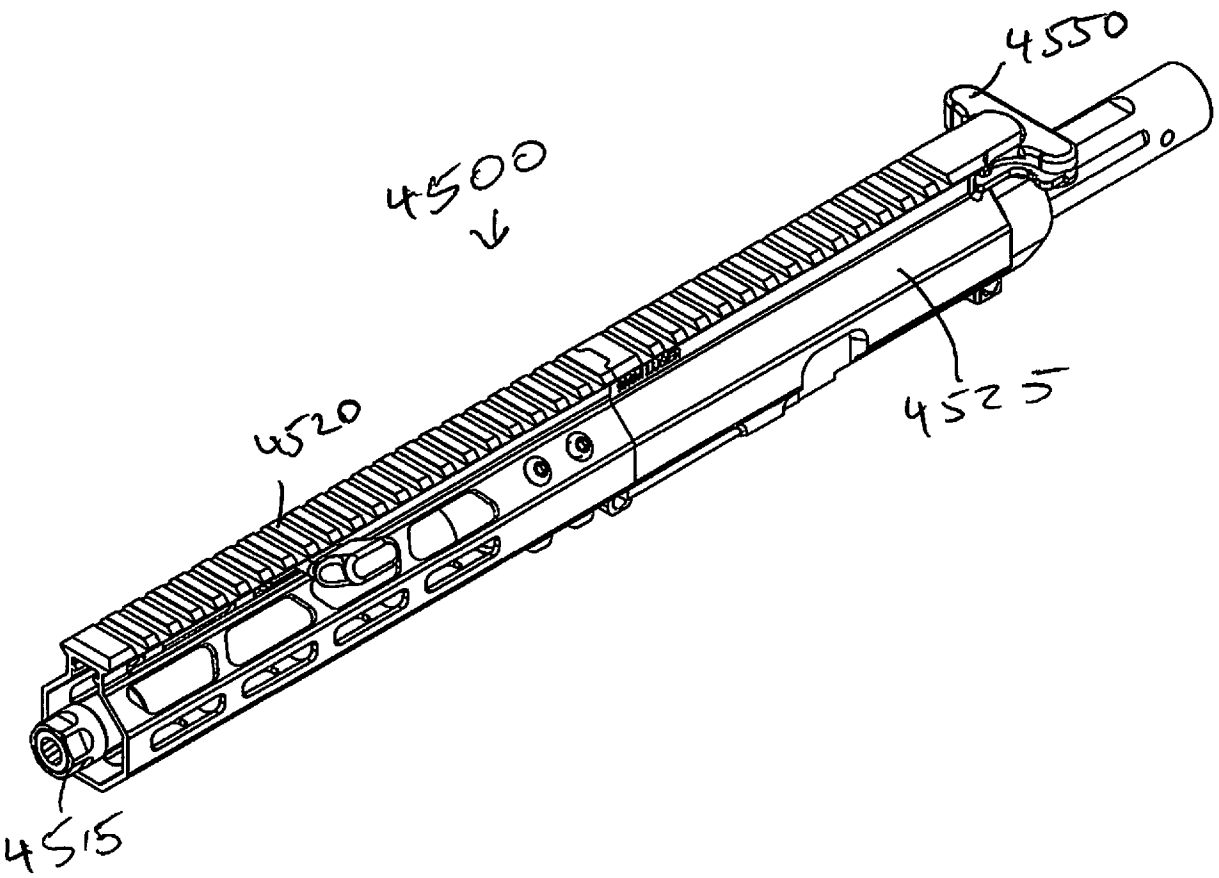
FIGS. 112-113 depict a partial view of a firearm according to some embodiments presently disclosed.
Figure 113:
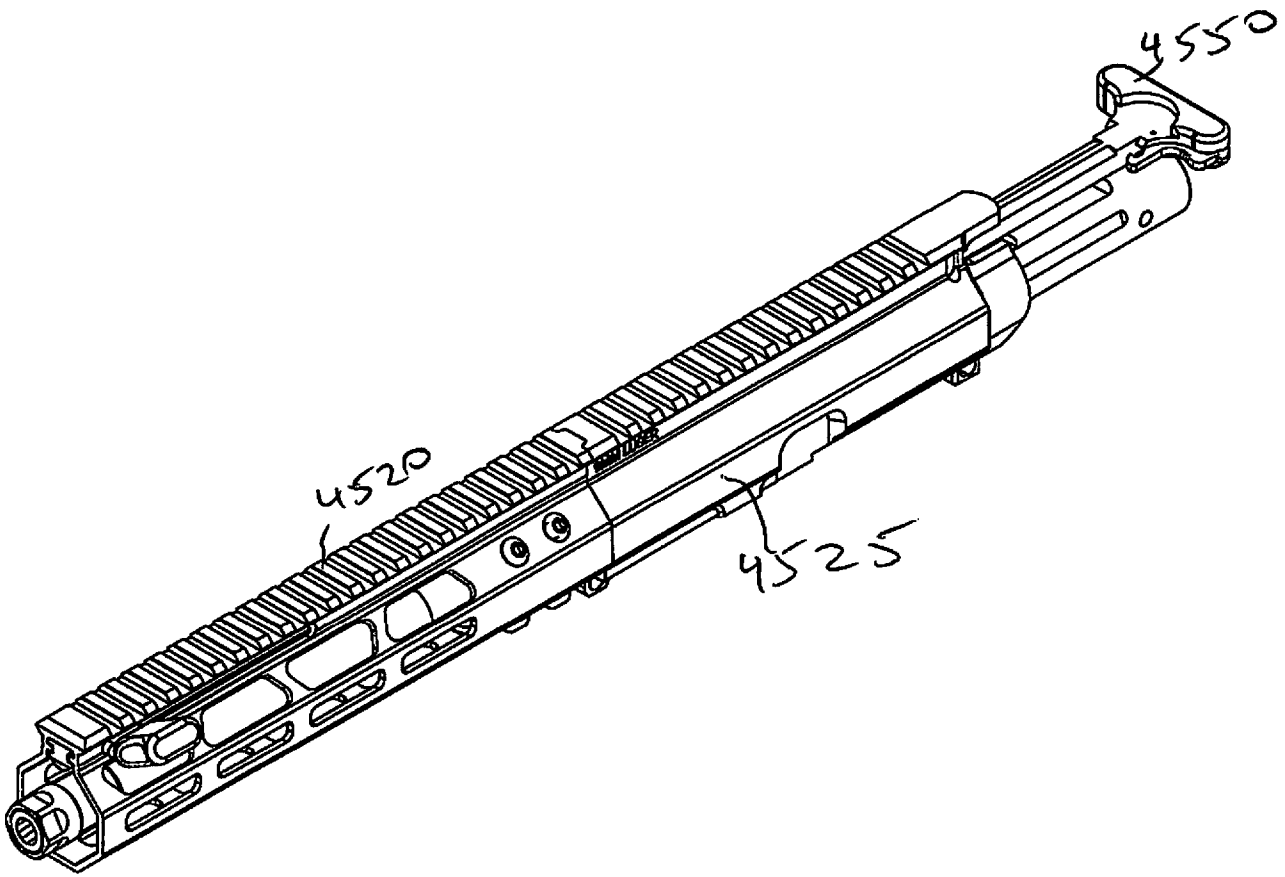
Figure 114:
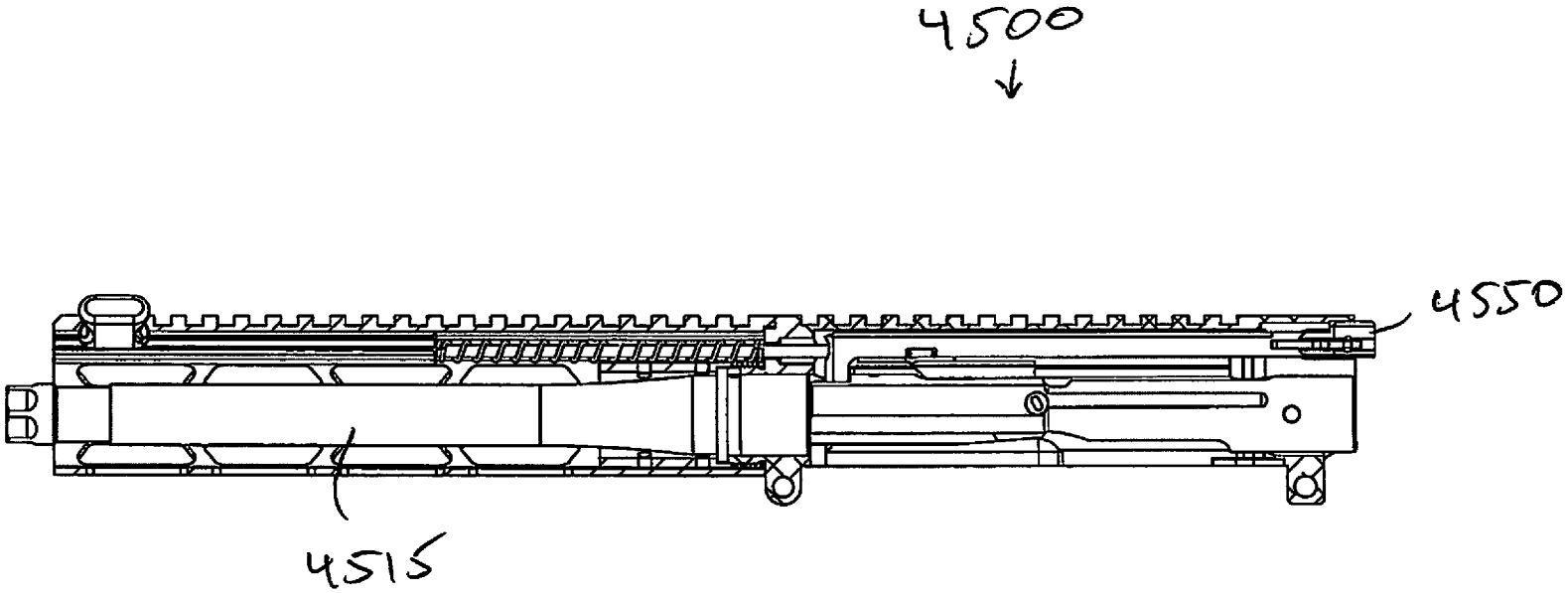
FIG. 114 depicts a cutaway view of an exemplary embodiment presently disclosed.
Figure 115:
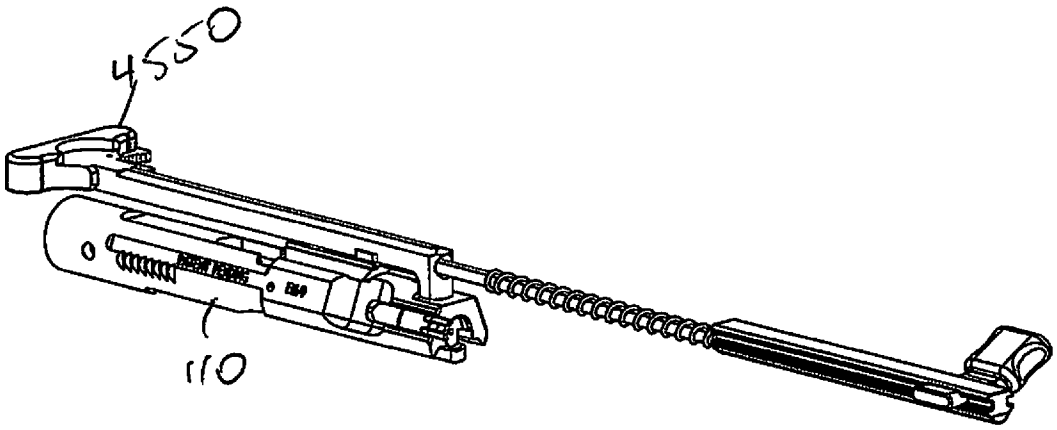
FIG. 115 depicts an assembled view of an exemplary embodiment presently disclosed.
Figure 116:
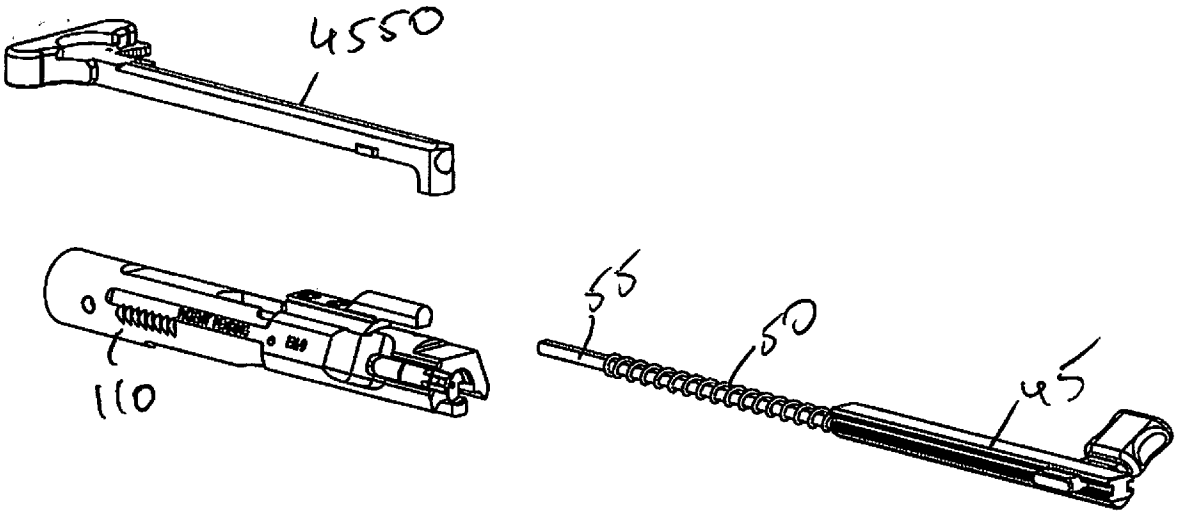
FIG. 116 depicts an exploded view of an exemplary embodiment presently disclosed.

According to some embodiments presently disclosed, the hand guard 3200 comprises an opening 3124 configured to accommodate a barrel (shown in FIGS. 101 and 109). According to some embodiments presently disclosed, the hand guard 3200 comprises an opening 3125 configured to accommodate the charging trolley 3045. According to some embodiments presently disclosed, the opening 3124 and/or 3125 are formed during manufacturing of the hand guard 3200. According to some embodiments presently disclosed, the opening 3124 and/or 3125 are extruded during manufacturing of the hand guard 3200. According to some embodiments presently disclosed, the opening 3124 and/or 3125 run along the entire length of the hand guard 3200. According to some embodiments presently disclosed, the opening 3125 runs along a portion of the hand guard 3200.

The charging trolley 3045 is configured to slide within the opening 3125 from a first (rest) position to a second (charging) position and back to the first (rest) position.

According to some embodiments presently disclosed, the opening 3125 comprises a circular cross section. According to some embodiments presently disclosed, the opening 3125 comprises a substantially circular cross section. According to some embodiments presently disclosed, the opening 3125 comprises a substantially U-shaped cross section.

According to some embodiments presently disclosed, the opening 3125 comprises one or more walls 3126 along the perimeter of the opening 3125. According to some embodiments presently disclosed, the opening 3125 comprises at least two walls 3126 along the perimeter of the opening 3125. According to some embodiments presently disclosed, the charging trolley 3045 is configured to slide along the at least two walls 3126 from a first (rest) position to a second (charging) position and back to the first (rest) position.

According to some embodiments presently disclosed, the opening 3125 comprises a plurality of walls 3126 defining the perimeter of the opening 3125. According to some embodiments presently disclosed, the charging trolley 3045 is configured to slide along the plurality of walls 3126 from a first (rest) position to a second (charging) position and back to the first (rest) position.

According to some embodiments presently disclosed, the opening 3125 comprises five outer walls 3126 defining the perimeter of the opening 3125. According to some embodiments presently disclosed, the charging trolley 3045 is configured to slide along the one or more walls 3126 from a first (rest) position to a second (charging) position and back to the first (rest) position.

According to some embodiments presently disclosed, moving the charging trolley 3045 towards the second (charging) position causes rod 55's rear portion 58 to abut (i.e. engage) the carrier key 115 described above. According to some embodiments presently disclosed, moving the charging trolley 3045 towards the second (charging) position causes rod 55's rear portion 58 to engage the carrier key 115 and move the bolt carrier assembly 110 from the first (locked) position to the second (unlocked) position as described above. According to some embodiments presently disclosed, moving the charging trolley 3045 towards the second (charging) position causes rod 55's rear portion 58 to move the bolt carrier assembly 110 from the first (locked) position to the second (unlocked) position as described above. According to some embodiments presently disclosed, moving the charging trolley 3045 towards the second (charging) position causes rod 55's rear portion 58 to engage the carrier key 115 and move the bolt carrier assembly 110 away from the barrel as described above.

According to some embodiments presently disclosed, the charging trolley 3045's second (charging) position is position in which the charging trolley 3045 is positioned closer to the upper receiver 25. According to some embodiments presently disclosed, the charging trolley 3045's first (rest) position is position in which the charging trolley 3045 is positioned closer to the front of the firearm and away from the upper receiver 25. According to some embodiments presently disclosed, the charging trolley 3045's second (charging) position is position in which the rod 55 moves the bolt carrier assembly 110 to the second (unlocked) position. According to some embodiments presently disclosed, the charging trolley 3045's first (rest) position is position in which the rod 55 allows the bolt carrier assembly 110 to return to the first (locked) position. According to some embodiments presently disclosed, the charging trolley 3045's first (rest) position is position in which the rod 55 is positioned away from the carrier key 115.

According to some embodiments presently disclosed, the charging trolley 3045 is moved towards the second (charging) position by applying a first force on the charging handle 3040 towards the second (charging) position. According to some embodiments presently disclosed, the charging trolley 3045 is moved towards the second (charging) position by applying a first force on the charging handle 3040 towards a buttstock located at the rear of the firearm.

According to some embodiments presently disclosed, the upper receiver 25 comprises a through opening 150 to allow the rod 55 to pass though and be able to engage the carrier key 115.

According to some embodiments presently disclosed, the rod 55 passes through the return spring 50 that is positioned between the upper receiver 25 and the charging trolley 3045 as shown in FIG. 103. According to some embodiments presently disclosed, moving the charging trolley 3045 towards the second (charging) position compresses the return spring 50 between the charging trolley 3045 and the upper receiver 25. According to some embodiments presently disclosed, applying the first force to the charging handle 3040 compresses the return spring 50 between the charging trolley 3045 and the upper receiver 25. Removing the first force causes the compressed return spring 50 to return the charging trolley 3045 back to the first (rest) position. According to some embodiments presently disclosed, the return spring 50 prevents the charging trolley 3045 from moving from the first (rest) position towards the second (charging position). According to some embodiments presently disclosed, the return spring 50 prevents the charging trolley 3045 from moving from the first (rest) position towards the second (charging position) during normal operations of the firearm.

Referring to FIGS. 111-116, an upper receiver assembly 4500 is shown according to some embodiments presently disclosed. The upper receiver assembly 4500 comprises a barrel 4515, a hand guard 4520 and an upper receiver 4525. According to some embodiments the upper receiver 4525 is coupled to a lower receiver (not shown). The hand guard 4520 may removably encircle the barrel 4515.

According to some embodiments presently disclosed, the upper receiver assembly 4500 comprises two charging systems. One system is the forward charging system 30 as described above. The forward charging system 30 comprises a charging base 40, a charging trolley 45, and a rod 55. The forward charging system 30 may also comprise a return spring 50.

A second charging system is a rear charging system comprising a T-shaped charging handle 4550. When the charging handle 4550 is pulled hack towards the buttstock, the operator of the firearm can eject a spent shell casing or an unfired cartridge from a chamber, load a round from the magazine, clear a jam or misfire, move a bolt into battery, and/or release a bolt locked to the rear.

According to some embodiments presently disclosed, the upper receiver 4525 comprises the bolt carrier assembly 110. The bolt carrier assembly 110 is movable between a first (locked) position and a second (unlocked) position. The bolt carrier assembly 110 supports and positions a bolt (not shown). The first (locked) position is position in which the bolt carrier 110 has positioned the bolt (not shown) for firing ammunition through the barrel 515. The second (unlocked) position is any position other than the first (locked) position.

As described above, the forward charging system 30 and/or the T-shaped charging handle 550 are configured to move the bolt carrier assembly 110 from the first (locked) position to the second (unlocked).

It is to be understood that the embodiments described above may be implemented on different types of firearms. The embodiments described above may be implemented on firearms using a blowback system of operation, and/or firearm using a direct impingement system of operation, and/or firearm using piston system of operation. Blowback is a system of operation for self-loading firearms that obtains energy from the motion of the cartridge case as it is pushed to the rear by expanding gas crated by the ignition of the propellant charge. Direct impingement is a type of gas operation for a firearm that directs gas from a fired cartridge directly into the bolt carrier to cycle the action. Piston system uses gas pressure to mechanically move the bolt carrier to cycle the action. It is also to be understood that the embodiments described above may be implemented on M-16 and Armalite style rifles (ARs).

While several illustrative embodiments of the invention have been shown and described, numerous variations and alternative embodiments will occur to those skilled in the art. Such variations and alternative embodiments are contemplated, and can be made without departing from the scope of the invention as defined in the appended claims. As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

What is claimed is:

1. A bolt carrier assembly comprising:

a bolt carrier;

a carrier key coupled with the bolt carrier, wherein the carrier key comprises a through aperture;

a recoil spring guide rod at least partially positioned within the through aperture, wherein the bolt carrier is configured to slide along the recoil spring guide rod between a locked position and an unlocked position; and a first recoil spring, wherein the recoil spring guide rod is positioned within the first recoil spring.

2. The bolt carrier assembly of claim 1 further comprising a charging handle positioned away from the upper receiver.

3. The bolt carrier assembly of claim 1, wherein the through aperture is stepped hole.

4. The bolt carrier assembly of claim 1 further comprising a forward charging handle positioned away from the upper receiver and a rear charging handle.

5. The bolt carrier assembly of claim 1 further comprising a second recoil spring, wherein the recoil spring guide rod is positioned within the second recoil spring, wherein the first recoil spring is at least partially positioned within the second recoil spring.

* * * * *